US010653218B1

(12) United States Patent
Volin

(10) Patent No.: US 10,653,218 B1
(45) Date of Patent: May 19, 2020

(54) UMBRELLA WITH PROJECTOR LIGHTING DEVICE

(71) Applicant: Dee Volin, Gresham, OR (US)

(72) Inventor: Dee Volin, Gresham, OR (US)

( * ) Notice: Subject to any disclaimer, the term of this patent is extended or adjusted under 35 U.S.C. 154(b) by 0 days.

(21) Appl. No.: 16/782,066

(22) Filed: Feb. 5, 2020

(51) Int. Cl.

| | |
|---|---|
| ***A45B 25/02*** | (2006.01) |
| ***A45B 25/14*** | (2006.01) |
| ***F21V 1/08*** | (2006.01) |
| ***A45B 25/00*** | (2006.01) |

(52) U.S. Cl.
CPC ..... *A45B 25/02* (2013.01); *A45B 25/14* (2013.01); *F21V 1/08* (2013.01); *A45B 2025/003* (2013.01); *A45B 2200/1018* (2013.01)

(58) Field of Classification Search
CPC ... A45B 2200/1018; A45B 25/02; F21V 1/08; F21V 1/06
See application file for complete search history.

(56) References Cited

U.S. PATENT DOCUMENTS

| | | | | |
|---|---|---|---|---|
| 1,782,601 | A * | 11/1930 | Brady | F21V 1/06 362/360 |
| 2,568,362 | A | 9/1951 | Primavera | |
| 2,745,421 | A | 4/1956 | Russell | |
| 3,003,510 | A | 4/1956 | Fischinger | |
| 2,937,653 | A | 3/1957 | Danciart | |
| 3,586,014 | A | 6/1971 | Weber | |
| 4,567,907 | A | 2/1986 | Dubinsky | |
| 4,807,655 | A | 2/1989 | Robertson | |
| 4,928,718 | A | 5/1990 | Apple | |
| 4,993,445 | A | 2/1991 | Dubinsky | |
| 5,036,872 | A | 8/1991 | Huang | |
| 5,058,613 | A | 10/1991 | Su et al. | |
| 5,144,969 | A | 9/1992 | Chou et al. | |
| 5,492,140 | A | 2/1996 | Lin et al. | |
| 5,626,160 | A | 5/1997 | Ko | |
| 6,016,822 | A | 1/2000 | Lin et al. | |
| 6,129,101 | A | 10/2000 | Dubinsky | |
| 6,173,721 | B1 | 1/2001 | Mery | |
| 6,821,002 | B1 * | 11/2004 | Morgen | F21S 6/005 362/351 |
| 7,484,517 | B2 | 2/2009 | Chen | |
| 7,581,554 | B2 | 9/2009 | Glasser | |
| 8,087,420 | B1 | 1/2012 | Lukacsy | |
| 8,459,281 | B2 | 6/2013 | Chen | |
| 8,555,905 | B2 | 10/2013 | Ma | |
| D744,742 | S | 12/2015 | You | |
| 9,259,064 | B1 | 2/2016 | Chen | |
| 9,468,273 | B1 | 10/2016 | Hasselbach | |
| 9,713,367 | B2 | 9/2017 | Duhon | |
| D818,697 | S | 5/2018 | Ma | |
| 9,989,242 | B1 * | 6/2018 | Pradas | G02B 6/001 |
| 10,034,524 | B2 | 7/2018 | Ma | |

(Continued)

*Primary Examiner* — Alexander K Garlen
*Assistant Examiner* — Eric T Eide

(57) ABSTRACT

An illumination providing umbrella with two water sealing cable pulleys and an LED projector. The umbrella having a canopy, upper and lower ribs, foldable rib joints respectively attached to the upper ribs, an umbrella pole, and a cable pulley with a counter wright. An upper hub attached to the top of the umbrella pole for housing the two rotatable pulleys and for preventing rainwater from entering the umbrella pole. The LED projector having an interchangeable image which can be magnified on a surface below and being attached to the umbrella pole.

20 Claims, 80 Drawing Sheets

(56) References Cited

U.S. PATENT DOCUMENTS

| | | | | |
|---|---|---|---|---|
| 10,039,353 | B2 | 8/2018 | Mullet | |
| 2004/0025915 | A1 | 2/2004 | Wang | |
| 2006/0124160 | A1 | 6/2006 | Lee | |
| 2007/0211450 | A1* | 9/2007 | You | A45B 3/04 362/102 |
| 2008/0094844 | A1* | 4/2008 | Small | F21V 1/04 362/311.06 |
| 2009/0071518 | A1 | 3/2009 | Amsel | |
| 2010/0232175 | A1* | 9/2010 | Ho | B60Q 1/26 362/551 |
| 2017/0055653 | A1* | 3/2017 | Pan | A45B 25/00 |

* cited by examiner

125

UMBRELLA WITH PROJECTOR LIGHTING DEVICE

1) FIELD OF THE INVENTION

The present invention relates to a foldable umbrella, which is economical to produce, is easy to ship as one unit, requires no tools, and can be quickly and easily folded and unfolded. Particularly, the present invention relates to an arthritic-aiding rainwater-sealing-to-protect-cable-pulley cable-pulley-hiding-hub LED-light-turning-on-and-off image-projecting counter-weight-decelerating umbrella, comprising:

1) Rainwater-sealing-for-cable-pulley cable-pulley-hiding-hub canopy and pole system,
2) Rainwater-sealing corrosion-eliminating LED-light-turning-on-and-off interchangeable-multi-angle LED-light-magnifying image-projector-securing pulley-plug system,
3) Arthritic-aiding cable-pulley-hiding pole-rust-eliminating counter-weight-decelerating image-projector-locking elastic cable system,
4) Deceleration-capable hand-pain-eliminating counter-weight system,
5) Arthritic-aiding pin-centering pin-guiding auditorily-snap-locking tower-locking system, and
6) Portable tow-hitch-connectable pet-shade-and-chair-locking umbrella-base system.

2) DESCRIPTION OF THE PRIOR ART

A number of foldable umbrellas have been introduced.

U.S. Pat. No. 2,568,362, issued 1951 Sep. 18, to V. A. R. Primavera, demonstrates a combination umbrella and gazebo that can be used as an umbrella or a gazebo. The combination includes a frame, a canopy, and a side. The canopy is affixed to the frame and has an open position and a closed position. The side is affixed to the canopy and has an extended position in which the combination functions as the gazebo and a retracted position in which the combination functions as the umbrella. And, the side achieves its extended and retracted positions by turning a crank which causes a first cable that is operatively connected to eight second cables which are operatively connected to eight third cables which are operatively connected to the side to displace half as much as each of the eight third cables so as to reduce the amount of turning of the crank required to lower and raise the side.

U.S. Pat. No. 2,745,421, issued 1956 Apr. 15, to R. A. Russell, demonstrates a vertical umbrella staff having a lateral opening in a side wall thereof; an elongated latch member mounted within said staff on a transverse axis and having an end portion adapted to extend through said opening and to be directed upward therein and to be swung back therethrough; a runner sleeve slidable upon said staff in a path to engage the extended end portion of said latch member in both upward and downward movement, said sleeve having an internal horizontal groove providing a downwardly faced shoulder to be engaged by the upper extremity of said latch member when said end portion is directed upward whereby to support said runner on said extremity; and yielding means connected with said latch member to project said end portion normally laterally outward into the path of both the upper and lower ends of said runner sleeve.

U.S. Pat. No. 2,937,653, issued 1957 Mar. 4, to Danciart Ted, and Harry C Schluter, demonstrates a catch for an umbrella runner movable along a staff comprising the combination of a staff member having spaced laterally opening slots therein, and a runner slidable there along of a catch member pivotally connected to said staff member in such manner that longitudinal shifting of said catch member is prevented, and said catch member having a finger extending outwardly through the uppermost slot, and a detent member adapted to extend through the lowermost slot; said runner when moved to umbrella opening position being engageable with said finger to extend said detent member through said lowermost slot to support said runner and maintain said umbrella in opened position said catch member being so constructed and so pivoted that said detent member normally tends to be supported in retracted position.

U.S. Pat. No. 3,003,510, issued 1956 Apr. 3, to Fischinger Herbert, demonstrates a collapsible umbrella frame comprising a stick including two stick members adapted to be telescoped into each other, one of said members having a crown fixed to its end remote from the other of said members in an extended position thereof; releasable means adapted to lock said members in their extended position; a plurality of ribs each having one end pivotally connected to said crown, each rib including two rib members adapted to be telescoped into each other; a main slider slidable on said stick; a plurality of struts each pivotally connected to said main slider and hinged to its respective rib member; and auxiliary slider slidable on said stick between said crown and said main slider; a plurality of braces each pivotally connected to said auxiliary slider and to one of said struts by means of a hinge disposed on said strut intermediate the ends of said strut; stop means capable when in an effective position of positively stopping the motion of said auxiliary slider towards said crown, said stop means including a catch movably mounted on said auxiliary slider and a formation engageable by said catch.

U.S. Pat. No. 3,586,014, issued 1968 Nov. 9, to Heinz Weber, demonstrates a construction in accableance with the invention including an umbrella comprising a telescopic stick, a crown at one end and a handle at the other end of the stick, dome ribs pivotally mounted to the crown, a first runner slidably mounted on the stick, with the second runner slidably mounted on the stick between the first runner and the crown. Stretcher members are pivotally connected to the first runner and the dome ribs, while strut members are pivotally connected to the median portion of the stretcher members and to the second runner. Means associated with the auxiliary runner and the stick momentarily retard the advance of the auxiliary runner relative to the advance of the first runner as the umbrella is being opened.

U.S. Pat. No. 4,567,907, issued 1984 Jun. 26, to Dubinsky Emanuel, demonstrates a pulley system for opening and closing an umbrella which has a ribholder adapted for slidable movement along an umbrella pole. A pulley wheel is mounted in the umbrella pole below its top portion with one end of a pulley cord fixedly attached to the ribholder while the other end of the pulley cord extends below the closed umbrella cover with a first cord handle adapted for being grasped by an operator. The first cord handle has a locking pin adapted for insertion into a hole in the umbrella pole for stopping the downward travel of the ribholder and supporting the umbrella in its open position. A second cord handle is secured to the pulley cord at a predetermined distance from the first handle such that the second handle can be readily grasped and pulled further downward for raising the ribholder to permit the locking pin to be inserted into the hole for locking the umbrella in its open position.

U.S. Pat. No. 4,807,655, issued 1989 Feb. 28, to Malcolm S. Robertson, demonstrates a garden or sun umbrella being provided with spring means for automatically opening the umbrella. In a preferred embodiment the spring is a gas spring mounted inside the central post of the umbrella and is operatively connected to a collar slidably mounted on the post and which in turn is connected via struts to the arm of the umbrella, by means of a flexible cord connected at its opposite ends to the collar and reeved around pulley blocks at opposite ends of the gas spring. After manually initiating the opening of the umbrella by pivoting the arms, in the collapsed position, away from the post, the opening action is completed automatically by the action of the spring. Closing of the umbrella is effected by downward pressure on the arms of the umbrella against the action of the spring.

U.S. Pat. No. 4,928,718, issued 1990 May 29, to Phillip C. Apple, demonstrates an automatic umbrella including a central post, a canopy assembly, and a spring and linkage mechanism which causes the umbrella to open when desired. There is also commonly a feature used for securing the umbrella in the closed position.

U.S. Pat. No. 4,993,445, issued 1990 Aug. 16, to Emanuel Dubinsky, demonstrates a solid wood pole garden umbrella being adapted to permit a hand crank and pulley system to slidably move a rib holder vertically along such wood pole for opening and closing the umbrella. A pulley wheel is mounted in the umbrella pole below its top portion, with one end of a pulley cable attached to the rib holder while the other end of the pulley cable extends through a narrow groove formed longitudinally along the side of the pole down to a lower pole portion where such pulley cable is operatively connected to the hand crank. The pulley cable is contained within the groove in the umbrella pole by a flexible plastic bead or rod which is snugly held or attached to the outer part of the groove to thereby provide a retainer for the pulley cable. The groove and retainer design enables the pulley and crank system to be employed in a solid wooden pole umbrella while maintaining the structural integrity of the pole and avoiding other designs where the pulley cable might interfere with the rib holder operation.

U.S. Pat. No. 5,036,872, issued 1990 Jan. 3, to Yueh Huang, demonstrates an improved self-opening and self-closing umbrella including a canopy, a conventional self-opening and self-closing frame formed of ribs and a telescoping shaft, a handle and an auxiliary mechanism overcomes problems with a conventional self-opening and self-closing umbrella by means of the auxiliary mechanism which comprises a cylindrical tube fixed on the shaft, spring means provided over the shaft in the tube, a hollow push rod provided between the spring means and the handle, locking means provided between the shaft and the tube, two sleeves provided over the shaft and the tube respectively. The auxiliary mechanism serves to help the umbrella open quickly and fully, close to a condition where the umbrella folds tightly and stands ready for opening again, get its shaft strengthened and be used as a walking stick conveniently.

U.S. Pat. No. 5,058,613, issued 1990 Oct. 10, to Tseng Su and Yun C. Pon, demonstrates a one hand operated umbrella capable of self-closing, including a center shaft of outer tube and inner tube, both of which are engaged with a spring pawl, a connector with an upper link and a lower within the shaft, and a handle with a button connected with the bottom of inner tube. While pushing the button, a slider of the umbrella will be released and to push the spring pawl inward to close and shorten automatically.

U.S. Pat. No. 5,144,969, issued 1991 Sep. 12, to Luc L. Chou and Jonathan C. Cheng, demonstrates a fully automatic collapsible umbrella comprising a hollow shank including an upper, a middle and a lower tubes, telescopic to each other, an expansion spring disposed between the upper and lower tubes, and an umbrella closing spring disposed between the upper and middle tubes, as well as an upper, a middle and a lower rings; a grip mounted outside of the lower tube at lower portion, having an actuator for carrying out the umbrella opening and closing operation; a pawl provided at the upper portion of the upper tube; an inner tube provided with a positioner; twin wires movably connected to each other by a connector, in which the upper wire is provided at upper end with a slidable block for controlling the pawl and the lower wire is operated at lower end by the actuator; and an umbrella opening spring disposed between the middle and lower rings. Further, a safety member is provided for prevent the umbrella from opening by accident.

U.S. Pat. No. 5,492,140, issued 1995 Jul. 28, to Chung-Kuang Lin and Jung-Jen Chang, demonstrates a multiple-fold automatic umbrella including: a control device for controlling the opening and closing of the umbrella by excavating the grip of the umbrella for reducing the weight and volume of the umbrella for making a compact foldable umbrella, an opening controller of the control device formed as a sliding plate transversely slidably mounted in an upper portion of the grip for opening the umbrella from a closed state of the umbrella; and a spring plate held in the grip for respectively urging the opening controller formed on the upper portion of the grip and a closing controller of the control device having a sliding latch slidably mounted in a lower portion of the grip for closing an opened umbrella, thereby simplifying the control device and the grip of the automatic umbrella.

U.S. Pat. No. 5,626,160, issued 1996 Aug. 13, to Chin-sung Ko, demonstrates an umbrella including a control device capable of actuating an upward movement of the umbrella opening spring located in the shaft so as to bring about the automatic opening of the umbrella. The elastic elements regulating the closing of the umbrella are compressed such that the lower rib holder is in the state of being pulled by two pull cables so as to keep the umbrella in its open position. When the control button of the control device is pressed for the second time, a control member regulating the closing of the umbrella is actuated to bring about the expansion of the umbrella closing elastic elements so as to cause the downward travel of the lower rib holder to result in the closing of the umbrella.

U.S. Pat. No. 6,016,822, issued 1998 Apr. 28, to Chung-Kung Lin and Jung-Jen Chang, demonstrates an automatic umbrella including: a central shaft consisting of four tubes telescopically engageable with one another; a rib assembly consisting of at least a top rib pivotally secured to a top portion of the central shaft, a stretcher rib pivotally connected with the top rib and a lower runner slidably held on the central shaft, and several ribs pivotally connected to the top rib and the stretcher rib; an opening spring resiliently retained in the central shaft for opening the umbrella; a plurality of closing springs secured on the rib assembly for closing the umbrella; and a control device consisting of an upper roller rotatably mounted on the lower runner and an uppermost roller rotatably secured on a top portion of the shaft for continuously deflectively winding a rope of the control device on the rollers for making an automatic umbrella of quadruple folds.

U.S. Pat. No. 6,129,101, issued 1998 Sep. 16, to Emanuel Dubinsky, demonstrates a garden umbrella of the generally large size having a rib holder runner notch adapted for movement along a hollow umbrella pole for operating the canopy ribs to open and close the umbrella canopy. A pulley wheel is mounted in the umbrella pole below its top portion, with one end of a pulley cable being attached to the rib holder runner notch while the other end of the pulley cable extends down through the hollow pole where it connects to a ballast weight. The ballast weight is adapted to travel vertically in the pole in synchronism with movement of the runner notch. The umbrella can be open by pulling down on the pulley cable handle, or by raising the runner notch until the umbrella is fully open. During this opening operation, as the ballast weight is lowered, thereby substantially reducing the force otherwise required of the umbrella operator.

U.S. Pat. No. 6,173,721, issued 1999 Sep. 10, to Jhoni Mery, demonstrates a patio umbrella having a pole that has an opening extending therethrough. The patio umbrella has a plurality of ribs for supporting and umbrella covering, and a runner adapted to slide along the pole and coupled to the ribs. The patio umbrella further includes a pulley system that has a first pulley member secured to a first side of the pole, a second pulley member coupled to the runner on the first side of the pole, a wheel positioned inside the opening of the pole, and a pulley rope. The pulley rope has a first end secured to the second pulley member and passes through the first and second pulley members, and then through the wheel inside the opening of the pole, to a free end that is positioned on a side of the pole that is opposite to the first side.

U.S. Pat. No. 7,484,517, issued 2003 Mar. 21, to Fengchun Chen, demonstrates a large portable umbrella which relates to the technical field of large foldable umbrella. A large portable umbrella of the invention includes an umbrella column, supporting arms, tarpaulin, cover arms supporting tarpaulin, a develop-fold mechanism, an upper umbrella disk fixed on the top of the umbrella column, and a lower umbrella disk movable up and down along the umbrella column, wherein one end of the cover arms being hinged on the upper umbrella disk, one end of the supporting arms being hinged on the lower umbrella disk and the other end of the supporting arms being hinged at the middle of the cover arms, each cover arm is composed of an upper cover arm and a lower cover arm, each other via a position limiting hinge which serves for limiting the developing angle of the lower cover arm.

U.S. Pat. No. 7,581,554, issued 2005 Oct. 22, to Jerome Glasser, demonstrates a containerizable frame structure having a motion conversion means for telescopically projecting it out of and retracting it into a container. Some applications include umbrellas, banners, signs, portable wall structures, and tables.

U.S. Pat. No. 8,087,420, issued 2011 Apr. 25, to Steven A. Lukacsy, demonstrates a gravity-powered, and self-opening umbrella systems that can also be wind-resistant. As evidenced from the teachings provided herein, the systems can be designed in a variety of configurations. The umbrella system can include a counterweight and system of pulleys, where the system of pulleys includes class 1 and class 2 pulleys configured with the counterweight to gain a mechanical advantage in the normal operation of the umbrella. The umbrella can be, for example, a patio umbrella in which the mechanical advantage provides a self-opening of an umbrella canopy and ease-of-retracting of the canopy for a user. And, the system can also be dynamic, such that it's also resistant to external forces, such as the wind.

U.S. Pat. No. 8,459,281, issued 2011 Jan. 6, to Hsia-Hui Chen, demonstrates a runner fastening device being provided for holding a runner of an umbrella at an upper position relative to a central shaft unit, and includes a spring catch having a retaining region and an actuated region, a retained member moved with the runner and having a retained slot which extends to terminate at an abutment wall to abut against the retaining region at the upper position, and a sleeve member movably surrounding the retained member. By mating engagement between cammed and camming surfaces of the retained member and the sleeve member, the actuated region is pressed against a biasing action to retreat inwardly to sweep the retaining region away from the abutment wall to thereby permit downward movement of the runner.

U.S. Pat. No. 8,555,905, issued 2009 Jan. 13, to Oliver Joen-An Ma, demonstrates an umbrella hub being provided that is operative to engage an umbrella cable for maintaining an umbrella in an open position. The hub can comprise a cable retention mechanism. For example, the hub can comprise upper and lower hub portions that form a hub body and a cable retention mechanism comprising an aperture extending through the hub body, a recess disposed within the upper or lower hub portion, and a pair of engagement members disposed in the recess. The cable lock mechanism can be configured to allow the cable to pass freely in a first direction while preventing movement of the cable therethrough in a second direction that is opposite the first direction or to pass freely in both the first and second directions.

U.S. Pat. No. 9,259,064, issued 2014 Sep. 15, to Tien-Cheng Chen and Sun-Feng Sung, demonstrates an opening/closing structure for an automatic umbrella containing: a shaft assembly, a frame, a notch, a first runner, a second runner, a driving mechanism, and a handle. The shaft assembly includes a first tube and a second tube. The frame couples with the notch and the second runner. The driving mechanism includes a screw rod and a push post. The push post has a drive portion and inner threads. The push post is connected with the first tube by inserting a joining element into the second tube, and the second tube has a slot longitudinally formed on an outer wall thereof. The joining element moves upwardly or downwardly along the slot. The push post has the drive portion, a coupling portion, and a deforming portion.

U.S. Pat. No. 9,468,273, issued 2013 Jul. 26, to Henry J. Hasselbach, John C. Hasselbach and Robert G. Snow, demonstrates a retractable umbrella including a canopy with supporting ribs and a shaft with a handle located on a proximal end thereof. Inside the shaft resides an electric motor and a gearing mechanism for power transmission. When activated, the electric motor actuates the gearing mechanism to extend and retrieve the canopy from and into the shaft.

U.S. Pat. No. 9,713,367, issued 2017 Sep. 2, to Ronald Duhon, demonstrates an umbrella shaft assembly being provided for securing an umbrella to a chair or table. The umbrella shaft assembly includes an elongated shaft having a first end and a second end. A plurality of hinged finger projections are located on the elongated shaft. The finger projections are configured to extend outward and retract inward toward the elongated shaft. Further, an aperture is located on the elongated shaft, wherein a cable extends therethrough. The umbrella shaft assembly can be secured to a chair via securing the cable to a chair frame. Similarly, the umbrella shaft assembly can be secured to a table by extending the finger projections such that the umbrella cannot be hoisted through an umbrella receiving opening of the table.

U.S. Pat. No. 10,034,524, issued 2012 Apr. 19, to ZHUN-AN Ma, demonstrates an umbrella hub being provided that includes an inner portion, an outer periphery, a lower portion and an upper portion. A plurality of vertical grooves is disposed in the outer periphery and is configured to receive umbrella ribs or struts. A plurality of grooves extends transverse to the plurality of vertical grooves. A retention member is disposed in each of the transverse grooves. A first configuration of the hub permits deflection of the retention member such that a transverse pin coupled with the umbrella ribs or struts can be inserted into the transverse groove in which the retention member is disposed. A second configuration of the hub prevents deflection of the retention member such that inadvertent withdrawal of the pin from the transverse groove in which the retention member is disposed is prevented.

U.S. Pat. No. 10,039,353, issued 2015 Oct. 9, to Willis Jay Mullet, Richard Scott Hand and John Foreman, demonstrates an umbrella system including a support pole connected to a rotating tube positioned around a center tube that extends between the support pole and a center support that is connected to an umbrella frame. The rotating tube has one or more helical grooves therein that are engaged by teeth of a hub which is connected to the umbrella frame. As the hub is driven along the length of the rotating tube thereby opening and closing the umbrella frame. In one arrangement system includes a motor housing assembly including a plurality of batteries and a motor that includes a driven gear that meshes with a stationary gear which causes rotation of the rotating tube.

U.S. Pat. No. D744,742, issued 2013 Nov. 5, to Ching-Chuan You, depicts the ornamental design for an umbrella cap, as shown described.

U.S. Pat. No. D818,697, issued 2011 Dec. 26, to ZHUN-AN Ma, depicts the ornamental design for an umbrella cap, as shown described.

U.S. Publication No 20040025915, published 2004 Feb. 12, to Max Wang, discribes an umbrella including a tubular runner slidably sleeved on a stem between upper and lower positions. A tubular upper end portion of the stem defines a plurality of angularly displaced slots such that anchored segments of an anchored wire are exposed therefrom for pivotally mounting anchoring ends of a plurality of ribs. The ribs have distal ends disposed at an underside of a canopy for supporting the canopy in spread-out and collapsed positions when the runner is moved to the upper and lower positions, respectively. The ribs can be brought into close proximity of the stem after retraction for facilitating storage and carrying.

U.S. Publication No 20060124160, published 2006 Jun. 15, to Chia-Chen Lee, describes an umbrella runner assembly having a runner and multiple connectors. The runner has a tubular body with a top and a bottom, a top flange and multiple through holes. The top flange has an outer periphery and is formed on the top of the tubular body. The through holes are defined through the top flange and arranged in a circle. The connectors are connected to the tubular body of the runner. Each connector has a main body and a resilient strap connected to the main body and having a bottom provided with a hook engaging with one of the through holes in the top flange of the runner. With such an arrangement, the umbrella runner assembly is easily and conveniently assembled.

U.S. Publication No 20090071518, published 2009 Mar. 19, to Chaim Simcha Amsel, discribes an umbrella rib assembly being presented for use in strutless umbrella having a pin and slide canopy conducting mechanism. The rib assembly comprises a longitudinal rib body having a pivot member at its end, and a rib lever extending from the rib body, and being characterized in that the pivot member and the rib body together with the rib lever present a single piece of material, and the pivot member is located in a corner formed between the rib body and the rib lever.

DISADVANTAGES OF THE PRIOR ART

The prior art have failed to solve many problems associated with such folding umbrellas as follows:

1) No prior art mention or disclose any folding umbrella, having
   first rainwater-sealing corrosion-eliminating LED-light-turning-on-and-off pulley-plug 108.
   Therefore, the prior art of folding umbrellas:
   a) Can not seal out rainwater from penetrating the inside of cable-pulley-hiding pole-rust-eliminating counter-weight-rust-eliminating upper hub 117 and umbrella pole 106
      in the directions of arrows 99*e*, 99*f*, 100*a*, and 100*b*, respectively
      (see FIG. 1D (Prior Art), FIG. 1E, FIG. 1F (Prior Art), and FIG. 1G);
   b) Can not protect cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
      (see FIG. 1D (Prior Art), FIG. 1E, FIG. 1F (Prior Art), FIG. 1G, and FIG. 1H);
   c) Can not increase the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120;
   d) Can not insert into one of upside-down rainwater-blocking cable-pulley holes 115, respectively;
   e) Can not seal one of upside-down rainwater-blocking cable-pulley holes 115, respectively;
      in the directions of arrows 100*b* and 100*c*, respectively
      (see FIG. 1G and FIG. 1H); and
   f) Can not frictionably activate and deactivate an on/off-switch to an LED-light-on-off switch 100*f* by upward and downward movement, respectively
      in the directions of arrows 147*a*, 147*b*, 147*c*, and 147*d*
      (see FIG. 20A and FIG. 20B).

2) No prior art mention or disclose any folding umbrella, having
   second rainwater-sealing corrosion-eliminating LED-light-turning-on-and-off pulley-plug 109.
   Therefore, the prior art of folding umbrellas:
   a) Can not seal out rainwater from penetrating the inside of cable-pulley-hiding pole-rust-eliminating counter-weight-rust-eliminating upper hub 117 and umbrella pole 106
      in the directions of arrows 99*e*, 99*f*, 100*a*, and 100*b*, respectively
      (see FIG. 1D (Prior Art), FIG. 1E, FIG. 1F (Prior Art), and FIG. 1G);
   b) Can not protect cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), FIG. 1G, and FIG. 1H);

c) Can not increase the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120;

d) Can not insert into one of upside-down rainwater-blocking cable-pulley holes 115, respectively;

e) Can not seal one of upside-down rainwater-blocking cable-pulley holes 115, respectively;
in the directions of arrows 100*b* and 100*c*, respectively
(see FIG. 1G and FIG. 1H); and f) Can not frictionably activate and deactivate an on/off-switch to an LED-light-on-off switch 100*f* by upward and downward movement, respectively
in the directions of arrows 147*a*, 147*b*, 147*c*, and 147*d*
(see FIG. 20A and FIG. 20B).

3) No prior art mention or disclose any folding umbrella, having
interchangeable multi-angle LED-light-magnifying image projector 110*a*.
Therefore, the prior art of folding umbrellas:

a) Can not decrease and enlarge a projected image on a table, a patio, a deck, or a floor,
at angles 100*d* and 100*e*, and in the directions of arrows 145*a*, 145*b*, 145*c*, 145*d*, 145*e*, 145*f*, 145*g*, 145*h*, 146*a*, 146*b*, 146*c*, and 148, respectively
(see FIG. 17A, FIG. 17B, FIG. 19C, FIG. 19D, 20C, and FIG. 20D);

b) Can not project an image onto a floor surface, a patio, deck, or other floor
(see FIG. 21E and FIG. 21F);

c) Can not project an image at different angles
in the directions of arrows 149 and 150
(see FIG. 21A, FIG. 21B, FIG. 21E, and FIG. 21F);

d) Can not display a projected image in many color variations; and e) Can not interchange a variety of different images.

4) No prior art mention or disclose any folding umbrella, having
image-magnifying image-projecting lens 112.
Therefore, the prior art of folding umbrellas:

a) Can not project an image on a floor surface, a patio, deck, or a floor
(see FIG. 19C, FIG. 19D, 20C, FIG. 20D, FIG. 21C, and FIG. 21D);

b) Can not decrease and enlarge a projected image on an table, a patio, a deck, or a floor,
(see FIG. 17A, FIG. 17B, FIG. 19C, FIG. 19D, 20C, and FIG. 20D);

c) Can not display a projected image in many color variations; and d) Can not interchange a variety of images
(see FIG. 28C, 28D, 28E, 28F, 28G, 28H, 28I, and FIG. 29).

5) No prior art mention or disclose any folding umbrella, having
upside-down rainwater-blocking cable-pulley holes 115.
Therefore, the prior art of folding umbrellas:

a) Can not prevent rainwater from penetrating the inside of cable-pulley-hiding pole-rust-eliminating counter-weight-rust-eliminating upper hub 117 or umbrella pole 106
in the directions of arrows 99*e*, 99*f*, 100*a*, and 100*b*, respectively
(see FIG. 1D (Prior Art), FIG. 1E, FIG. 1F (Prior Art), and FIG. 1G);

b) Can not protect cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), and FIG. 1G);

c) Can not increase the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120; and d) Can not insert Inserting arthritic-aiding counter-weight-decelerating image-projector-locking elastic cable 116 therethrough.

6) No prior art mention or disclose any folding umbrella, having
arthritic-aiding counter-weight-decelerating image-projector-locking elastic cable 116.
Therefore, the prior art of folding umbrellas:

a) Can not decelerate deceleration-capable hand-pain-eliminating counter-weight 120
in the direction of and/or represented by arrows 151*a*, 151*b*, 151*c*, 152*a*, 152*b*, and 152*c*
(see FIG. 22C and FIG. 22D);

b) Can not cushion the tension, vibration, and impact from operating arthritic-aiding rainwater-sealing-to-protect-cable-pulley cable-pulley-hiding-hub LED-light-turning-on-and-off image-projecting counter-weight-decelerating umbrella
to eliminate the pain and discomfort experienced by an arthritic-suffering person when raising and lowering
in the direction of and/or represented by arrows 151*a*, 151*b*, 151*c*, 152*a*, 152*b*, and 152*c*
(see FIG. 22C and FIG. 22D); and c) Can not hoist and lower deceleration-capable hand-pain-eliminating counter-weight 120
to assist in operating arthritic-aiding rainwater-sealing-to-protect cable-pulley cable-pulley-hiding-hub LED-light-turning-on-and-off image-projecting counter-weight-decelerating umbrella
in the direction of arrows 151*a*, 151*b*, 151*c*, 152*a*, 152*b*, and 152*c*
(see FIG. 22C and FIG. 22D).

7) No prior art mention or disclose any folding umbrella, having
cable-pulley-hiding pole-rust-eliminating counter-weight-rust-eliminating upper hub 117.
Therefore, the prior art of folding umbrellas:

a) Can not house two rotatable pulleys 114;

b) Can not prevent rainwater from entering in through the top of umbrella pole 106
in the directions of arrows 99*e*, 99*f*, 100*a*, 100*b*, and 100*c*, respectively (see FIG. 1D (Prior Art), FIG. 1E, FIG. 1F (Prior Art), FIG. 1G, FIG. 1H, and FIG. 1I);

c) Can not mount upper ribs 103*a* (see FIG. 9 and FIG. 10C);

d) Can not mount rib screws 104 (see FIG. 9);

e) Can not insert first rainwater-sealing corrosion-eliminating LED-light-turning-on-and-off pulley-plug 108 and second rainwater-sealing corrosion-eliminating LED-light-turning-on-and-off pulley-plug 109 therein (see, FIG. 1E, FIG. 1G, FIG. 1H, FIG. 1I, FIG. 1L, FIG. 1S, and FIG. 1T); and f) Can not mount solar panels thereto (see FIG. 28B).

8) No prior art mention or disclose any folding umbrella, having arthritic-aiding arthritic-hand-accommodating lower hub 118.

Therefore, the prior art of folding umbrellas:

a) Can not provide an ergonomic arthritic-hand-accomodating surface to eliminate pain for an arthritic person when operating arthritic-aiding arthritic-hand-accommodating lower hub 118, as demonstrated by arthritic hand 99*d* in the directions of arrows 153*a* and 153*b* (see FIG. 22E and FIG. 22F);

b) Can not foldable rib joints 105 away from umbrella pole 106 to create larger angles between upper and lower ribs 103*a* and 103*b* which in turn will require less force and effort to move deceleration-capable hand-pain-eliminating counter-weight 120 as demonstrated by 100*d* and 100*e* (see FIG. 1J (Prior Art) and FIG. 1K); and c) Can not attach lower ribs 103*b* thereto (see FIG. 3).

9) No prior art mention or disclose any folding umbrella, having deceleration-capable hand-pain-eliminating counter-weight 120.

Therefore, the prior art of folding umbrellas:

a) Can not help an arthritic with deploying or collapsing arthritic-aiding rainwater-sealing-for-cable-pulley cable-pulley-hi ding-hub LED-light-turning-on-and-off image-projecting and weight-assisted umbrella, especially to help arthritic, small, or elderly persons who might have difficulty operating prior art umbrella systems in the directions of arrows 151*a*, 151*b*, 151*c*, 152*a*, 152*b*, and 152*c* (see FIG. 22A, FIG. 22B, FIG. 22C, and FIG. 22D); and b) Can not require less effort during retraction and deployment of arthritic-aiding rainwater-sealing-to-protect-cable-pulley cable-pulley-hiding-hub LED-light-turning-on-and-off image-projecting counter-weight-decelerating umbrella in the directions of arrows 145*a*, 145*b*, 145*c*, 145*d*, 145*e*, 145*f*, 145*g*, and 145*h* (see FIG. 17A and FIG. 17B).

10) No prior art mention or disclose any folding umbrella, having spiral flutes 123.

Therefore, the prior art of folding umbrellas:

Can not allow air to flow over said deceleration-capable hand-pain-eliminating counter-weight 120 as said deceleration-capable hand-pain-eliminating counter-weight 120 ascends or descends within said umbrella pole 106 (see FIG. 22A and FIG. 22B).

11) No prior art mention or disclose any folding umbrella, having locking pin 129.

Therefore, the prior art of folding umbrellas:

a) Can not guide locking pin 129 and help the hand 99*d* of an arthritic to operate its locking pin in the directions of arrows 99*a*, 99*b*, and 99*c* (see FIG. 1A (Prior Art), FIG. 1B, and FIG. 1C);

b) Can not lock arthritic-aiding arthritic-hand-accommodating lower hub 118 at one of three desired elevations of umbrella-pole pin openings 126, respectively, when being inserted into one of pin-centering pin-guiding tubes 132 in the directions of arrows 154, 155, and 156 (see FIG. 23A, FIG. 23B, FIG. 24A, FIG. 24B, and FIG. 24C);

c) Can not push two of auditorily-snap-locking leaf springs 133 outward until two of auditorily-snap-locking nipples 134 auditorily snap-lock into auditorily-snap-locking recess 130 in the directions of arrows 157*a*, 157*b*, 157*c*, and 157*d* (see FIG. 24A, FIG. 24B, and FIG. 24C);

d) Can not generate snap-locking sounds 157*e* and 157*e* (see FIG. 24C); and e) Can not lock locking pin 129 into one of pin-centering pin-guiding tubes 132 (see FIG. 13, FIG. 23A, FIG. 23B, FIG. 24C, and FIG. 25).

12) No prior art mention or disclose any folding umbrella, having tow-hitch-connectable pet-shade-and-chair-locking receptacle 143.

Therefore, the prior art of folding umbrellas:

a) Can not attach to a tow-hitch of a vehicle to provide shade to said vehicle (see FIG. 28A);

b) Can not attach an auxiliary umbrella post therein, in the directions of arrows 159, 160, and 161 (see FIG. 27A, FIG. 27B, and FIG. 27C); and c) Can not secure a leg of a chair therein in the directions of arrows 159, 160, and 161 (see FIG. 27A, FIG. 27B, and FIG. 27C).

13) No prior art mention or disclose any folding umbrella, having foldable rib joints 105.

Therefore, the prior art of folding umbrellas:

a) Can not create larger angles 100*e* between upper and lower canopy ribs which in turn requires less force/effort to move the counter weight of the umbrella than smaller angles 100*d* (see FIG. 1J (Prior Art), and FIG. 1K); and b) Can not pivotably secure upper ribs 103*a* to lower ribs 103*b* to allow upper ribs 103*a* and lower ribs 103*b* to fold and to deploy.

OBJECTS AND ADVANTAGES OF THE INVENTION

The present invention substantially departs from the conventional concepts and designs of the prior art. In doing so, the present invention provides an arthritic-aiding rainwater-sealing-to-protect-cable-pulley cable-pulley-hiding-hub LED-light-turning-on-and-off image-projecting counter-weight-decelerating umbrella (having: a) Rainwater-sealing-for-cable-pulley cable-pulley-hiding-hub canopy and pole system, b) Rainwater-sealing corrosion-eliminating LED-light-turning-on-and-off interchangeable-multi-angle LED-light-magnifying image-projector-securing pulley-plug system, c) Arthritic-aiding cable-pulley-hiding pole-rust-eliminating counter-weight-decelerating image-projector-locking elastic cable system, d) Deceleration-capable hand-pain-eliminating counter-weight system, e) Arthritic-aiding pin-centering pin-guiding auditorily-snap-locking tower-locking system, and f) Portable tow-hitch-connectable pet-shade-and-chair-locking umbrella-base system), having many new and significant features, functions, and advantages, which overcome all the disadvantages of the prior art, as follows:

1) It is an object of the new invention to provide (a or an) arthritic-aiding rainwater-sealing-to-protect-cable-pulley cable-pulley-hiding-hub LED-light-turning-on-and-off image-projecting counter-weight-decelerating umbrella, having first rainwater-sealing corrosion-eliminating LED-light-turning-on-and-off pulley-plug 108.

Therefore, the arthritic-aiding rainwater-sealing-to-protect-cable-pulley cable-pulley-hi di ng-hub LED-light-turning-on-and-off image-projecting counter-weight-decelerating umbrella:

a) Can seal out rainwater from penetrating the inside of cable-pulley-hiding pole-rust-eliminating counter-weight-rust-eliminating upper hub 117 and umbrella pole 106
in the directions of arrows 99*e*, 99*f*, 100*a*, and 100*b*, respectively
(see FIG. 1D (Prior Art), FIG. 1E, FIG. 1F (Prior Art), and FIG. 1G);

b) Can protect cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), FIG. 1G, and FIG. 1H);

c) Can increase the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120;

d) Can insert into one of upside-down rainwater-blocking cable-pulley holes 115, respectively;

e) Can seal one of upside-down rainwater-blocking cable-pulley holes 115, respectively;
in the directions of arrows 100*b* and 100*c*, respectively
(see FIG. 1G and FIG. 1H); and f) Can frictionably activate and deactivate an on/off-switch to an LED-light-on-off switch 100*f* by upward and downward movement, respectively
in the directions of arrows 147*a*, 147*b*, 147*c*, and 147*d*
(see FIG. 20A and FIG. 20B).

2) It is an object of the new invention to provide (a or an) arthritic-aiding rainwater-sealing-to-protect-cable-pulley cable-pulley-hiding-hub LED-light-turning-on-and-off image-projecting counter-weight-decelerating umbrella, having second rainwater-sealing corrosion-eliminating LED-light-turning-on-and-off pulley-plug 109.

Therefore, the arthritic-aiding rainwater-sealing-to-protect-cable-pulley cable-pulley-hiding-hub LED-light-turning-on-and-off image-projecting counter-weight-decelerating umbrella:

a) Can seal out rainwater from penetrating the inside of cable-pulley-hiding pole-rust-eliminating counter-weight-rust-eliminating upper hub 117 and umbrella pole 106
in the directions of arrows 99*e*, 99*f*, 100*a*, and 100*b*, respectively
(see FIG. 1D (Prior Art), FIG. 1E, FIG. 1F (Prior Art), and FIG. 1G);

b) Can protect cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), FIG. 1G, and FIG. 1H);

c) Can increase the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120;

d) Can insert into one of upside-down rainwater-blocking cable-pulley holes 115, respectively;

e) Can seal one of upside-down rainwater-blocking cable-pulley holes 115, respectively;
in the directions of arrows 100*b* and 100*c*, respectively
(see FIG. 1G and FIG. 1H); and f) Can frictionably activate and deactivate an on/off-switch to an LED-light-on-off switch 100*f* by upward and downward movement, respectively in the directions of arrows 147*a*, 147*b*, 147*c*, and 147*d*
(see FIG. 20A and FIG. 20B).

3) It is yet still another object of the new invention to provide (a or an) arthritic-aiding rainwater-sealing-to-protect-cable-pulley cable-pulley-hiding-hub LED-light-turning-on-and-off image-projecting counter-weight-decelerating umbrella, having interchangeable multi-angle LED-light-magnifying image projector 110*a*.

Therefore, the arthritic-aiding rainwater-sealing-to-protect-cable-pulley cable-pulley-hiding-hub LED-light-turning-on-and-off image-projecting counter-weight-decelerating umbrella:

a) Can decrease and enlarge a projected image on a table, a patio, a deck, or a floor,
at angles 100*d* and 100*e*, and in the directions of arrows 145*a*, 145*b*, 145*c*, 145*d*, 145*e*, 145*f*, 145*g*, 145*h*, 146*a*, 146*b*, 146*c*, and 148, respectively
(see FIG. 17A, FIG. 17B, FIG. 19C, FIG. 19D, 20C, and FIG. 20D);

b) Can project an image onto a floor surface, a patio, deck, or other floor
(see FIG. 21E and FIG. 21F);

c) Can project an image at different angles
in the directions of arrows 149 and 150
(see FIG. 21A, FIG. 21B, FIG. 21E, and FIG. 21F);

d) Can display a projected image in many color variations; and e) Can interchange a variety of different images.

4) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having image-magnifying image-projecting lens 112.

Therefore, the arthritic-aiding rainwater-sealing-to-protect-cable-pulley cable-pulley-hiding-hub LED-light-turning-on-and-off image-projecting counter-weight-decelerating umbrella:

a) Can project an image on a floor surface, a patio, deck, or a floor (see FIG. 19C, FIG. 19D, 20C, FIG. 20D, FIG. 21C, and FIG. 21D);

b) Can decrease and enlarge a projected image on an table, a patio, a deck, or a floor, (see FIG. 17A, FIG. 17B, FIG. 19C, FIG. 19D, 20C, and FIG. 20D);

c) Can display a projected image in many color variations; and d) Can interchange a variety of images (see FIG. 28C, 28D, 28E, 28F, 28G, 28H, 28I, and FIG. 29).

5) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having upside-down rainwater-blocking cable-pulley holes 115.

Therefore, the arthritic-aiding rainwater-sealing-to-protect-cable-pulley cable-pulley-hiding-hub LED-light-turning-on-and-off image-projecting counter-weight-decelerating umbrella:

a) Can prevent rainwater from penetrating the inside of cable-pulley-hiding pole-rust-eliminating counter-weight-rust-eliminating upper hub 117 or umbrella pole 106 in the directions of arrows 99*e*, 99*f*, 100*a*, and 100*b*, respectively (see FIG. 1D (Prior Art), FIG. 1E, FIG. 1F (Prior Art), and FIG. 1G);

b) Can protect cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion (see FIG. 1D (Prior Art), FIG. 1E, FIG. 1F (Prior Art), and FIG. 1G);

c) Can increase the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120; and d) Can insert Inserting arthritic-aiding counter-weight-decelerating image-projector-locking elastic cable 116 therethrough.

6) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having arthritic-aiding counter-weight-decelerating image-projector-locking elastic cable 116.

Therefore, the arthritic-aiding rainwater-sealing-to-protect-cable-pulley cable-pulley-hiding-hub LED-light-turning-on-and-off image-projecting counter-weight-decelerating umbrella:

a) Can decelerate deceleration-capable hand-pain-eliminating counter-weight 120 in the direction of and/or represented by arrows 151*a*, 151*b*, 151*c*, 152*a*, 152*b*, and 152*c*

(see FIG. 22C and FIG. 22D);

b) Can cushion the tension, vibration, and impact from operating arthritic-aiding rainwater-sealing-to-protect-cable-pulley cable-pulley-hiding-hub LED-light-turning-on-and-off image-projecting counter-weight-decelerating umbrella to eliminate the pain and discomfort experienced by an arthritic-suffering person when raising and lowering in the direction of and/or represented by arrows 151*a*, 151*b*, 151*c*, 152*a*, 152*b*, and 152*c*

(see FIG. 22C and FIG. 22D); and c) Can hoist and lower deceleration-capable hand-pain-eliminating counter-weight 120 to assist in operating arthritic-aiding rainwater-sealing-to-protect cable-pulley cable-pulley-hiding-hub LED-light-turning-on-and-off image-projecting counter-weight-decelerating umbrella in the direction of arrows 151*a*, 151*b*, 151*c*, 152*a*, 152*b*, and 152*c*

(see FIG. 22C and FIG. 22D).

7) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having cable-pulley-hiding pole-rust-eliminating counter-weight-rust-eliminating upper hub 117.

Therefore, the arthritic-aiding rainwater-sealing-to-protect-cable-pulley cable-pulley-hiding-hub LED-light-turning-on-and-off image-projecting counter-weight-decelerating umbrella:

a) Can house two rotatable pulleys 114;

b) Can prevent rainwater from entering in through the top of umbrella pole 106 in the directions of arrows 99*e*, 99*f*, 100*a*, 100*b*, and 100*c*, respectively (see FIG. 1D (Prior Art), FIG. 1E, FIG. 1F (Prior Art), FIG. 1G, FIG. 1H, and FIG. 1I);

c) Can mount upper ribs 103*a*

(see FIG. 9 and FIG. 10C);

d) Can mount rib screws 104

(see FIG. 9);

e) Can insert first rainwater-sealing corrosion-eliminating LED-light-turning-on-and-off pulley-plug 108 and second rainwater-sealing corrosion-eliminating LED-light-turning-on-and-off pulley-plug 109 therein (see, FIG. 1E, FIG. 1G, FIG. 1H, FIG. 1I, FIG. 1L, FIG. 1S, and FIG. 1T); and f) Can mount solar panels thereto (see FIG. 28B).

8) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having arthritic-aiding arthritic-hand-accommodating lower hub 118.

Therefore, the arthritic-aiding rainwater-sealing-to-protect-cable-pulley cable-pulley-hiding-hub LED-light-turning-on-and-off image-projecting counter-weight-decelerating umbrella:

a) Can provide an ergonomic arthritic-hand-accommodating surface
to eliminate pain for an arthritic person when operating arthritic-aiding arthritic-hand-accommodating lower hub 118,
as demonstrated by arthritic hand 99*d* in the directions of arrows 153*a* and 153*b*
(see FIG. 22E and FIG. 22F);

b) Can foldable rib joints 105 away from umbrella pole 106
to create larger angles between upper and lower ribs 103*a* and 103*b* which in turn will require less force and effort to move deceleration-capable hand-pain-eliminating counter-weight 120 as demonstrated by 100*d* and 100*e*
(see FIG. 1J (Prior Art) and FIG. 1K); and c) Can attach lower ribs 103*b* thereto
(see FIG. 3).

9) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
deceleration-capable hand-pain-eliminating counter-weight 120.

Therefore, the arthritic-aiding rainwater-sealing-to-protect-cable-pulley cable-pulley-hiding-hub LED-light-turning-on-and-off image-projecting counter-weight-decelerating umbrella:

a) Can help an arthritic with deploying or collapsing arthritic-aiding rainwater-sealing-for-cable-pulley cable-pulley-hiding-hub LED-light-turning-on-and-off image-projecting and weight-assisted umbrella, especially to help arthritic, small, or elderly persons who might have difficulty operating prior art umbrella systems
in the directions of arrows 151*a*, 151*b*, 151*c*, 152*a*, 152*b*, and 152*c*
(see FIG. 22A, FIG. 22B, FIG. 22C, and FIG. 22D); and b) Can require less effort during retraction and deployment of arthritic-aiding rainwater-sealing-to-protect-cable-pulley cable-pulley-hiding-hub LED-light-turning-on-and-off image-projecting counter-weight-decelerating umbrella
in the directions of arrows 145*a*, 145*b*, 145*c*, 145*d*, 145*e*, 145*f*, 145*g*, and 145*h*
(see FIG. 17A and FIG. 17B).

10) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
spiral flutes 123.

Therefore, the arthritic-aiding rainwater-sealing-to-protect-cable-pulley cable-pulley-hiding-hub LED-light-turning-on-and-off image-projecting counter-weight-decelerating umbrella:

Can allow air to flow over said deceleration-capable hand-pain-eliminating counter-weight 120 as said deceleration-capable hand-pain-eliminating counter-weight 120 ascends or descends within said umbrella pole 106
(see FIG. 22A and FIG. 22B).

11) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
locking pin 129.

Therefore, the arthritic-aiding rainwater-sealing-to-protect-cable-pulley cable-pulley-hiding-hub LED-light-turning-on-and-off image-projecting counter-weight-decelerating umbrella:

a) Can guide locking pin 129 and help the hand 99*d* of an arthritic to operate its locking pin
in the directions of arrows 99*a*, 99*b*, and 99*c*
(see FIG. 1A (Prior Art), FIG. 1B, and FIG. 1C);

b) Can lock arthritic-aiding arthritic-hand-accommodating lower hub 118 at one of three desired elevations of umbrella-pole pin openings 126, respectively, when being inserted into one of pin-centering pin-guiding tubes 132
in the directions of arrows 154, 155, and 156
(see FIG. 23A, FIG. 23B, FIG. 24A, FIG. 24B, and FIG. 24C);

c) Can push two of auditorily-snap-locking leaf springs 133 outward until two of auditorily-snap-locking nipples 134 auditorily snap-lock into auditorily-snap-locking recess 130
in the directions of arrows 157*a*, 157*b*, 157*c*, and 157*d*
(see FIG. 24A, FIG. 24B, and FIG. 24C);

d) Can generate snap-locking sounds 157*e* and 157*e*
(see FIG. 24C); and e) Can lock locking pin 129 into one of pin-centering pin-guiding tubes 132
(see FIG. 13, FIG. 23A, FIG. 23B, FIG. 24C, and FIG. 25).

12) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
tow-hitch-connectable pet-shade-and-chair-locking receptacle 143.

Therefore, the arthritic-aiding rainwater-sealing-to-protect-cable-pulley cable-pulley-hi di ng-hub LED-light-turning-on-and-off image-projecting counter-weight-decelerating umbrella:

a) Can attach to a tow-hitch of a vehicle
to provide shade to said vehicle
(see FIG. 28A);

b) Can attach an auxiliary umbrella post therein,
in the directions of arrows 159, 160, and 161
(see FIG. 27A, FIG. 27B, and FIG. 27C); and c) Can secure a leg of a chair therein
in the directions of arrows 159, 160, and 161
(see FIG. 27A, FIG. 27B, and FIG. 27C).

13) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
foldable rib joints 105.

Therefore, the arthritic-aiding rainwater-sealing-to-protect-cable-pulley cable-pulley-hiding-hub LED-light-turning-on-and-off image-projecting counter-weight-decelerating umbrella:

a) Can create larger angles 100*e* between upper and lower canopy ribs which in turn requires less force/effort to move the counter weight of the umbrella than smaller angles 100*d* (see FIG. 1J (Prior Art), and FIG. 1K); and b) Can pivotably secure upper ribs 103*a* to lower ribs 103*b* to allow upper ribs 103*a* and lower ribs 103*b* to fold and to deploy.

Other objects and advantages of the present invention will become apparent from a consideration of the accompanying drawings and ensuing description.

SUMMARY OF THE INVENTION

An arthritic-aiding rainwater-sealing-to-protect-cable-pulley cable-pulley-hiding-hub LED-light-turning-on-and-off image-projecting counter-weight-decelerating umbrella comprises a canopy, upper and lower ribs, foldable rib joints respectively attached to upper ribs, an umbrella pole, a cable-pulley-hiding pole-rust-eliminating counter-weight-rust-eliminating upper hub attached to the top of the umbrella pole for housing two rotatable pulleys inside and for preventing rainwater from entering inside the umbrella pole, upside-down rainwater-blocking cable-pulley holes respectively drilled into the undersurface of the upper hub for preventing rainwater from penetrating inside the upper hub thereby protecting the upper hub, the pole, the cable and counter-weight from internal corrosion, a first rainwater-sealing corrosion-eliminating LED-light-turning-on-and-off pulley-plug and a second rainwater-sealing corrosion-eliminating LED-light-turning-on-and-off pulley-plug for sealing out rainwater from penetrating inside the upper hub and the umbrella pole, an arthritic-aiding arthritic-hand-accommodating lower hub slidably attached to the umbrella pole for providing an ergonomic arthritic-hand-accommodating surface to eliminate pain for an arthritic person when operating, an interchangeable multi-angle LED-light-magnifying image projector for decreasing and enlarging a projected image on a table, a patio, a deck, or a floor, a deceleration-capable hand-pain-eliminating counter-weight for helping and arthritic with deploying or collapsing the rainwater-sealing counter-weight-decelerating umbrella, a deceleration-capable hand-pain-eliminating counter-weight arthritic-aiding counter-weight-decelerating image-projector-locking elastic cable attached to the lower hub, threaded over one of the two rotatable pulleys, threaded into the pole top and into the inside of the umbrella pole, threaded through a blade hole, threaded over another one of the two rotatable pulleys, threaded out of the pole top and out of the inside of the umbrella pole, and attached to the lower hub for decelerating the counter-weight and cushioning tension, vibration, and impact from operating the rainwater-sealing counter-weight-decelerating umbrella to eliminate pain and discomfort experienced by an arthritic, and to assist in folding or deploying the canopy, umbrella-pole pin openings drilled through the umbrella pole, an arthritic-aiding cable-hook grip ring, a locking pin, an arthritic-aiding cable-hook grip ring attached to locking pin, pin-centering pin-guiding plugs molded to each other and inserted into the umbrella pole, pin-centering pin-guiding tubes molded in the pin-guiding plugs and aligned with the pin openings, an umbrella-pole vertical support tube detachably receives the umbrella pole, an umbrella base welded to the bottom of the vertical support tube, and a tow-hitch-connectable pet-shade-and-chair-locking receptacle formed into the umbrella base for attaching to a tow-hitch of a vehicle, attaching an auxiliary umbrella post therein, or securing a leg of a chair therein.

DETAILED DESCRIPTION OF THE INVENTION

The arthritic-aiding rainwater-sealing-to-protect-cable-pulley cable-pulley-hiding-hub LED-light-turning-on-and-off image-projecting counter-weight-decelerating umbrella comprises:

1) Rainwater-sealing-for-cable-pulley cable-pulley-hiding-hub canopy and pole system,
   2) Rainwater-sealing corrosion-eliminating LED-light-turning-on-and-off interchangeable-multi-angle LED-light-magnifying image-projector-securing pulley-plug system,
   3) Arthritic-aiding cable-pulley-hiding pole-rust-eliminating counter-weight-decelerating image-projector-locking elastic cable system,
   4) Deceleration-capable hand-pain-eliminating counter-weight system,
   5) Arthritic-aiding pin-centering pin-guiding auditorily-snap-locking tower-locking system, and
   6) Portable tow-hitch-connectable pet-shade-and-chair-locking umbrella-base system.

Component

Figure 1A:
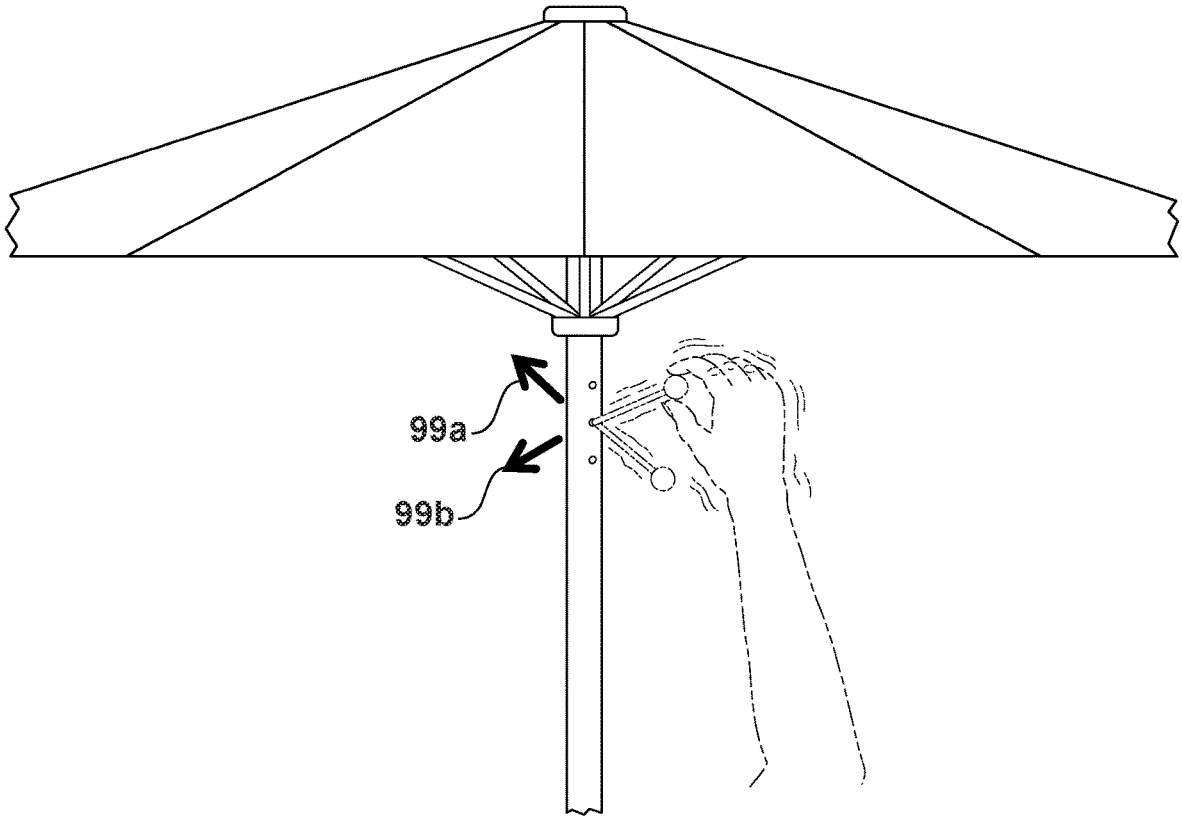
FIG. 1A (Prior Art)
FIG. 1A (PRIOR ART)
Figure 1B:
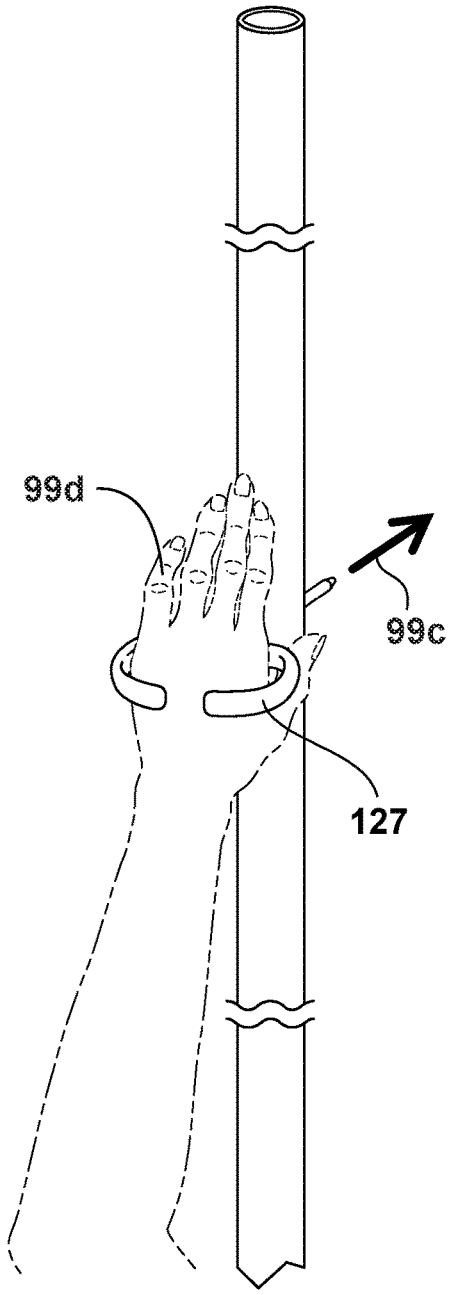
FIG. 1B, and FIG. 1C illustrate front and perspective views of the disadvantages of the prior art, and the advantage of the new invention allowing a user with arthritic hand 99*d* to keep his/her hand straight (to eliminate the need for bending his/her fingers and wrist) when holding and operating arthritic-aiding cable-hook grip ring by inserting his/her hand through arthritic-aiding cable-hook grip ring and inserting locking pin into one of pin-centering pin-guiding tubes.
Figure 1C:
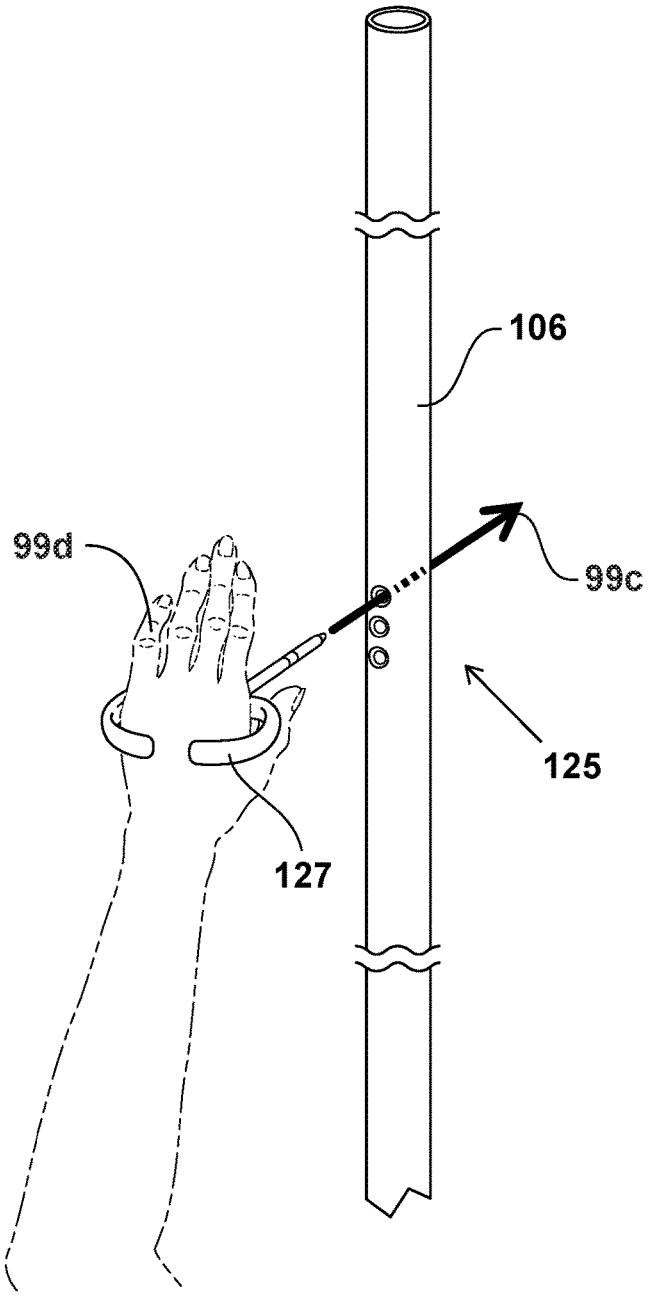
Figure 1D:
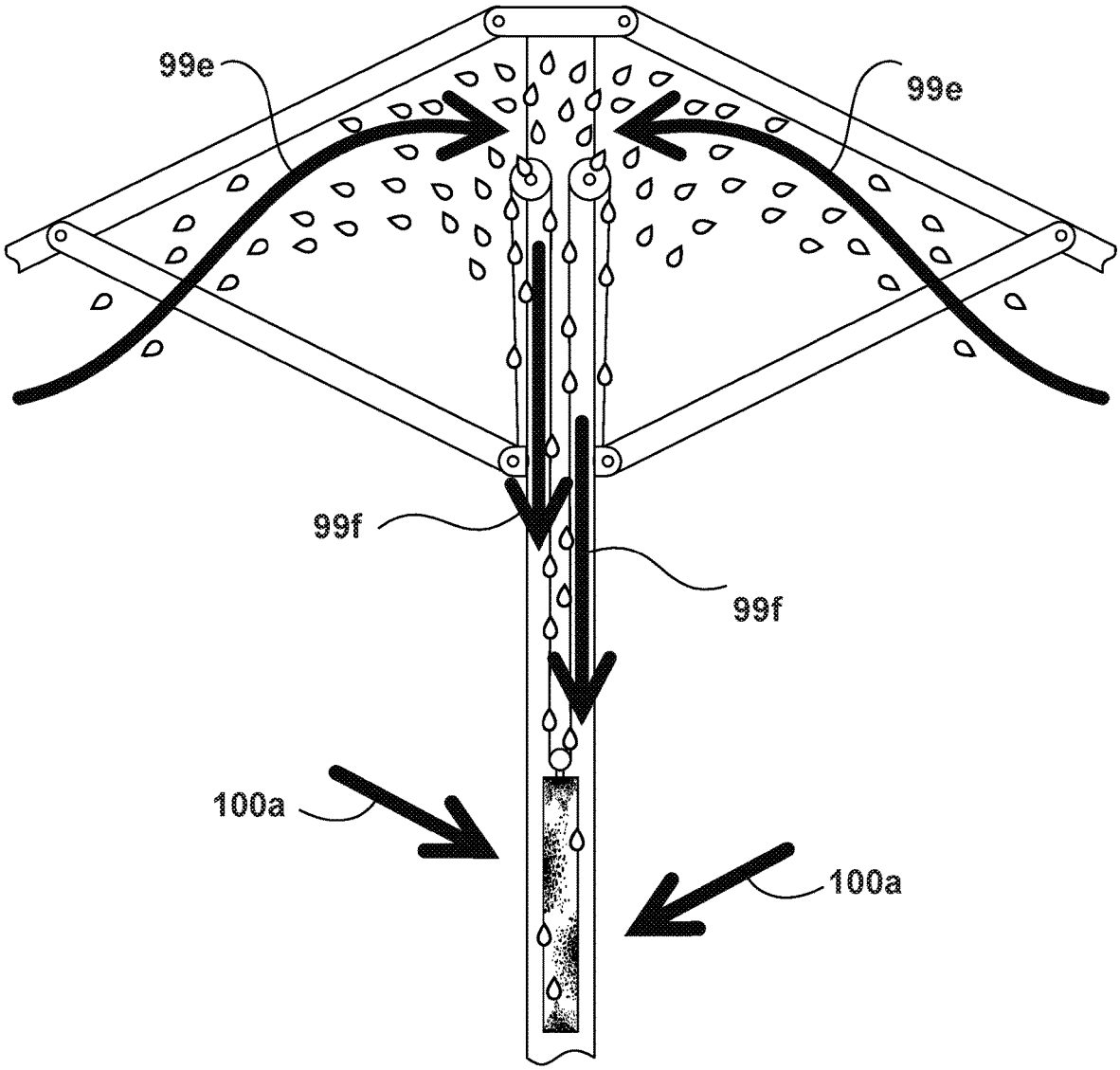
FIG. 1D (Prior Art)
FIG. 1D (PRIOR ART) illustrates a front view of the disadvantage of having pulleys, cable, and counter-weight being exposed to rainwater and moisture (see arrows 99*e*), which allow rainwater and moisture to enter into the inside of the umbrella pole (see arrows 99*f*), which, over time, will create rust and corrosion 100*a* therein, which, in turn, will hinder the intended shuttling movement of the counter weight inside the umbrella pole.
Figure 1E:
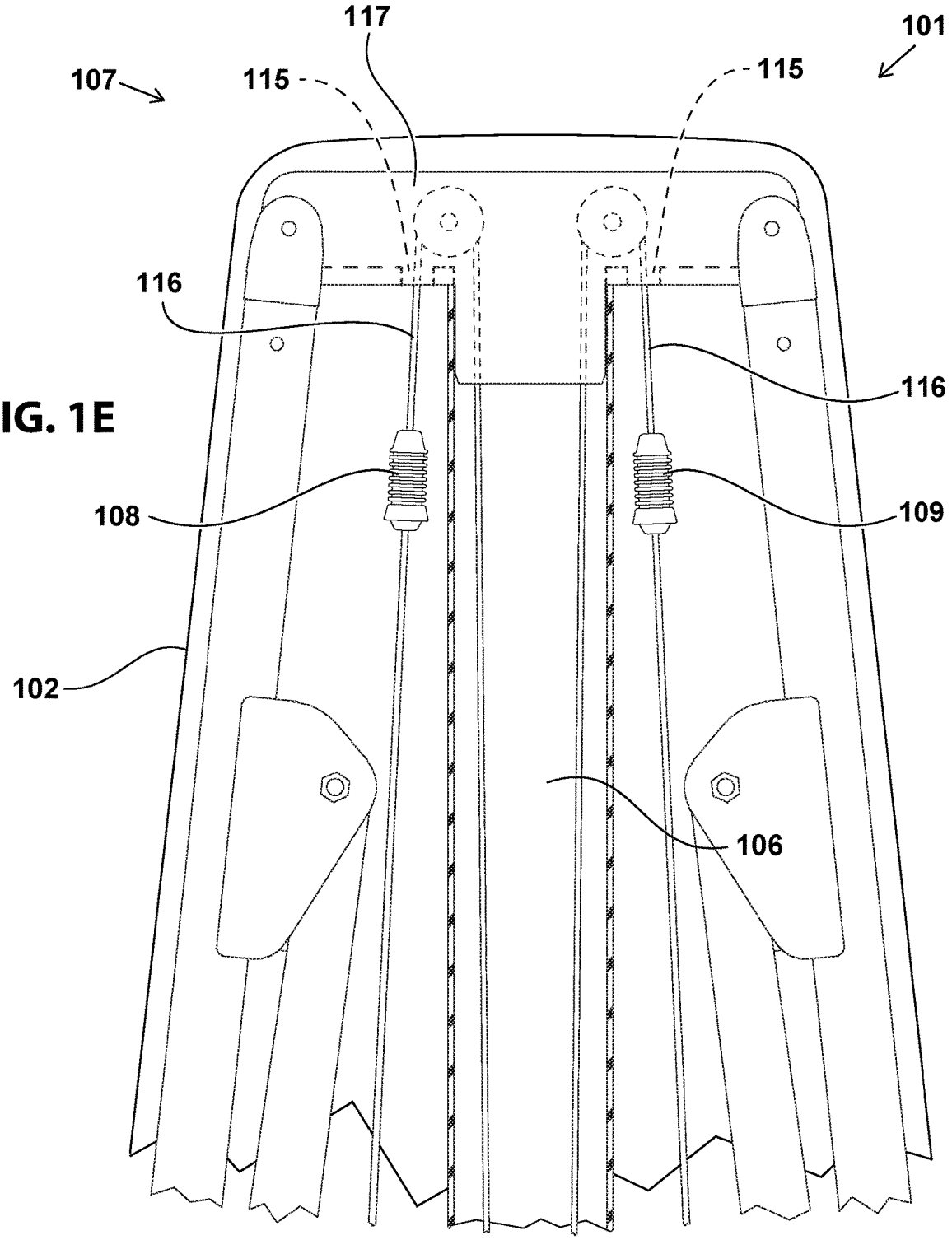
FIG. 1E illustrates a front view of the advantage of having the sealed cable-pulley-hiding pole-rust-eliminating counter-weight-rust-eliminating upper hub, and the advantage of having rainwater-sealing corrosion-eliminating LED-light-turning-on-and-off interchangeable-multi-angle LED-light-magnifying image-projector-securing pulley-plug system providing first and second rainwater-sealing corrosion-eliminating LED-light-turning-on-and-off pulley-plugs, thus eliminating internal moisture and protecting the internal components from rust and corrosion.
Figure 1F:
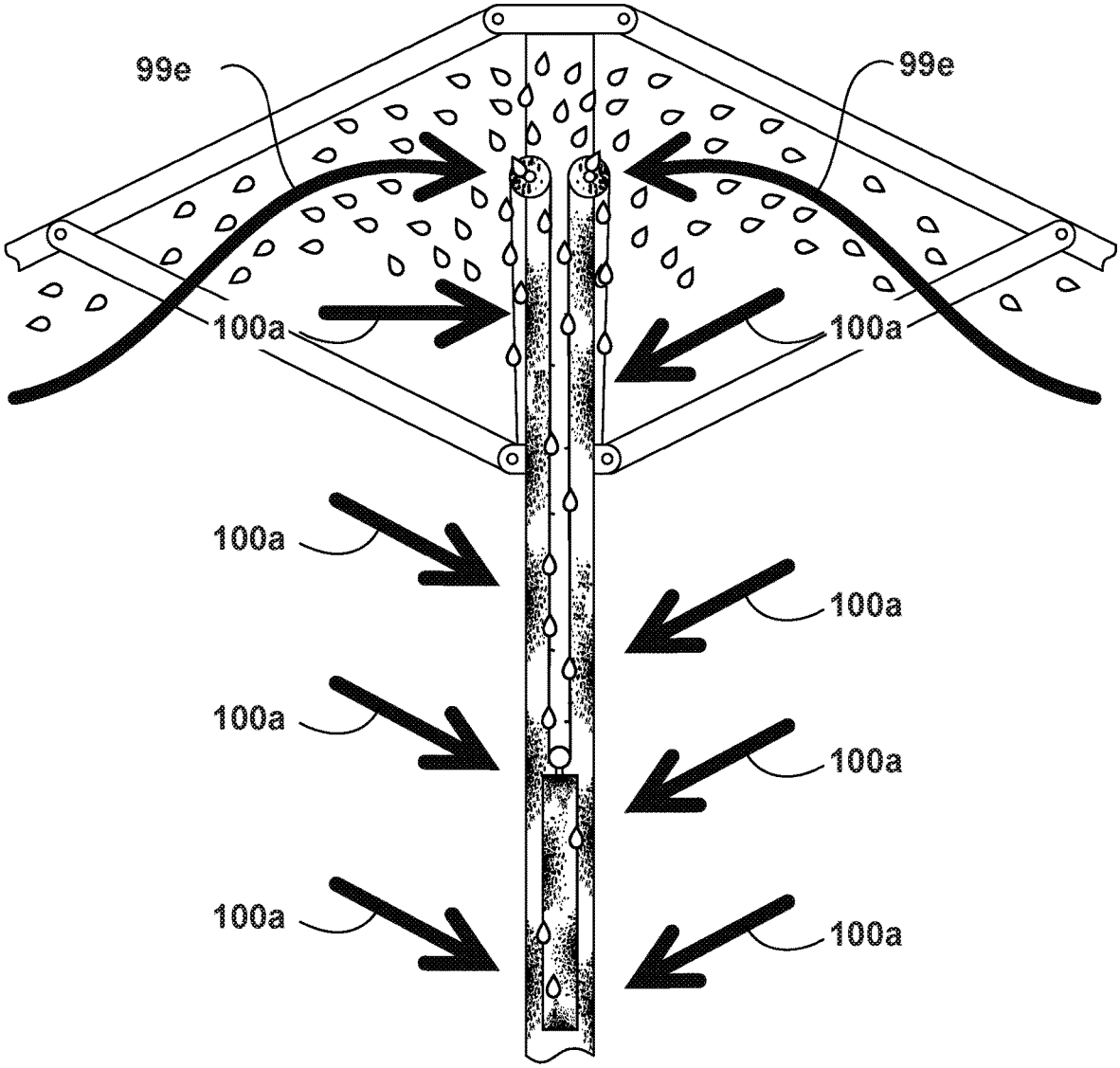
FIG. 1F (Prior Art)
FIG. 1F (PRIOR ART) illustrates a front view of the disadvantage of having the pulleys, cable, and counter-weight unsealed and therefore to exposed to rainwater and moisture (see arrows 99*e*), which allow rainwater and moisture to enter into the inside of the umbrella pole, which over time, will create rust and corrosion 100*a* therein, which, in turn, will hinder the intended shuttling movement of the counter weight inside the umbrella pole.

Referring to FIG. 1A (PRIOR ART), FIG. 1B, FIG. 1C, FIG. 1D (PRIOR ART), FIG. 1E, FIG. 1F (PRIOR ART), FIG. 1G, FIG. 1H, FIG. 1I, FIG. 1J (PRIOR ART), FIG. 1K, FIG. 1L, FIG. 1M, FIG. 1N, FIG. 1O, FIG. 1P, FIG. 1Q, FIG. 1R, FIG. 1S, FIG. 1T, FIG. 1U, FIG. 1V, FIG. 1W, FIG. 1X, FIG. 1Y, FIG. 1Z, FIG. 2, FIG. 3, FIG. 4, FIG. 5, FIG. 6, FIG. 7, FIG. 8, FIG. 9, FIG. 10A, FIG. 10B, FIG. 10C, FIG. 10D, FIG. 11, FIG. 12A, FIG. 12B, FIG. 13, FIG. 14, FIG. 15A, FIG. 15B, FIG. 15C, FIG. 15D, FIG. 15E, FIG. 16A, FIG. 16B, FIG. 16C, and FIG. 16D, the arthritic-aiding rainwater-sealing-to-protect-cable-pulley cable-pulley-hiding-hub LED-light-turning-on-and-off image-projecting counter-weight-decelerating umbrella comprises:

1) Rainwater-sealing-for-cable-pulley cable-pulley-hiding-hub canopy and pole system 101, comprising:
2) Canopy 102,
3) Upper and lower ribs 103*a* and 103*b*,
4) Rib screws 104,
5) Foldable rib joints 105, and
6) Umbrella pole 106;
7) Rainwater-sealing corrosion-eliminating LED-light-turning-on-and-off interchangeable-multi-angle LED-light-magnifying image-projector-securing pulley-plug system 107, comprising:
8) First rainwater-sealing corrosion-eliminating LED-light-turning-on-and-off pulley-plug 108,
9) Second rainwater-sealing corrosion-eliminating LED-light-turning-on-and-off pulley-plug 109,
10) Interchangeable multi-angle LED-light-magnifying image projector 110*a*, Image-projector LED-light opening 110*b*,
11) Projector docks 111, and
12) Image-magnifying image-projecting lens 112;
13) Arthritic-aiding cable-pulley-hiding pole-rust-eliminating counter-weight-decelerating image-projector-locking elastic cable system 113, comprising:
14) Two rotatable pulleys 114,
15) Upside-down rainwater-blocking cable-pulley holes 115,
16) Arthritic-aiding counter-weight-decelerating image-projector-locking elastic cable 116,
17) Cable-pulley-hiding pole-rust-eliminating counter-weight-rust-eliminating upper hub 117, and
18) Arthritic-aiding arthritic-hand-accommodating lower hub 118;
19) Deceleration-capable hand-pain-eliminating counter-weight system 119, comprising:
20) Deceleration-capable hand-pain-eliminating counter-weight 120,
21) Aerodynamic propeller-shaped head blade 121,
22) Counter-weight spiral spoilers 122,
23) Spiral flutes 123, and
24) Blade hole 124;
25) Arthritic-aiding pin-centering pin-guiding auditorily-snap-locking tower-locking system 125, comprising:
26) Umbrella-pole pin openings 126,
27) Arthritic-aiding cable-hook grip ring 127,
28) Anti-finger-pinching spacer 128,
29) Locking pin 129,
30) Auditorily-snap-locking recess 130,
31) Pin-centering pin-guiding plugs 131,
32) Pin-centering pin-guiding tubes 132,
33) Auditorily-snap-locking leaf springs 133,
34) Auditorily-snap-locking nipples 134,
35) Four internally-taperedly-threaded flexible towers 135,
36) Twelve triangular tower leaf springs 136, and
37) Tower-locking screw 137; and
38) Portable tow-hitch-connectable pet-shade-and-chair-locking umbrella-base system 138, comprising:
39) Umbrella-pole vertical support tube 139,
40) Umbrella-pole-locking knobs 140*a* and 140*b*,
41) Threaded knob holes 141*a* and 141*b*,
42) Umbrella base 142,
43) Tow-hitch-connectable pet-shade-and-chair-locking receptacle 143, and
44) Umbrella base wheels 144*a* and 144*b*.

Material

Referring to FIG. 1A (PRIOR ART), FIG. 1B, FIG. 1C, FIG. 1D (PRIOR ART), FIG. 1E, FIG. 1F (PRIOR ART), FIG. 1G, FIG. 1H, FIG. 1I, FIG. 1J (PRIOR ART), FIG. 1K, FIG. 1L, FIG. 1M, FIG. 1N, FIG. 1O, FIG. 1P, FIG. 1Q, FIG. 1R, FIG. 1S, FIG. 1T, FIG. 1U, FIG. 1V, FIG. 1W, FIG. 1X, FIG. 1Y, FIG. 1Z, FIG. 2, FIG. 3, FIG. 4, FIG. 5, FIG. 6, FIG. 7, FIG. 8, FIG. 9, FIG. 10A, FIG. 10B, FIG. 10C, FIG. 10D, FIG. 11, FIG. 12A, FIG. 12B, FIG. 13, FIG. 14, FIG. 15A, FIG. 15B, FIG. 15C, FIG. 15D, FIG. 15E, FIG. 16A, FIG. 16B, FIG. 16C, and FIG. 16D:

1) Rainwater-sealing-for-cable-pulley cable-pulley-hiding-hub canopy and pole system 101 is (or are each) made up of the combined materials of its components.
2) Canopy 102 is (or are each) made up of canvas material.
3) Upper and lower ribs 103*a* and 103*b* is (or are each) made of metallic material.
4) Rib screws 104 is (or are each) made of metallic material.
5) Foldable rib joints 105 is (or are each) made of metallic material.
6) Umbrella pole 106 is (or are each) made of metallic material.
7) Rainwater-sealing corrosion-eliminating LED-light-turning-on-and-off interchangeable-multi-angle LED-light-magnifying image-projector-securing pulley-plug system 107 is (or are each) made up of the combined materials of its components.
8) First rainwater-sealing corrosion-eliminating LED-light-turning-on-and-off pulley-plug 108 is (or are each) made of rubber material.
9) Second rainwater-sealing corrosion-eliminating LED-light-turning-on-and-off pulley-plug 109 is (or are each) made of rubber material.
10) Interchangeable multi-angle LED-light-magnifying image projector 110*a* is (or are each) made of plastic material.
    Image-projector LED-light opening 110*b* is (or are each) made of empty space.
11) Projector docks 111 is (or are each) made of plastic material.
12) Image-magnifying image-projecting lens 112 is (or are each) made of plastic material.
13) Arthritic-aiding cable-pulley-hiding pole-rust-eliminating counter-weight-decelerating image-projector-locking elastic cable system 113 is (or are each) made up of the combined materials of its components.
14) Two rotatable pulleys 114 is (or are each) made of metallic or plastic material.
15) Upside-down rainwater-blocking cable-pulley holes 115 is (or are each) made of empty space.
16) Arthritic-aiding counter-weight-decelerating image-projector-locking elastic cable 116 is (or are each) made of elastic material.
17) Cable-pulley-hiding pole-rust-eliminating counter-weight-rust-eliminating upper hub 117 is (or are each) made of plastic material.
18) Arthritic-aiding arthritic-hand-accommodating lower hub 118 is (or are each) made of plastic material.
19) Deceleration-capable hand-pain-eliminating counter-weight system 119 is (or are each) made up of the combined materials of its components.
20) Deceleration-capable hand-pain-eliminating counter-weight 120 is (or are each) made of metallic material.
21) Aerodynamic propeller-shaped head blade 121 is (or are each) made of metallic material.
22) Counter-weight spiral spoilers 122 is (or are each) made of metallic material.
23) Spiral flutes 123 is (or are each) made of empty space.
24) Blade hole 124 is (or are each) made of empty space.
25) Arthritic-aiding pin-centering pin-guiding auditorily-snap-locking tower-locking system 125 is (or are each) made of the combined materials of its components.
26) Umbrella-pole pin openings 126 is (or are each) made of empty space.
27) Arthritic-aiding cable-hook grip ring 127 is (or are each) made of metallic material.
28) Anti-finger-pinching spacer 128 is (or are each) made of metallic material.
29) Locking pin 129 is (or are each) made of metallic material.
30) Auditorily-snap-locking recess 130 is (or are each) made of metallic material.
31) Pin-centering pin-guiding plugs 131 is (or are each) made of plastic material.
32) Pin-centering pin-guiding tubes 132 is (or are each) made of plastic material.
33) Auditorily-snap-locking leaf springs 133 is (or are each) made of plastic material.
34) Auditorily-snap-locking nipples 134 is (or are each) made of plastic material.
35) Four internally-taperedly-threaded flexible towers 135 is (or are each) made of plastic material.
36) Twelve triangular tower leaf springs 136 is (or are each) made of plastic material.
37) Tower-locking screw 137 is (or are each) made of metallic material.
38) Portable tow-hitch-connectable pet-shade-and-chair-locking umbrella-base system 138 is (or are each) made of the combined materials of its components.
39) Umbrella-pole vertical support tube 139 is (or are each) made of metallic material.
40) Umbrella-pole-locking knobs 140*a* and 140*b* is (or are each) made of plastic and metallic material.
41) Threaded knob holes 141*a* and 141*b* is (or are each) made of empty space.
42) Umbrella base 142 is (or are each) made of metallic material.
43) Tow-hitch-connectable pet-shade-and-chair-locking receptacle 143 is (or are each) made of empty space.
44) Umbrella base wheels 144*a* and 144*b* is (or are each) made of plastic and metallic material.

Shape

Referring to FIG. 1A (PRIOR ART), FIG. 1B, FIG. 1C, FIG. 1D (PRIOR ART), FIG. 1E, FIG. 1F (PRIOR ART), FIG. 1G, FIG. 1H, FIG. 1I, FIG. 1J (PRIOR ART), FIG. 1K, FIG. 1L, FIG. 1M, FIG. 1N, FIG. 1O, FIG. 1P, FIG. 1Q, FIG. 1R, FIG. 1S, FIG. 1T, FIG. 1U, FIG. 1V, FIG. 1W, FIG. 1X, FIG. 1Y, FIG. 1Z, FIG. 2, FIG. 3, FIG. 4, FIG. 5, FIG. 6, FIG. 7, FIG. 8, FIG. 9, FIG. 10A, FIG. 10B, FIG. 10C, FIG. 10D, FIG. 11, FIG. 12A, FIG. 12B, FIG. 13, FIG. 14, FIG. 15A, FIG. 15B, FIG. 15C, FIG. 15D, FIG. 15E, FIG. 16A, FIG. 16B, FIG. 16C, and FIG. 16D:

1) Rainwater-sealing-for-cable-pulley cable-pulley-hiding-hub canopy and pole system 101 is (or are each) formed into the combined shapes of its components.
2) Canopy 102 is (or are each) formed into a circular shape.
3) Upper and lower ribs 103*a* and 103*b* is (or are each) formed into a tubular shape.
4) Rib screws 104 is (or are each) formed into a screw shape.
5) Foldable rib joints 105 is (or are each) formed into a triangular-sandwich shape, with one swollen side.
6) Umbrella pole 106 is (or are each) formed into a tubular shape.

7) Rainwater-sealing corrosion-eliminating LED-light-turning-on-and-off interchangeable-multi-angle LED-light-magnifying image-projector-securing pulley-plug system 107 is (or are each) formed into the combined shapes of its components.

8) First rainwater-sealing corrosion-eliminating LED-light-turning-on-and-off pulley-plug 108 is (or are each) formed into a tubular shape.

9) Second rainwater-sealing corrosion-eliminating LED-light-turning-on-and-off pulley-plug 109 is (or are each) formed into a tubular shape.

10) Interchangeable multi-angle LED-light-magnifying image projector 110*a* is (or are each) formed into a rounded-rectangular shape.

Image-projector LED-light opening 110*b* is (or are each) formed into a round shape.

11) Projector docks 111 is (or are each) formed into a U shape.

12) Image-magnifying image-projecting lens 112 is (or are each) formed into a rounded-rectangular shape.

13) Arthritic-aiding cable-pulley-hiding pole-rust-eliminating counter-weight-decelerating image-projector-locking elastic cable system 113 is (or are each) formed into the combined shapes of its components.

14) Two rotatable pulleys 114 is (or are each) formed into a pulley shape.

15) Upside-down rainwater-blocking cable-pulley holes 115 is (or are each) formed into a circular shape.

16) Arthritic-aiding counter-weight-decelerating image-projector-locking elastic cable 116 is (or are each) formed into a round cross-sectional shape.

17) Cable-pulley-hiding pole-rust-eliminating counter-weight-rust-eliminating upper hub 117 is (or are each) formed into a sixteen-pointed-star shape.

18) Arthritic-aiding arthritic-hand-accommodating lower hub 118 is (or are each) formed into a funnel-like like sixteen-pointed-star shape.

19) Deceleration-capable hand-pain-eliminating counter-weight system 119 is (or are each) formed into the combined shapes of its components.

20) Deceleration-capable hand-pain-eliminating counter-weight 120 is (or are each) formed into a rounded-cylinder shape.

21) Aerodynamic propeller-shaped head blade 121 is (or are each) formed into a rounded-blade shape.

22) Counter-weight spiral spoilers 122 is (or are each) formed into a spiraling-ridge shape.

23) Spiral flutes 123 is (or are each) formed into a spiraling-furrow shape.

24) Blade hole 124 is (or are each) formed into a circular shape.

25) Arthritic-aiding pin-centering pin-guiding auditorily-snap-locking tower-locking system 125 is (or are each) formed into the combined shapes of its components.

26) Umbrella-pole pin openings 126 is (or are each) formed into a circular shape.

27) Arthritic-aiding cable-hook grip ring 127 is (or are each) formed into an oval shape.

28) Anti-finger-pinching spacer 128 is (or are each) formed into a round shape.

29) Locking pin 129 is (or are each) formed into a round-tubular shape.

30) Auditorily-snap-locking recess 130 is (or are each) formed into a round-tubular shape.

31) Pin-centering pin-guiding plugs 131 is (or are each) formed into a round tubular shape.

32) Pin-centering pin-guiding tubes 132 is (or are each) formed into a round tubular shape.

33) Auditorily-snap-locking leaf springs 133 is (or are each) formed into a long-flat shape.

34) Auditorily-snap-locking nipples 134 is (or are each) formed into a round shape.

35) Four internally-taperedly-threaded flexible towers 135 is (or are each) formed into an elongated-L-bracket shape.

36) Twelve triangular tower leaf springs 136 is (or are each) formed into a triangular-flat shape.

37) Tower-locking screw 137 is (or are each) formed into a screw shape.

38) Portable tow-hitch-connectable pet-shade-and-chair-locking umbrella-base system 138 is (or are each) formed into the combined shapes of its components.

39) Umbrella-pole vertical support tube 139 is (or are each) formed into a tubular shape.

40) Umbrella-pole-locking knobs 140*a* and 140*b* is (or are each) formed into a five-pointed-star shape.

41) Threaded knob holes 141*a* and 141*b* is (or are each) formed into a circular shape.

42) Umbrella base 142 is (or are each) formed into a rectangular shape.

43) Tow-hitch-connectable pet-shade-and-chair-locking receptacle 143 is (or are each) formed into an oval shape.

44) Umbrella base wheels 144*a* and 144*b* is (or are each) formed into a round shape.

Connection

Referring to FIG. 1A (PRIOR ART), FIG. 1B, FIG. 1C, FIG. 1D (PRIOR ART), FIG. 1E, FIG. 1F (PRIOR ART), FIG. 1G, FIG. 1H, FIG. 1I, FIG. 1J (PRIOR ART), FIG. 1K, FIG. 1L, FIG. 1M, FIG. 1N, FIG. 1O, FIG. 1P, FIG. 1Q, FIG. 1R, FIG. 1S, FIG. 1T, FIG. 1U, FIG. 1V, FIG. 1W, FIG. 1X, FIG. 1Y, FIG. 1Z, FIG. 2, FIG. 3, FIG. 4, FIG. 5, FIG. 6, FIG. 7, FIG. 8, FIG. 9, FIG. 10A, FIG. 10B, FIG. 10C, FIG. 10D, FIG. 11, FIG. 12A, FIG. 12B, FIG. 13, FIG. 14, FIG. 15A, FIG. 15B, FIG. 15C, FIG. 15D, FIG. 15E, FIG. 16A, FIG. 16B, FIG. 16C, and FIG. 16D:

1) Rainwater-sealing-for-cable-pulley cable-pulley-hiding-hub canopy and pole system 101 is (or are respectively) connected by the combined connections of its components.

2) Canopy 102 is (or are respectively) screwed on upper ribs 103*a*.

3) Upper and lower ribs 103*a* and 103*b* is (or are respectively) foldably screwed together, to cable-pulley-hiding pole-rust-eliminating counter-weight-rust-eliminating upper hub 117, and to foldable rib joints 105.

4) Rib screws 104 is (or are respectively) screwed to upper and lower ribs 103*a* and 103*b*, cable-pulley-hiding pole-rust-eliminating counter-weight-rust-eliminating upper hub 117, and arthritic-aiding arthritic-hand-accommodating lower hub 118.

5) Foldable rib joints 105 is (or are respectively) molded to arthritic-aiding arthritic-hand-accommodating lower hub 118.

6) Umbrella pole 106 is (or are respectively) attached to cable-pulley-hiding pole-rust-eliminating counter-weight-rust-eliminating upper hub 117.

7) Rainwater-sealing corrosion-eliminating LED-light-turning-on-and-off interchangeable-multi-angle LED-light-magnifying image-projector-securing pulley-plug system 107 is (or are respectively) connected by the combined connections of its components.

8) First rainwater-sealing corrosion-eliminating LED-light-turning-on-and-off pulley-plug 108 is (or are respectively)

attached to arthritic-aiding counter-weight-decelerating image-projector-locking elastic cable 116.

9) Second rainwater-sealing corrosion-eliminating LED-light-turning-on-and-off pulley-plug 109 is (or are respectively) clamped on arthritic-aiding counter-weight-decelerating image-projector-locking elastic cable 116.

10) Interchangeable multi-angle LED-light-magnifying image projector 110*a* is (or are respectively) removably and repositionably snapped into an LED light 100*e*. Image-projector LED-light opening 110*b* is (or are respectively) molded to interchangeable multi-angle LED-light-magnifying image projector 110*a*.

11) Projector docks 111 respectively is (or are respectively) molded to interchangeable multi-angle LED-light-magnifying image projector 110*a*.

12) Image-magnifying image-projecting lens 112 is (or are respectively) slidably clamped to arthritic-aiding counter-weight-decelerating image-projector-locking elastic cable 116.

13) Arthritic-aiding cable-pulley-hiding pole-rust-eliminating counter-weight-decelerating image-projector-locking elastic cable system 113 is (or are respectively) connected by the combined connections of its components.

14) Two rotatable pulleys 114 is (or are respectively) hidden within cable-pulley-hiding pole-rust-eliminating counter-weight-rust-eliminating upper hub 117 and rotatably riveted to cable-pulley-hiding pole-rust-eliminating counter-weight-rust-eliminating upper hub 117.

15) Upside-down rainwater-blocking cable-pulley holes 115 is (or are respectively) drilled into cable-pulley-hiding pole-rust-eliminating counter-weight-rust-eliminating upper hub 117.

16) Arthritic-aiding counter-weight-decelerating image-projector-locking elastic cable 116 is (or are respectively) attached to arthritic-aiding arthritic-hand-accommodating lower hub 118, threaded over one of two rotatable pulleys 114, threaded into the top end of umbrella pole 106 and into the inside of umbrella pole 106, threaded through blade hole 124, threaded over another one of two rotatable pulleys 114, threaded out of the top end and out of the inside of umbrella pole 106, and attached to arthritic-aiding arthritic-hand-accommodating lower hub 118.

17) Cable-pulley-hiding pole-rust-eliminating counter-weight-rust-eliminating upper hub 117 is (or are respectively) attached to the top of umbrella pole 106.

18) Arthritic-aiding arthritic-hand-accommodating lower hub 118 is (or are respectively) slidably attached to umbrella pole 106.

19) Deceleration-capable hand-pain-eliminating counter-weight system 119 is (or are respectively) connected by the combined connections of its components.

20) Deceleration-capable hand-pain-eliminating counter-weight 120 is (or are respectively) slid into umbrella pole 106.

21) Aerodynamic propeller-shaped head blade 121 is (or are respectively) molded to the two opposite ends of deceleration-capable hand-pain-eliminating counter-weight 120.

22) Counter-weight spiral spoilers 122 is (or are respectively) molded to deceleration-capable hand-pain-eliminating counter-weight 120.

23) Spiral flutes 123 is (or are respectively) routed out of deceleration-capable hand-pain-eliminating counter-weight 120.

24) Blade hole 124 is (or are respectively) drilled out of aerodynamic propeller-shaped head blade 121.

25) Arthritic-aiding pin-centering pin-guiding auditorily-snap-locking tower-locking system 125 is (or are respectively) connected by the combined connections of its components.

26) Umbrella-pole pin openings 126 is (or are respectively) drilled through the two opposite walls of umbrella pole 106.

27) Arthritic-aiding cable-hook grip ring 127 is (or are respectively) attached to locking pin 129.

28) Anti-finger-pinching spacer 128 is (or are respectively) screwed on locking pin 129.

29) Locking pin 129 is (or are respectively) molded to anti-finger-pinching spacer 128.

30) Auditorily-snap-locking recess 130 is (or are respectively) molded in locking pin 129.

31) Pin-centering pin-guiding plugs 131 is (or are respectively) molded to each other, and inserted into umbrella pole 106.

32) Pin-centering pin-guiding tubes 132 is (or are respectively) molded in pin-centering pin-guiding plugs 131, and aligned with umbrella-pole pin openings 126.

33) Auditorily-snap-locking leaf springs 133 is (or are respectively) molded on the opposite walls of pin-centering pin-guiding tubes 132.

34) Auditorily-snap-locking nipples 134 is (or are respectively) molded on auditorily-snap-locking leaf springs 133.

35) Four internally-taperedly-threaded flexible towers 135 is (or are respectively) molded to a pin-centering pin-guiding plug 131.

36) Twelve triangular tower leaf springs 136 is (or are respectively) molded to four internally-taperedly-threaded flexible towers 135.

37) Tower-locking screw 137 is (or are respectively) screwed between and on four internally-taperedly-threaded flexible towers 135.

38) Portable tow-hitch-connectable pet-shade-and-chair-locking umbrella-base system 138 is (or are respectively) connected by the combined connections of its components.

39) Umbrella-pole vertical support tube 139 is (or are respectively) welded atop umbrella base 142.

40) Umbrella-pole-locking knobs 140*a* and 140*b* is (or are respectively) screwed through threaded knob holes 141*a* and 141*b*.

41) Threaded knob holes 141*a* and 141*b* is (or are respectively) drilled and threaded into umbrella-pole vertical support tube 139.

42) Umbrella base 142 is (or are respectively) welded to umbrella-pole vertical support tube 139.

43) Tow-hitch-connectable pet-shade-and-chair-locking receptacle 143 is (or are respectively) formed into umbrella base 142.

44) Umbrella base wheels 144*a* and 144*b* is (or are respectively) welded to umbrella base 142.

Function

Referring to FIG. 1A (PRIOR ART), FIG. 1B, FIG. 1C, FIG. 1D (PRIOR ART), FIG. 1E, FIG. 1F (PRIOR ART), FIG. 1G, FIG. 1H, FIG. 1I, FIG. 1J (PRIOR ART), FIG. 1K FIG. 1L, FIG. 1N, FIG. 1O, FIG. 1P, FIG. 1S, FIG. 1T, FIG. 1U, FIG. 1V, FIG. 3, FIG. 9, FIG. 10A, FIG. 10B, FIG. 10C, FIG. 10D, FIG. 11, FIG. 12A, FIG. 12B, FIG. 13, FIG. 14, FIG. 15A, FIG. 15B, FIG. 15C, FIG. 15D, FIG. 15E, FIG. 16A, FIG. 16B, FIG. 16C, FIG. 16D, FIG. 17A, FIG. 17B, FIG. 18, FIG. 19A, FIG. 19B, FIG. 19C, FIG. 19D, FIG. 20A, FIG. 20B, FIG. 20C, FIG. 20D, FIG. 21A, FIG. 21B, FIG. 21C, FIG. 21D, FIG. 21E, FIG. 21F, FIG. 22A, FIG.

22B, FIG. 22C, FIG. 22D, FIG. 22E, FIG. 22F, FIG. 23A, FIG. 23B, FIG. 24A, FIG. 24B, FIG. 24C, FIG. 25, FIG. 26A, FIG. 26B, FIG. 27A, FIG. 27B, FIG. 27C, FIG. 28A, FIG. 28B, FIG. 28C, FIG. 28D, FIG. 28E, FIG. 28F, FIG. 28G, FIG. 28H, FIG. 28I, and FIG. 29:

1) Rainwater-sealing-for-cable-pulley cable-pulley-hiding-hub canopy and pole system 101 is (or are respectively) for performing the combined functions of its components.

2) Canopy 102 is (or are respectively) for:
Providing shade.

3) Upper and lower ribs 103*a* and 103*b* is (or are respectively) for:
Framingly bracing canopy 102.

4) Rib screws 104 is (or are respectively) for:
Securing upper and lower ribs 103*a* and 103*b* to cable-pulley-hiding pole-rust-eliminating counter-weight-rust-eliminating upper hub 117, and arthritic-aiding arthritic-hand-accommodating lower hub 118, respectively.

5) Foldable rib joints 105 is (or are respectively) for:
Creating larger angles 100*e* between upper and lower canopy ribs which in turn requires less force/effort to move the counter weight of the umbrella than smaller angles 100*d*
(see FIG. 1J (Prior Art), and FIG. 1K); and
Pivotably securing upper ribs 103*a* to lower ribs 103*b* to allow upper ribs 103*a* and lower ribs 103*b* to fold and to deploy.

6) Umbrella pole 106 is (or are respectively) for:
Supporting cable-pulley-hiding pole-rust-eliminating counter-weight-rust-eliminating upper hub 117 and arthritic-aiding arthritic-hand-accommodating lower hub 118, and
Providing umbrella-pole pin openings 126
to aid arthritic hands 99*d* to insert locking pin 129
in the directions of arrows 99*a*, 99*b*, 99*c*, and 99*d*
(see FIG. 1A (Prior Art), FIG. 1B, and FIG. 1C).

7) Rainwater-sealing corrosion-eliminating LED-light-turning-on-and-off interchangeable-multi-angle LED-light-magnifying image-projector-securing pulley-plug system 107 is (or are respectively) for performing the combined functions of its components.

8) First rainwater-sealing corrosion-eliminating LED-light-turning-on-and-off pulley-plug 108 is (or are respectively) for:
Sealing out rainwater from penetrating the inside of cable-pulley-hiding pole-rust-eliminating counter-weight-rust-eliminating upper hub 117 and umbrella pole 106
in the directions of arrows 99*e*, 99*f*, 100*a*, and 100*b*, respectively
(see FIG. 1D (Prior Art), FIG. 1E, FIG. 1F (Prior Art), and FIG. 1G);
Protecting cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), FIG. 1G, and FIG. 1H);
Increasing the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120;
Inserting into one of upside-down rainwater-blocking cable-pulley holes 115, respectively;
Sealing one of upside-down rainwater-blocking cable-pulley holes 115, respectively;
in the directions of arrows 100*b* and 100*c*, respectively
(see FIG. 1G and FIG. 1H and
Frictionably activating and deactivating an on/off-switch to an LED-light-on-off switch 100*f* by upward and downward movement, respectively
in the directions of arrows 147*a*, 147*b*, 147*c*, and 147*d*
(see FIG. 20A and FIG. 20B).

9) Second rainwater-sealing corrosion-eliminating LED-light-turning-on-and-off pulley-plug 109 is (or are respectively) for:
Sealing out rainwater from penetrating the inside of cable-pulley-hiding pole-rust-eliminating counter-weight-rust-eliminating upper hub 117 and umbrella pole 106
in the directions of arrows 99*e*, 99*f*, 100*a*, and 100*b*, respectively
(see FIG. 1D (Prior Art), FIG. 1E, FIG. 1F (Prior Art), and FIG. 1G);
Protecting cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), FIG. 1G, and FIG. 1H);
Increasing the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120;
Inserting into one of upside-down rainwater-blocking cable-pulley holes 115, respectively;
Sealing one of upside-down rainwater-blocking cable-pulley holes 115, respectively;
in the directions of arrows 100*b* and 100*c*, respectively
(see FIG. 1G and FIG. 1H); and
Frictionably activating and deactivating an on/off-switch to an LED-light-on-off switch 100*f* by upward and downward movement, respectively
in the directions of arrows 147*a*, 147*b*, 147*c*, and 147*d*
(see FIG. 20A and FIG. 20B).

Figure 1G:
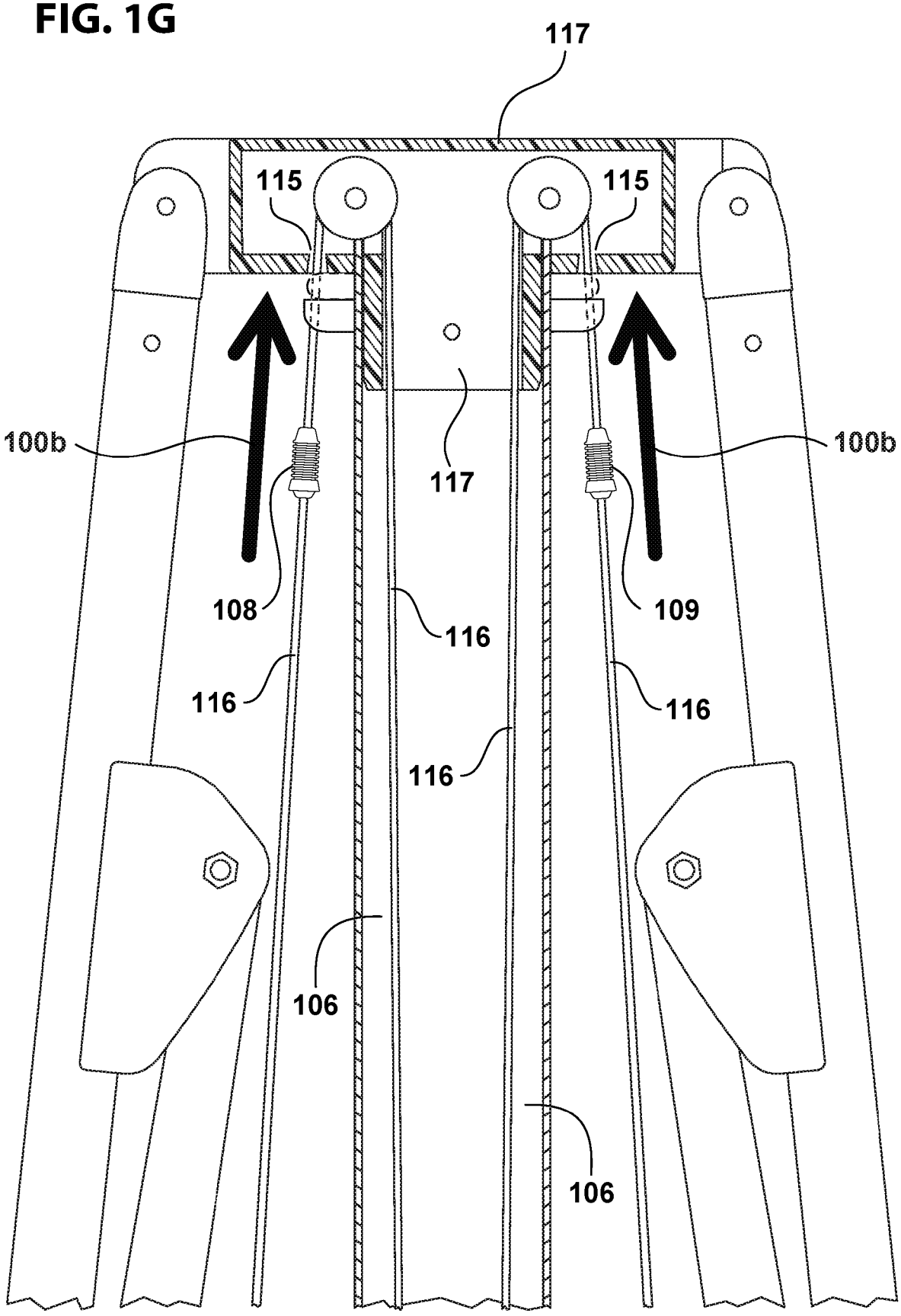
FIG. 1G illustrates a front view of the advantage of the sealed cable-pulley-hiding pole-rust-eliminating counter-weight-rust-eliminating upper hub, and the advantage of having the rainwater-sealing corrosion-eliminating LED-light-turning-on-and-off interchangeable-multi-angle LED-light-magnifying image-projector-securing pulley-plug system providing first rainwater-sealing corrosion-eliminating LED-light-turning-on-and-off pulley-plug, thus eliminating internal moisture and protecting the internal components from corrosion.
Figure 1H:
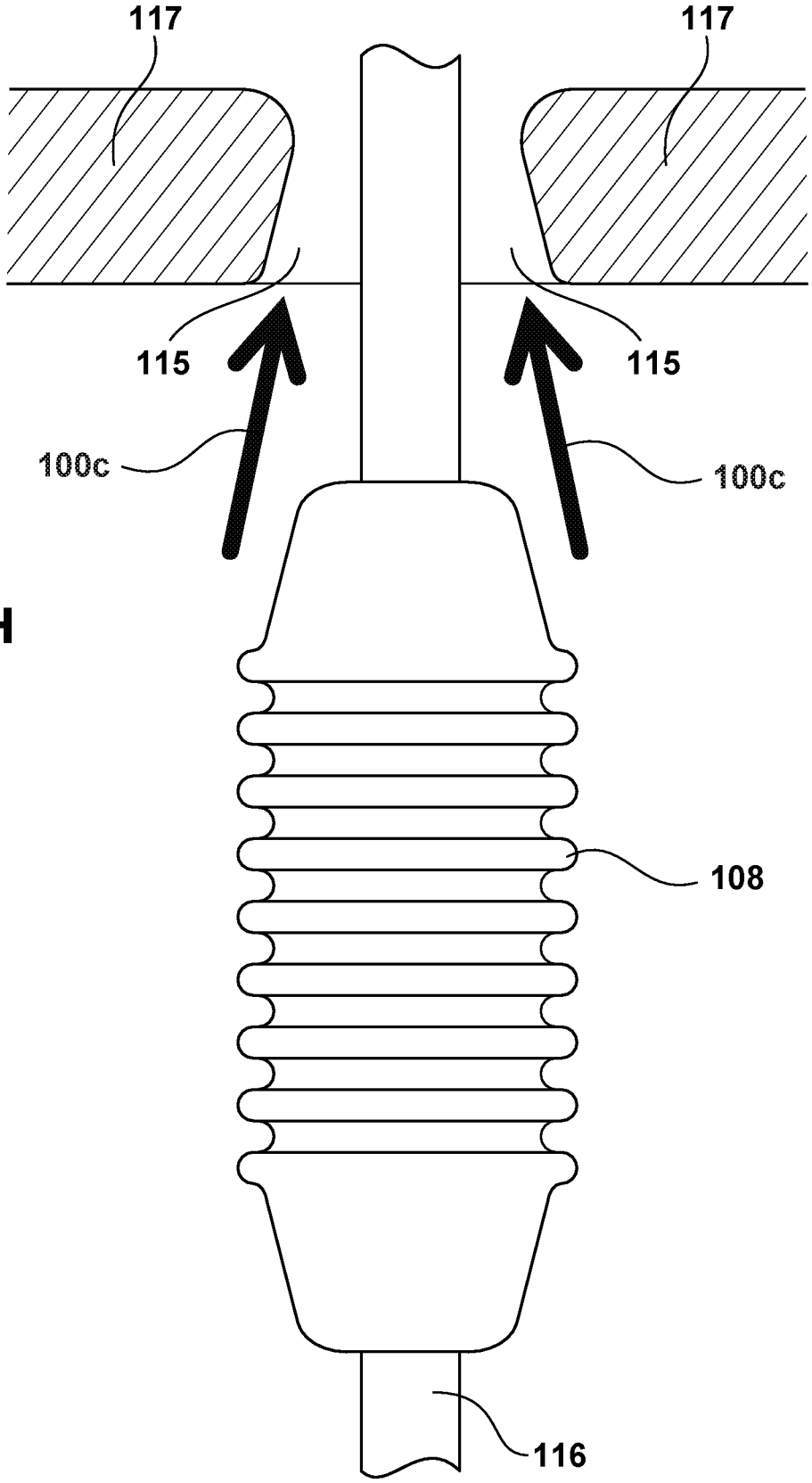
FIG. 1H and FIG. 1I illustrate the insertion of the first rainwater-sealing corrosion-eliminating LED-light-turning-on-and-off pulley-plug into upside-down rainwater-blocking cable-pulley holes, thus eliminating internal moisture and protecting the internal components from corrosion.
Figure 1I:
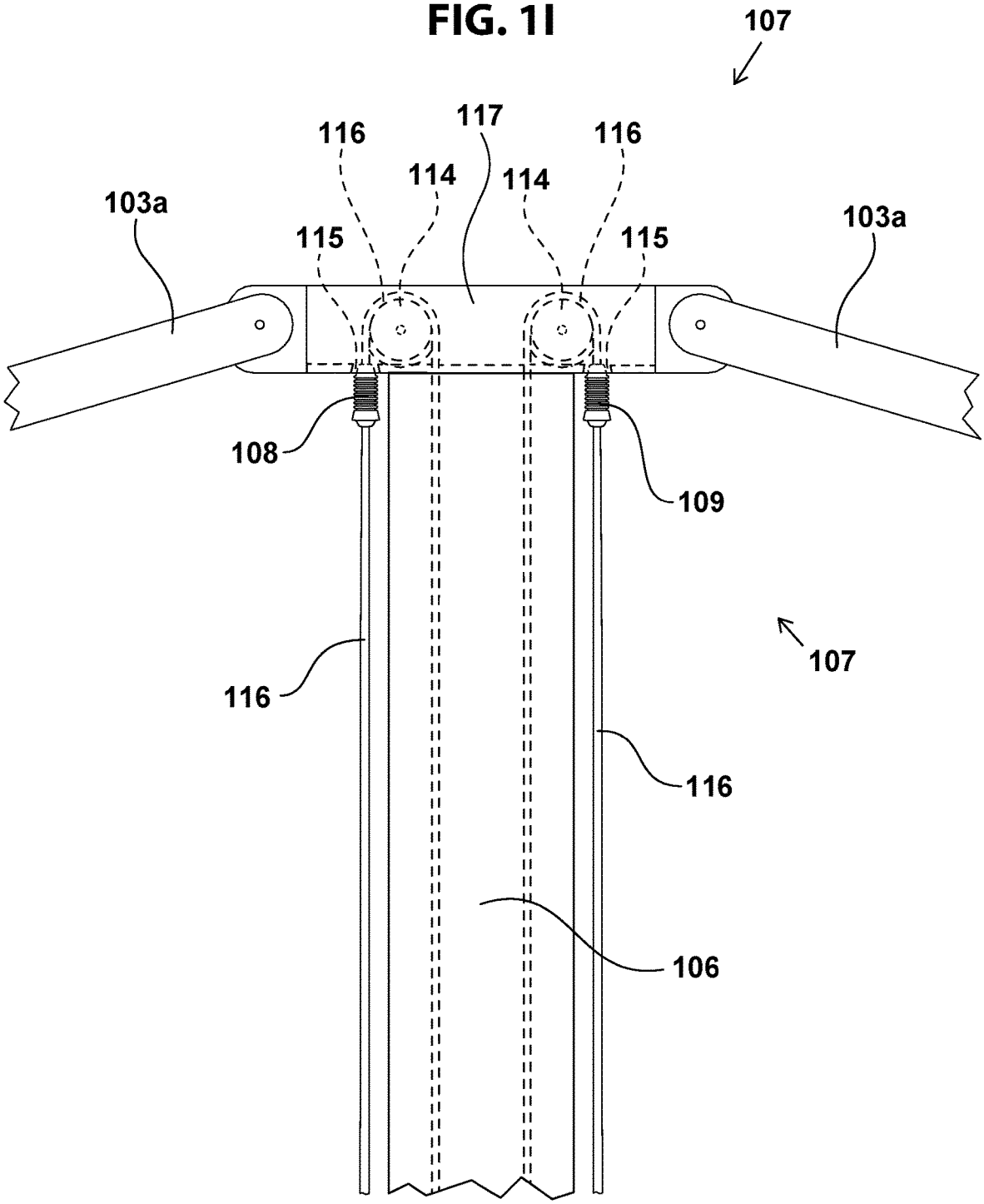
Figure 1J:
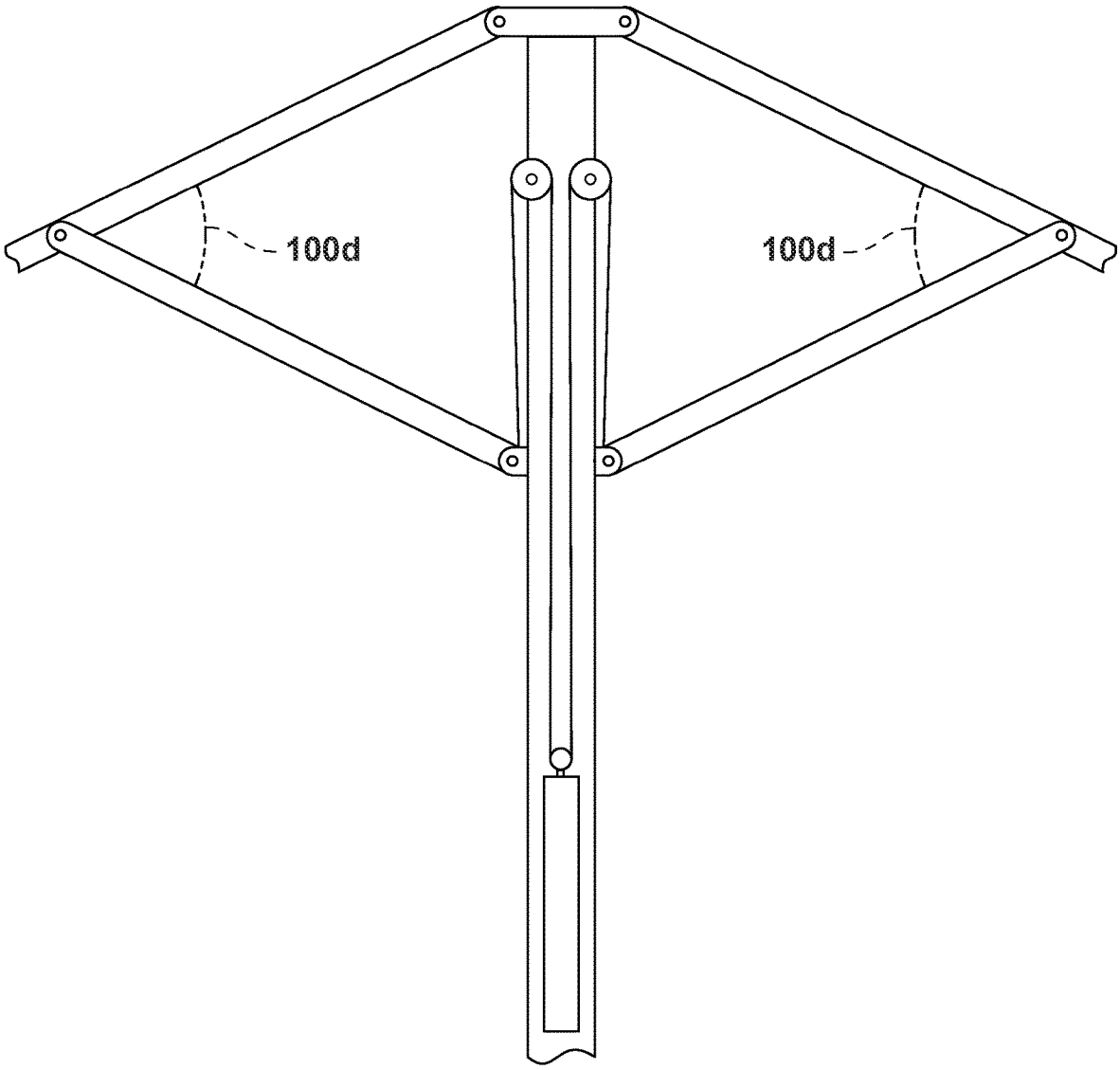
FIG. 1J (Prior Art)
FIG. 1J (PRIOR ART) illustrates a front view of the disadvantage of having the foldable rib joints positioned next to the umbrella pole, which creates a smaller angle 100*d* between the lower ribs and the upper ribs, which, in turn, will require more force/effort to move the counter weight.
Figure 1K:
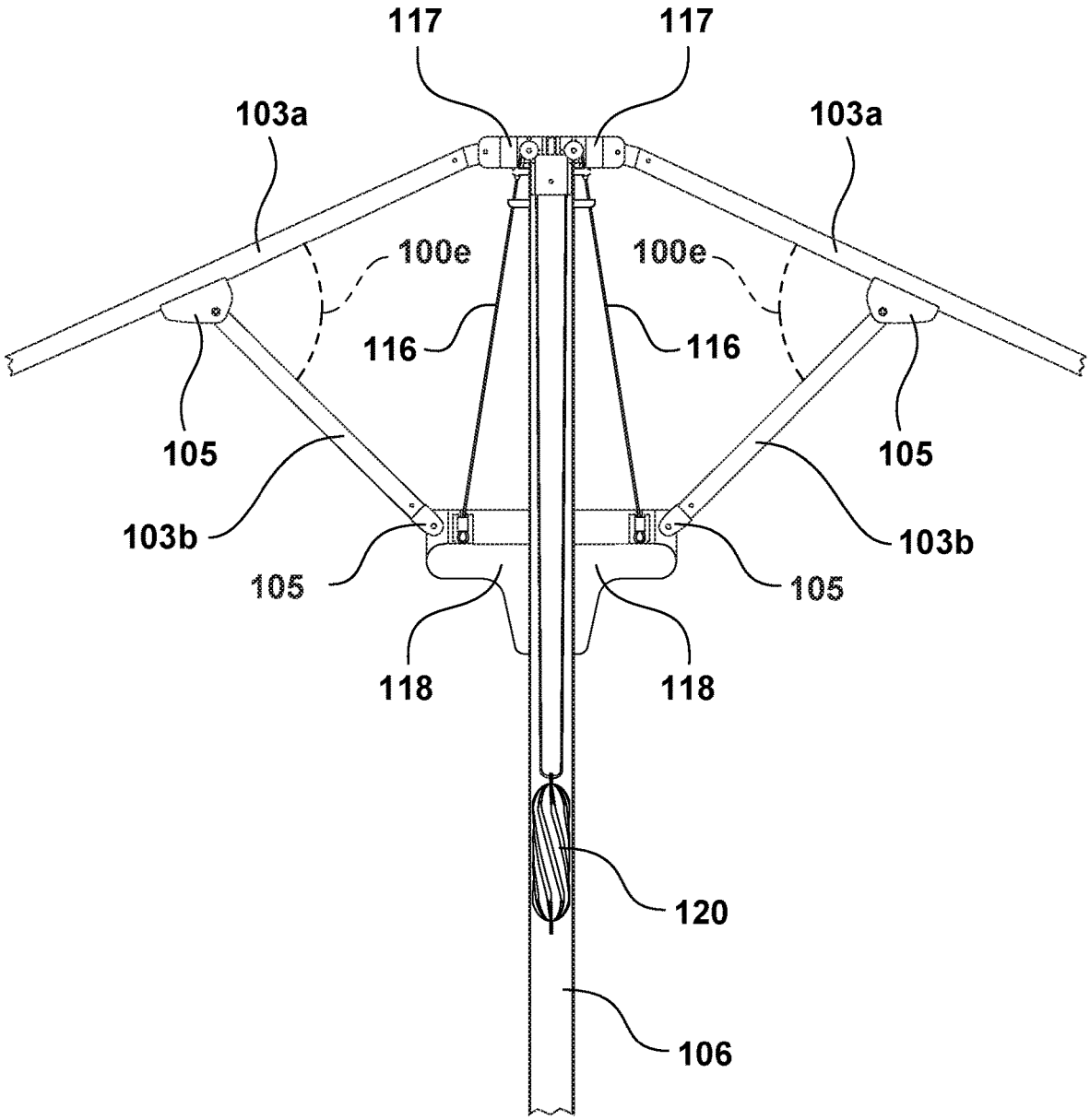
FIG. 1K and FIG. 1L illustrate front views of the advantage of having the foldable rib joints positioned away from the umbrella pole, which creates a larger angle 100*e* between the upper ribs and the lower ribs, which, in turn, will require less force/effort to move the counter weight.
Figure 1L:
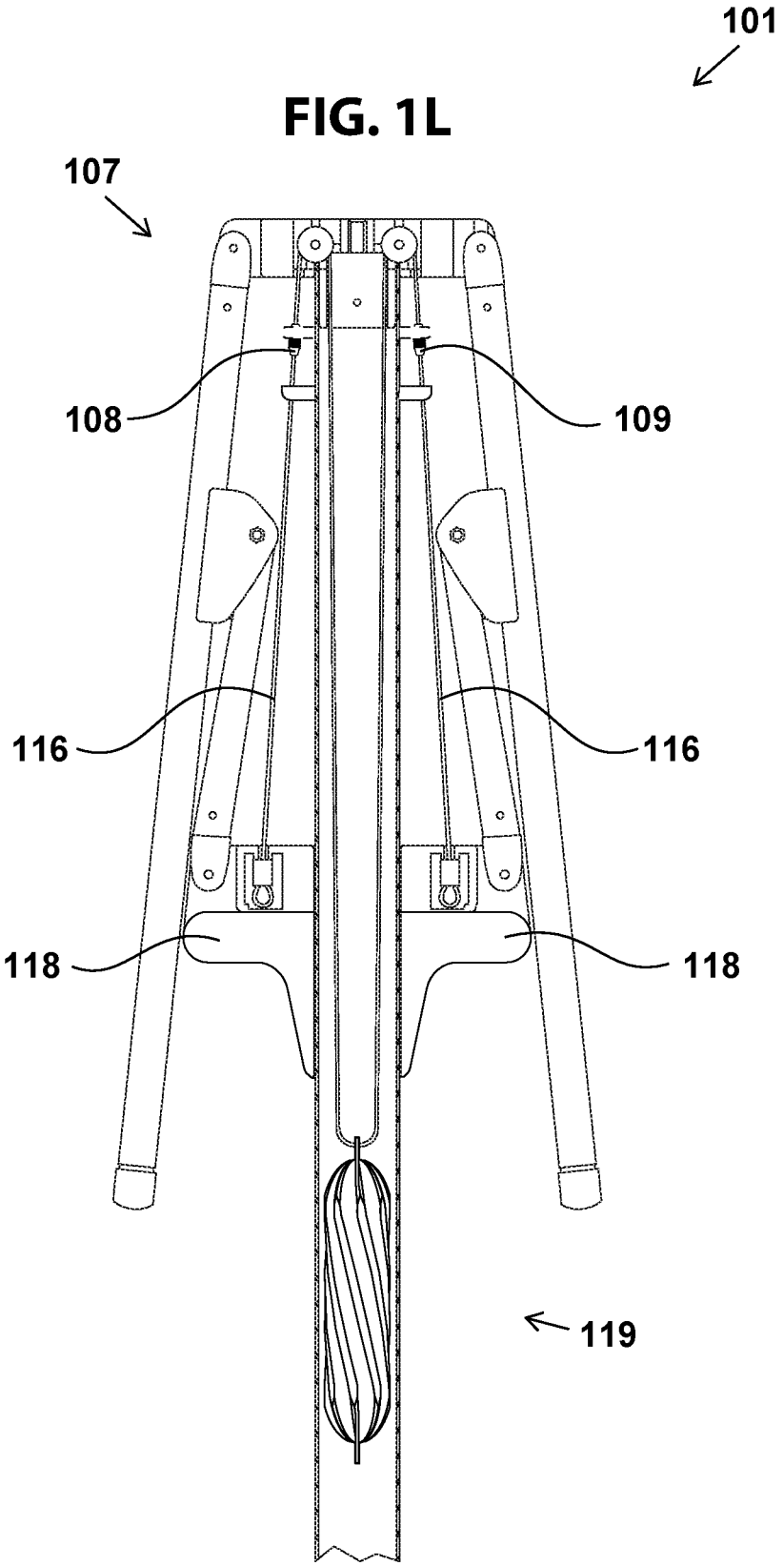
Figure 1M:
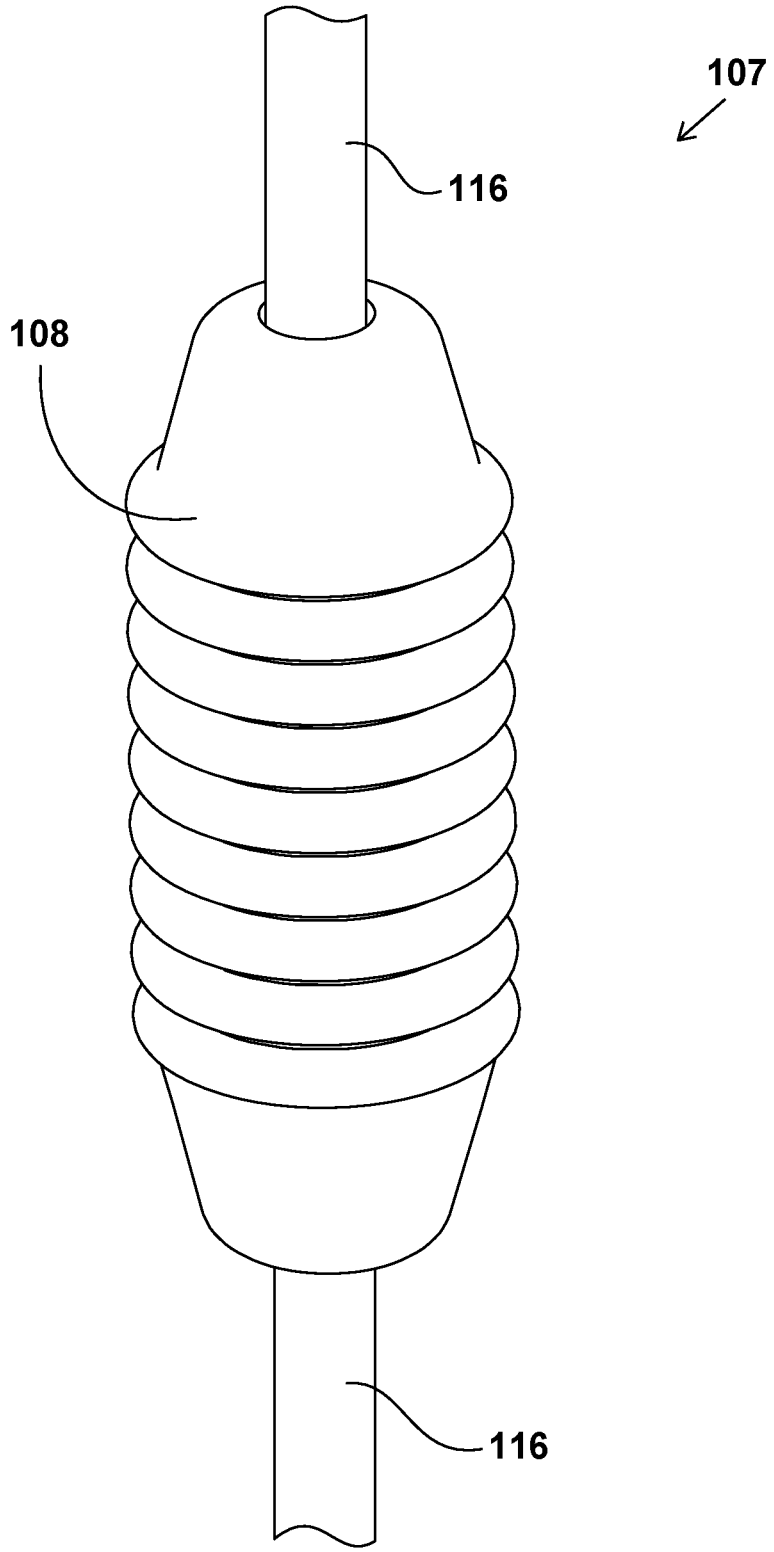
FIG. 1M illustrates a front view of first rainwater-sealing corrosion-eliminating LED-light-turning-on-and-off pulley-plug.
Figure 1N:
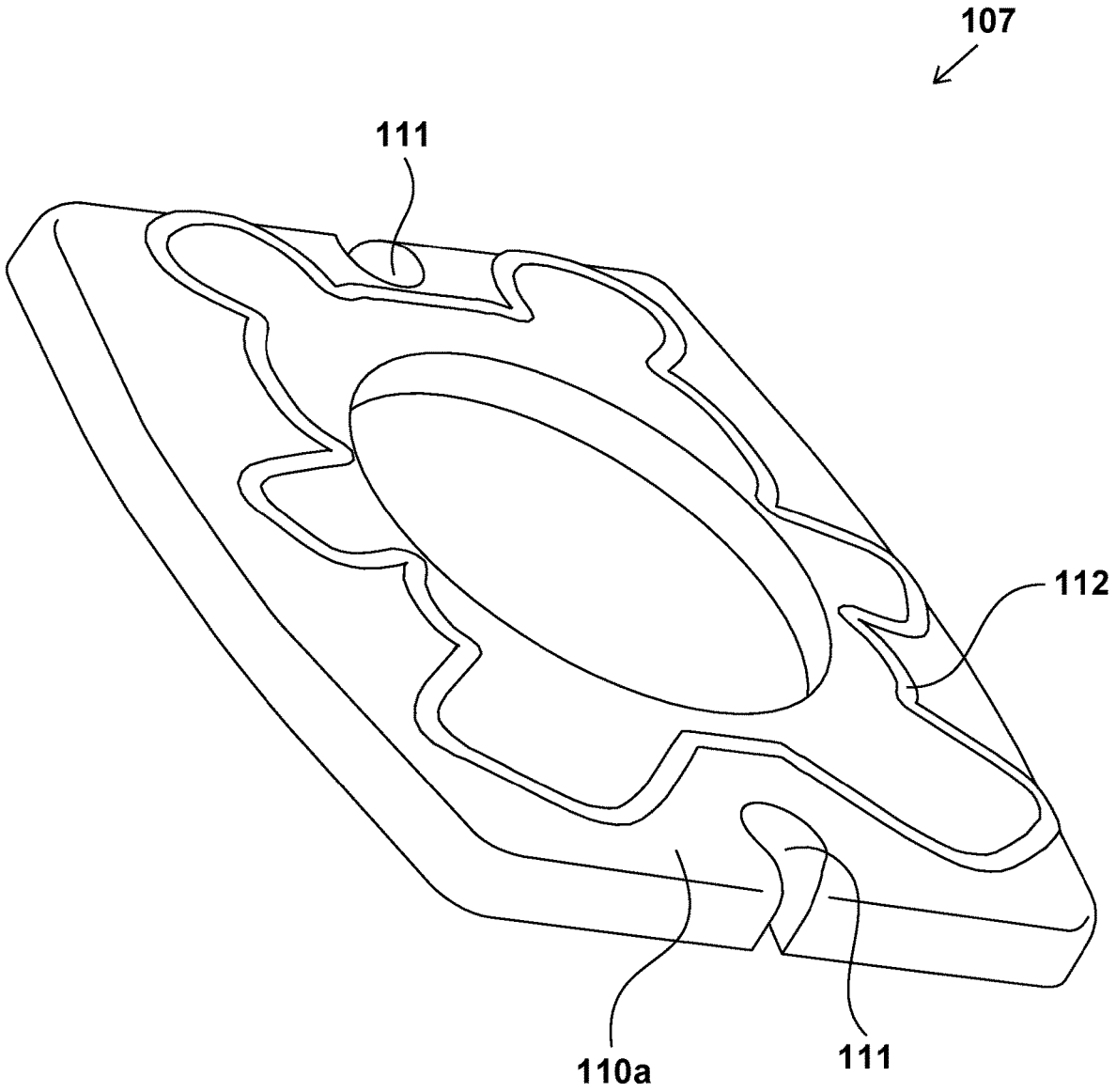
FIG. 1N and FIG. 1O illustrate a perspective and bottom views of interchangeable multi-angle LED-light-magnifying image projector.
Figure 1O:
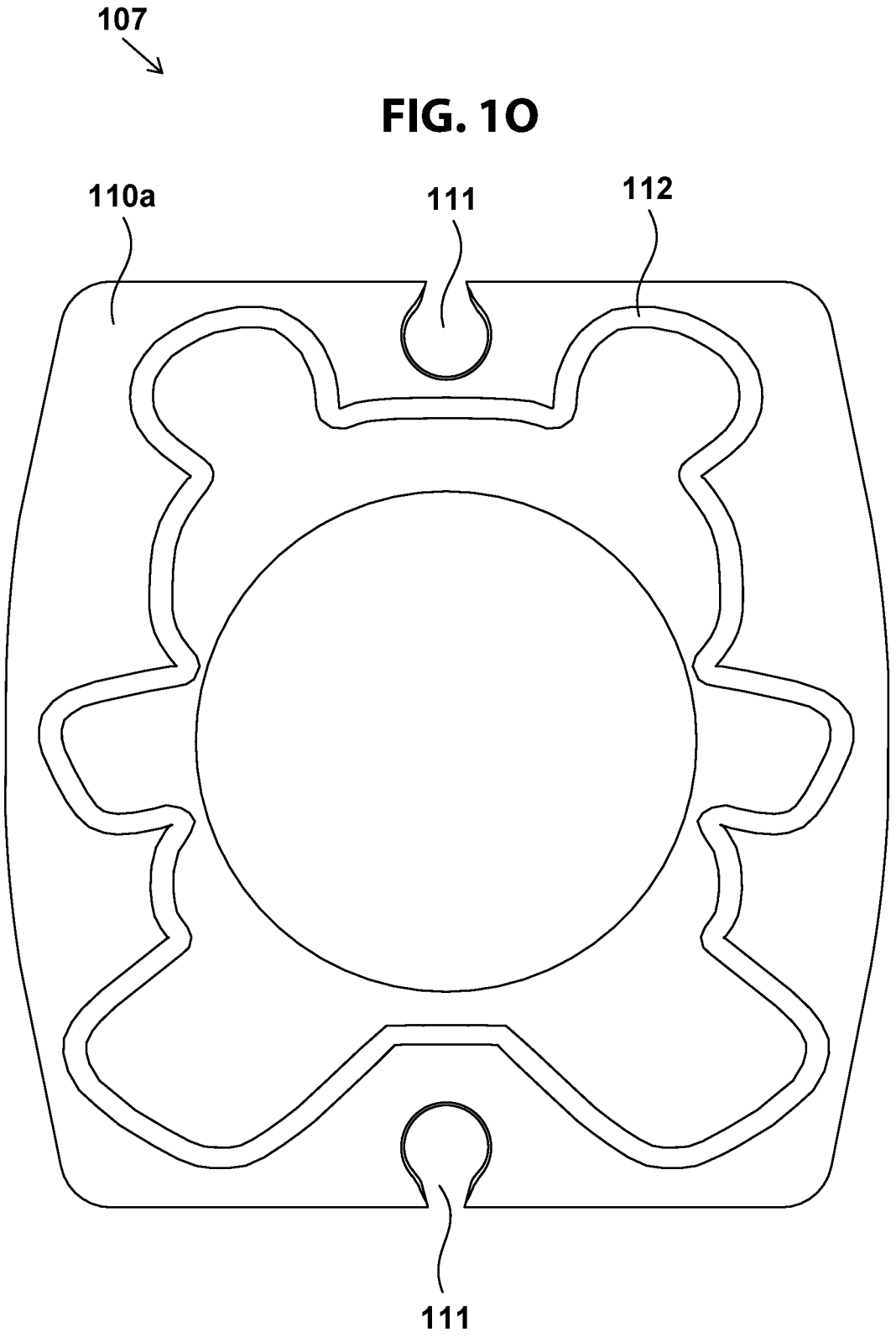
Figure 1P:
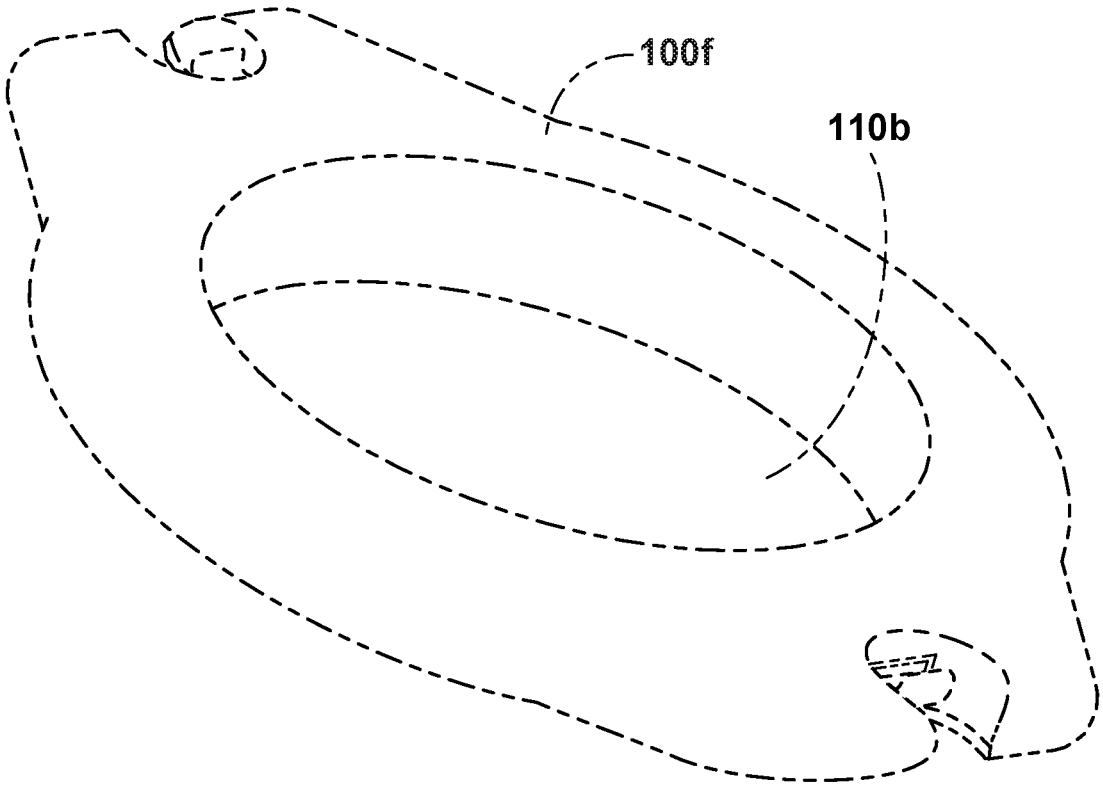
FIG. 1P, FIG. 1Q, and FIG. 1R illustrate a perspective, top and side views of an LED light.
Figure 1Q:
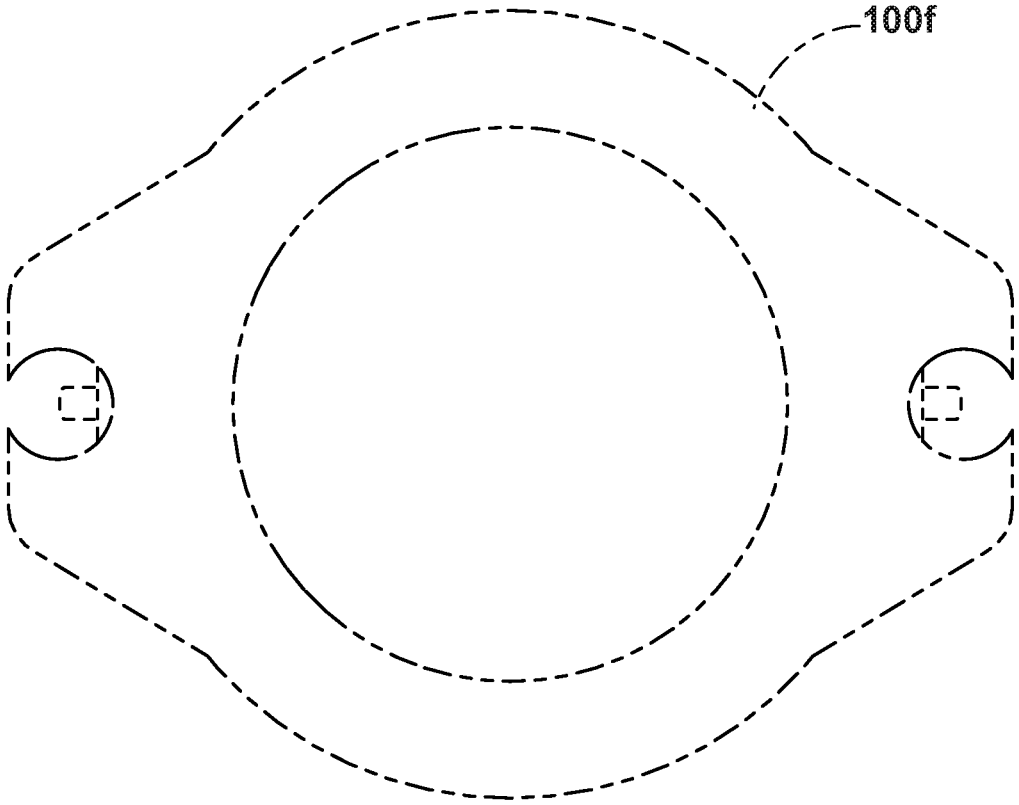
Figure 1R:
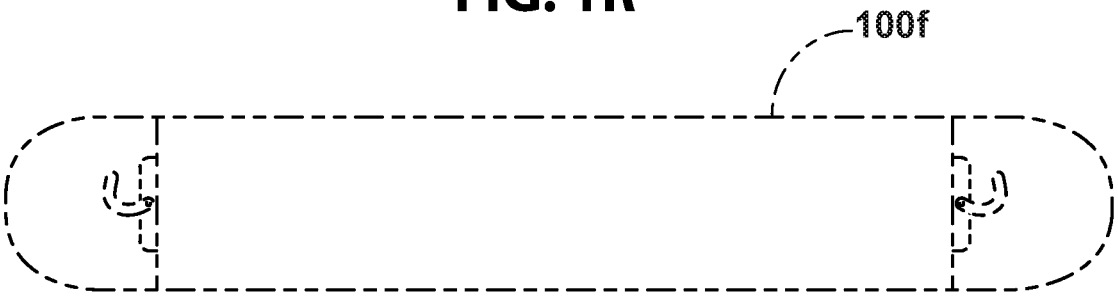
Figure 1S:
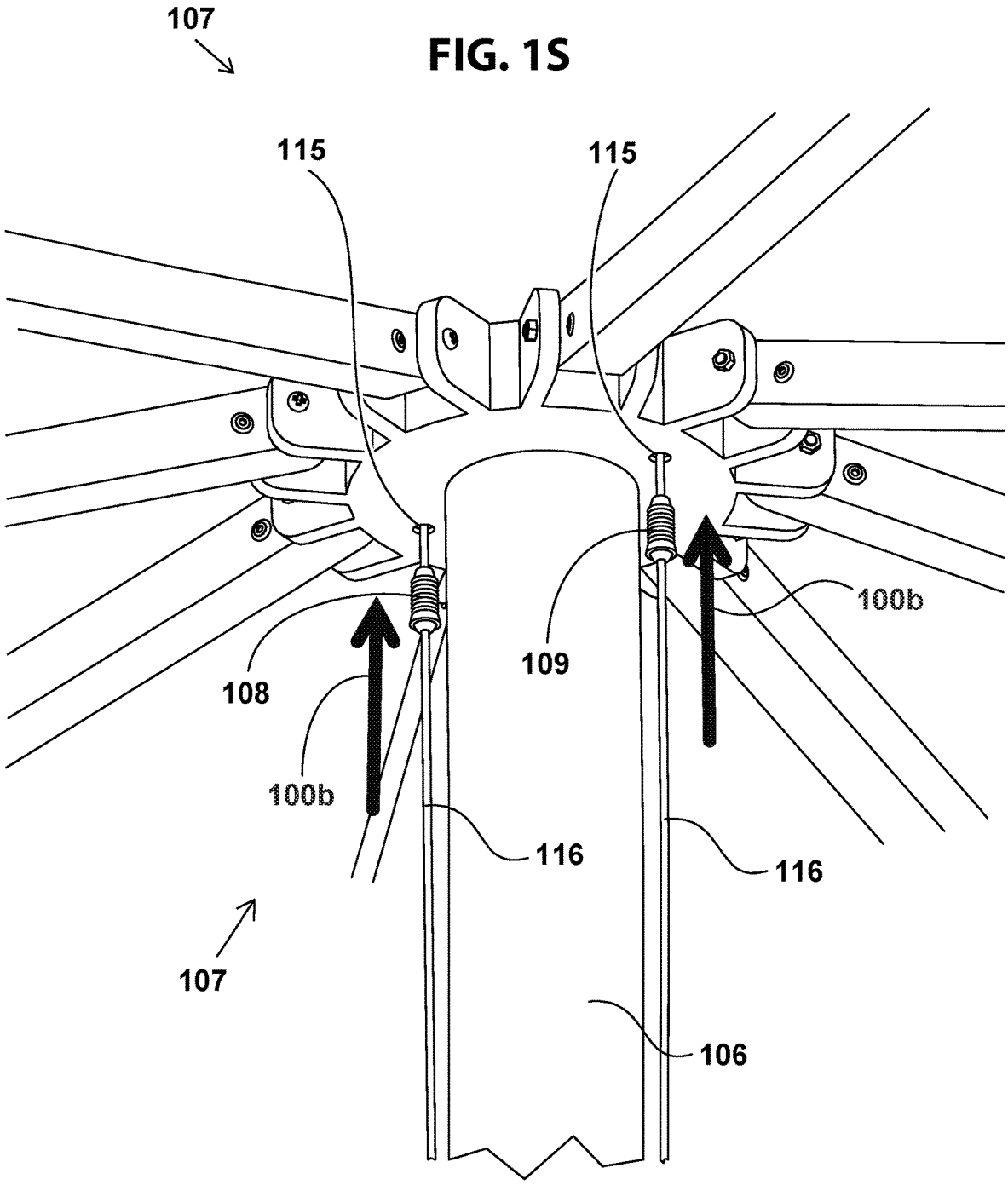
FIG. 1S and FIG. 1T illustrate perspective views of rainwater-sealing corrosion-eliminating LED-light-turning-on-and-off interchangeable-multi-angle LED-light-magnifying image-projector-securing pulley-plug system.
Figure 1T:
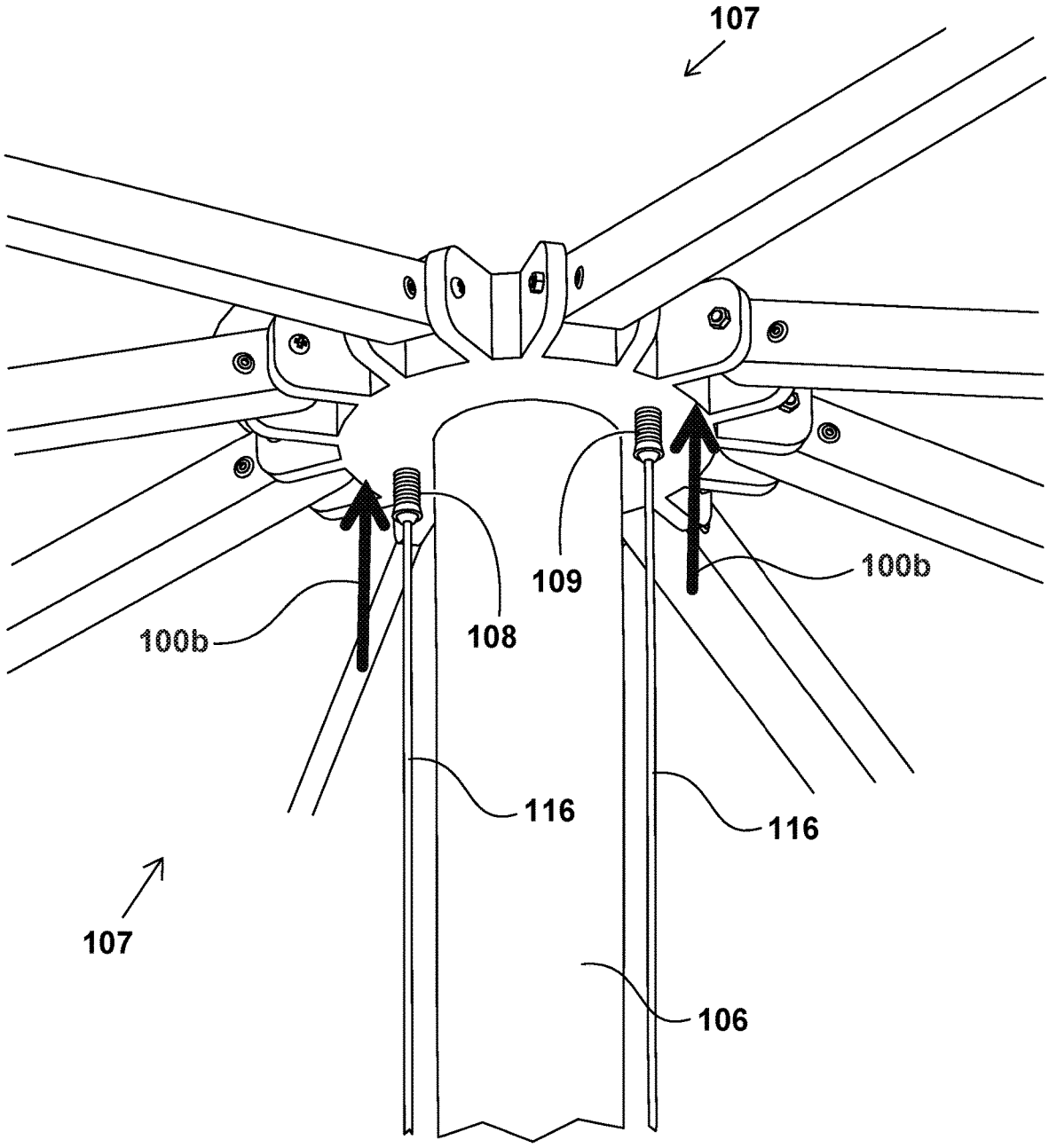
Figure 1U:
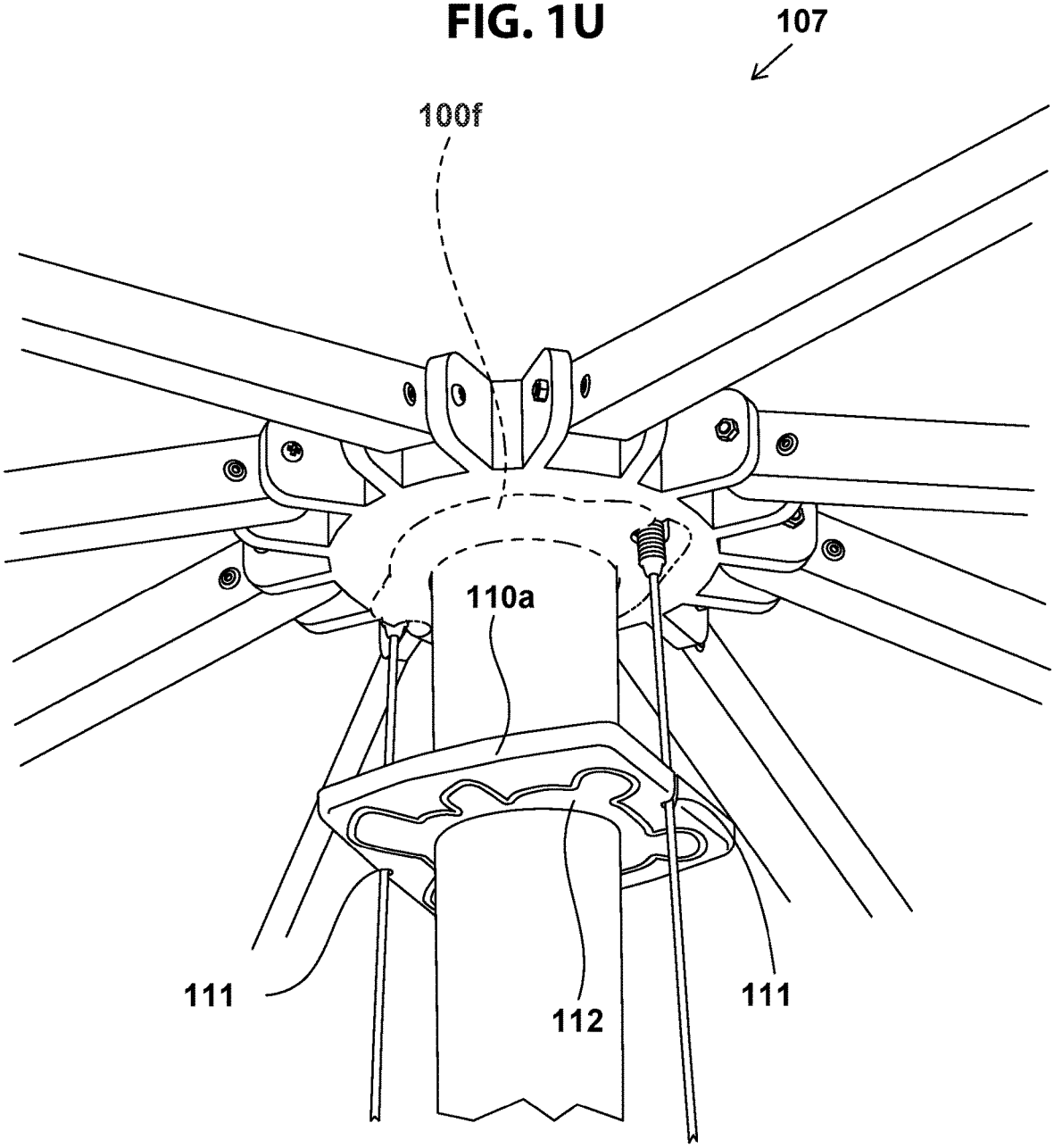
FIG. 1U and FIG. 1V illustrate a perspective and side views of an LED light and interchangeable multi-angle LED-light-magnifying image projector.
Figure 1V:
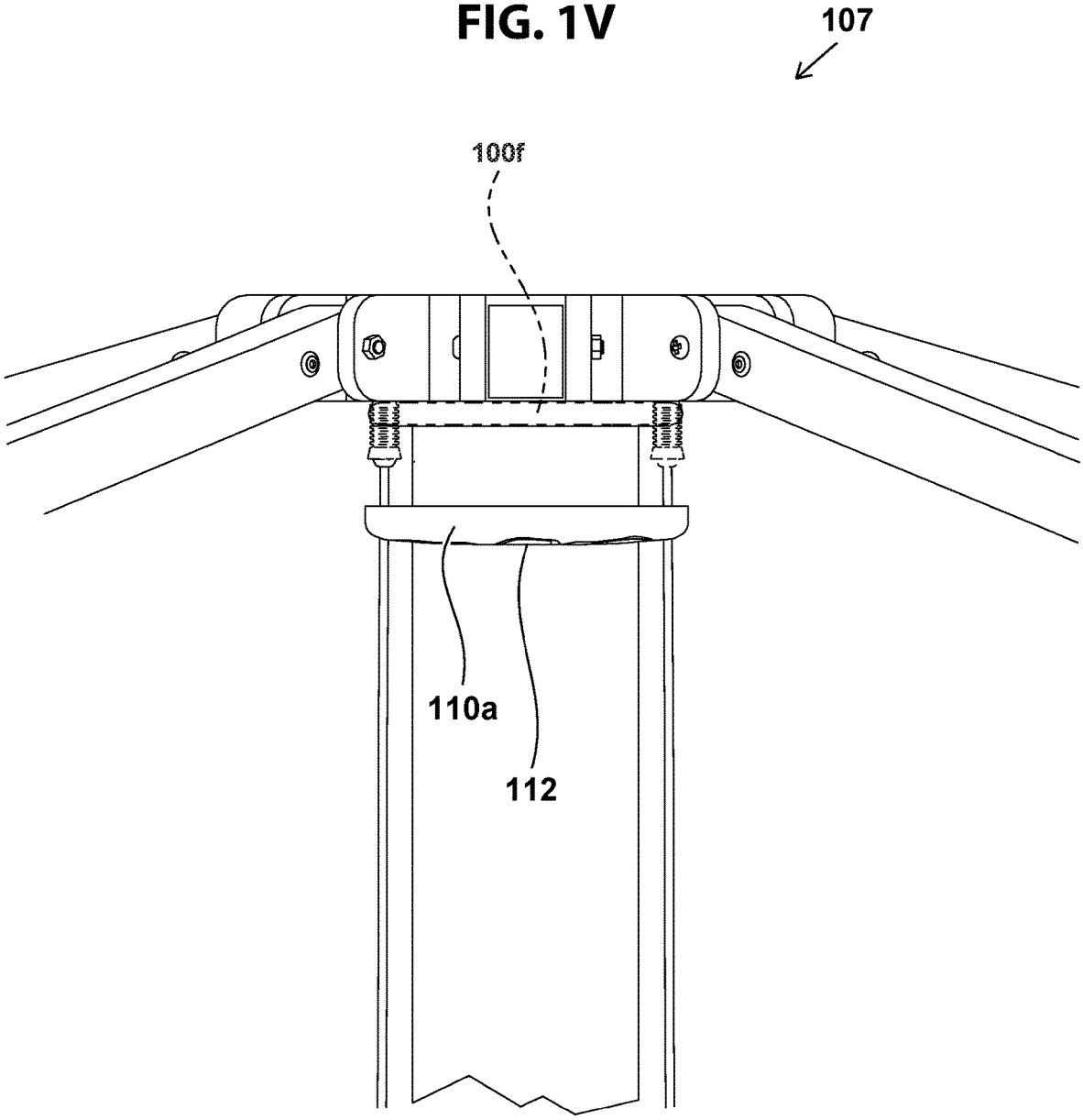
Figure 1W:
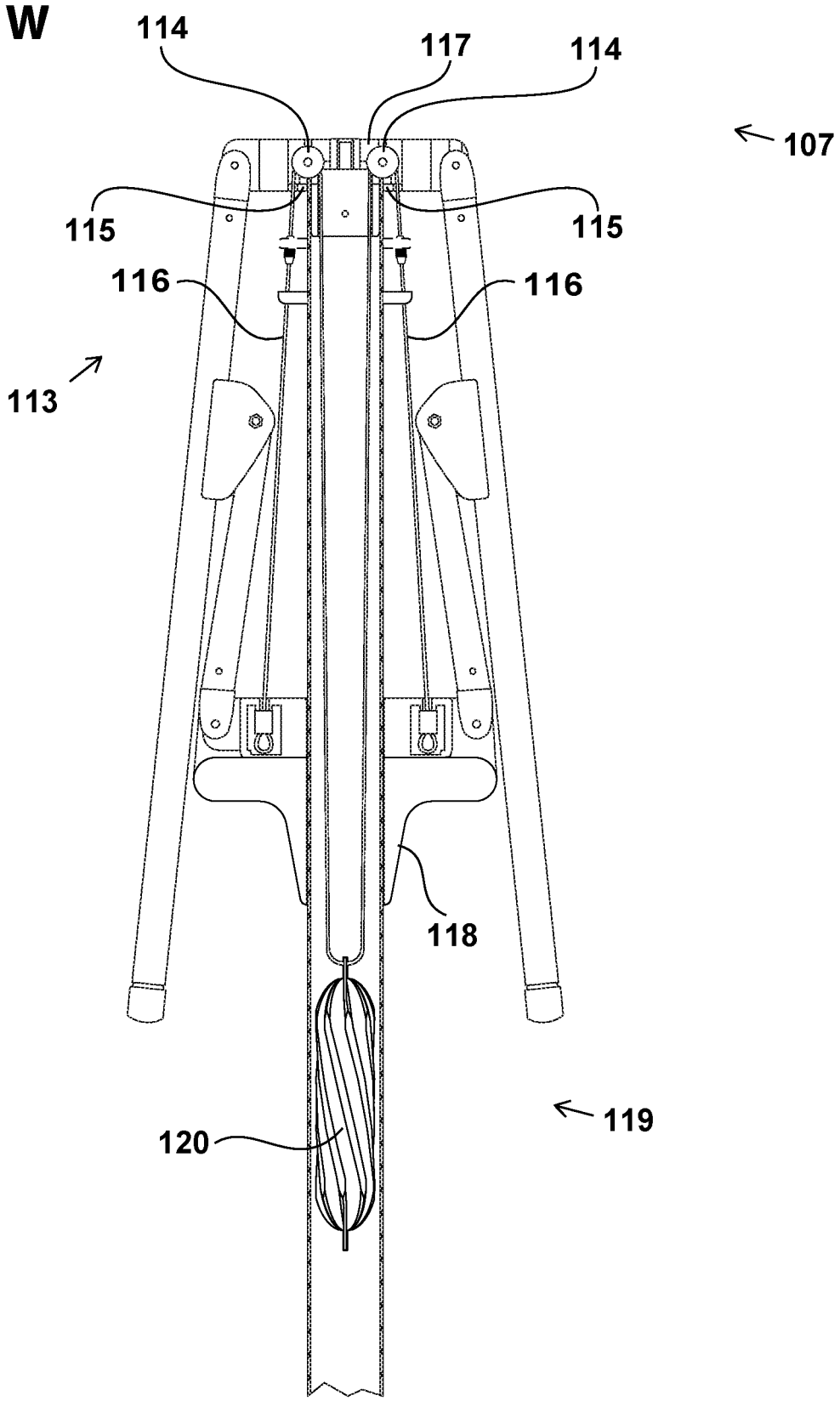
FIG. 1W illustrates a side view of the arthritic-aiding cable-pulley-hiding pole-rust-eliminating counter-weight-decelerating image-projector-locking elastic cable system and the deceleration-capable hand-pain-eliminating counter-weight system.
Figure 1X:
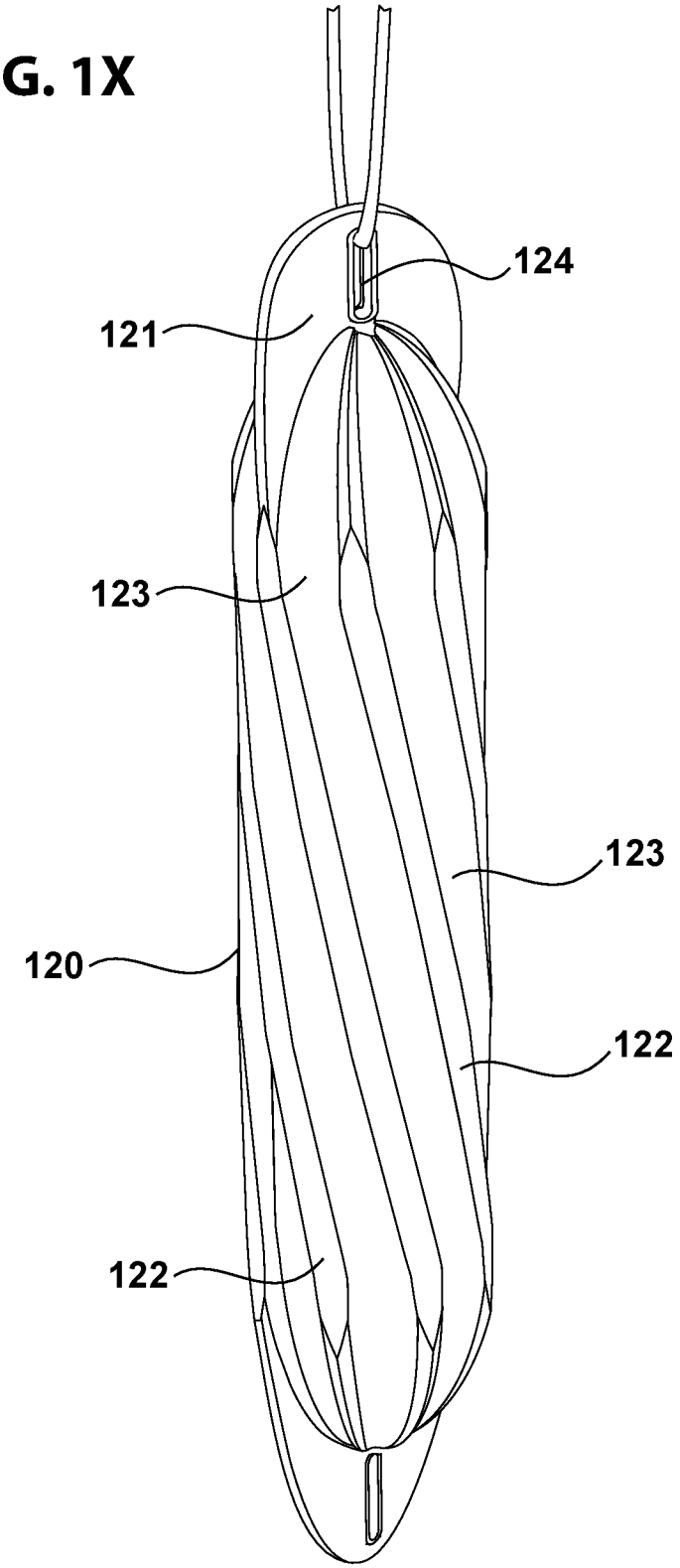
FIG. 1X, FIG. 1Y, and FIG. 1Z illustrate perspective, front, and side views of the deceleration-capable hand-pain-eliminating counter-weight system.
Figure 1Y:
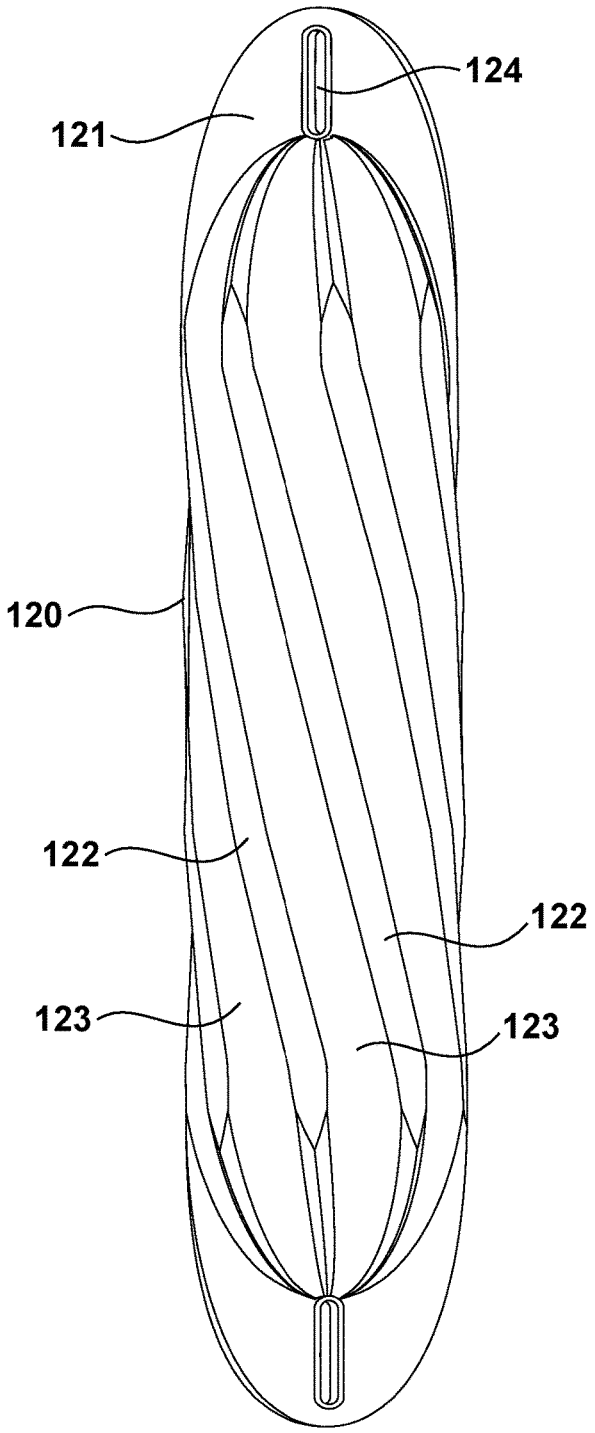
Figure 1Z:
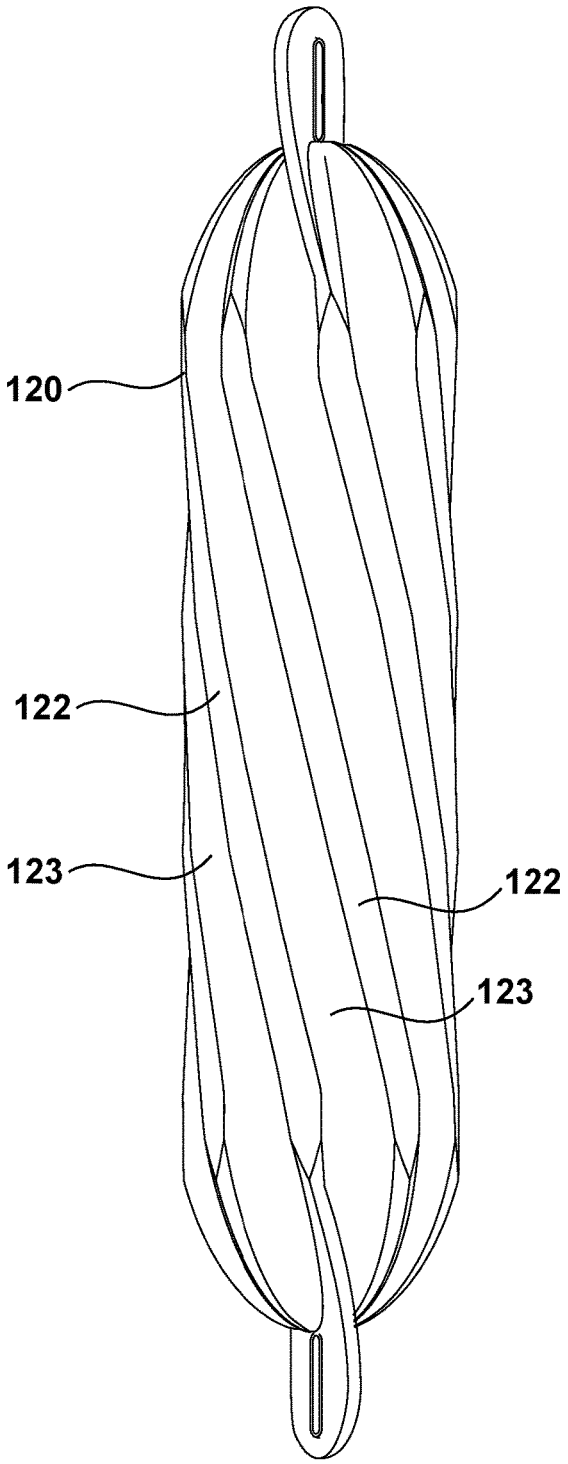
Figure 2:
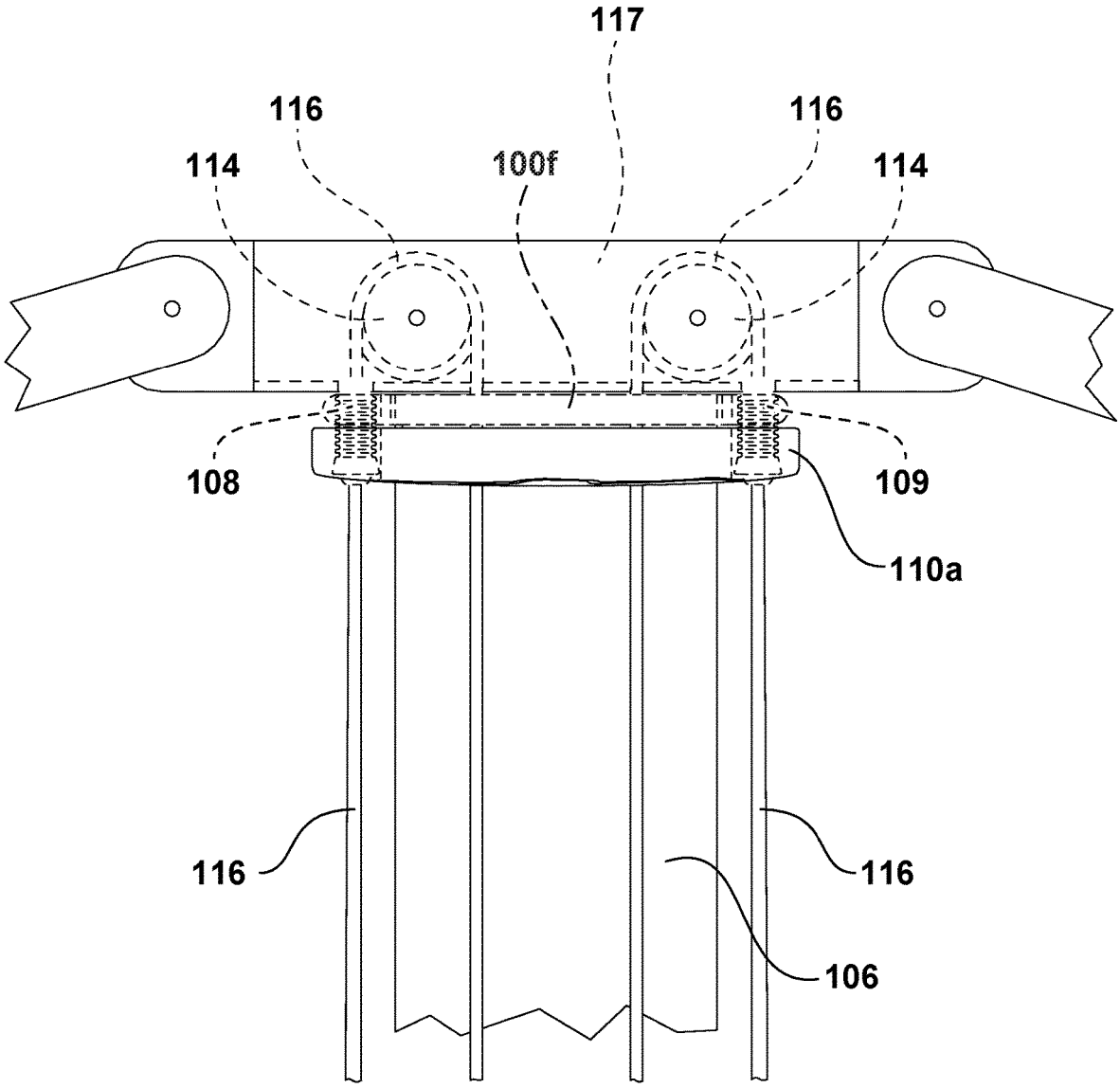
FIG. 2 illustrates a side hidden-element view of rainwater-sealing corrosion-eliminating LED-light-turning-on-and-off interchangeable-multi-angle LED-light-magnifying image-projector-securing pulley-plug system and arthritic-aiding cable-pulley-hiding pole-rust-eliminating counter-weight-decelerating image-projector-locking elastic cable system.

10) Interchangeable multi-angle LED-light-magnifying image projector 110*a* is (or are respectively) for:
Decreasing and enlarging a projected image on a table, a patio, a deck, or a floor,
at angles 100*d* and 100*e*, and in the directions of arrows 145*a*, 145*b*, 145*c*, 145*d*, 145*e*, 145*f*, 145*g*, 145*h*, 146*a*, 146*b*, 146*c*, and 148, respectively
(see FIG. 17A, FIG. 17B, FIG. 19C, FIG. 19D, 20C, and FIG. 20D);
Projecting an image onto a floor surface, a patio, deck, or other floor
(see FIG. 21E and FIG. 21F);
Projecting an image at different angles
in the directions of arrows 149 and 150
(see FIG. 21A, FIG. 21B, FIG. 21E, and FIG. 21F);
Displaying a projected image in many color variations; and
Interchanging a variety of different images.
Image-projector LED-light opening 110*b* is (or are respectively) for:

Slidably connecting an LED light 100*f* to umbrella pole 106
(see FIG. 1P).

11) Projector docks 111 is (or are respectively) for:
Repositionably clamping on arthritic-aiding counter-weight-decelerating image-projector-locking elastic cable 116
(see FIG. 1N, FIG. 1O, FIG. 1U, and FIG. 1V).

12) Image-magnifying image-projecting lens 112 is (or are respectively) for:
Projecting an image on a floor surface, a patio, deck, or a floor
(see FIG. 19C, FIG. 19D, 20C, FIG. 20D, FIG. 21C, and FIG. 21D);
Decreasing and enlarging a projected image on an table, a patio, a deck, or a floor,
(see FIG. 17A, FIG. 17B, FIG. 19C, FIG. 19D, 20C, and FIG. 20D);
Displaying a projected image in many color variations; and
Interchanging a variety of images
(see FIG. 28C, 28D, 28E, 28F, 28G, 28H, 28I, and FIG. 29).

13) Arthritic-aiding cable-pulley-hiding pole-rust-eliminating counter-weight-decelerating image-projector-locking elastic cable system 113 is (or are respectively) for performing the combined functions of its components.

14) Two rotatable pulleys 114 is (or are respectively) for:
Rotatably reducing the pulling force needed to hoist arthritic-aiding lower hub 118
to decrease the effort of folding and deploying canopy 102 in the directions of arrows 145*a*, 145*b*, 145*c*, 145*d*, 145*e*, 145*f*, 145*g*, and 145*h*
(see FIG. 17A and FIG. 17B).

15) Upside-down rainwater-blocking cable-pulley holes 115 is (or are respectively) for:
Preventing rainwater from penetrating the inside of cable-pulley-hiding pole-rust-eliminating counter-weight-rust-eliminating upper hub 117 or umbrella pole 106
in the directions of arrows 99*e*, 99*f*, 100*a*, and 100*b*, respectively
(see FIG. 1D (Prior Art), FIG. 1E, FIG. 1F (Prior Art), and FIG. 1G);
Protecting cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), and FIG. 1G);
Increasing the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120; and
Inserting arthritic-aiding counter-weight-decelerating image-projector-locking elastic cable 116 therethrough.

16) Arthritic-aiding counter-weight-decelerating image-projector-locking elastic cable 116 is (or are respectively) for:
Decelerating deceleration-capable hand-pain-eliminating counter-weight 120
in the direction of and/or represented by arrows 151*a*, 151*b*, 151*c*, 152*a*, 152*b*, and 152*c*
(see FIG. 22C and FIG. 22D);
Cushioning the tension, vibration, and impact from operating arthritic-aiding rainwater-sealing-to-protect-cable-pulley cable-pulley-hiding-hub LED-light-turning-on-and-off image-projecting counter-weight-decelerating umbrella
to eliminate the pain and discomfort experienced by an arthritic-suffering person when raising and lowering in the direction of and/or represented by arrows 151*a*, 151*b*, 151*c*, 152*a*, 152*b*, and 152*c*
(see FIG. 22C and FIG. 22D);
Hoisting or lowering deceleration-capable hand-pain-eliminating counter-weight 120
to assist in operating arthritic-aiding rainwater-sealing-to-protect cable-pulley cable-pulley-hiding-hub LED-light-turning-on-and-off image-projecting counter-weight-decelerating umbrella
in the direction of arrows 151*a*, 151*b*, 151*c*, 152*a*, 152*b*, and 152*c*
(see FIG. 22C and FIG. 22D); and
Releasably and slidably locking image-magnifying image-projecting lens 112 thereto.

17) Cable-pulley-hiding pole-rust-eliminating counter-weight-rust-eliminating upper hub 117 is (or are respectively) for:
Housing two rotatable pulleys 114;
Preventing rainwater from entering in through the top of umbrella pole 106
in the directions of arrows 99*e*, 99*f*, 100*a*, 100*b*, and 100*c*, respectively
(see FIG. 1D (Prior Art), FIG. 1E, FIG. 1F (Prior Art), FIG. 1G, FIG. 1H, and FIG. 1I);
Mounting upper ribs 103*a*
(see FIG. 9 and FIG. 10C);
Mounting rib screws 104
(see FIG. 9);
Inserting first rainwater-sealing corrosion-eliminating LED-light-turning-on-and-off pulley-plug 108 and second rainwater-sealing corrosion-eliminating LED-light-turning-on-and-off pulley-plug 109 therein
(see, FIG. 1E, FIG. 1G, FIG. 1H, FIG. 1I, FIG. 1L, FIG. 1S, and FIG. 1T); and
Mounting solar panels thereto
(see FIG. 28B).

18) Arthritic-aiding arthritic-hand-accommodating lower hub 118 is (or are respectively) for:
Providing an ergonomic arthritic-hand-accomodating surface
to eliminate pain for an arthritic person when operating arthritic-aiding arthritic-hand-accommodating lower hub 118, as demonstrated by arthritic hand 99*d* in the directions of arrows 153*a* and 153*b*
(see FIG. 22E and FIG. 22F);
Pushing foldable rib joints 105 away from umbrella pole 106
to create larger angles between upper and lower ribs 103*a* and 103*b* which in turn will require less force and effort to move deceleration-capable hand-pain-eliminating counter-weight 120 as demonstrated by 100*d* and 100*e*
(see FIG. 1J (Prior Art) and FIG. 1K); and
Attaching lower ribs 103*b* thereto
(see FIG. 3).

19) Deceleration-capable hand-pain-eliminating counter-weight system 119 is (or are respectively) for performing the combined functions of its components.

20) Deceleration-capable hand-pain-eliminating counter-weight 120 is (or are respectively) for:

Helping and arthritic with deploying or collapsing arthritic-aiding rainwater-sealing-for-cable-pulley cable-pulley-hiding-hub LED-light-turning-on-and-off image-projecting and weight-assisted umbrella, especially to help arthritic, small, or elderly persons who might have difficulty operating prior art umbrella systems in the directions of arrows 151*a*, 151*b*, 151*c*, 152*a*, 152*b*, and 152*c*

(see FIG. 22A, FIG. 22B, FIG. 22C, and FIG. 22D); and

Requiring less effort during retraction and deployment of arthritic-aiding rainwater-sealing-to-protect-cable-pulley cable-pulley-hiding-hub LED-light-turning-on-and-off image-projecting counter-weight-decelerating umbrella in the directions of arrows 145*a*, 145*b*, 145*c*, 145*d*, 145*e*, 145*f*, 145*g*, and 145*h*

Figure 17A:
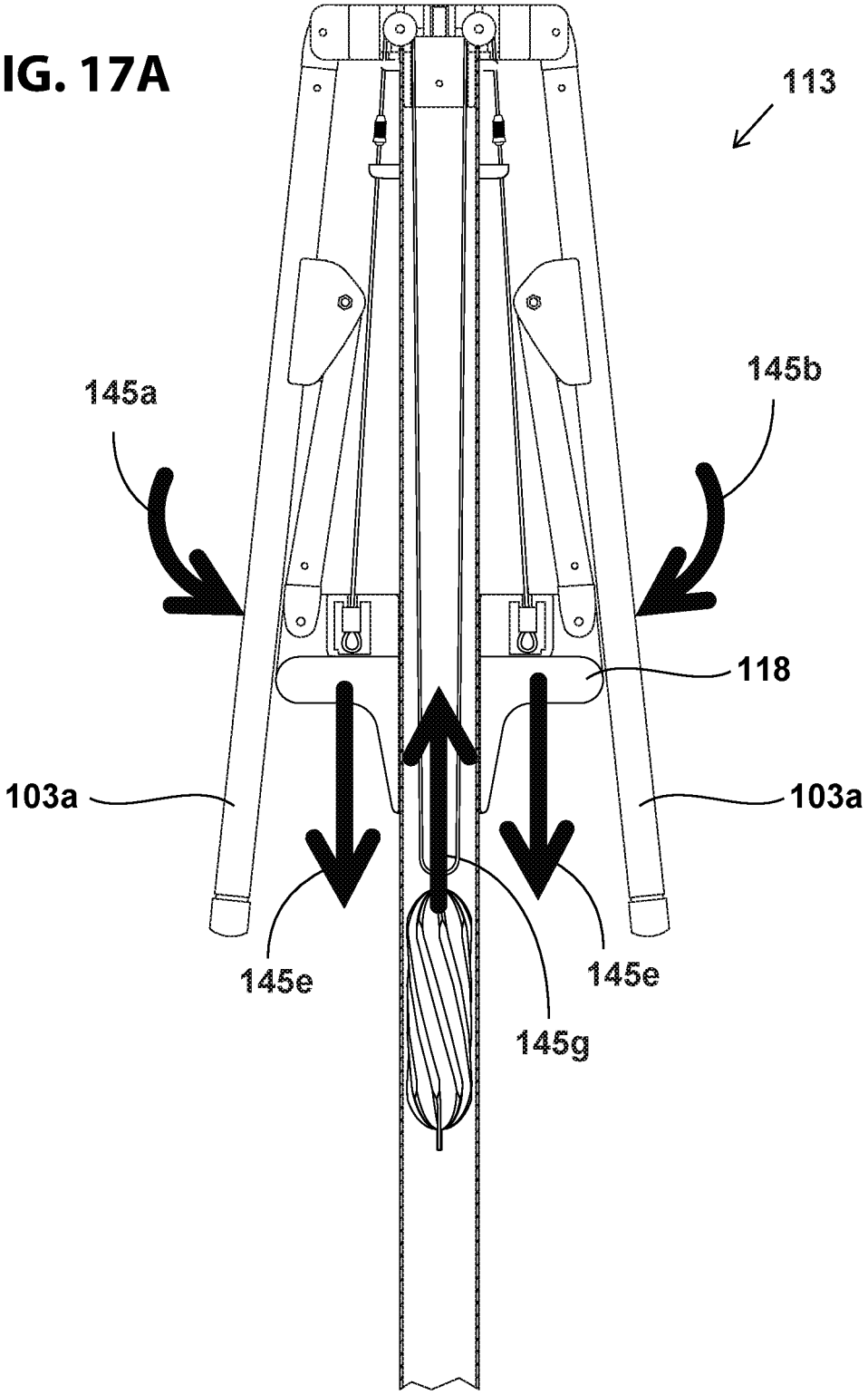
FIG. 17A and FIG. 17B illustrate front views of the arthritic-aiding cable-pulley-hiding pole-rust-eliminating counter-weight-decelerating image-projector-locking elastic cable system and the deceleration-capable hand-pain-eliminating counter-weight system.
Figure 17B:
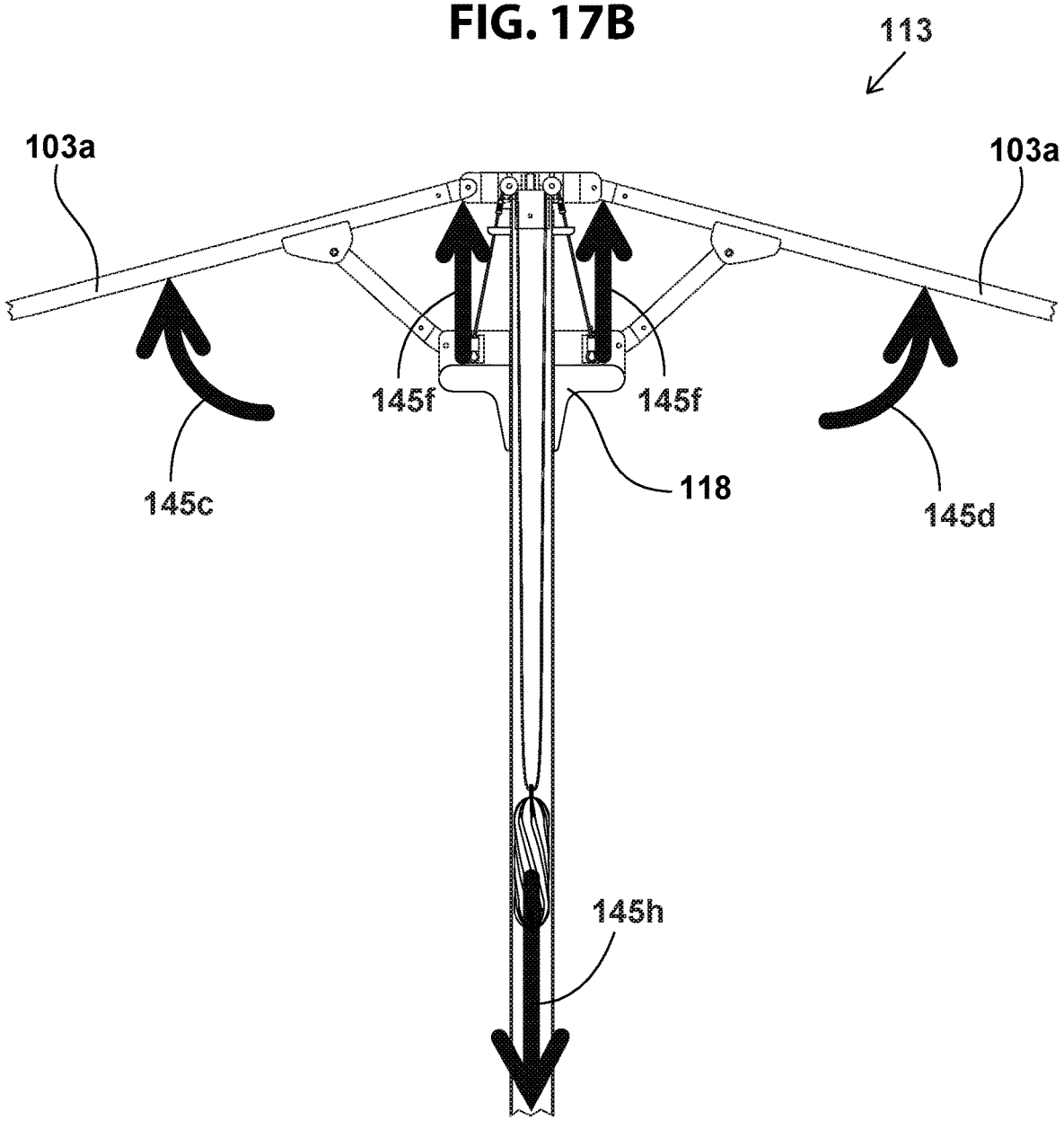
Figure 18:
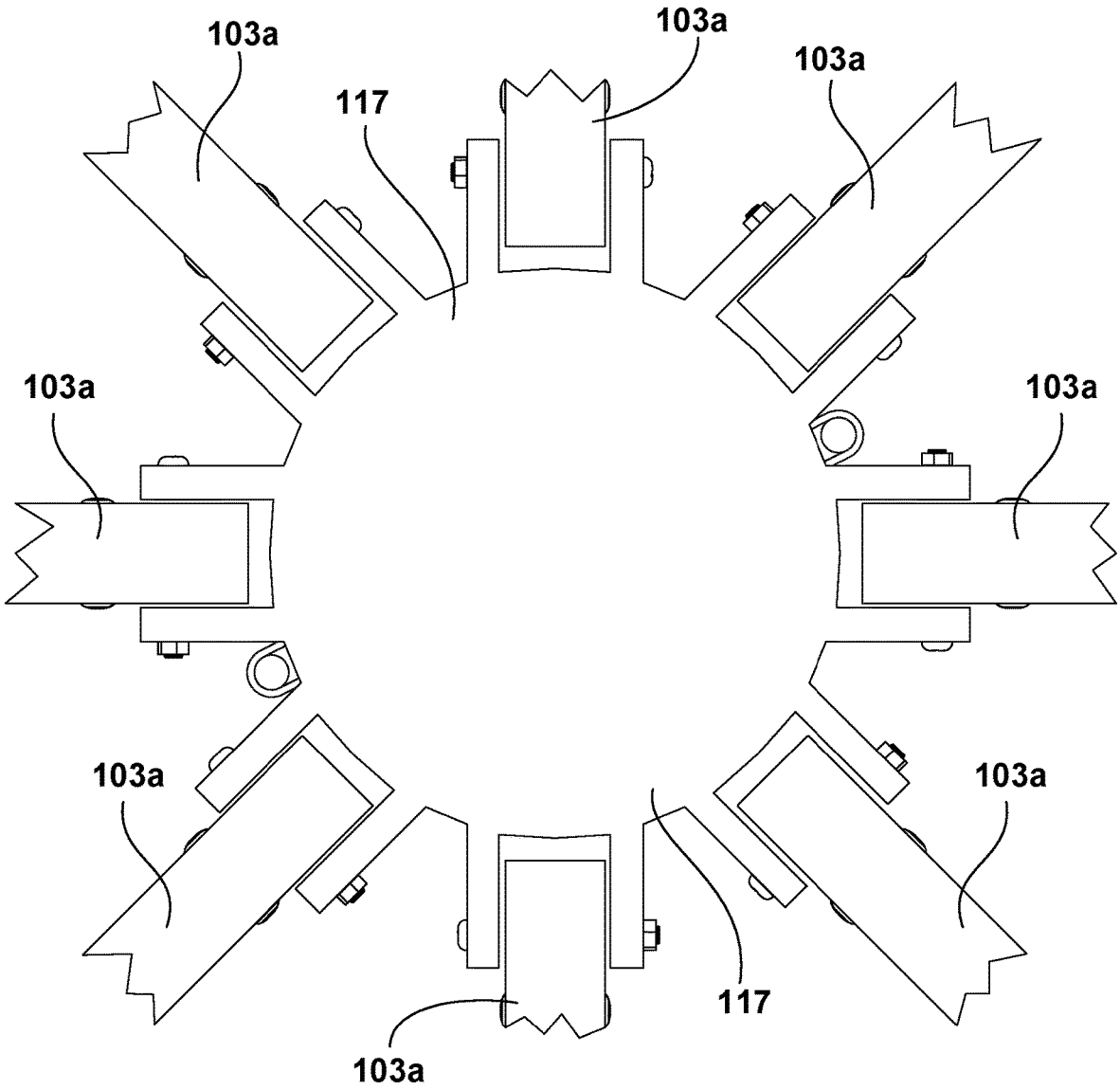
FIG. 18 illustrates a top view of the cable-pulley-hiding pole-rust-eliminating counter-weight-rust-eliminating upper hub.
Figure 19A:
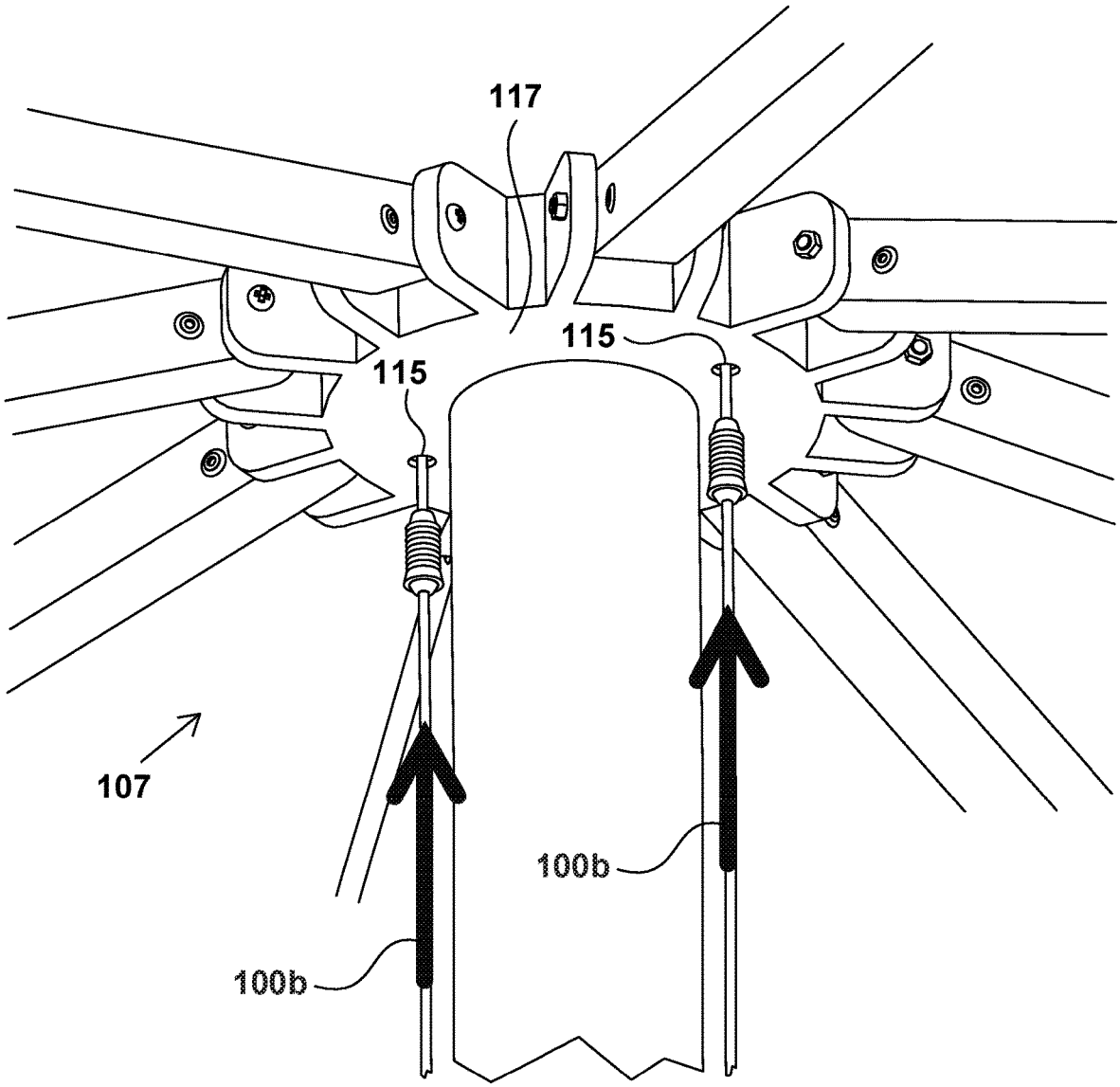
FIG. 19A, FIG. 19B, FIG. 19C, and FIG. 19D illustrate perspective and side views demonstrating the functionality of the rainwater-sealing corrosion-eliminating LED-light-turning-on-and-off interchangeable-multi-angle LED-light-magnifying image-projector-securing pulley-plug system with arthritic-aiding counter-weight-decelerating image-projector-locking elastic cable sealing the cable-pulley-hiding pole-rust-eliminating counter-weight-rust-eliminating upper hub, and the supporting and movement of interchangeable multi-angle LED-light-magnifying image projector and an LED light.
Figure 19B:
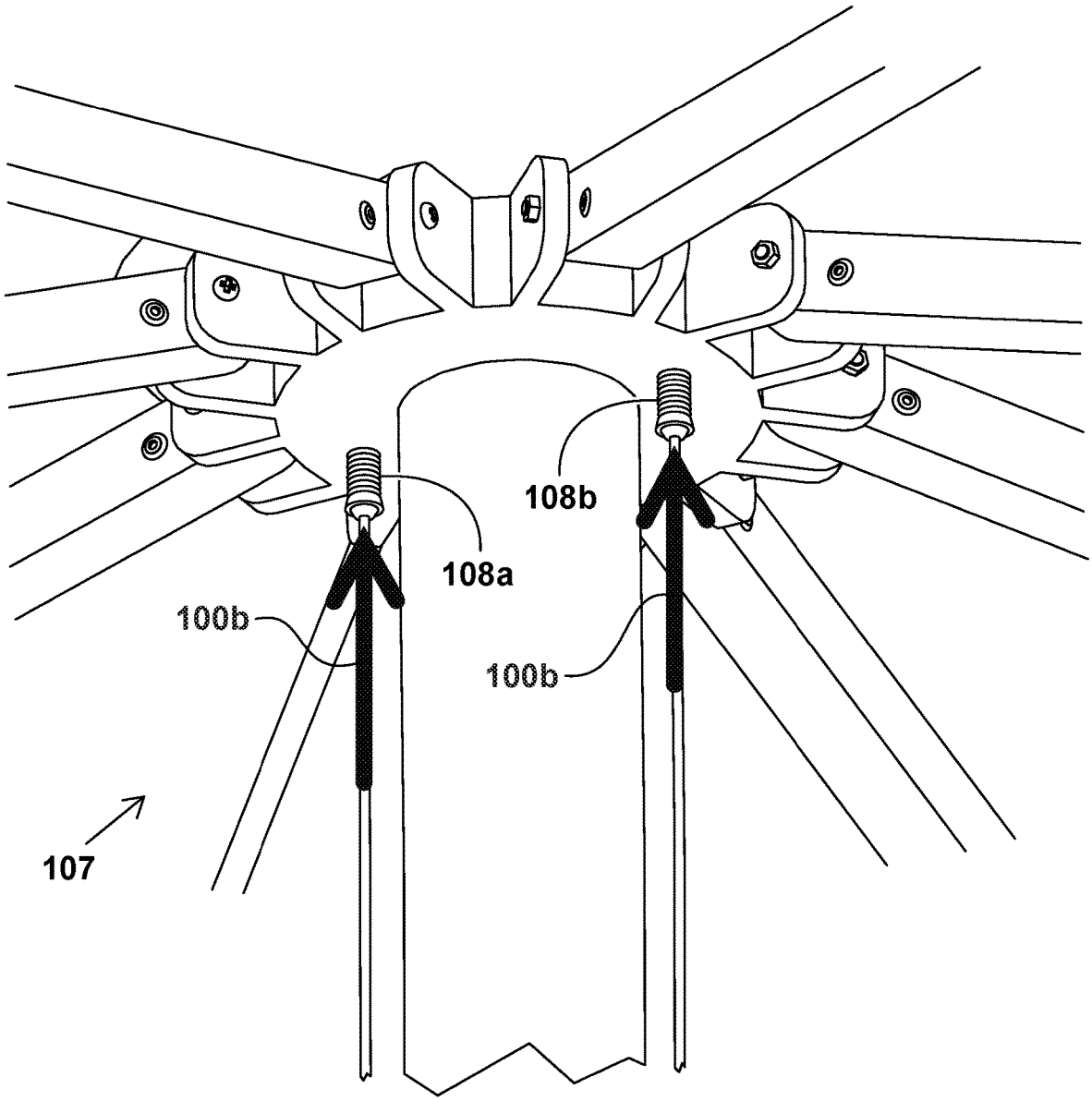
Figure 19C:
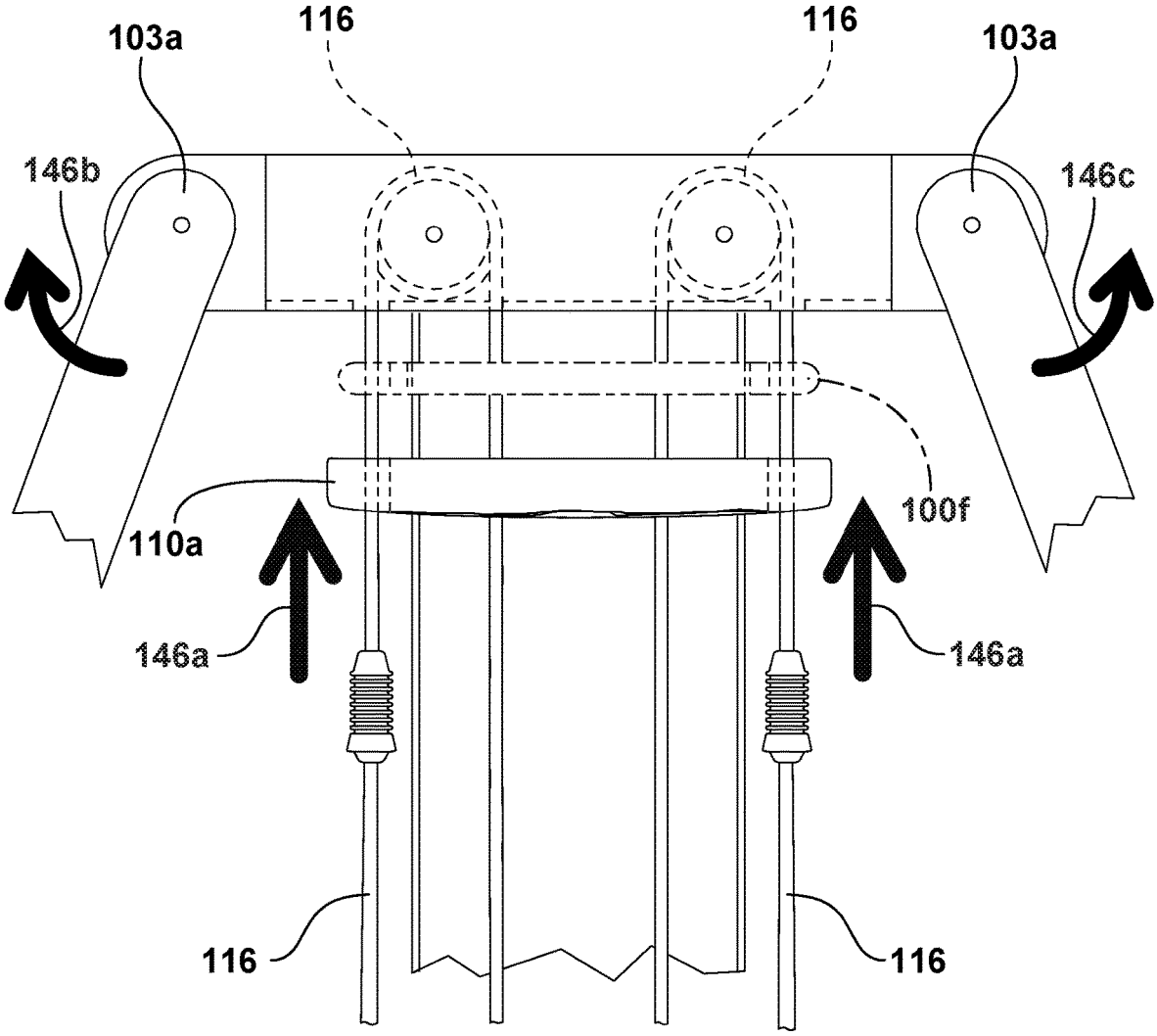
Figure 19D:
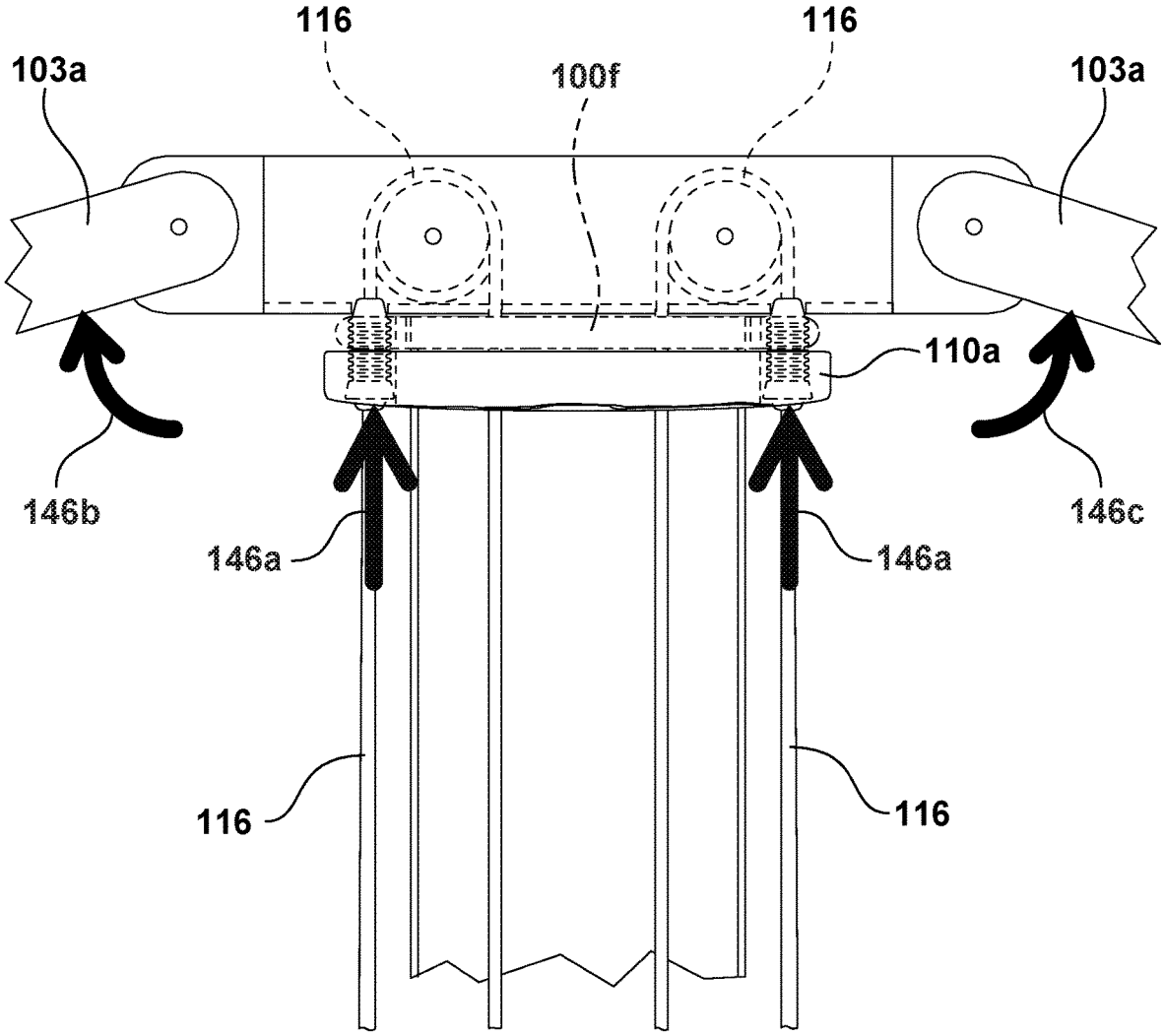

(see FIG. 17A and FIG. 17B).

Figure 11:
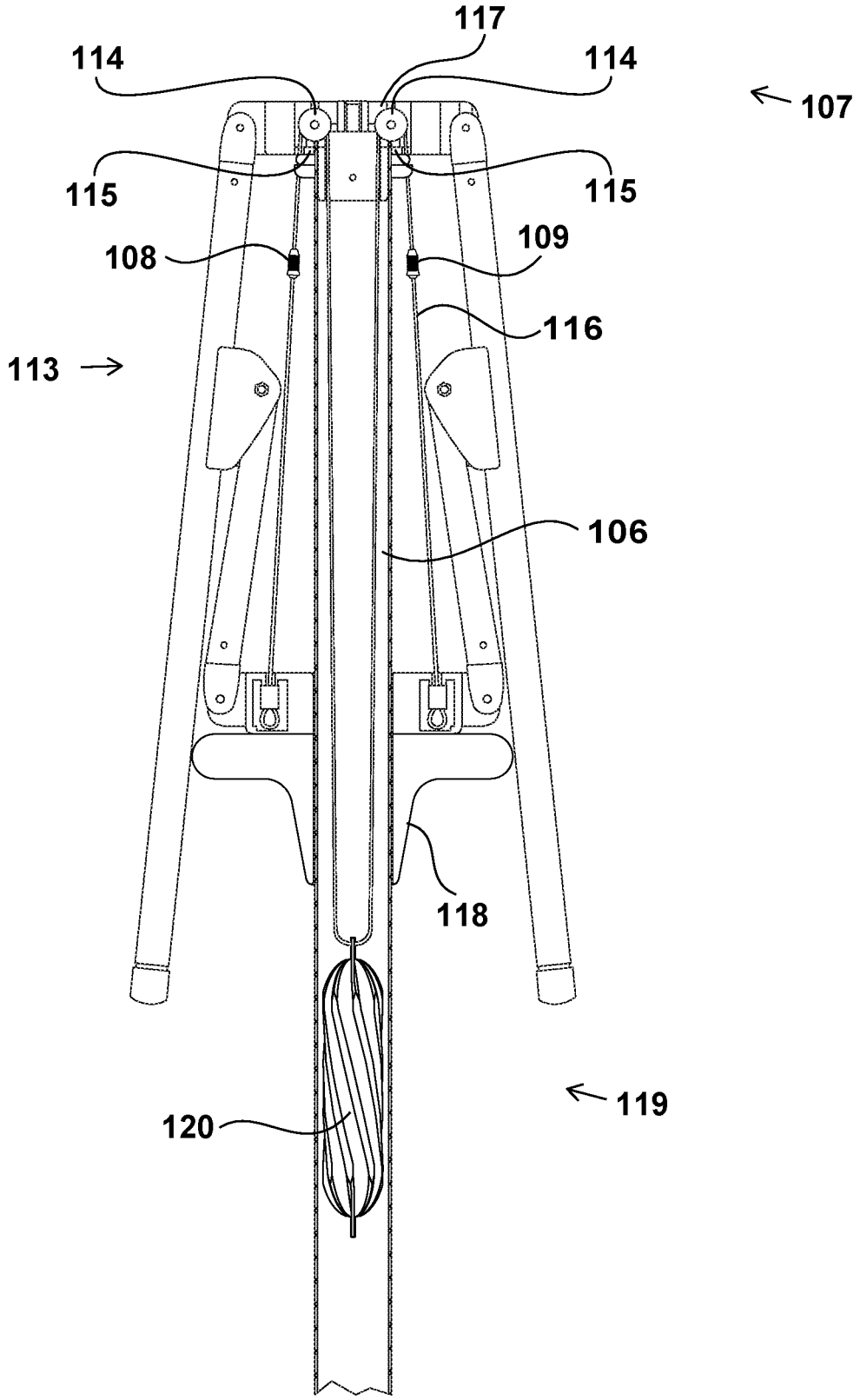
FIG. 11 illustrates a front view of the arthritic-aiding cable-pulley-hiding pole-rust-eliminating counter-weight-decelerating image-projector-locking elastic cable system and the deceleration-capable hand-pain-eliminating counter-weight system.
Figure 12A:
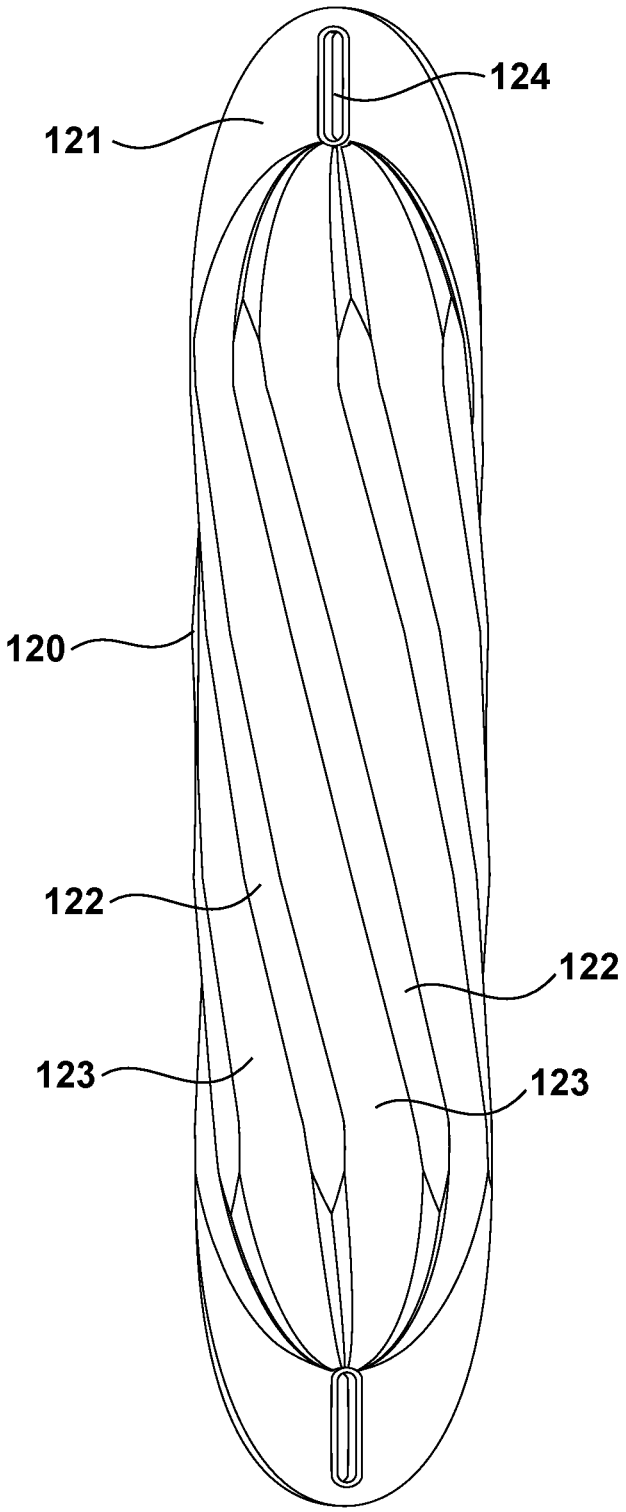
FIG. 12A and FIG. 12B illustrate front and side views of the deceleration-capable hand-pain-eliminating counter-weight system.
Figure 12B:
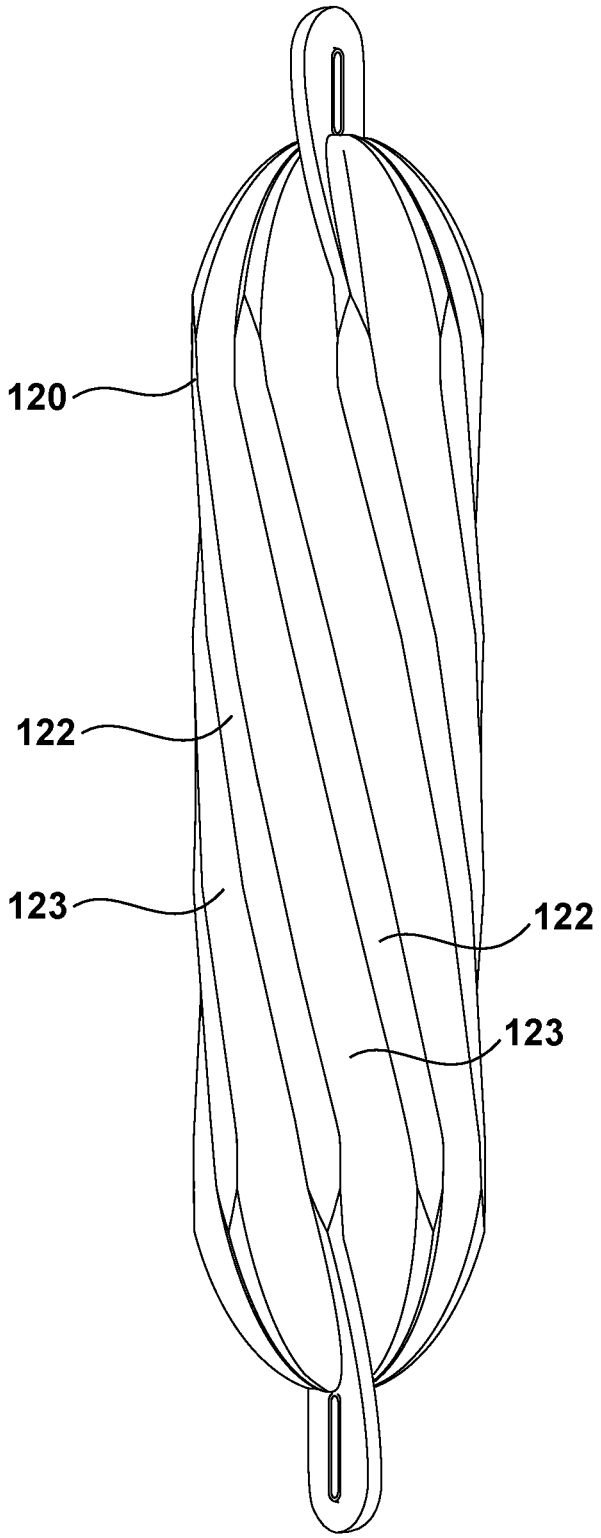
Figure 13:
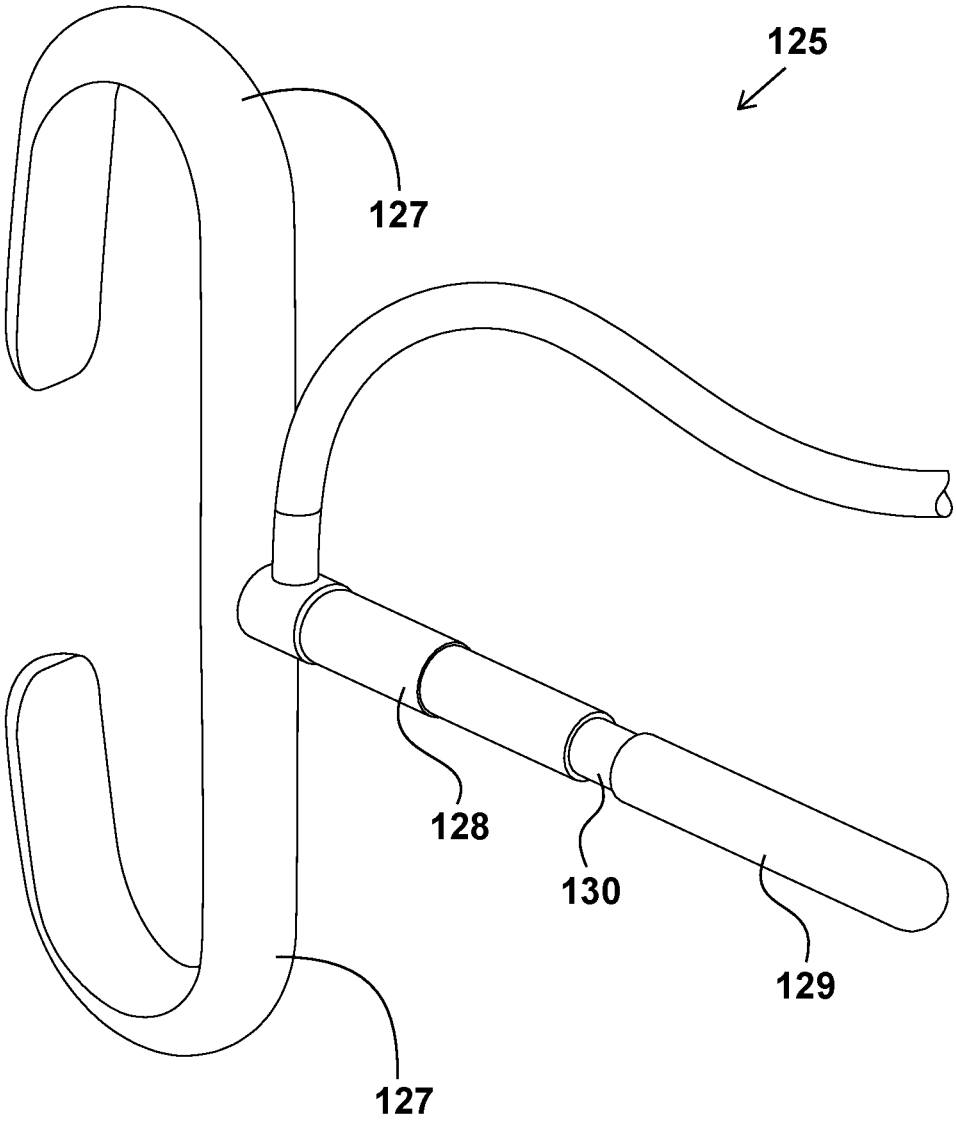
FIG. 13 illustrates a perspective view of the arthritic-aiding cable-hook grip ring.

21) Aerodynamic propeller-shaped head blade 121 is (or are respectively) for:

Providing an aerodynamic forward edge to deceleration-capable hand-pain-eliminating counter-weight 120; and Providing a structural member in which blade hole 124 are located, respectively (see FIG. 11, FIG. 12A, and FIG. 12B).

22) Counter-weight spiral spoilers 122 is (or are respectively) for:

Providing aerodynamic shapes at opposite ends of deceleration-capable hand-pain-eliminating counter-weight 120, respectively (see FIG. 11, FIG. 12A, and FIG. 12B); and Providing spiraled surfaces to interact with the internal surface of umbrella pole 106, minimizing friction as deceleration-capable hand-pain-eliminating counter-weight 120 moves up and down (see FIG. 11, FIG. 12A, FIG. 12B, FIG. 17A and FIG. 17B).

23) Spiral flutes 123 is (or are respectively) for:

Allowing air to flow over said deceleration-capable hand-pain-eliminating counter-weight 120 as said deceleration-capable hand-pain-eliminating counter-weight 120 ascends or descends within said umbrella pole 106

Figure 22A:
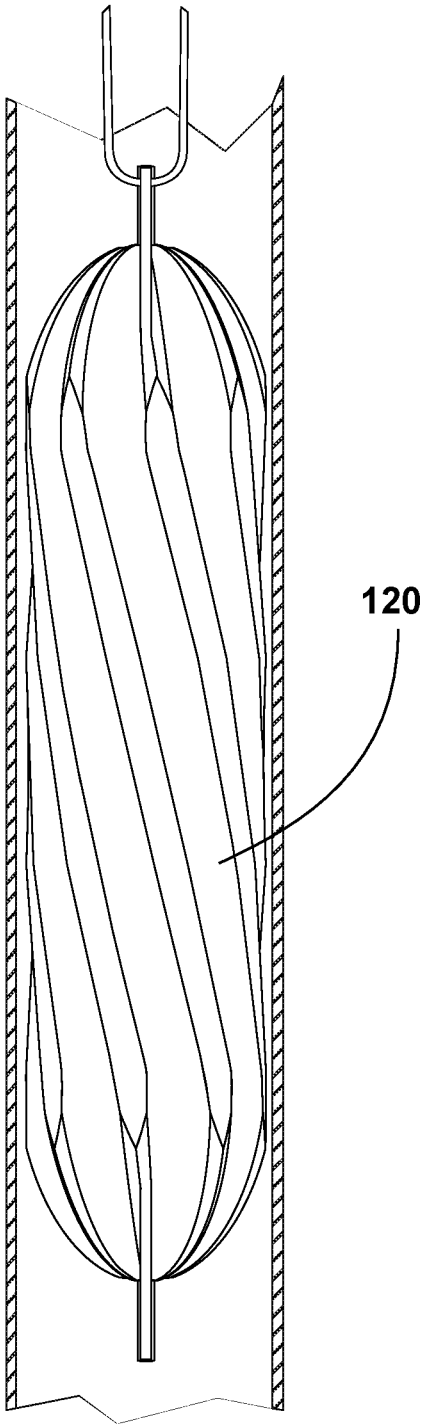
FIG. 22A and FIG. 22B illustrate cross-sectional side views demonstrating how the arthritic-aiding cable-pulley-hiding pole-rust-eliminating counter-weight-decelerating image-projector-locking elastic cable system and the deceleration-capable hand-pain-eliminating counter-weight system work in unison with the aerodynamic propeller-shaped head blade and the spiral flutes rotating the deceleration-capable hand-pain-eliminating counter-weight.
Figure 22B:
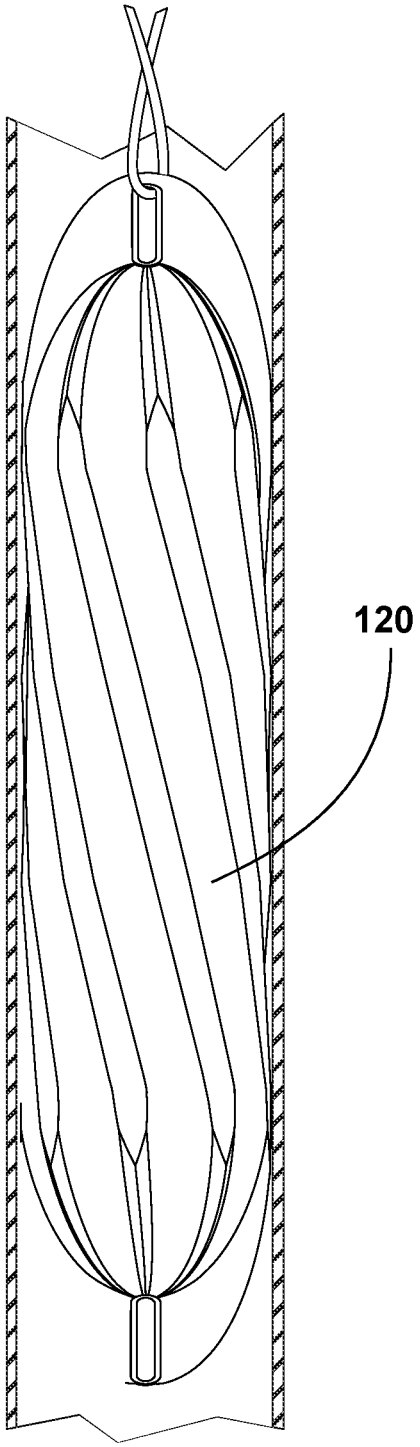

(see FIG. 22A and FIG. 22B).

24) Blade hole 124 is (or are respectively) for:

Providing structural openings in aerodynamic propeller-shaped head blade 121 through which arthritic-aiding counter-weight-decelerating image-projector-locking elastic cable 116 is laced (see FIG. 11, FIG. 12A, and FIG. 12B).

25) Arthritic-aiding pin-centering pin-guiding auditorily-snap-locking tower-locking system 125 is (or are respectively) for performing the combined functions of its components.

26) Umbrella-pole pin openings 126 is (or are respectively) for:

Inserting locking pin 129 therethrough demonstrated by arthritic hand 99*d* in the direction of arrows 154, and 155

Figure 23A:
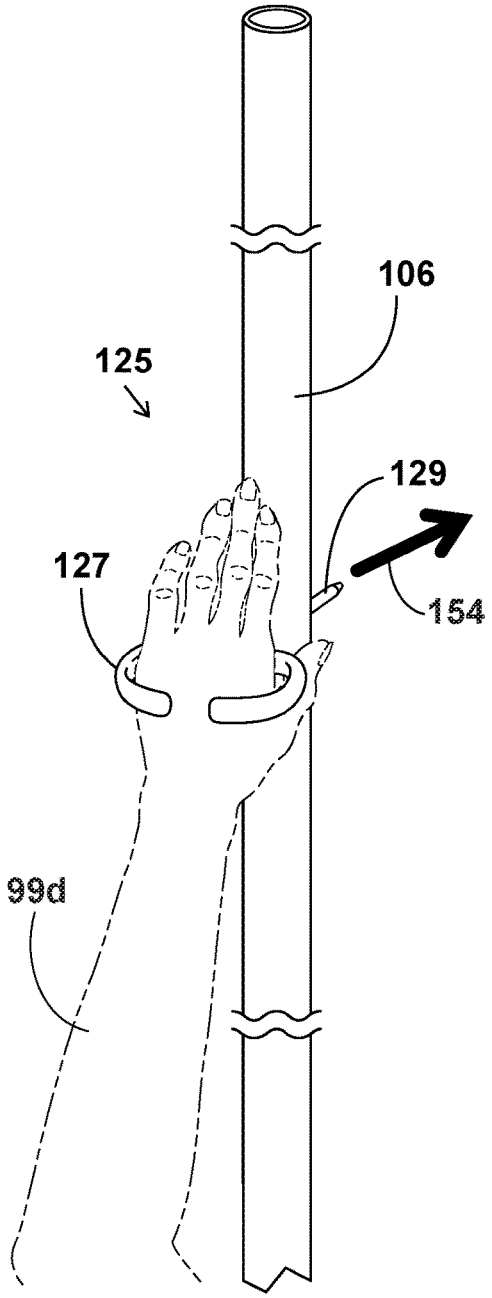
FIG. 23A, FIG. 23B, FIG. 24A, FIG. 24B, FIG. 24C, and FIG. 25 illustrate perspective and cross-sectional side views of the functionality of the arthritic-aiding pin-centering pin-guiding auditorily-snap-locking tower-locking system.
Figure 23B:
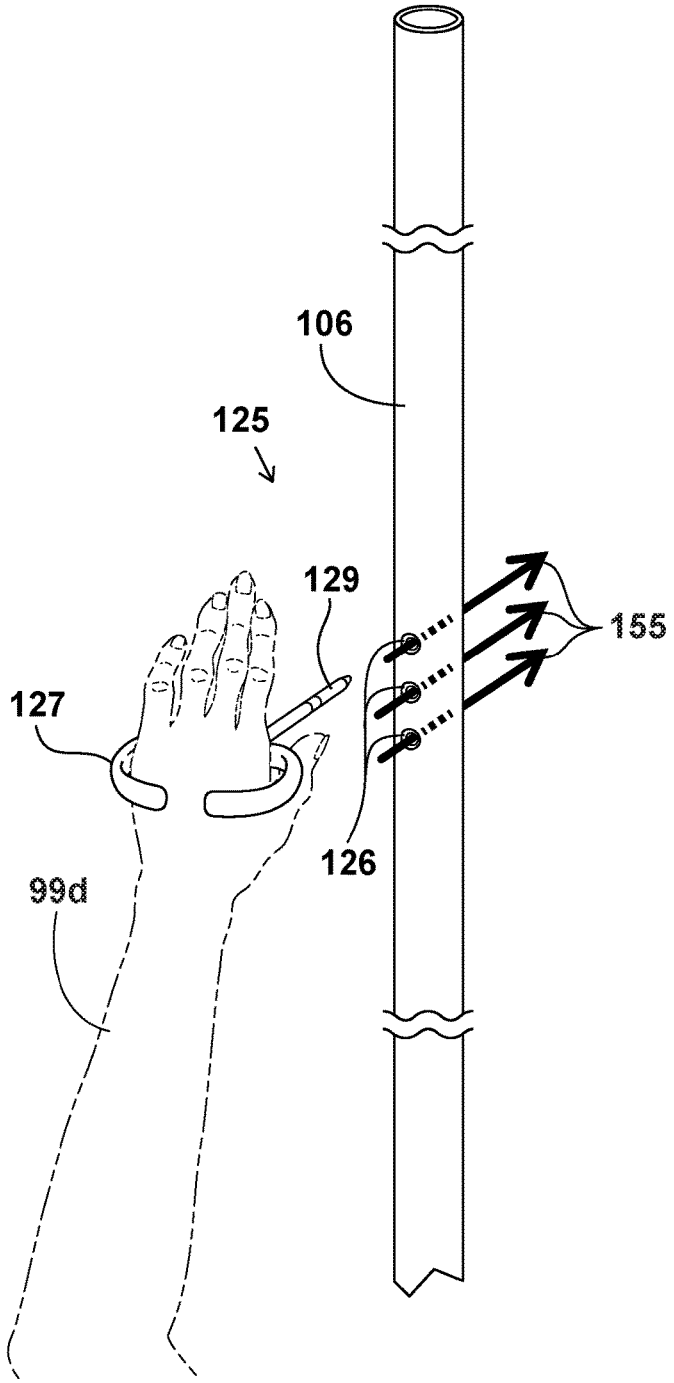
Figure 25:
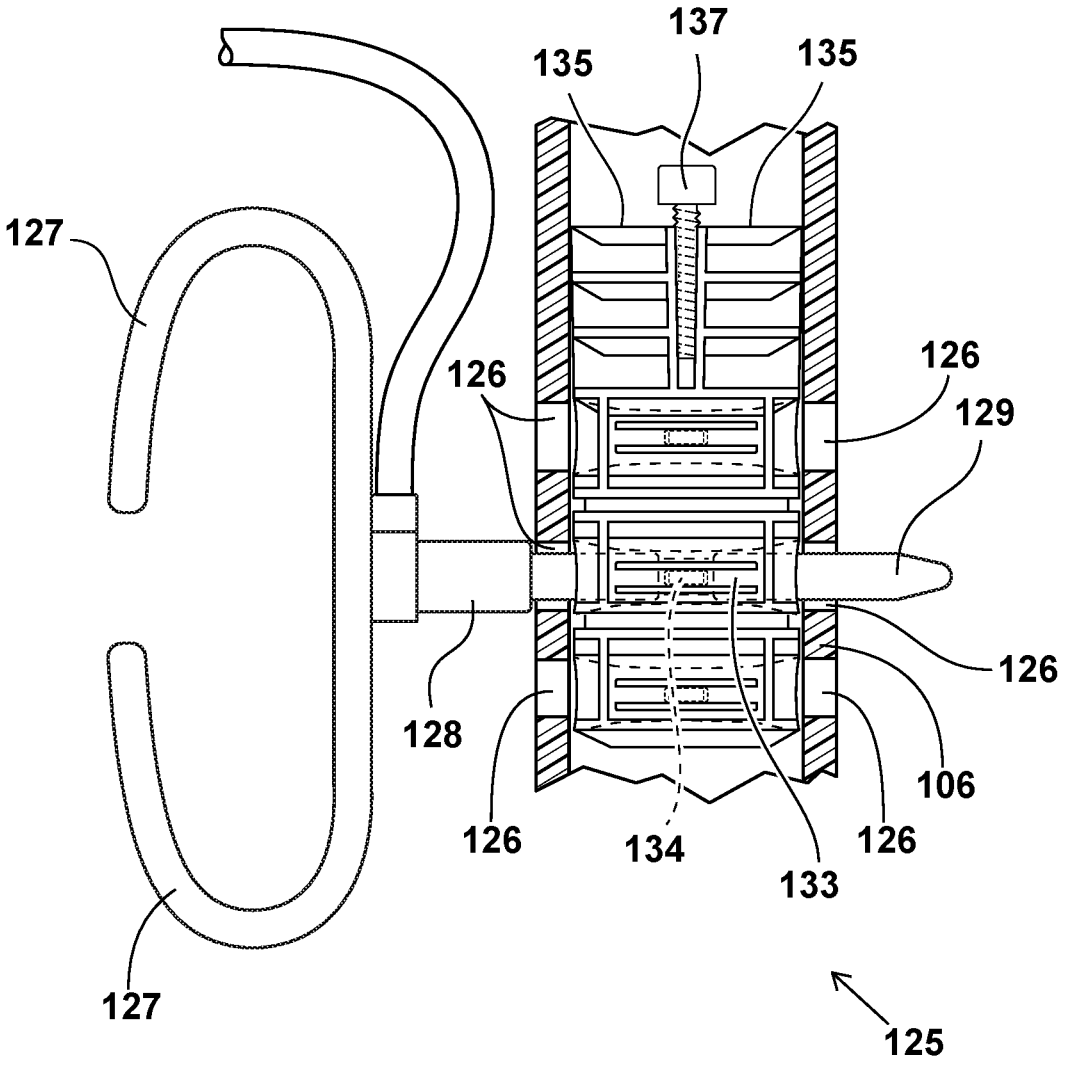
Figure 26A:
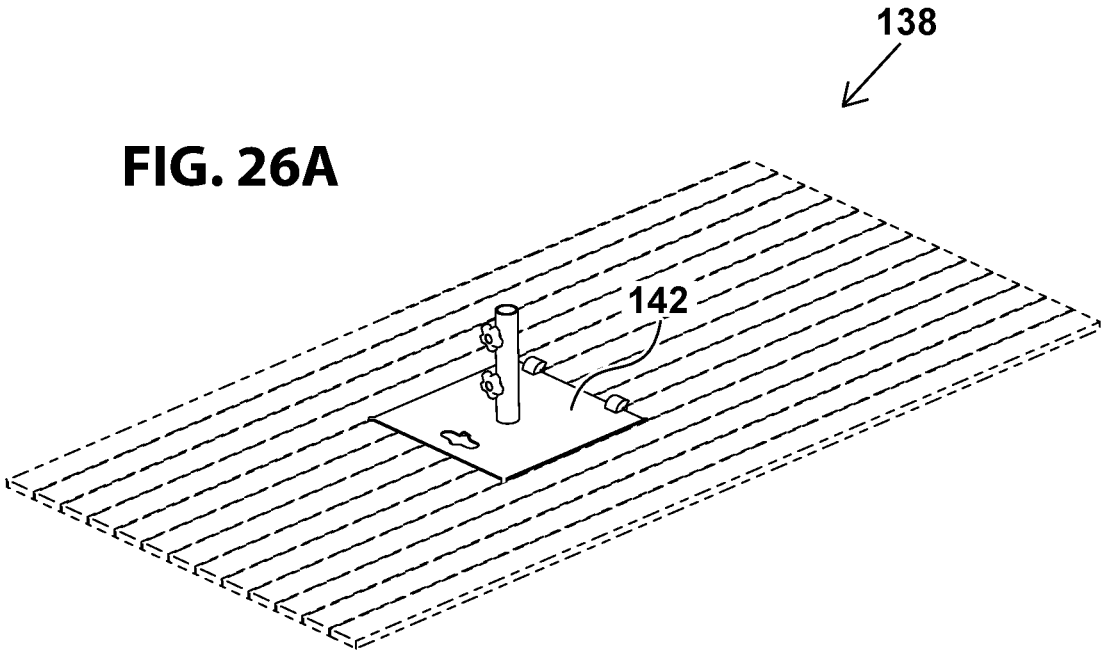
FIG. 26A and FIG. 26B illustrate perspective and front views demonstrating how the portable tow-hitch-connectable pet-shade-and-chair-locking umbrella-base system can be secured to a deck.
Figure 26B:
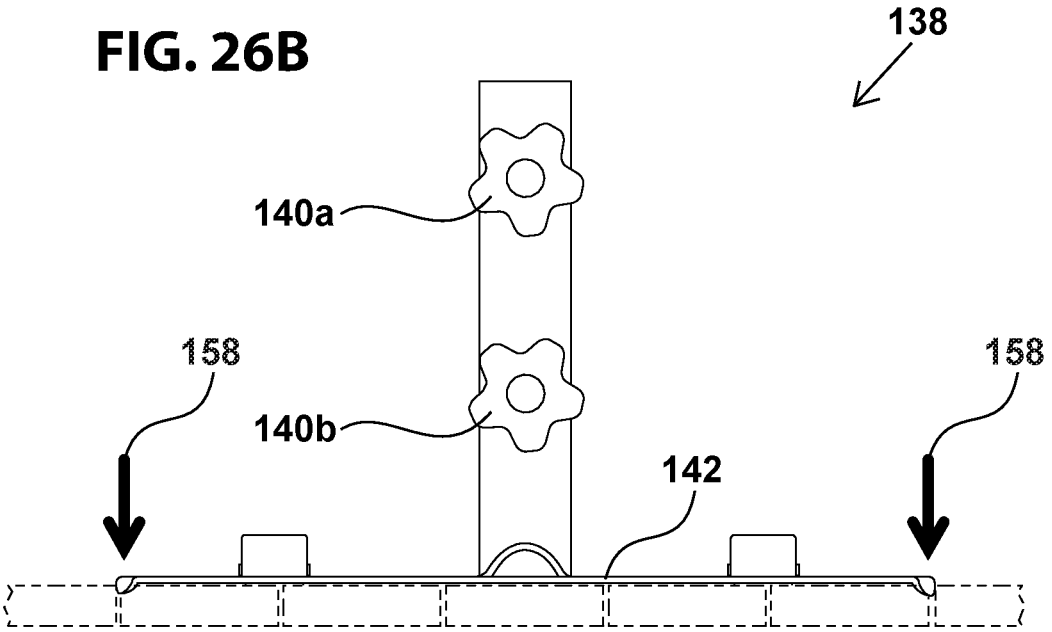

(see FIG. 23A, FIG. 23B, and FIG. 25).

27) Arthritic-aiding cable-hook grip ring 127 is (or are respectively) for:

Medicinally beneficially allowing a user with an arthritic hand to keep his/her hand straight (to eliminate the need for bending his/her fingers and wrist) when holding and operating arthritic-aiding cable-hook grip ring 127 by inserting his/her hand through arthritic-aiding cable-hook grip ring 127 and inserting locking pin 129 into one of pin-centering pin-guiding tubes 132 in the direction of arrow 151 to require less effort to deploy canopy for those with limited hand mobility due to arthritis (see FIG. 13, FIG. 23A, FIG. 23B, and FIG. 25).

28) Anti-finger-pinching spacer 128 is (or are respectively) for:

Safely keeping a user's hand away from umbrella-pole pin openings 126 to prevent the hand's skin from being pinched by locking pin 129

(see FIG. 25).

29) Locking pin 129 is (or are respectively) for:

Locking arthritic-aiding arthritic-hand-accommodating lower hub 118 at one of three desired elevations of umbrella-pole pin openings 126, respectively, when being inserted into one of pin-centering pin-guiding tubes 132 in the directions of arrows 154, 155, and 156

(see FIG. 23A, FIG. 23B, FIG. 24A, FIG. 24B, and FIG. 24C);

Pushing two of auditorily-snap-locking leaf springs 133 outward until two of auditorily-snap-locking nipples 134 auditorily snap-lock into auditorily-snap-locking recess 130 in the directions of arrows 157*a*, 157*b*, 157*c*, and 157*d*

Figure 24A:
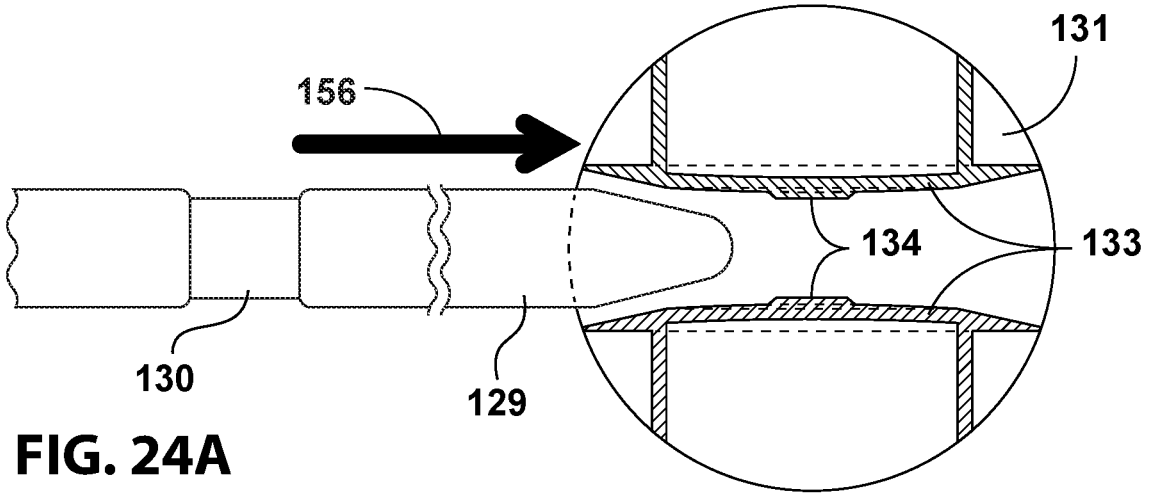
Figure 24B:
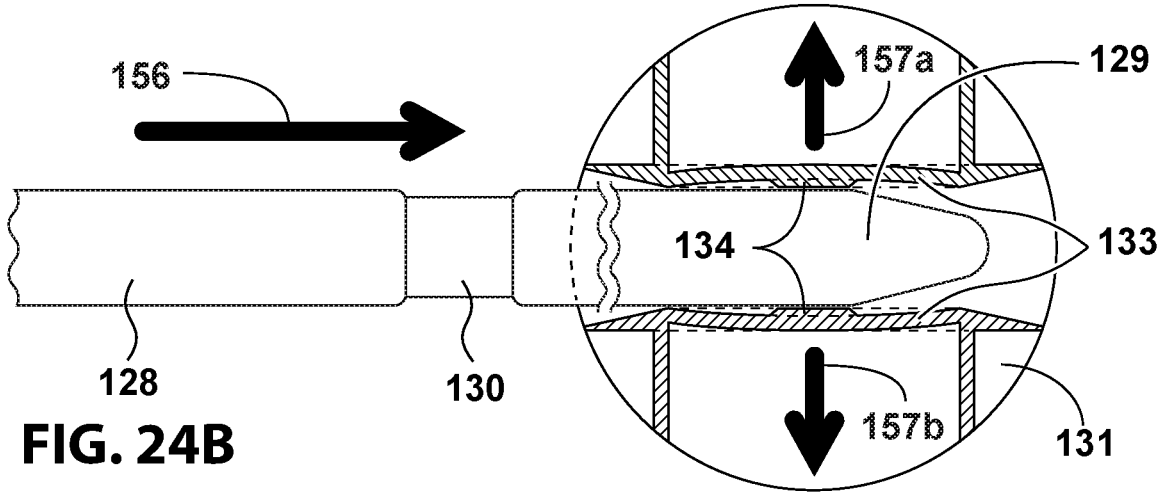
Figure 24C:
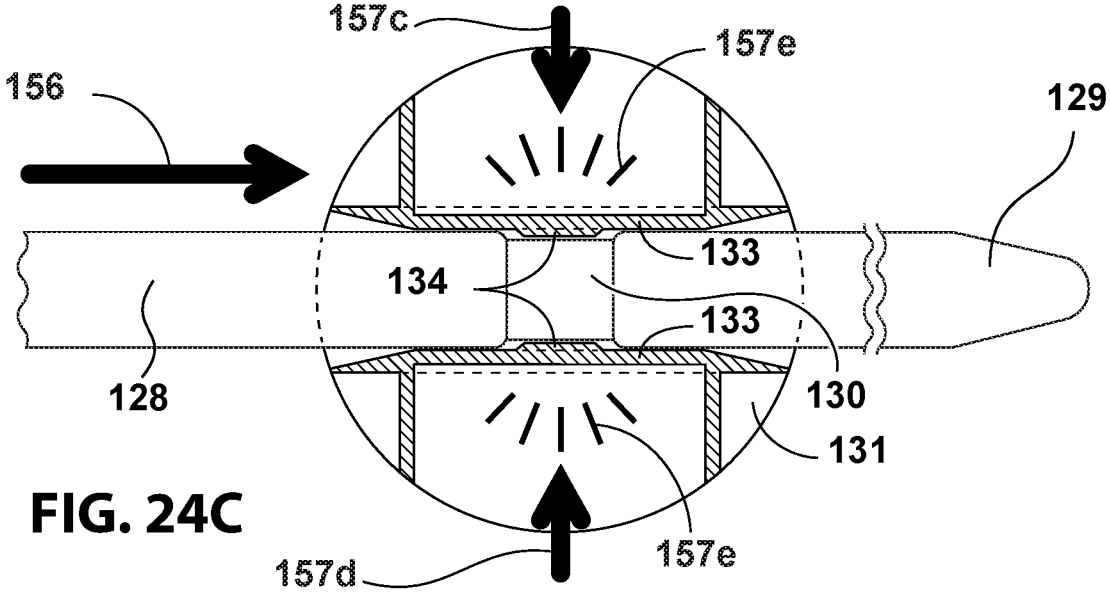

(see FIG. 24A, FIG. 24B, and FIG. 24C);

Generating snap-locking sounds 157*e* and 157*e*

(see FIG. 24C); and

Locking locking pin 129 into one of pin-centering pin-guiding tubes 132

(see FIG. 13, FIG. 23A, FIG. 23B, FIG. 24C, and FIG. 25).

30) Auditorily-snap-locking recess 130 is (or are respectively) for:

Locking two of auditorily-snap-locking nipples 134 therein; and

Alerting auditorily that two of auditorily-snap-locking nipples 134 are locked therein (see FIG. 23A, FIG. 23B, and FIG. 24C).

31) Pin-centering pin-guiding plugs 131 is (or are respectively) for:

Centering and aligning pin-centering pin-guiding tubes 132 with umbrella-pole pin openings 126 inside umbrella pole 106

(see FIG. 23A, FIG. 23B, and FIG. 24C).

32) Pin-centering pin-guiding tubes 132 is (or are respectively) for:

Accurately and conveniently guiding locking pin 129 from one of umbrella-pole pin openings 126 to another of umbrella-pole pin openings 126.

33) Auditorily-snap-locking leaf springs 133 is (or are respectively) for:

Springably pushing and auditorily snap-locking auditorily-snap-locking nipples 134 inside auditorily-snap-locking recess 130, respectively, in the directions of arrows 152*c* and 152*d*

(see FIG. 24C).

34) Auditorily-snap-locking nipples 134 is (or are respectively) for:

Auditorily snap-locking locking pin 129 inside auditorily-snap-locking recess 130

(see FIG. 23A, FIG. 23B, and FIG. 24C).

Figure 14:
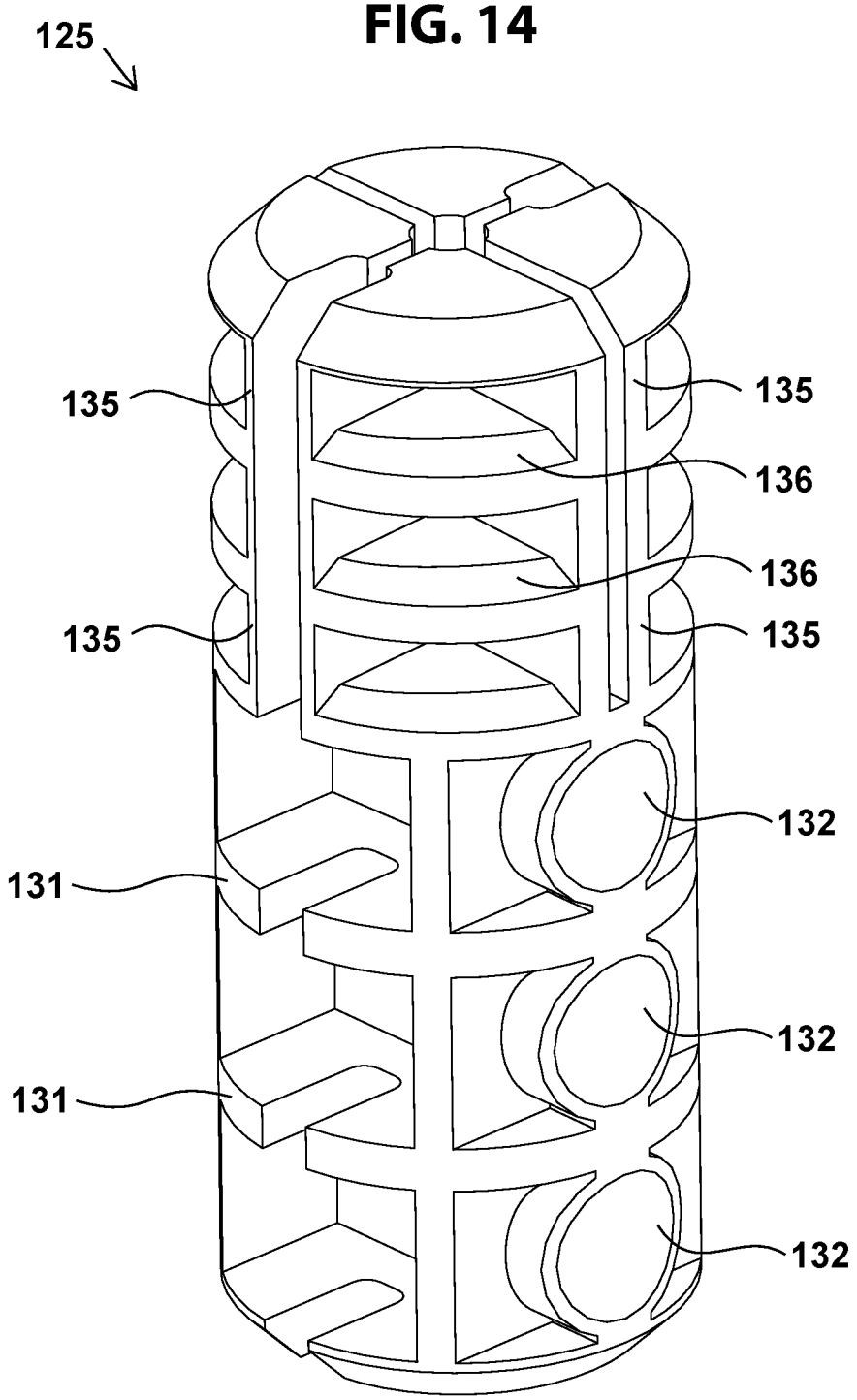
FIG. 14, FIG. 15A, FIG. 15B, FIG. 15C, FIG. 15D, and FIG. 15E illustrate perspective, top, bottom, front, side, and side hidden-element views of the arthritic-aiding pin-centering pin-guiding auditorily-snap-locking tower-locking system, respectively.
Figure 15A:
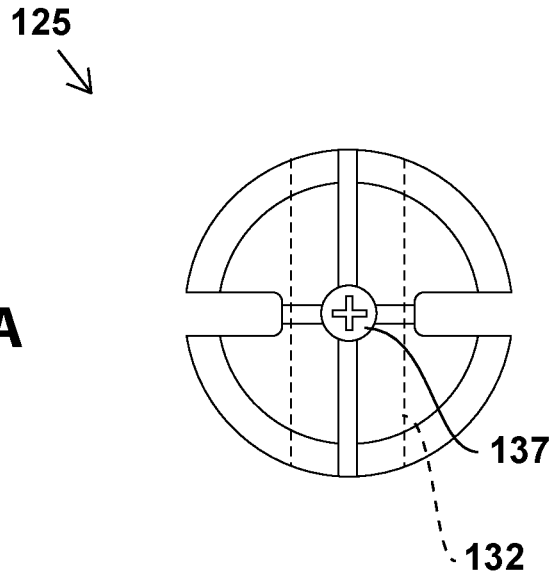
Figure 15B:
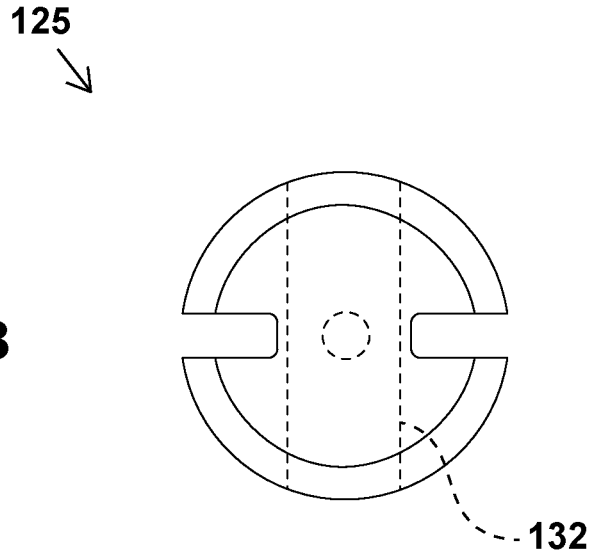
Figure 15C:
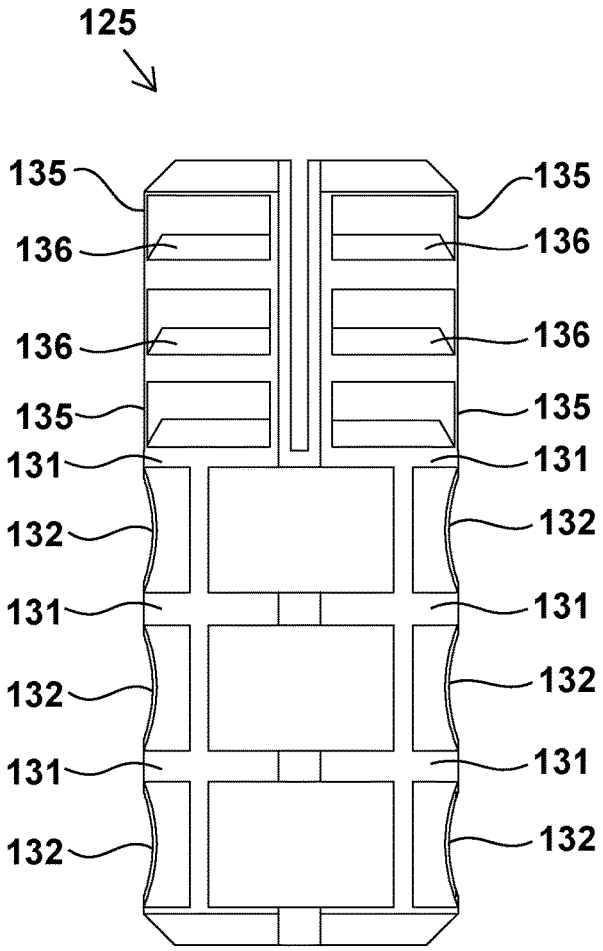
Figure 15D:
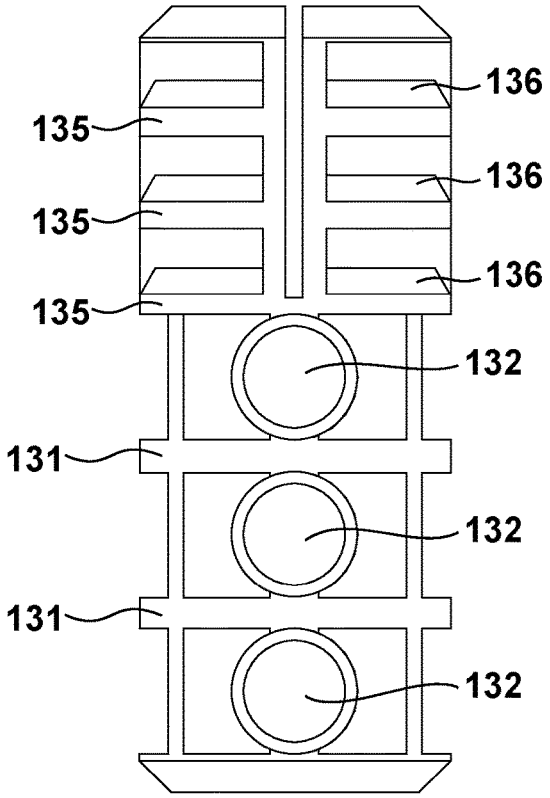
Figure 15E:
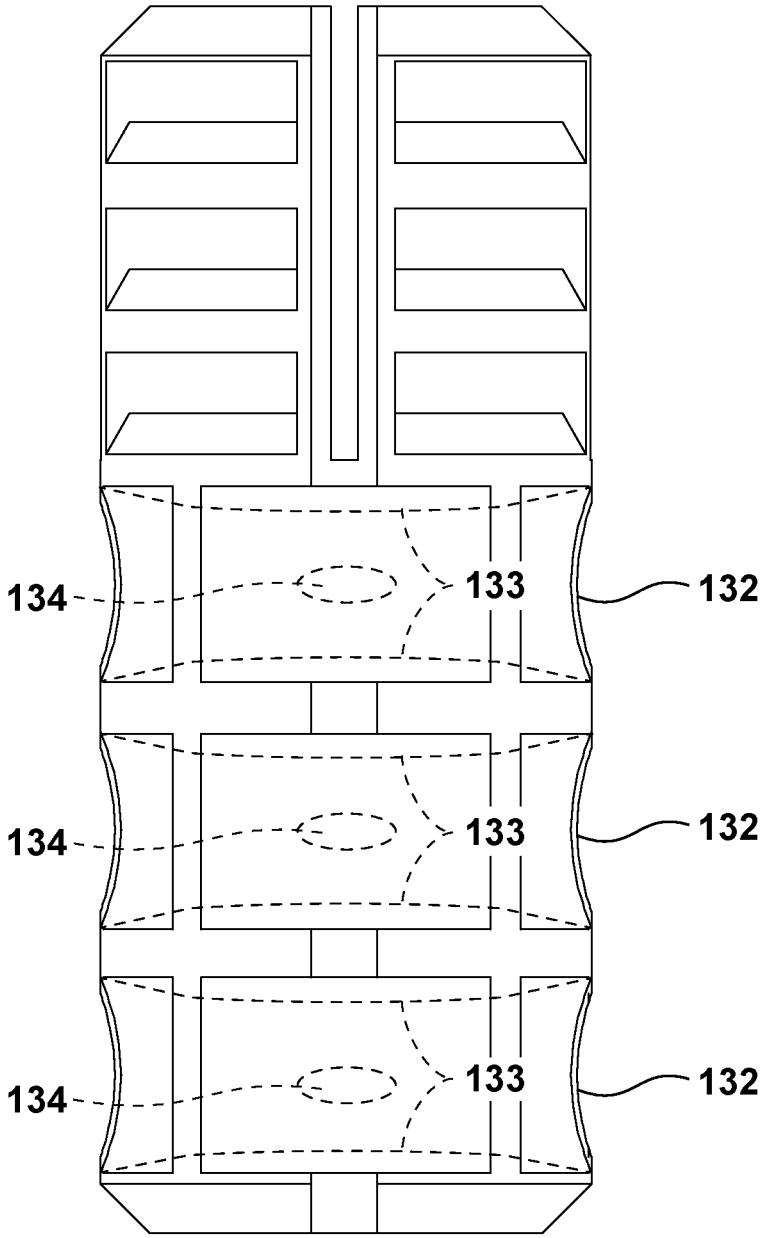
Figure 16A:
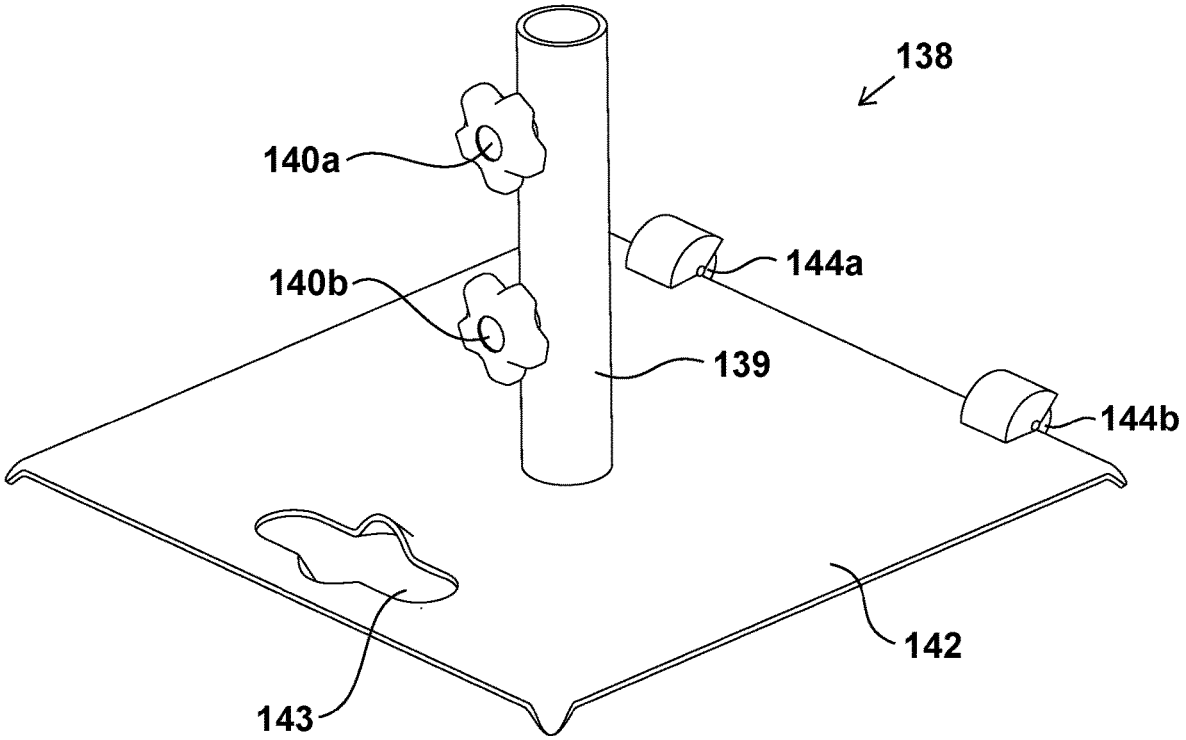
FIG. 16A, FIG. 16B, FIG. 16C, and FIG. 16D illustrate perspective, top, bottom, front, and side views of the portable tow-hitch-connectable pet-shade-and-chair-locking umbrella-base system, respectively.
Figure 16B:
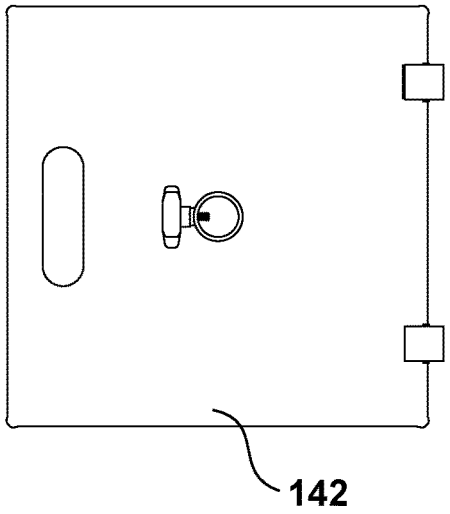
Figure 16C:
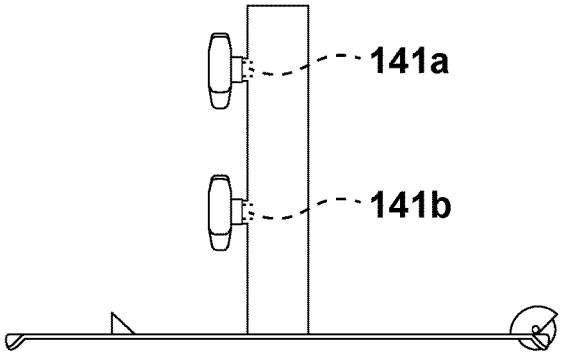
Figure 16D:
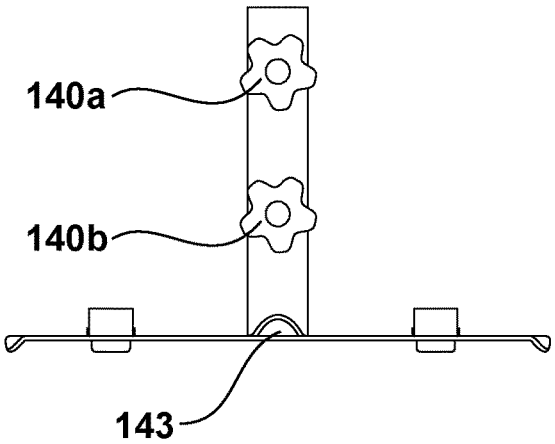

35) Four internally-taperedly-threaded flexible towers 135 is (or are respectively) for:

Springably being pushed outwardly by tower-locking screw 137 to releasably secure pin-centering pin-guiding plugs 131, pin-centering pin-guiding tubes 132 auditorily-snap-locking leaf springs 136 auditorily-snap-locking nipples 134 four internally-taperedly-threaded flexible towers 135 and twelve triangular tower leaf springs 136 inside umbrella pole 106 at a desired elevation
(see FIG. 14, FIG. 15C, and FIG. 15D).

36) Twelve triangular tower leaf springs 136 is (or are respectively) for:
Springably pushing four internally-taperedly-threaded flexible towers 135 toward the central axis therebetween when four internally-taperedly-threaded flexible towers 135 are pushed outward by tower-locking screw 137
(see FIG. 14, FIG. 15C, and FIG. 15D).

37) Tower-locking screw 137 is (or are respectively) for:
Threadedly pushing four internally-taperedly-threaded flexible towers 135 outward to releasably secure two pin-centering pin-guiding plugs 131, pin-centering pin-guiding tubes 132, auditorily-snap-locking leaf springs 136, auditorily-snap-locking nipples 134, four internally-taperedly-threaded flexible towers 135, and twelve triangular tower leaf springs 136 inside umbrella pole 106 at a desired elevation
(see FIG. 15A).

38) Portable umbrella-base system 138 is (or are respectively) for performing the combined functions of its components.

39) Umbrella-pole vertical support tube 139 is (or are respectively) for:
Vertically and structurally supporting umbrella pole 106
(see FIG. 16A, FIG. 16B, FIG. 16C, and FIG. 16D).

40) Umbrella-pole-locking knobs 140*a* and 140*b* is (or are respectively) for:
Securing umbrella pole 106 inside of umbrella-pole vertical support tube 139
(see FIG. 16A, FIG. 16B, FIG. 16C, and FIG. 16D).

41) Threaded knob holes 141*a* and 141*b* is (or are respectively) for:
Threadedly screwing umbrella-pole-locking knobs 140*a* and 140*b* into umbrella-pole vertical support tube 139 respectively
(see FIG. 16A, FIG. 16B, FIG. 16C, and FIG. 16D).

42) Umbrella base 142 is (or are respectively) for:
Horizontally supporting umbrella-pole vertical support tube 139; and Securing umbrella base 142 to a deck by inserting folded corners in between slats
in the direction of arrows 158
(see FIG. 26B).

43) Tow-hitch-connectable pet-shade-and-chair-locking receptacle 143 is (or are respectively) for:
Attaching to a tow-hitch of a vehicle
to provide shade to said vehicle
(see FIG. 28A);
Attaching an auxiliary umbrella post therein,
in the directions of arrows 159, 160, and 161
(see FIG. 27A, FIG. 27B, and FIG. 27C); and
Securing a leg of a chair therein
in the directions of arrows 159, 160, and 161
(see FIG. 27A, FIG. 27B, and FIG. 27C).

44) Umbrella base wheels 144*a* and 144*b* is (or are respectively) for:
Rollably transporting portable umbrella-base system 138.

Variation

Figure 30A:
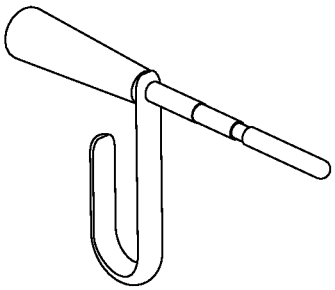
FIG. 30A and FIG. 30B illustrate side and perspective views of a variation of the arthritic-aiding cable-hook grip ring.
Figure 30B:
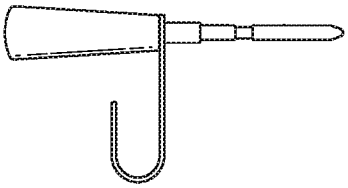
Figure 31:
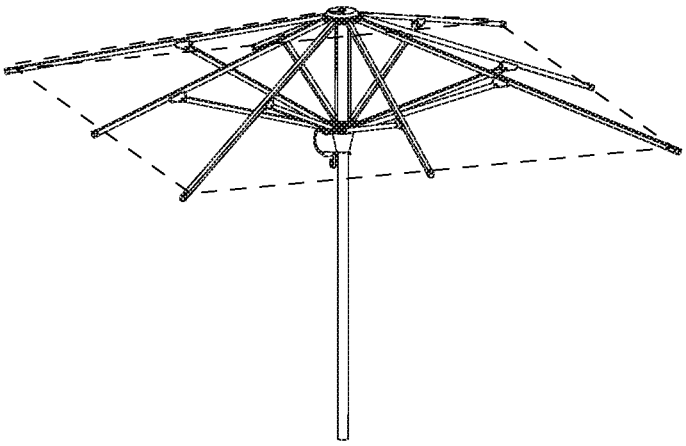
FIG. 31 illustrates a perspective view demonstrating a variation of the arthritic-aiding rainwater-sealing-to-protect-cable-pulley cable-pulley-hiding-hub LED-light-turning-on-and-off image-projecting counter-weight-decelerating umbrella with a square canopy.
Figure 32:
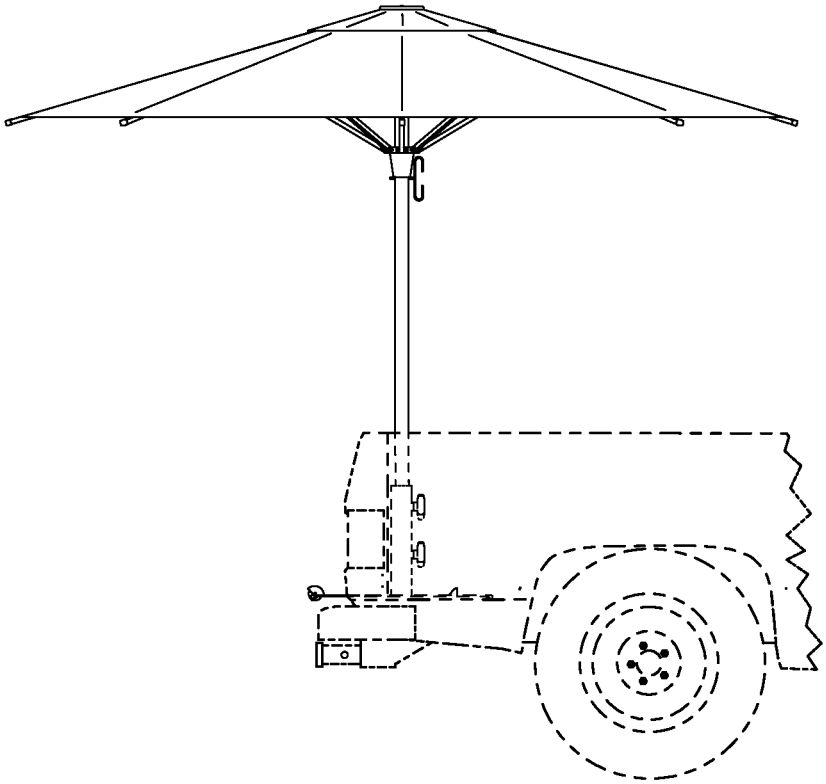
FIG. 32 illustrates a side view of how the umbrella base of the umbrella can be locked in place on a tailgate of a truck to provide shade on and behind a truck bed.
Figure 33:
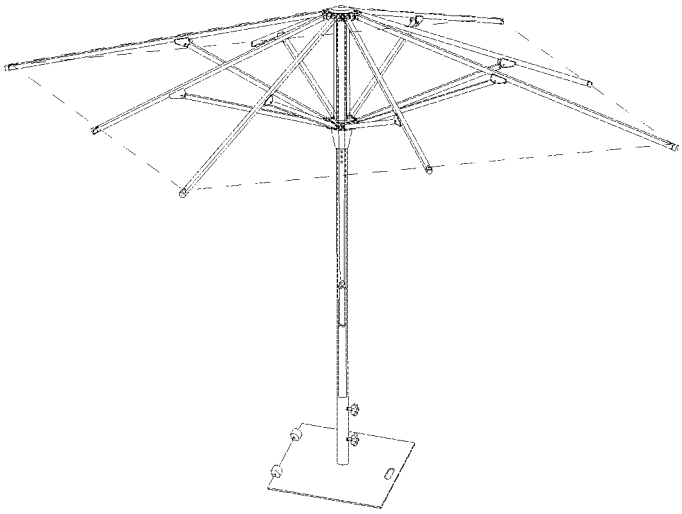
FIG. 33 and FIG. 34 illustrate side and perspective views of a variation of the arthritic-aiding rainwater-sealing-to-protect-cable-pulley cable-pulley-hiding-hub LED-light-turning-on-and-off image-projecting counter-weight-decelerating umbrella.
Figure 34:
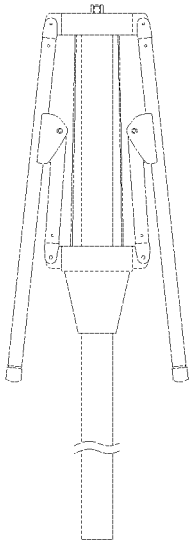

Referring to FIG. 28C, FIG. 28D, FIG. 28E, FIG. 28F, FIG. 28G, FIG. 28H, FIG. 28I, FIG. 29, FIG. 30A, FIG. 30B, FIG. 31, FIG. 32, FIG. 33, and FIG. 34:

Any component of the arthritic-aiding rainwater-sealing-to-protect-cable-pulley cable-pulley-hiding-hub LED-light-turning-on-and-off image-projecting counter-weight-decelerating umbrella can have any shape and size. Any component of the arthritic-aiding rainwater-sealing-to-protect-cable-pulley cable-pulley-hiding-hub LED-light-turning-on-and-off image-projecting counter-weight-decelerating umbrella can be made of any material(s). FIG. 28C, FIG. 28D, FIG. 28E, FIG. 28F, FIG. 28G, FIG. 28H, FIG. 28I, and FIG. 29 illustrate bottom views of equivalent variations of designs of the image-magnifying image-projecting lens. FIG. 30A and FIG. 30B illustrate side and perspective views of a variation of the arthritic-aiding cable-hook grip ring. FIG. 31 illustrates a perspective view demonstrating a variation of the arthritic-aiding rainwater-sealing-to-protect-cable-pulley cable-pulley-hiding-hub LED-light-turning-on-and-off image-projecting counter-weight-decelerating umbrella with a square canopy. FIG. 32 illustrates a side view of how the umbrella base of the umbrella can be locked in place on a tailgate of a truck to provide shade on and behind a truck bed. FIG. 33 and FIG. 34 illustrate side and perspective views of a variation of the arthritic-aiding rainwater-sealing-to-protect-cable-pulley cable-pulley-hiding-hub LED-light-turning-on-and-off image-projecting counter-weight-decelerating umbrella.

MAJOR ADVANTAGES OF THE INVENTION

Figure 20A:
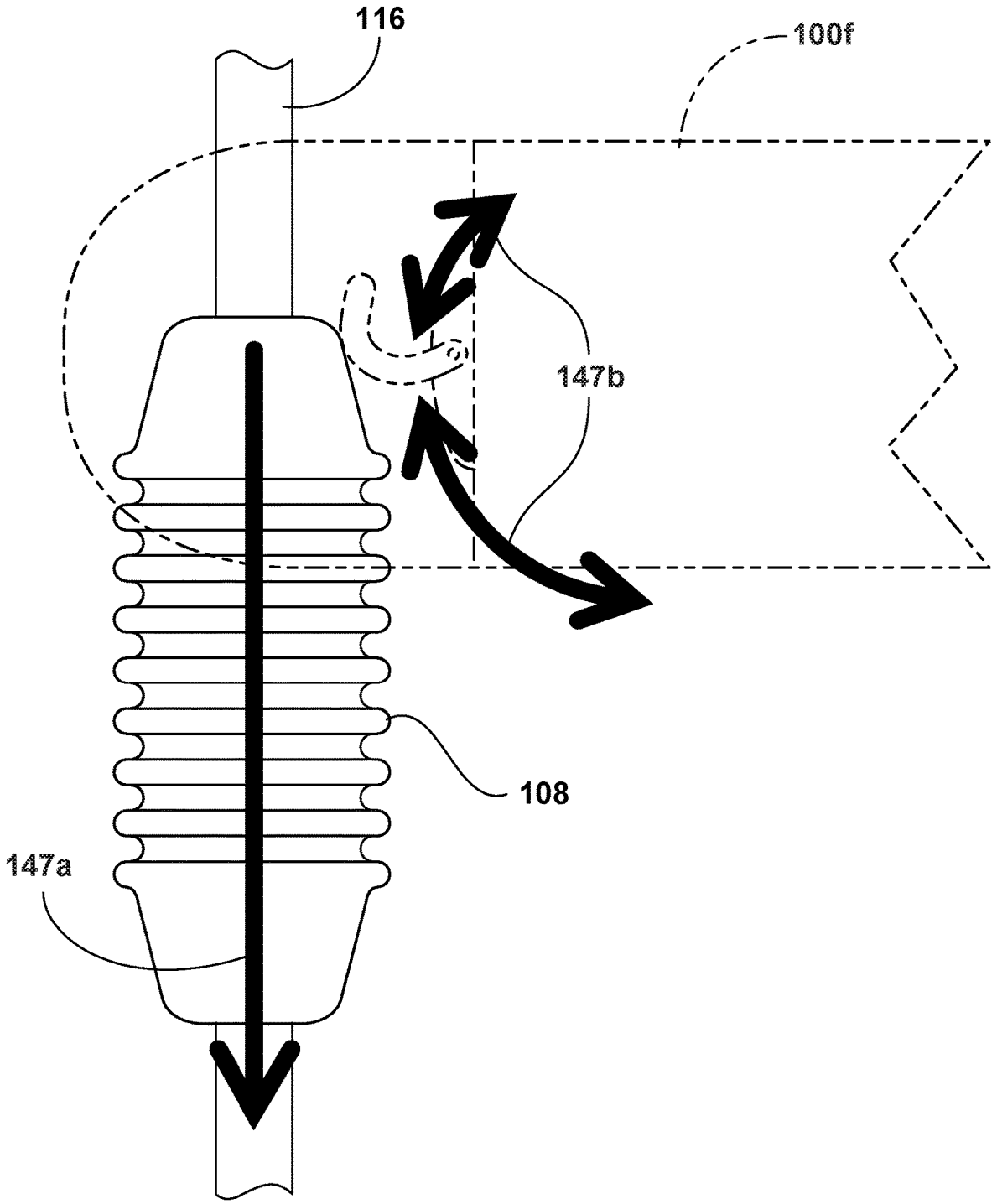
FIG. 20A and FIG. 20B illustrate side views demonstrating the function of the switching on and off of an LED light.
Figure 20B:
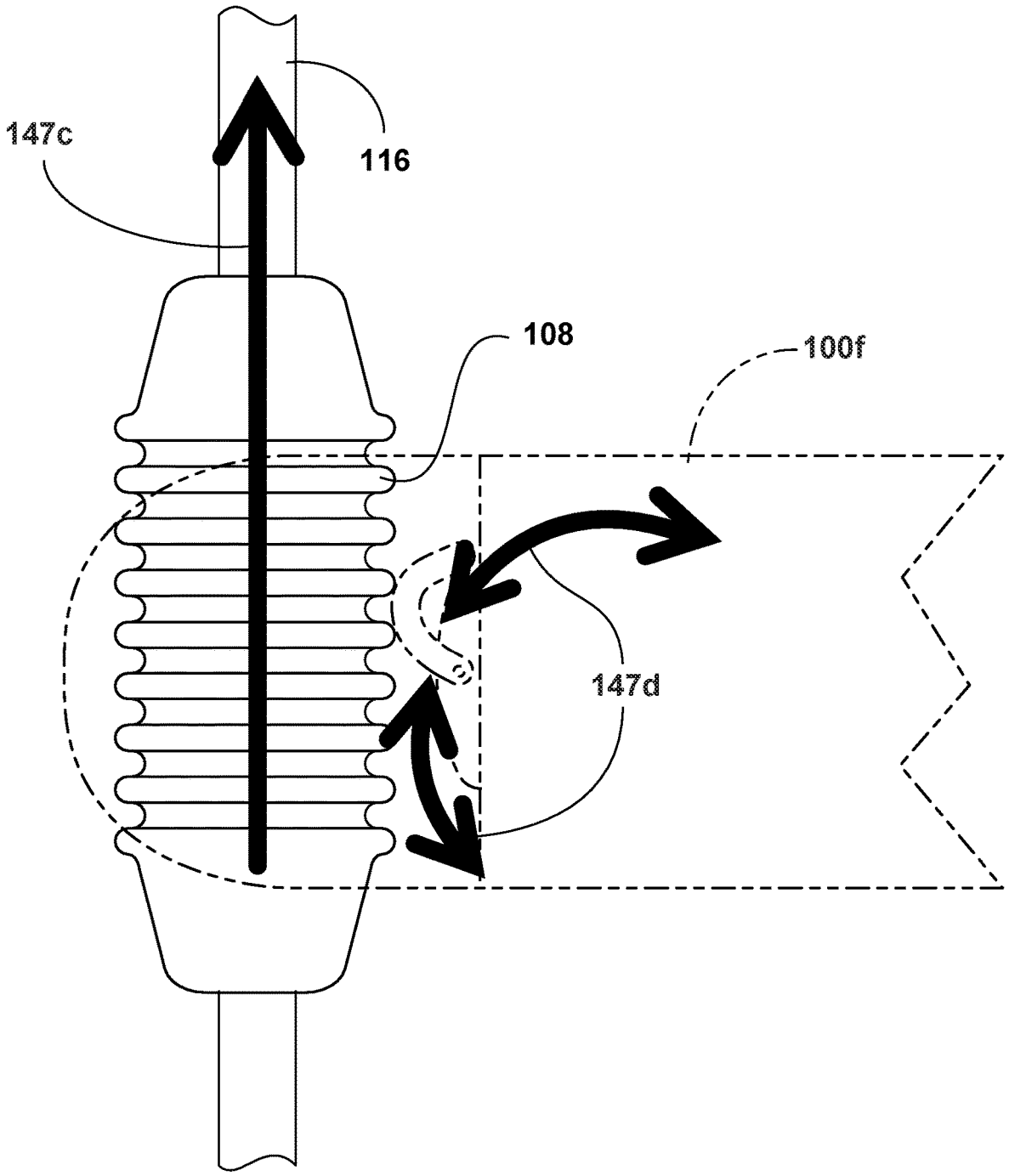
Figure 20C:
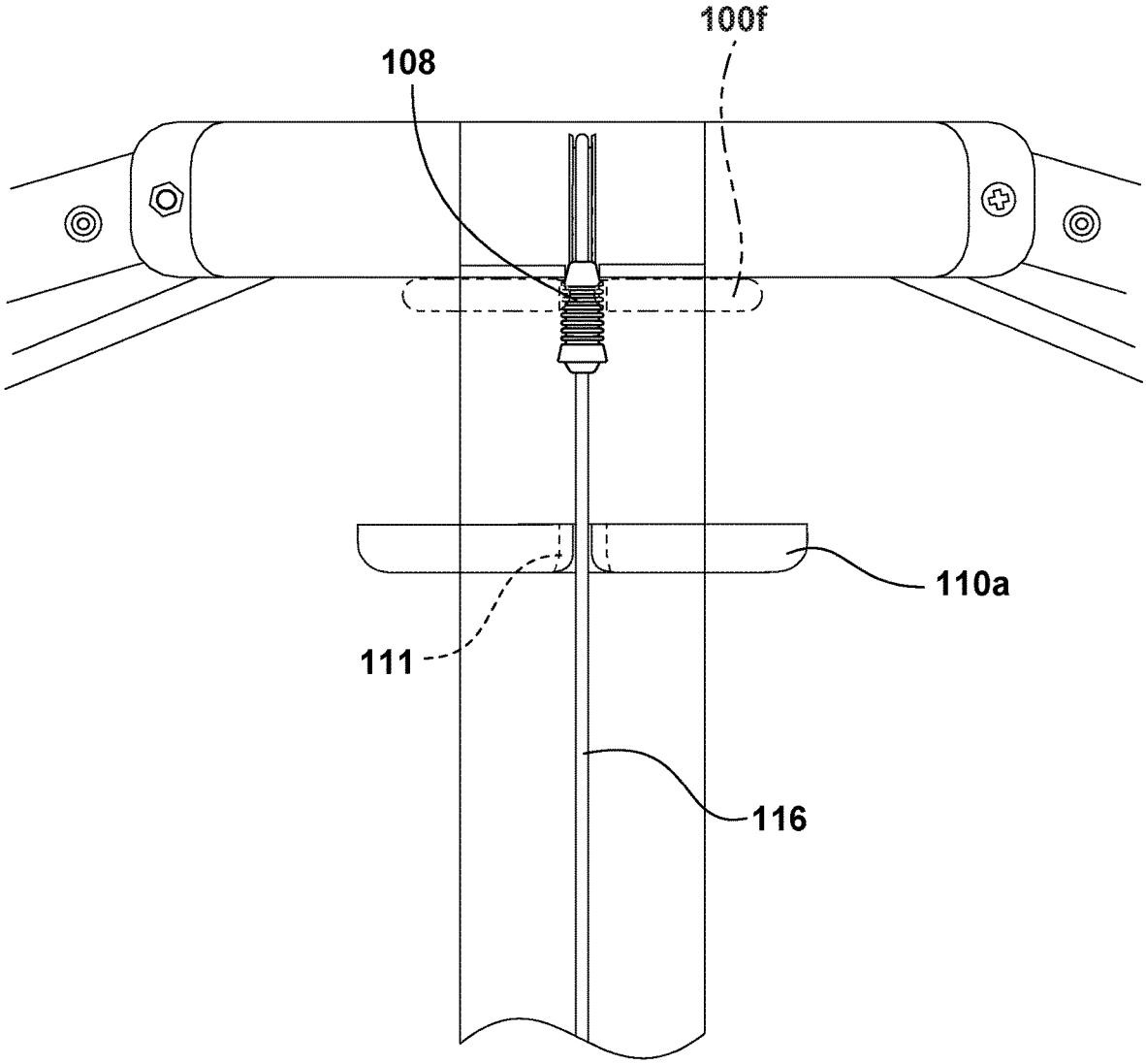
FIG. 20C and FIG. 20D illustrate side views demonstrating the functionality of the rainwater-sealing corrosion-eliminating LED-light-turning-on-and-off interchangeable-multi-angle LED-light-magnifying image-projector-securing pulley-plug system supporting and movement of interchangeable multi-angle LED-light-magnifying image projector and an LED light.
Figure 20D:
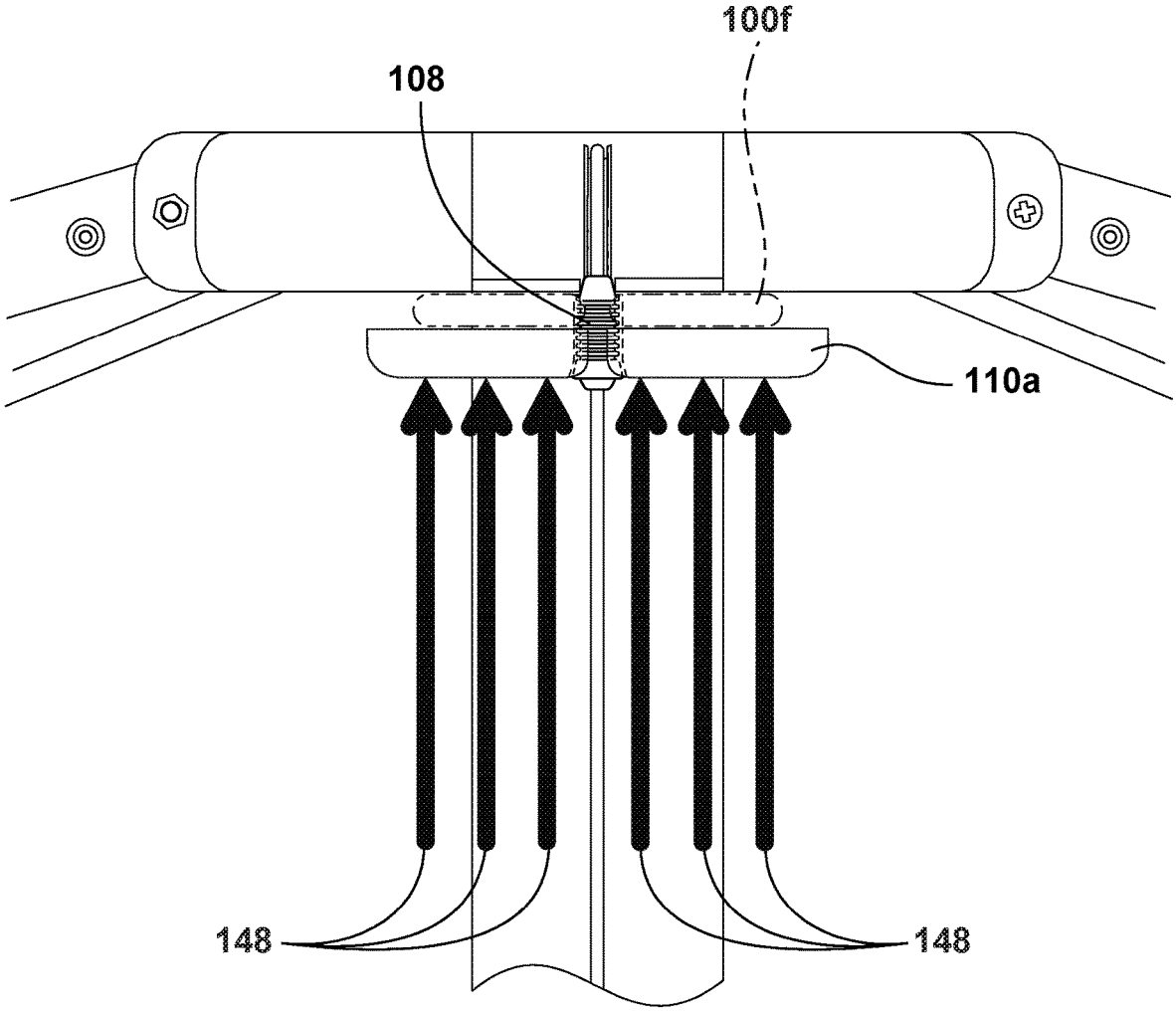

The present invention substantially departs from the conventional concepts and designs of the prior art. In doing so, the present invention provides an arthritic-aiding rainwater-sealing-to-protect-cable-pulley cable-pulley-hiding-hub LED-light-turning-on-and-off image-projecting counter-weight-decelerating umbrella (having: a) Rainwater-sealing-for-cable-pulley cable-pulley-hiding-hub canopy and pole system, b) Rainwater-sealing corrosion-eliminating LED-light-turning-on-and-off interchangeable-multi-angle LED-light-magnifying image-projector-securing pulley-plug system, c) Arthritic-aiding cable-pulley-hiding pole-rust-eliminating counter-weight-decelerating image-projector-locking elastic cable system, d) Deceleration-capable hand-pain-eliminating counter-weight system, e) Arthritic-aiding pin-centering pin-guiding auditorily-snap-locking tower-locking system, and f) Portable tow-hitch-connectable pet-shade-and-chair-locking umbrella-base system), having many new and significant features, functions, and advantages, which overcome all the disadvantages of the prior art, as follows:

1) It is an object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
first rainwater-sealing corrosion-eliminating LED-light-turning-on-and-off pulley-plug 108.
Therefore, the arthritic-aiding rainwater-sealing-to-protect-cable-pulley cable-pulley-hiding-hub LED-light-turning-on-and-off image-projecting counter-weight-decelerating umbrella:
a) Can seal out rainwater from penetrating the inside of cable-pulley-hiding pole-rust-eliminating counter-weight-rust-eliminating upper hub 117 and umbrella pole 106
in the directions of arrows 99*e*, 99*f*, 100*a*, and 100*b*, respectively
(see FIG. 1D (Prior Art), FIG. 1E, FIG. 1F (Prior Art), and FIG. 1G);

b) Can protect cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), FIG. 1G, and FIG. 1H);

c) Can increase the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120;

d) Can insert into one of upside-down rainwater-blocking cable-pulley holes 115, respectively;

e) Can seal one of upside-down rainwater-blocking cable-pulley holes 115, respectively;
in the directions of arrows 100*b* and 100*c*, respectively
(see FIG. 1G and FIG. 11I); and f) Can frictionably activate and deactivate an on/off-switch to an LED-light-on-off switch 100*f* by upward and downward movement, respectively
in the directions of arrows 147*a*, 147*b*, 147*c*, and 147*d*
(see FIG. 20A and FIG. 20B).

2) It is an object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
second rainwater-sealing corrosion-eliminating LED-light-turning-on-and-off pulley-plug 109.
Therefore, the arthritic-aiding rainwater-sealing-to-protect-cable-pulley cable-pulley-hiding-hub LED-light-turning-on-and-off image-projecting counter-weight-decelerating umbrella:

a) Can seal out rainwater from penetrating the inside of cable-pulley-hiding pole-rust-eliminating counter-weight-rust-eliminating upper hub 117 and umbrella pole 106
in the directions of arrows 99*e*, 99*f*, 100*a*, and 100*b*, respectively
(see FIG. 1D (Prior Art), FIG. 1E, FIG. 1F (Prior Art), and FIG. 1G);

b) Can protect cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), FIG. 1G, and FIG. 1H);

c) Can increase the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120;

d) Can insert into one of upside-down rainwater-blocking cable-pulley holes 115, respectively;

e) Can seal one of upside-down rainwater-blocking cable-pulley holes 115, respectively;
in the directions of arrows 100*b* and 100*c*, respectively
(see FIG. 1G and FIG. 1H); and f) Can frictionably activate and deactivate an on/off-switch to an LED-light-on-off switch 100*f* by upward and downward movement, respectively
in the directions of arrows 147*a*, 147*b*, 147*c*, and 147*d*
(see FIG. 20A and FIG. 20B).

Figure 21A:
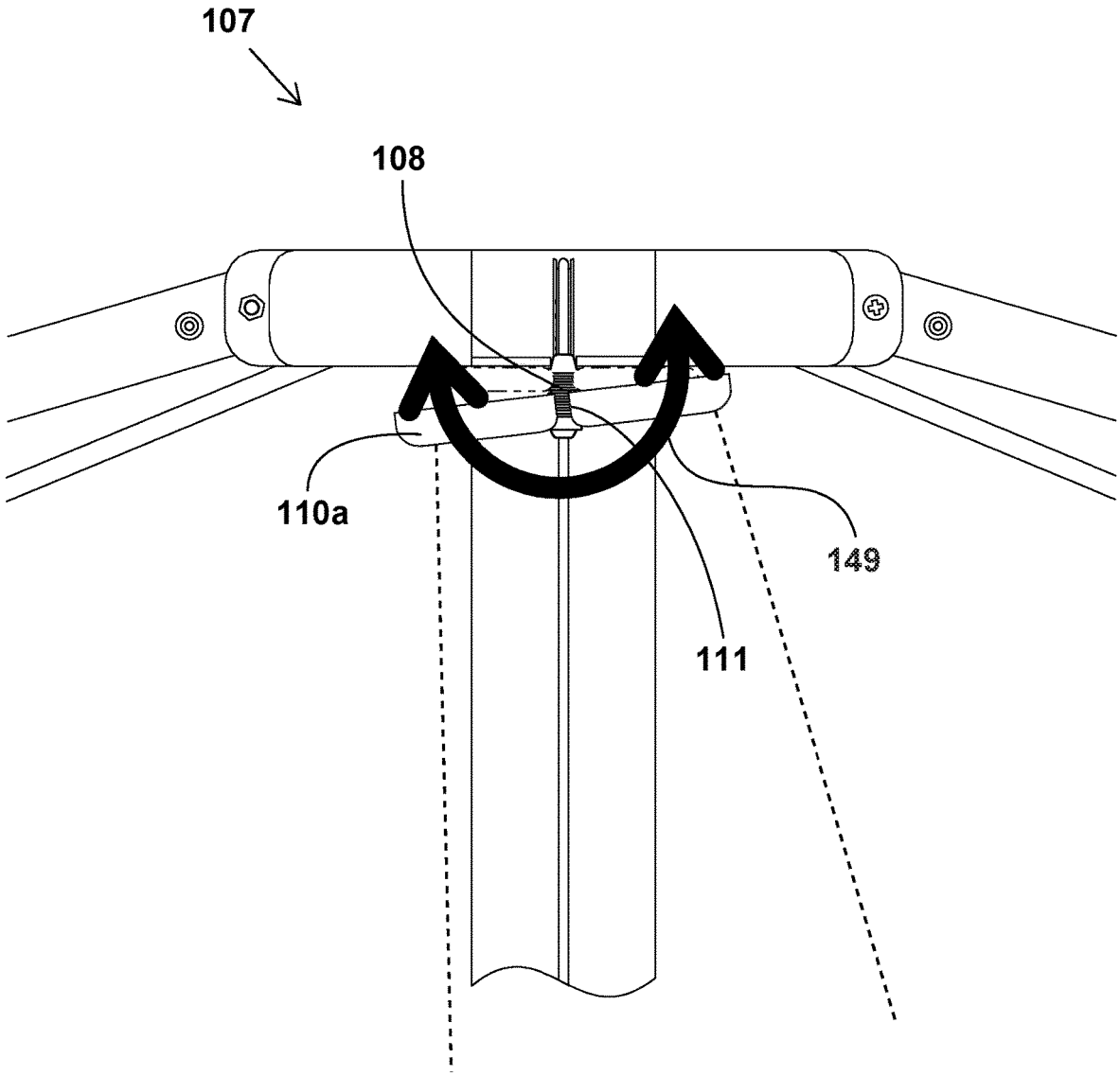
FIG. 21A and FIG. 21B illustrate side views demonstrating how the rainwater-sealing corrosion-eliminating LED-light-turning-on-and-off interchangeable-multi-angle LED-light-magnifying image-projector-securing pulley-plug system provides function to rotate interchangeable multi-angle LED-light-magnifying image projector to project an image in variable angles.
Figure 21B:
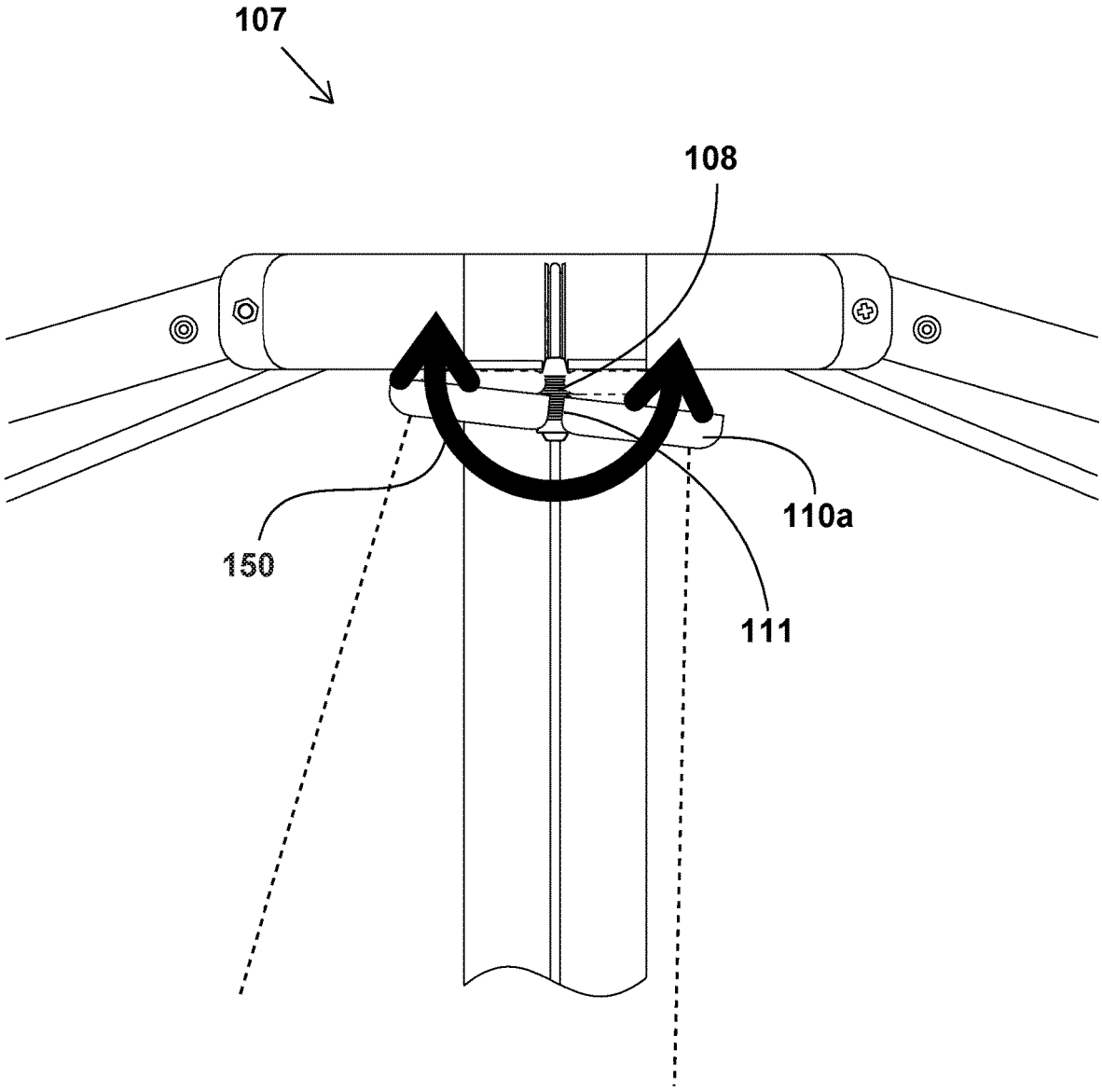
Figure 21C:
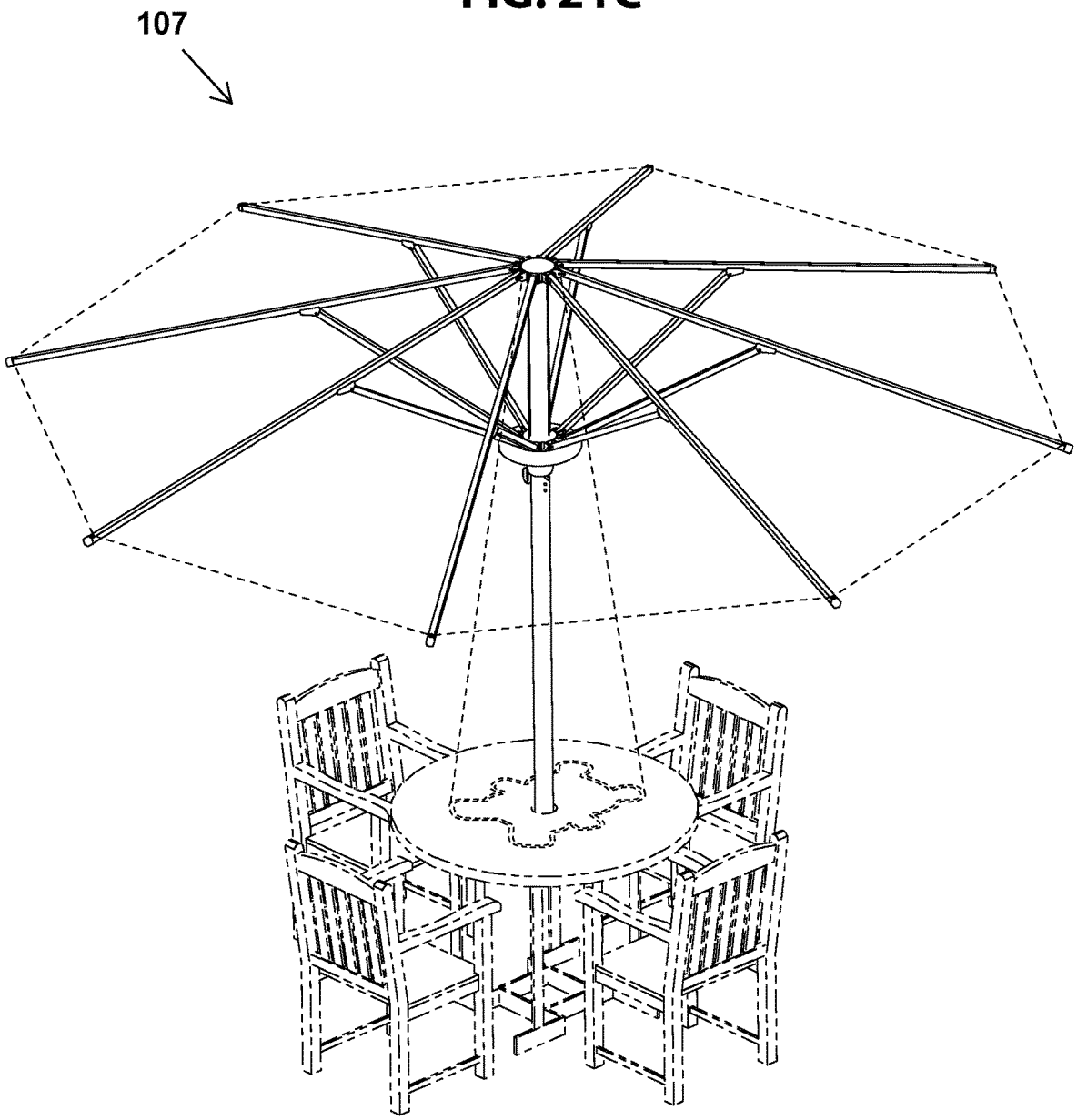
FIG. 21C, FIG. 21D, FIG. 21E, and FIG. 21F illustrate perspective views demonstrating how the interchangeable multi-angle LED-light-magnifying image projector projects images onto a table or a floor in variable magnifications.
Figure 21D:
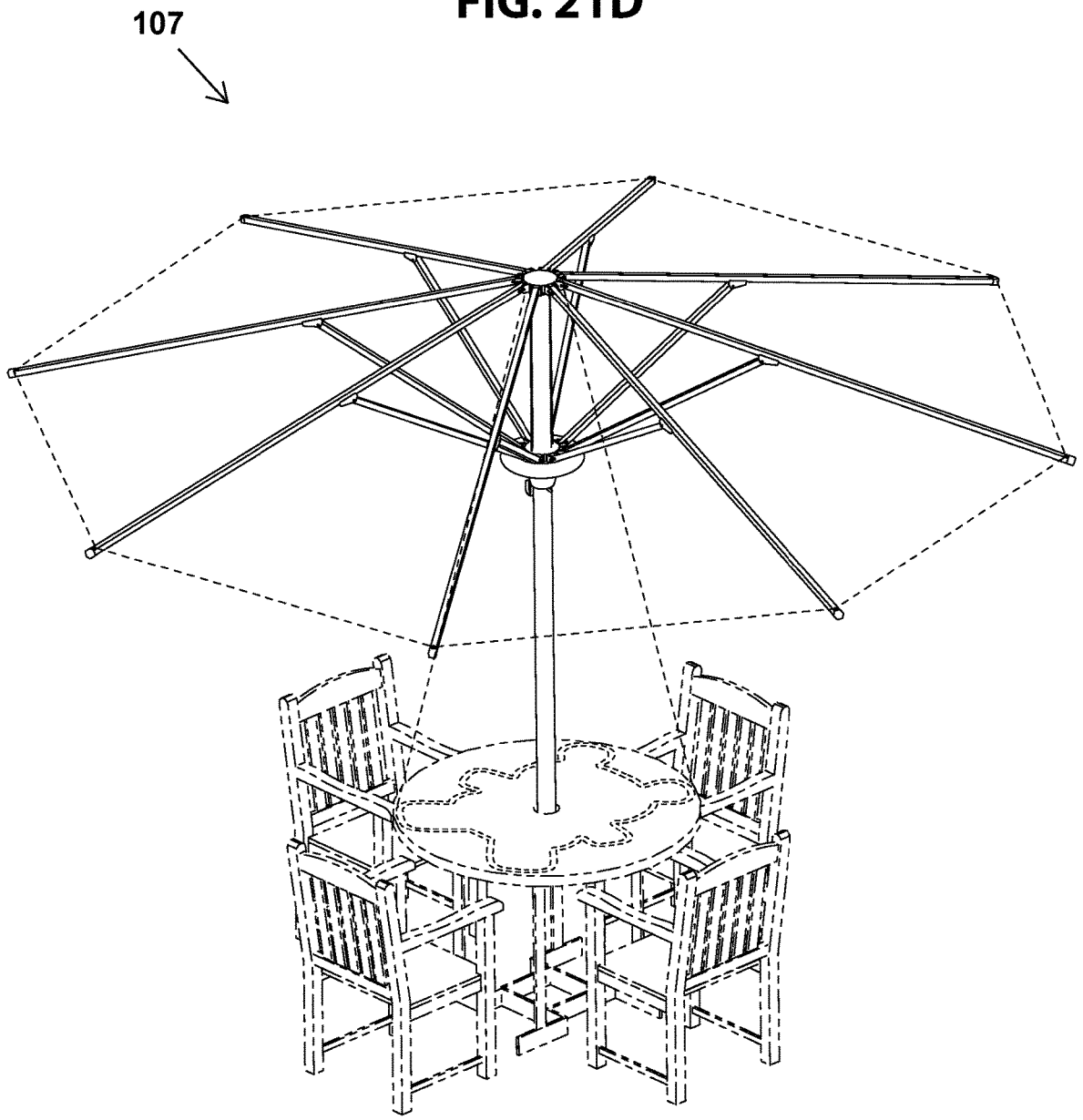
Figure 21E:
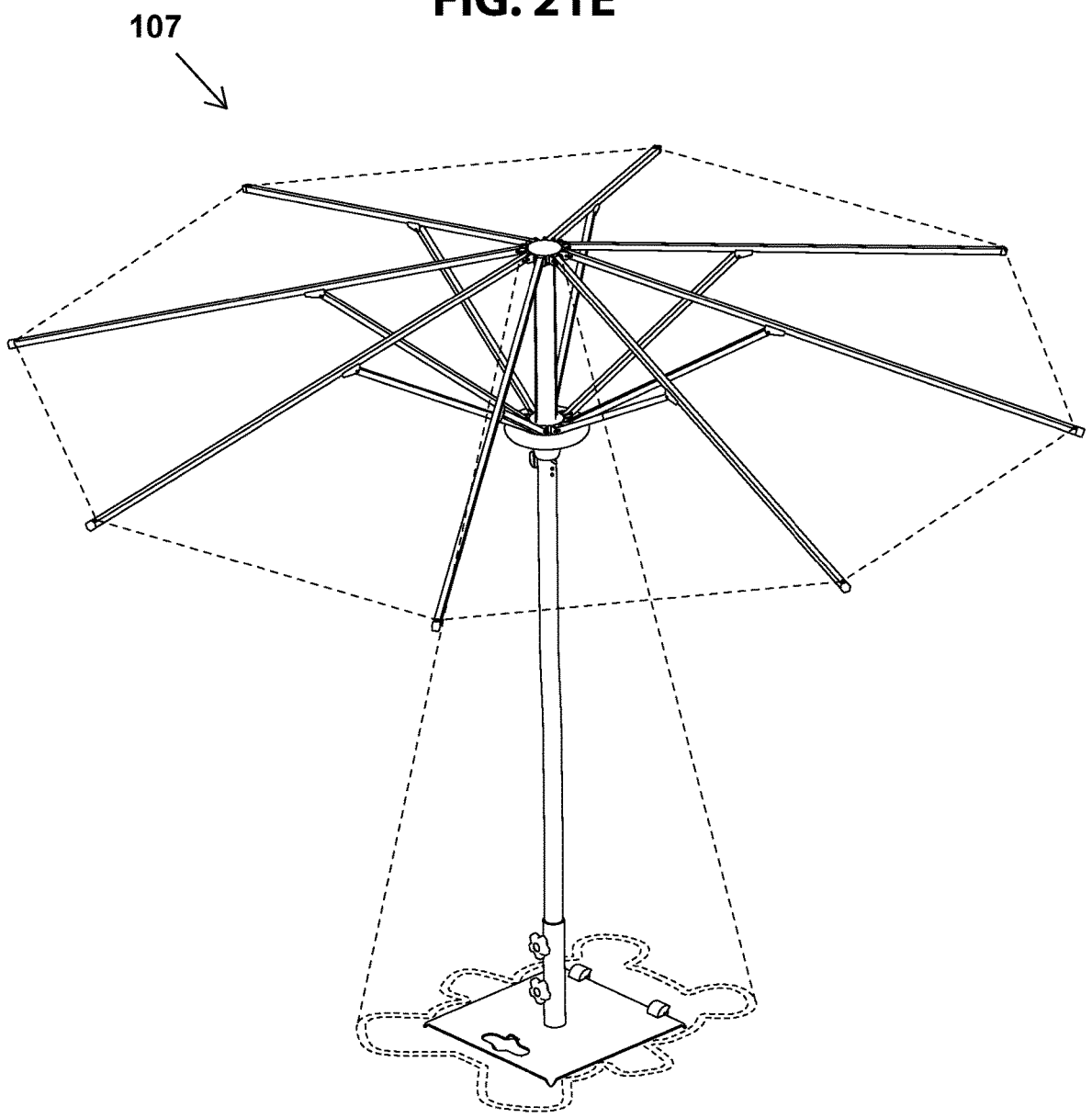
Figure 21F:
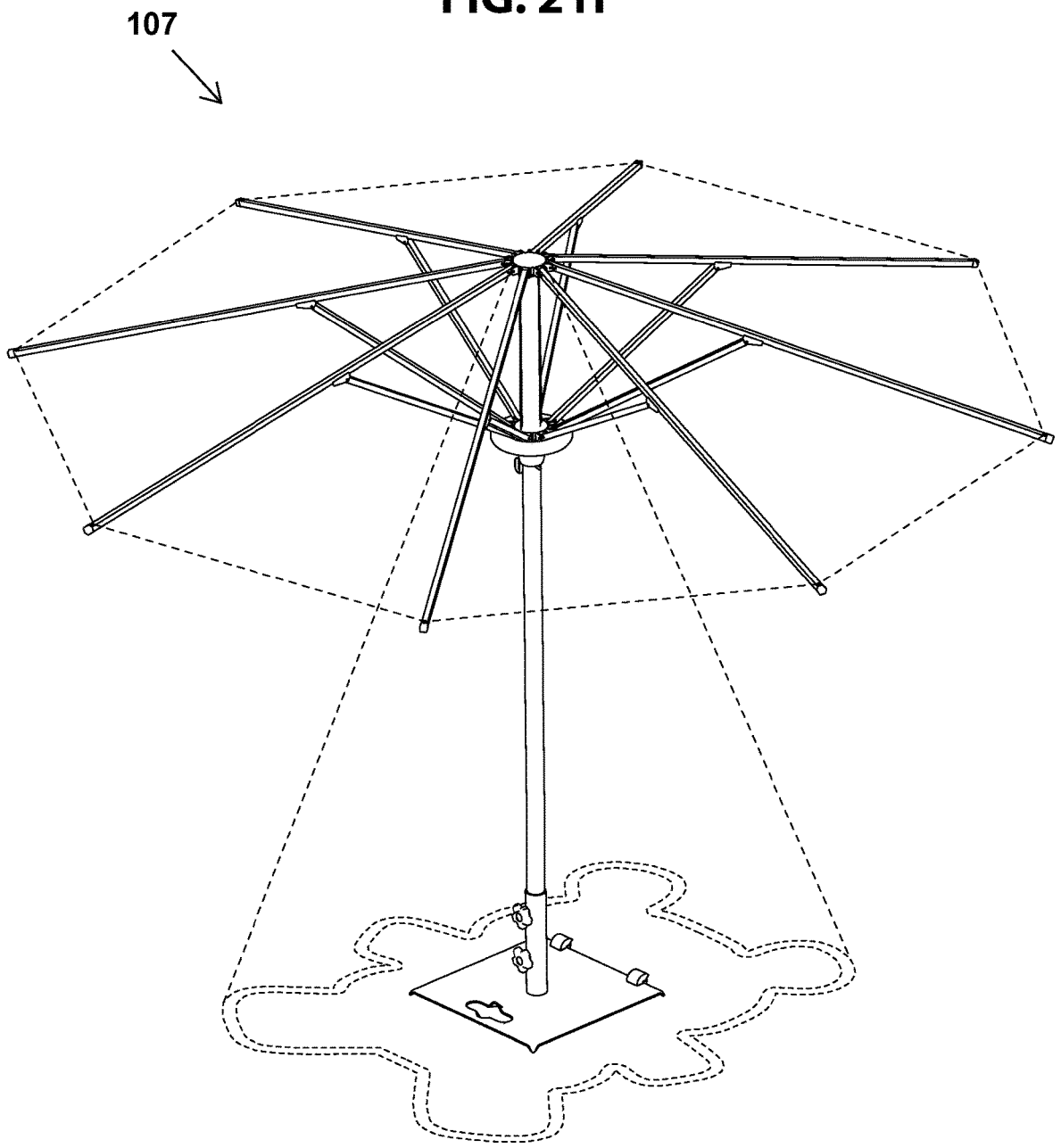

3) It is yet still another object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
interchangeable multi-angle LED-light-magnifying image projector 110*a*.
Therefore, the arthritic-aiding rainwater-sealing-to-protect-cable-pulley cable-pulley-hiding-hub LED-light-turning-on-and-off image-projecting counter-weight-decelerating umbrella:

a) Can decrease and enlarge a projected image on a table, a patio, a deck, or a floor,
at angles 100*d* and 100*e*, and in the directions of arrows 145*a*, 145*b*, 145*c*, 145*d*, 145*e*, 145*f*, 145*g*, 145*h*, 146*a*, 146*b*, 146*c*, and 148, respectively
(see FIG. 17A, FIG. 17B, FIG. 19C, FIG. 19D, 20C, and FIG. 20D);

b) Can project an image onto a floor surface, a patio, deck, or other floor
(see FIG. 21E and FIG. 21F);

c) Can project an image at different angles
in the directions of arrows 149 and 150
(see FIG. 21A, FIG. 21B, FIG. 21E, and FIG. 21F);

d) Can display a projected image in many color variations; and e) Can interchange a variety of different images.

4) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
image-magnifying image-projecting lens 112.
Therefore, the arthritic-aiding rainwater-sealing-to-protect-cable-pulley cable-pulley-hiding-hub LED-light-turning-on-and-off image-projecting counter-weight-decelerating umbrella:

a) Can project an image on a floor surface, a patio, deck, or a floor
(see FIG. 19C, FIG. 19D, 20C, FIG. 20D, FIG. 21C, and FIG. 21D);

b) Can decrease and enlarge a projected image on an table, a patio, a deck, or a floor,
(see FIG. 17A, FIG. 17B, FIG. 19C, FIG. 19D, 20C, and FIG. 20D);

c) Can display a projected image in many color variations; and d) Can interchange a variety of images
(see FIG. 28C, 28D, 28E, 28F, 28G, 28H, 28I, and FIG. 29).

5) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
upside-down rainwater-blocking cable-pulley holes 115.
Therefore, the arthritic-aiding rainwater-sealing-to-protect-cable-pulley cable-pulley-hiding-hub LED-light-turning-on-and-off image-projecting counter-weight-decelerating umbrella:

a) Can prevent rainwater from penetrating the inside of cable-pulley-hiding pole-rust-eliminating counter-weight-rust-eliminating upper hub 117 or umbrella pole 106
in the directions of arrows 99*e*, 99*f*, 100*a*, and 100*b*, respectively
(see FIG. 1D (Prior Art), FIG. 1E, FIG. 1F (Prior Art), and FIG. 1G);

b) Can protect cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120 from internal corrosion
(see FIG. 1D (Prior Art), FIG. 1E, FIG. 1F (Prior Art), and FIG. 1G);

c) Can increase the service life of cable-pulley-hiding pole-rust-eliminating counter-weight-rust-eliminating upper hub 117, umbrella pole 106, arthritic-aiding counter-weight-decelerating image-projector-locking elastic cable 116, and deceleration-capable hand-pain-eliminating counter-weight 120; and d) Can insert Inserting arthritic-aiding counter-weight-decelerating image-projector-locking elastic cable 116 therethrough.

6) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
arthritic-aiding counter-weight-decelerating image-projector-locking elastic cable 116.

Figure 22C:
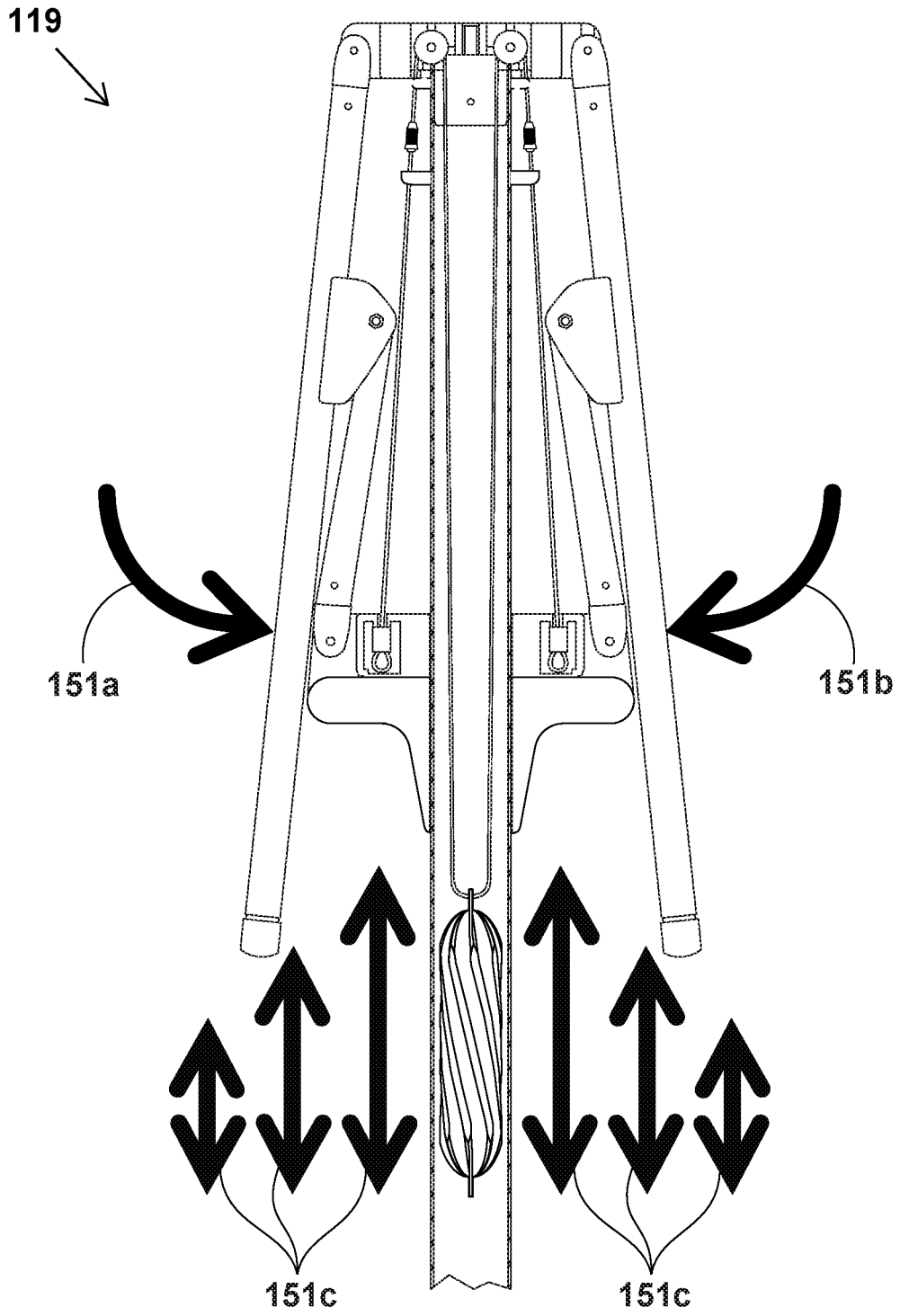
FIG. 22C and FIG. 22D illustrate side views demonstrating how the arthritic-aiding cable-pulley-hiding pole-rust-eliminating counter-weight-decelerating image-projector-locking elastic cable system and the deceleration-capable hand-pain-eliminating counter-weight system work in unison to decelerate the deceleration-capable hand-pain-eliminating counter-weight, thus reducing pain and discomfort to an arthritic person when operating such.
Figure 22D:
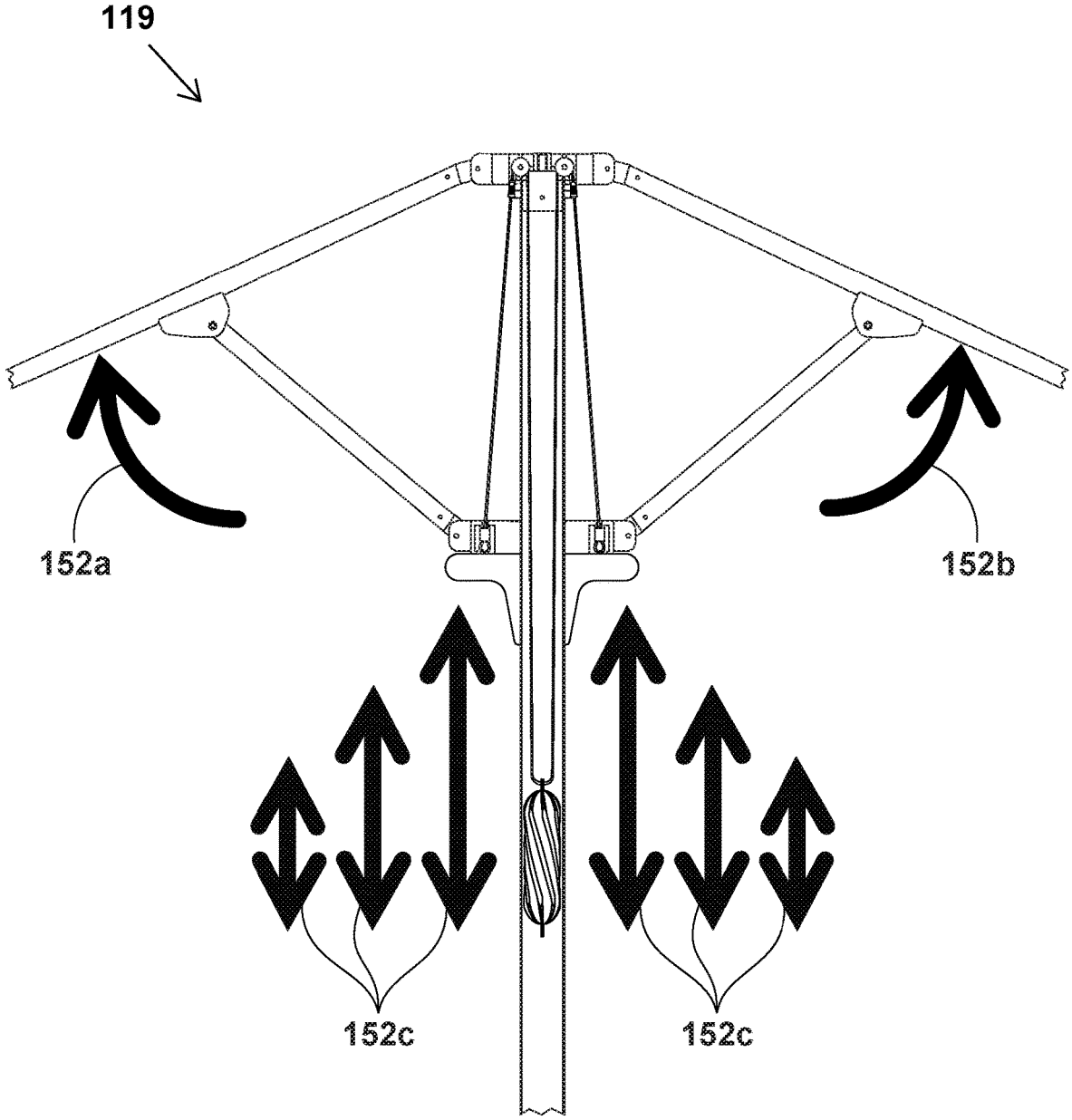

Therefore, the arthritic-aiding rainwater-sealing-to-protect-cable-pulley cable-pulley-hiding-hub LED-light-turning-on-and-off image-projecting counter-weight-decelerating umbrella:

a) Can decelerate deceleration-capable hand-pain-eliminating counter-weight 120
in the direction of and/or represented by arrows 151*a*, 151*b*, 151*c*, 152*a*, 152*b*, and 152*c*
(see FIG. 22C and FIG. 22D);

b) Can cushion the tension, vibration, and impact from operating arthritic-aiding rainwater-sealing-to-protect-cable-pulley cable-pulley-hiding-hub LED-light-turning-on-and-off image-projecting counter-weight-decelerating umbrella
to eliminate the pain and discomfort experienced by an arthritic-suffering person when raising and lowering
in the direction of and/or represented by arrows 151*a*, 151*b*, 151*c*, 152*a*, 152*b*, and 152*c*
(see FIG. 22C and FIG. 22D); and c) Can hoist and lower deceleration-capable hand-pain-eliminating counter-weight 120
to assist in operating arthritic-aiding rainwater-sealing-to-protect cable-pulley cable-pulley-hiding-hub LED-light-turning-on-and-off image-projecting counter-weight-decelerating umbrella
in the direction of arrows 151*a*, 151*b*, 151*c*, 152*a*, 152*b*, and 152*c*
(see FIG. 22C and FIG. 22D).

7) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
cable-pulley-hiding pole-rust-eliminating counter-weight-rust-eliminating upper hub 117.

Figure 9:
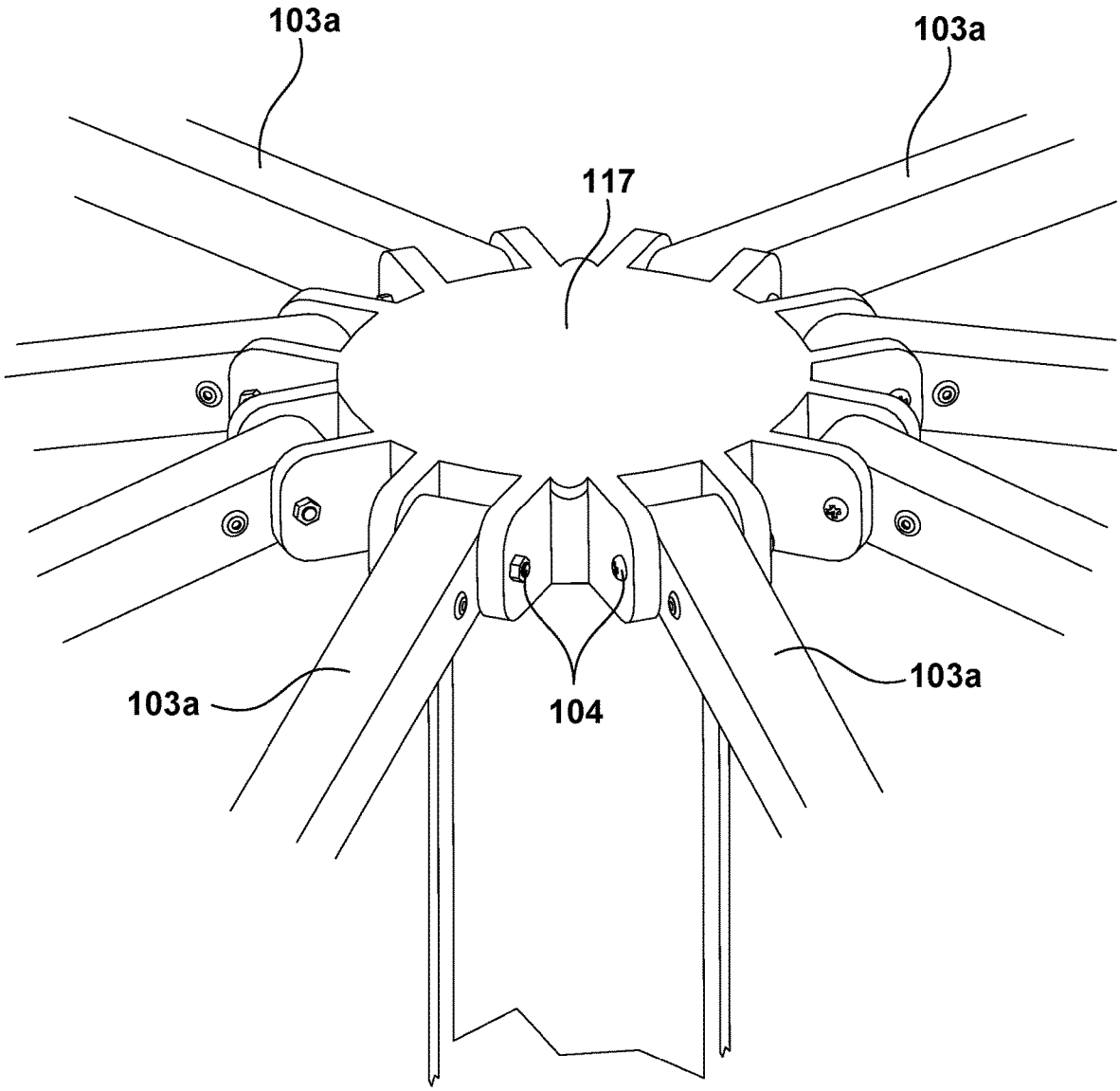
FIG. 9 illustrates a bottom perspective view of the cable-pulley-hiding pole-rust-eliminating counter-weight-rust-eliminating upper hub and upper ribs.
Figure 10A:
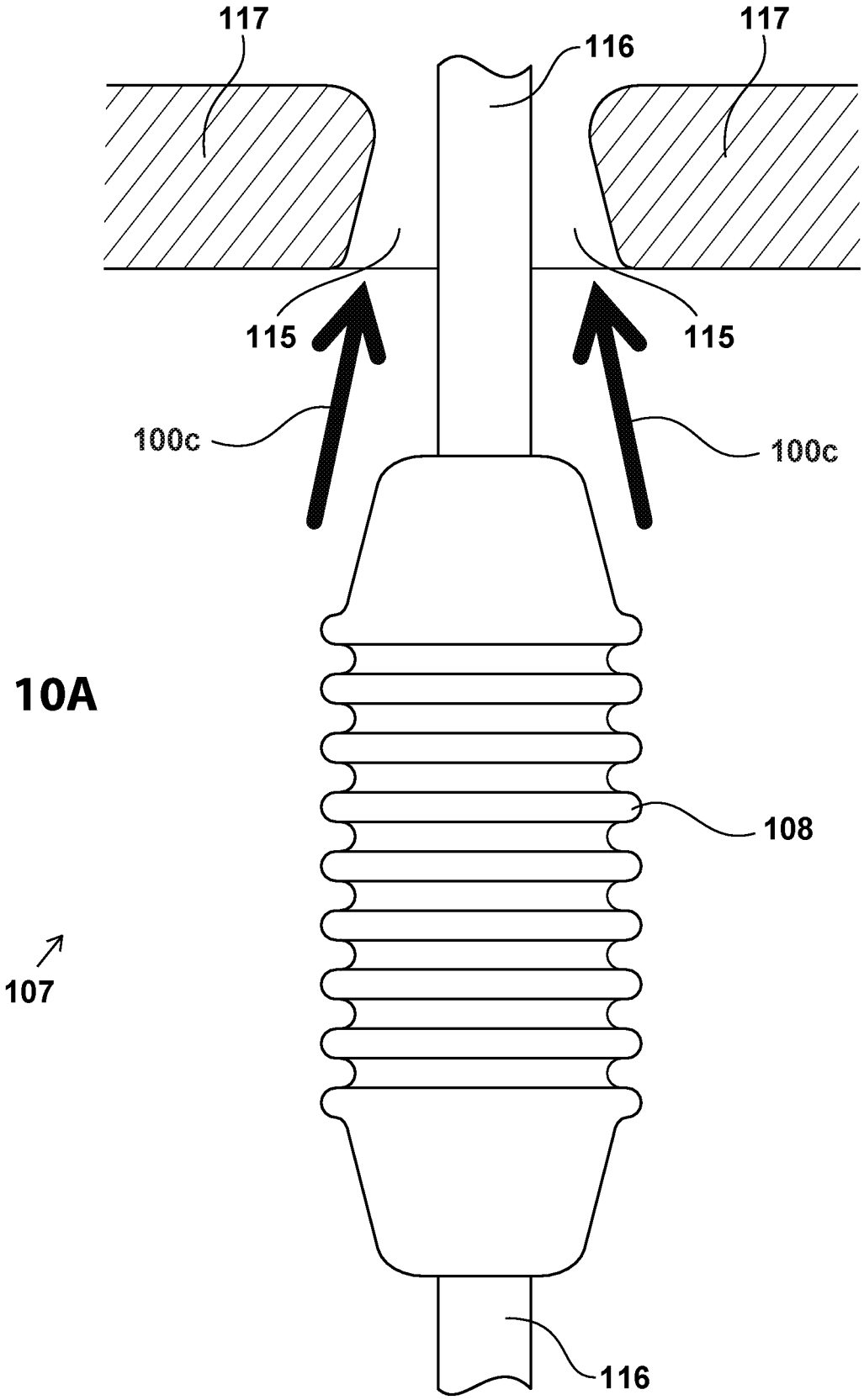
FIG. 10A, FIG. 10B, FIG. 10C, and FIG. 10D illustrate side and perspective views of the sealing function of the first and second rainwater-sealing corrosion-eliminating LED-light-turning-on-and-off pulley-plugs, respectively.
Figure 10B:
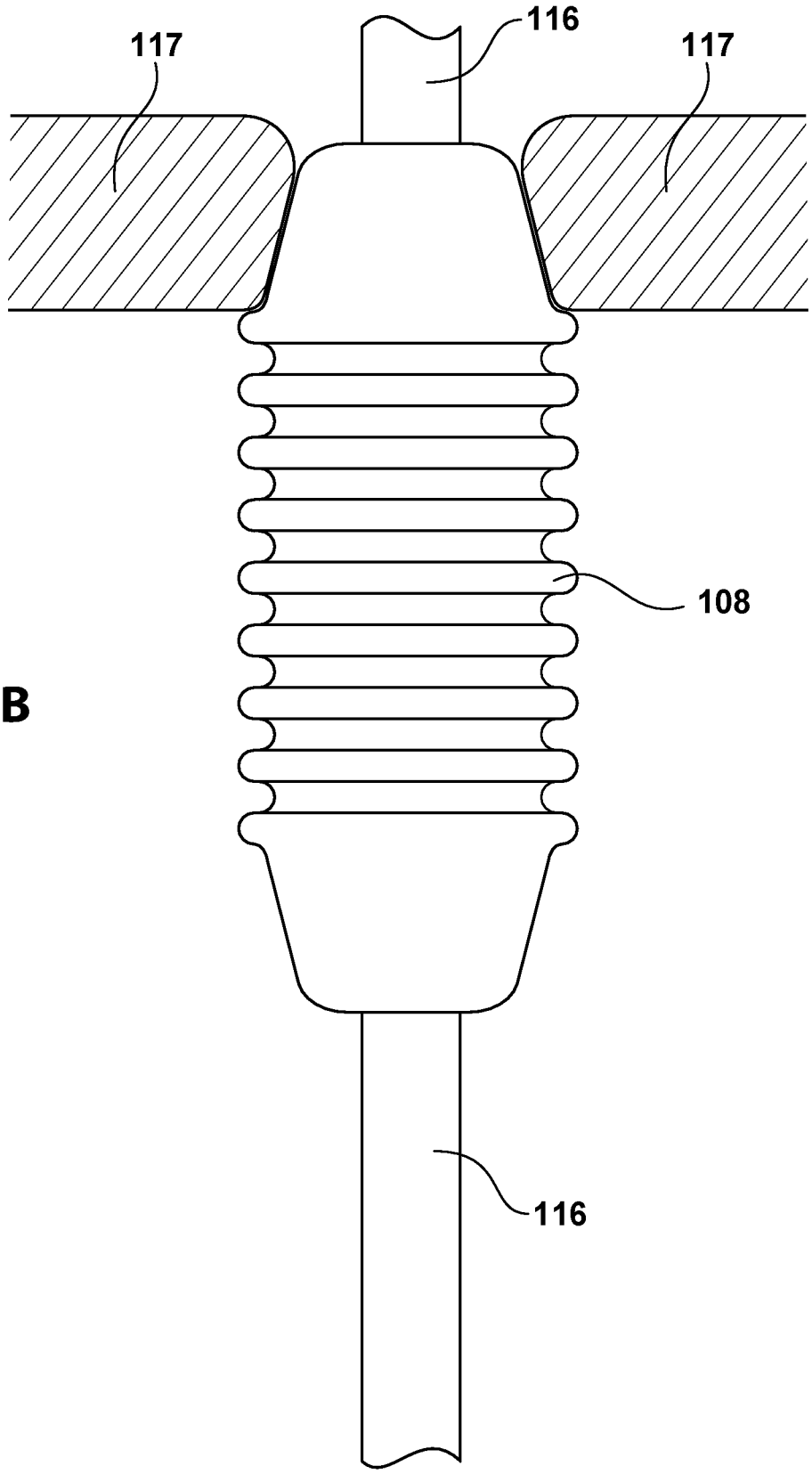
Figure 10C:
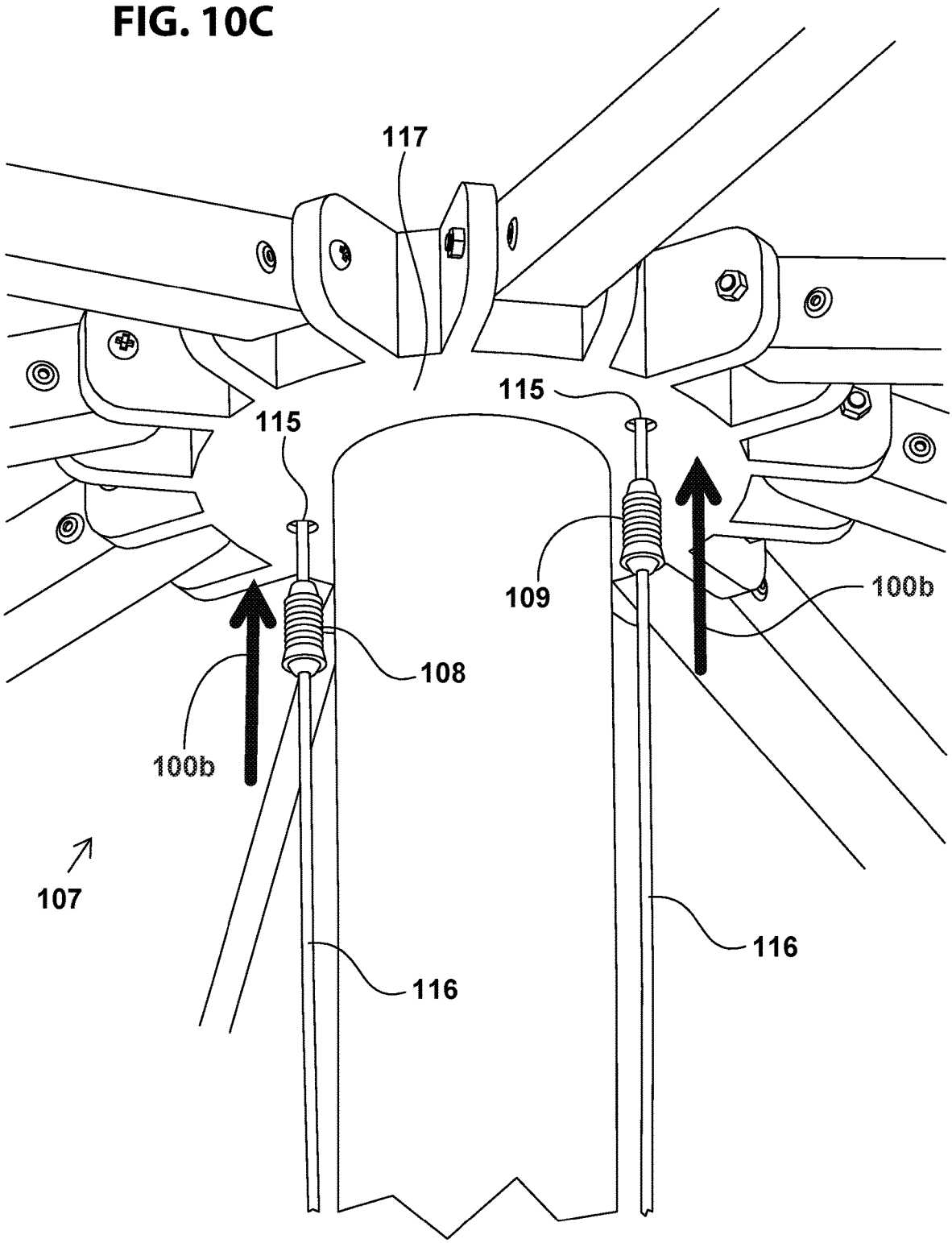
Figure 10D:
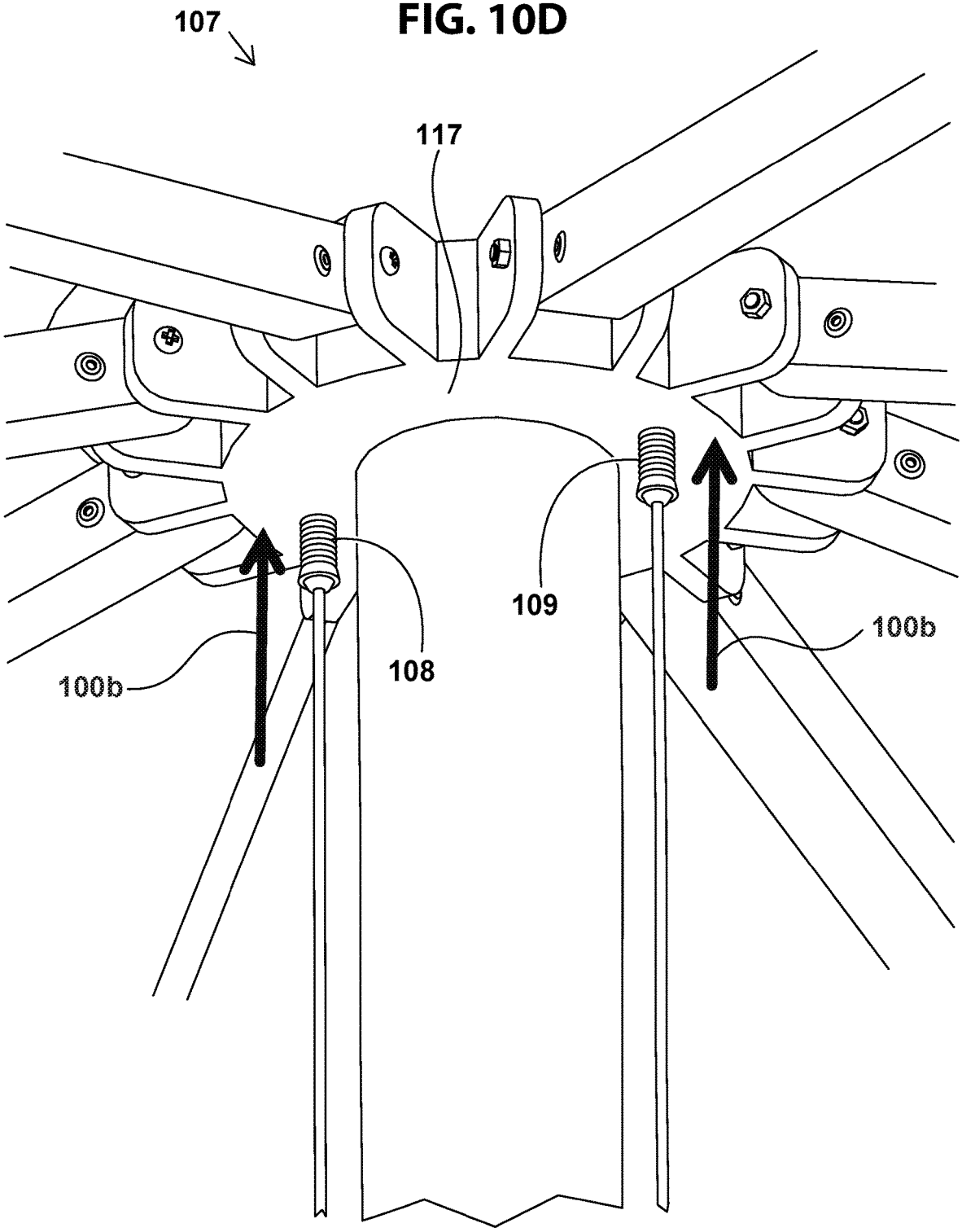
Figure 28A:
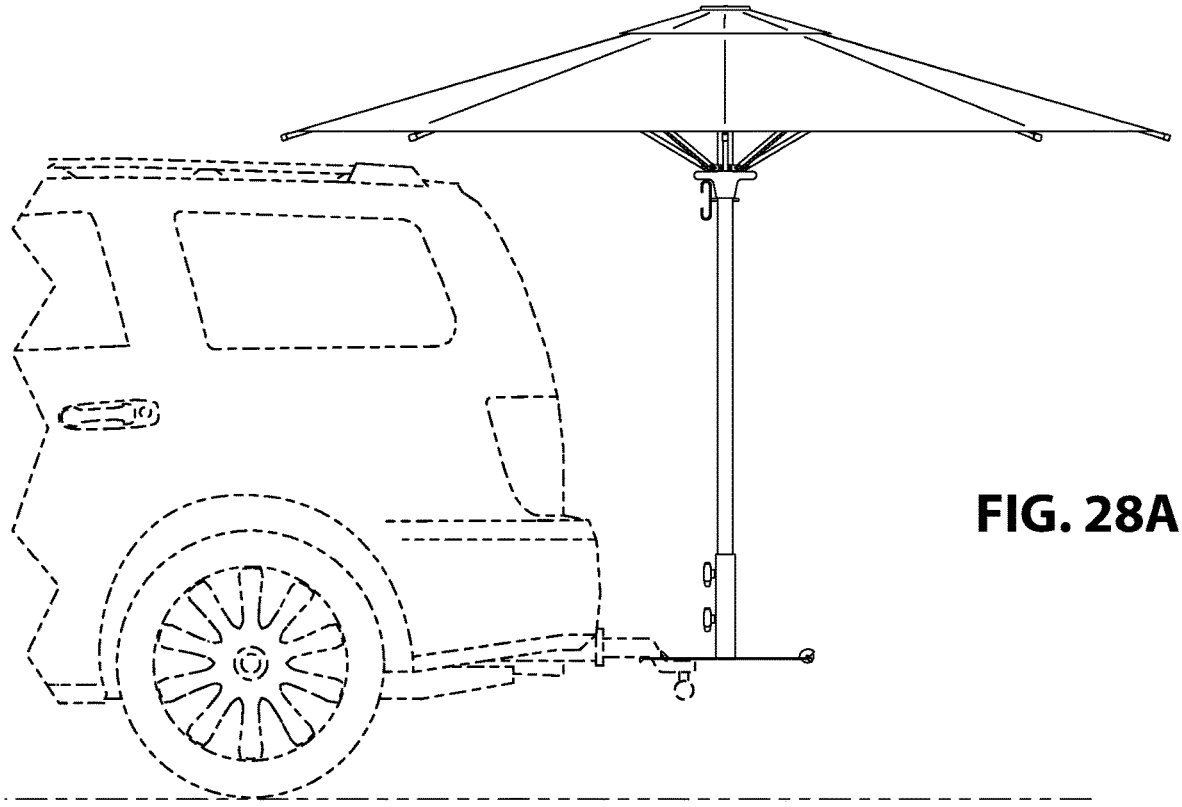
FIG. 28A illustrates a side view demonstrating how the portable tow-hitch-connectable pet-shade-and-chair-locking umbrella-base system can be attached to the tow hitch of a vehicle.
Figure 28B:
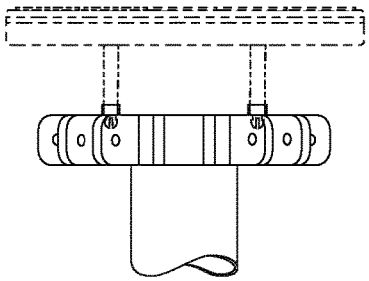
FIG. 28B illustrates a side view demonstrating how the cable-pulley-hiding pole-rust-eliminating counter-weight-rust-eliminating upper hub can be used to attach a solar panel thereon.
Figure 28C:
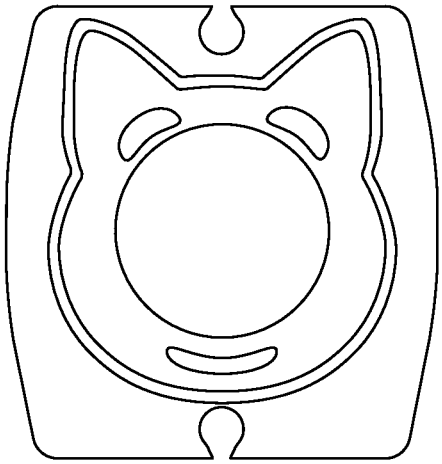
FIG. 28C, FIG. 28D, FIG. 28E, FIG. 28F, FIG. 28G, FIG. 28H, FIG. 28I, and FIG. 29 illustrate bottom views of equivalent variations of designs of the image-magnifying image-projecting lens.
Figure 28D:
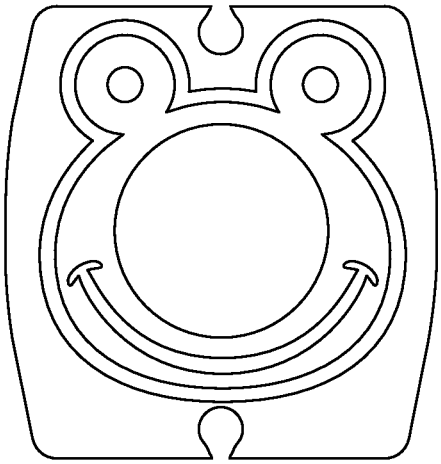
Figure 28E:
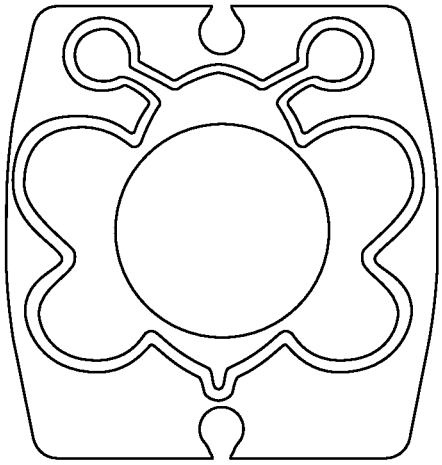
Figure 28F:
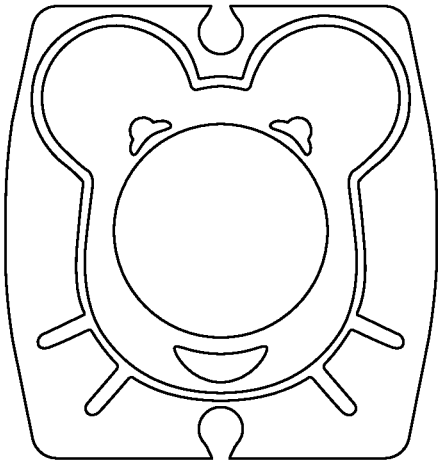
Figure 28G:
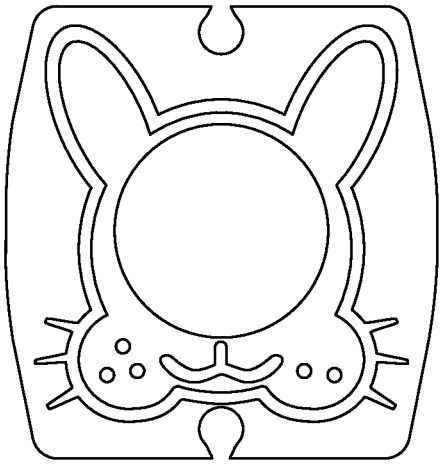
Figure 28H:
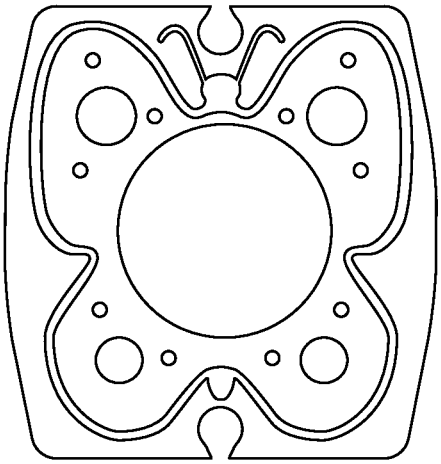
Figure 28I:
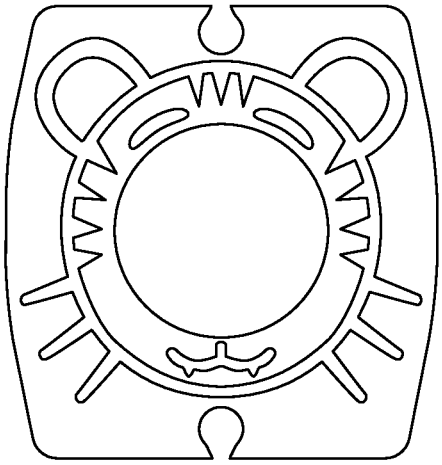
Figure 29:
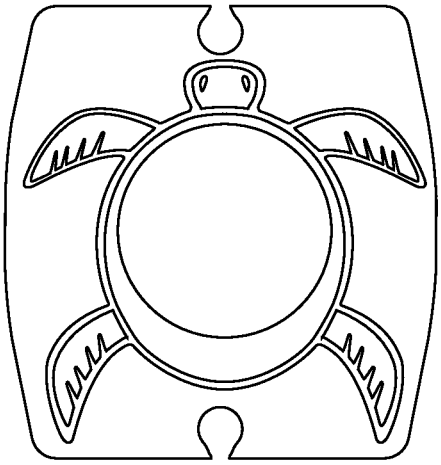

Therefore, the arthritic-aiding rainwater-sealing-to-protect-cable-pulley cable-pulley-hiding-hub LED-light-turning-on-and-off image-projecting counter-weight-decelerating umbrella:

a) Can house two rotatable pulleys 114;

b) Can prevent rainwater from entering in through the top of umbrella pole 106
in the directions of arrows 99*e*, 99*f*, 100*a*, 100*b*, and 100*c*, respectively
(see FIG. 1D (Prior Art), FIG. 1E, FIG. 1F (Prior Art), FIG. 1G, FIG. 1H, and FIG. 1I);

c) Can mount upper ribs 103*a*
(see FIG. 9 and FIG. 10C);

d) Can mount rib screws 104
(see FIG. 9);

e) Can insert first rainwater-sealing corrosion-eliminating LED-light-turning-on-and-off pulley-plug 108 and second rainwater-sealing corrosion-eliminating LED-light-turning-on-and-off pulley-plug 109 therein
(see, FIG. 1E, FIG. 1G, FIG. 1H, FIG. 1I, FIG. 1L, FIG. 1S, and FIG. 1T); and f) Can mount solar panels thereto
(see FIG. 28B).

8) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
arthritic-aiding arthritic-hand-accommodating lower hub 118.

Figure 3:
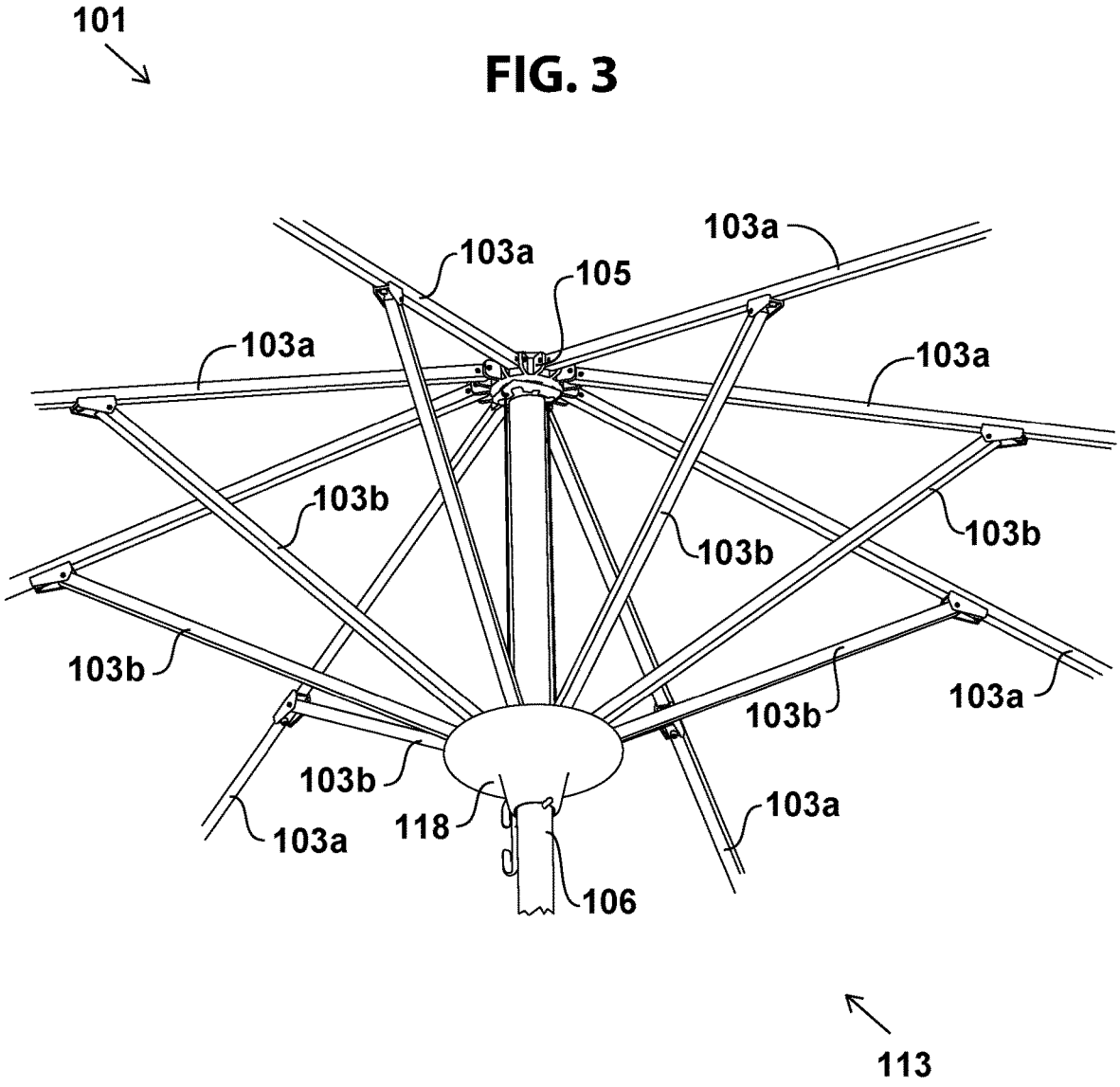
FIG. 3 illustrates a bottom perspective view of the rainwater-sealing-for-cable-pulley cable-pulley-hiding-hub canopy and pole system.
Figure 4:
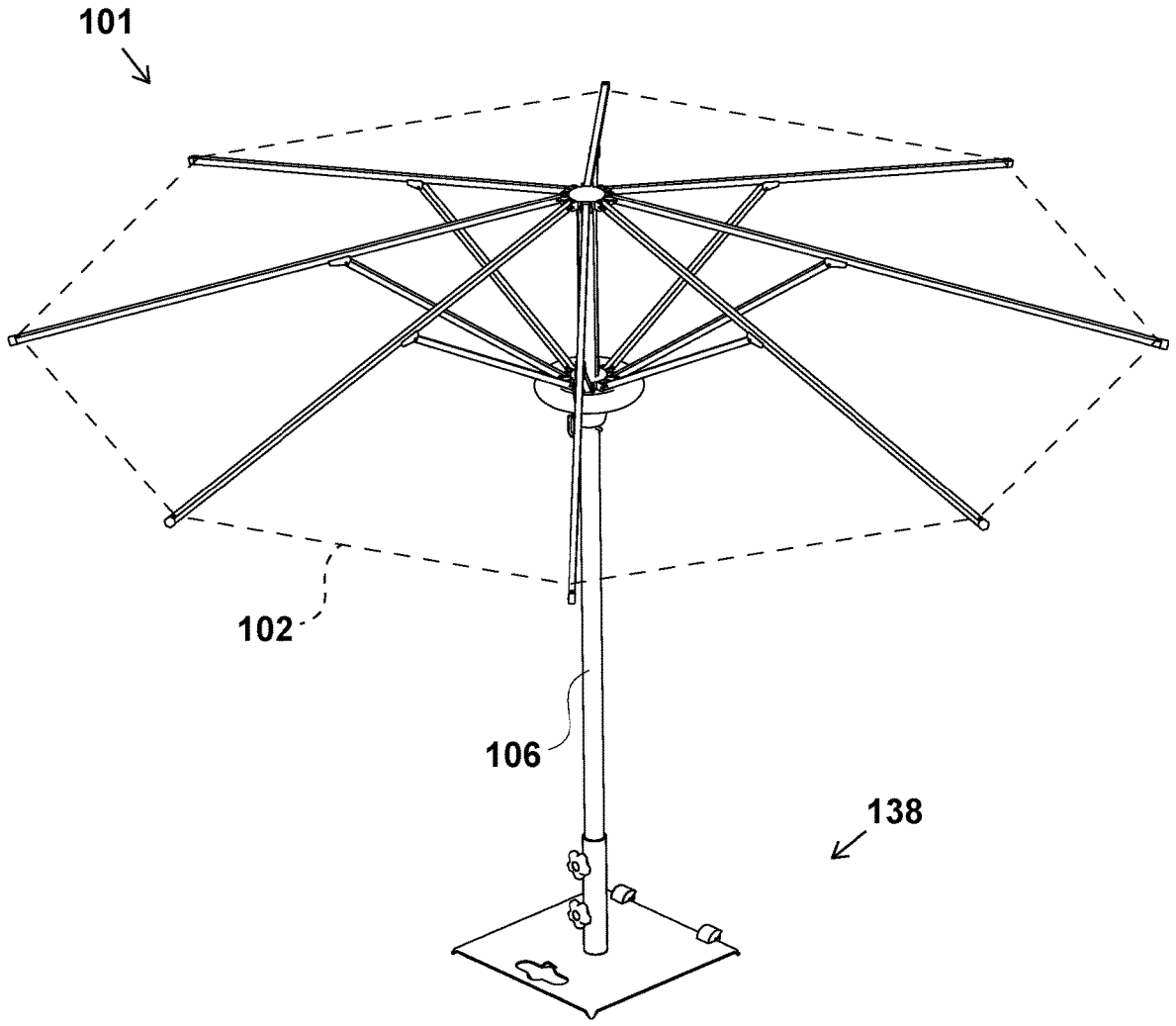
FIG. 4, FIG. 5, FIG. 6, FIG. 7, and FIG. 8 illustrate side, front, and perspective views of the arthritic-aiding rainwater-sealing-to-protect-cable-pulley cable-pulley-hiding-hub LED-light-turning-on-and-off image-projecting counter-weight-decelerating umbrella, respectively.
Figure 5:
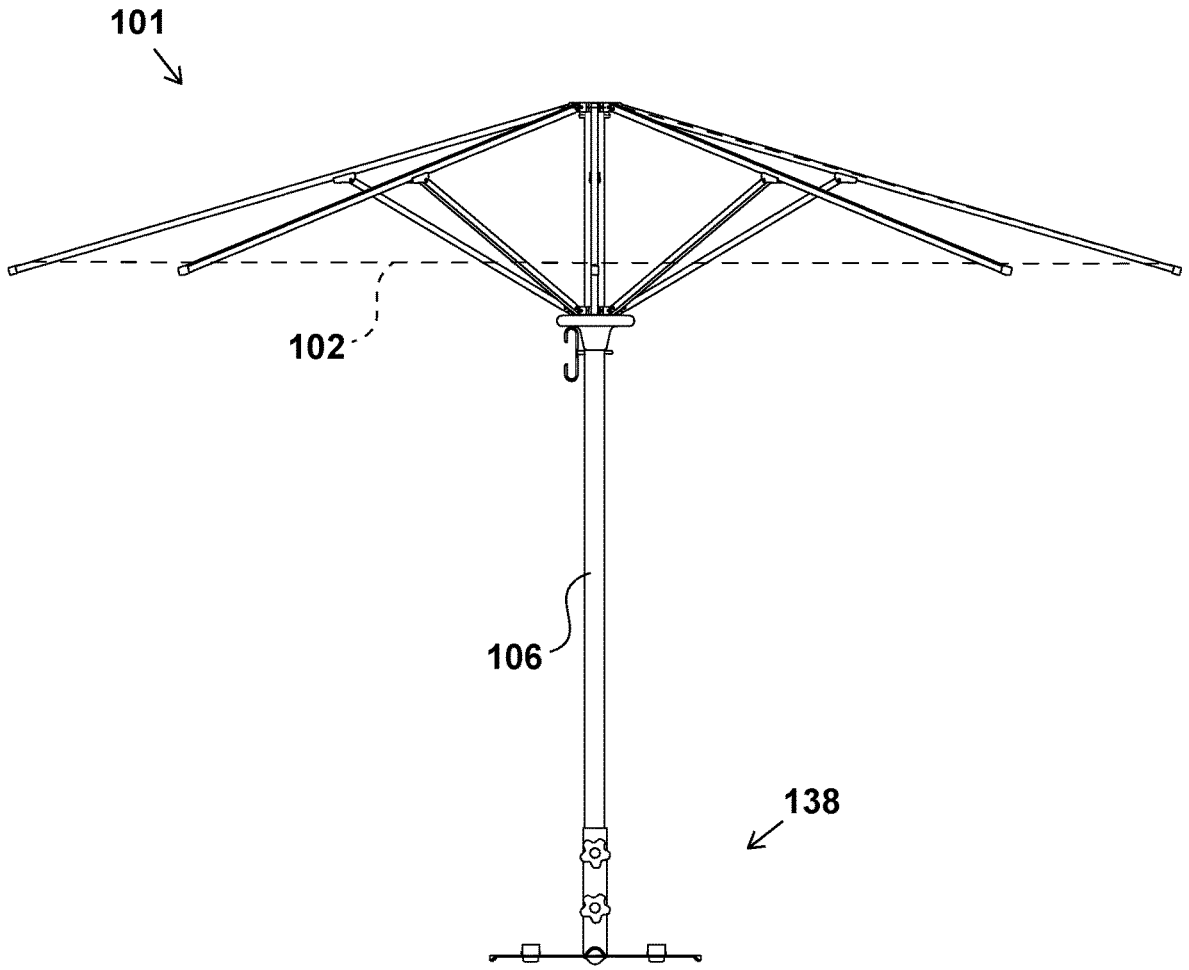
Figure 6:
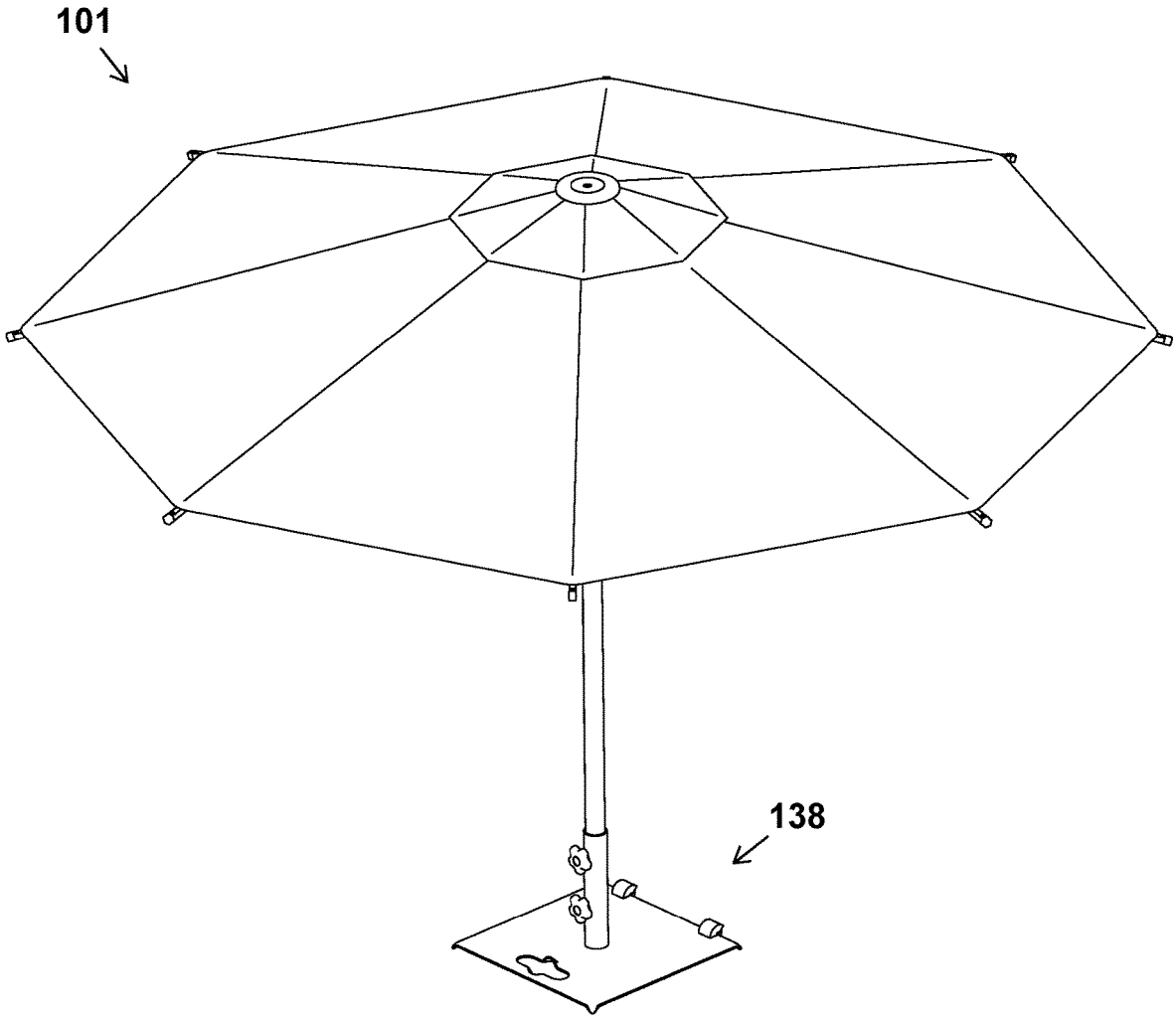
Figure 7:
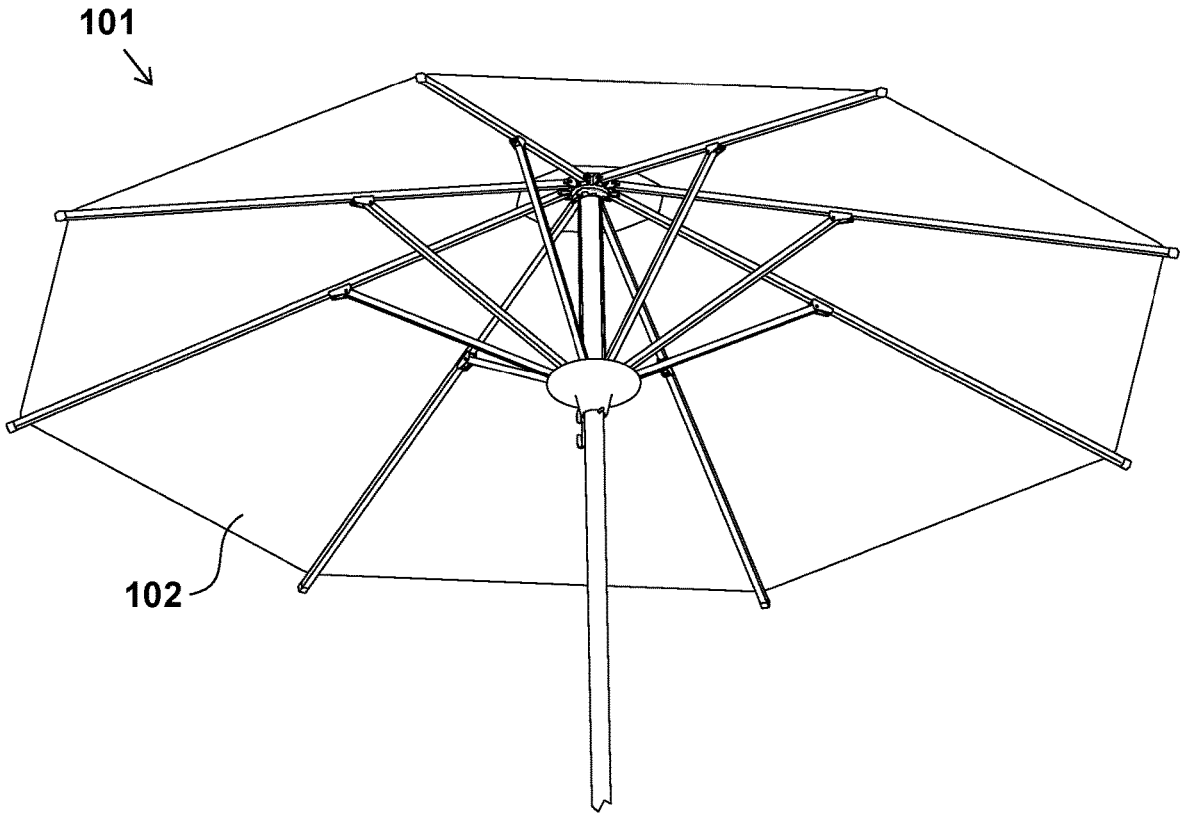
Figure 8:
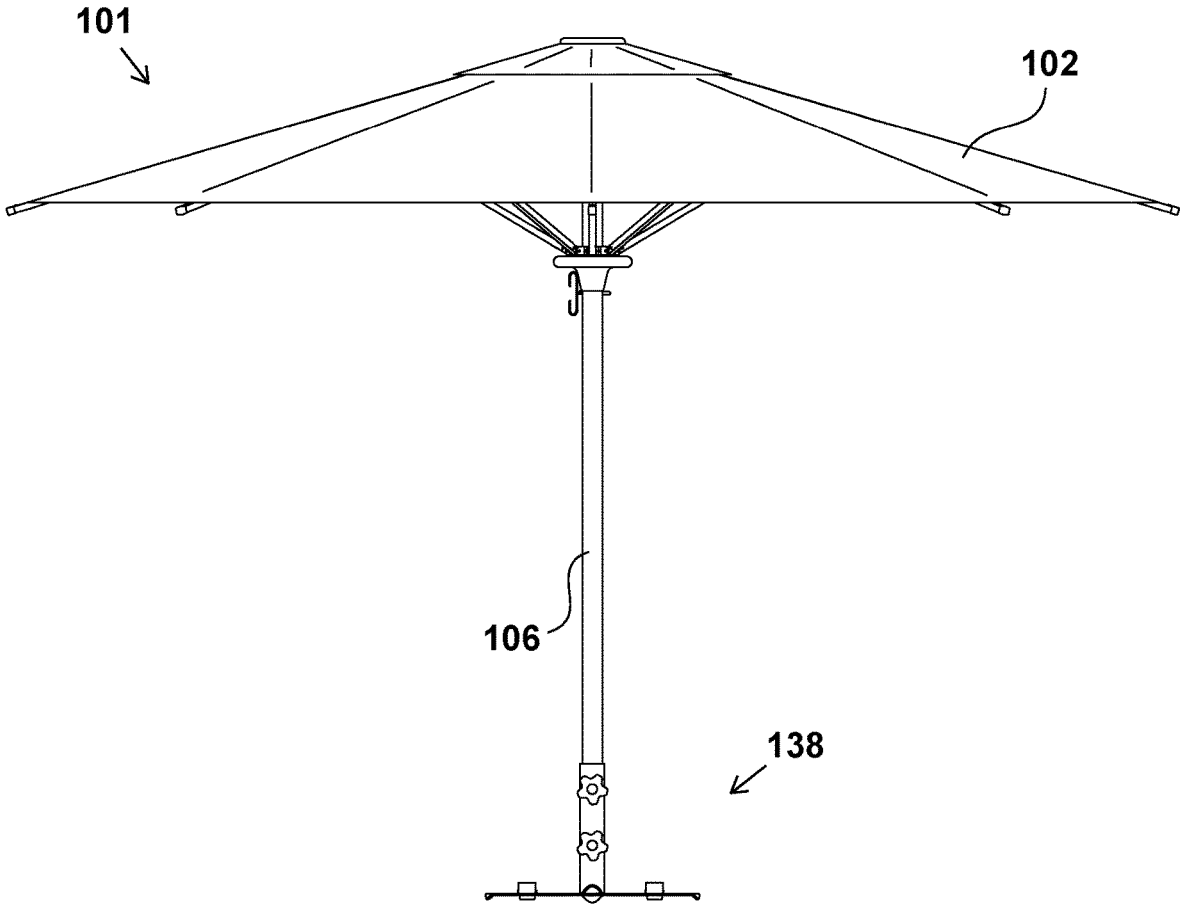
Figure 22E:
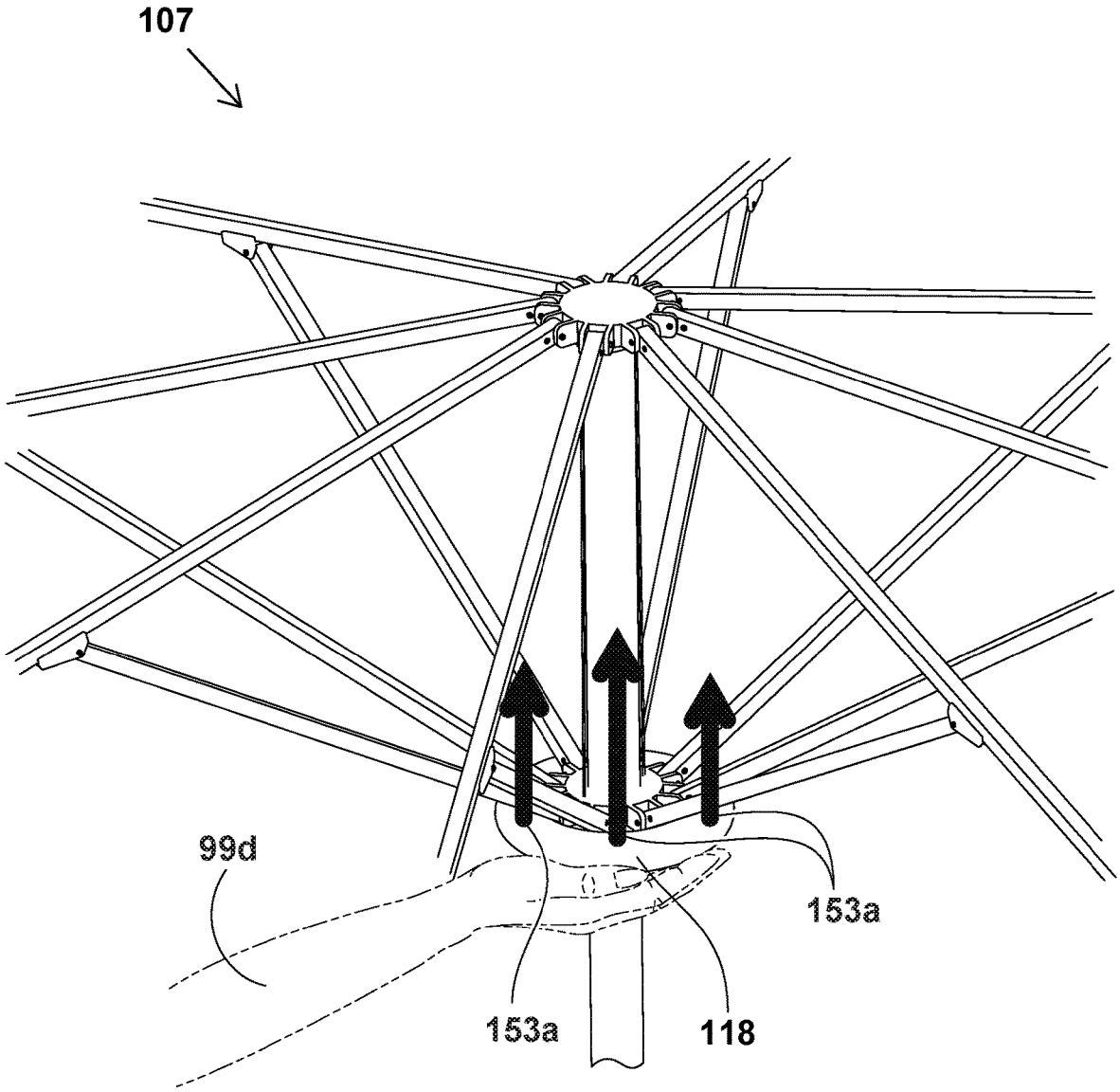
FIG. 22E and FIG. 22F illustrate perspective views demonstrating how the arthritic-aiding arthritic-hand-accommodating lower hub provides a large, smooth operating surface for an arthritic person's hand to push upward and downward, thus reducing pain and discomfort.
Figure 22F:
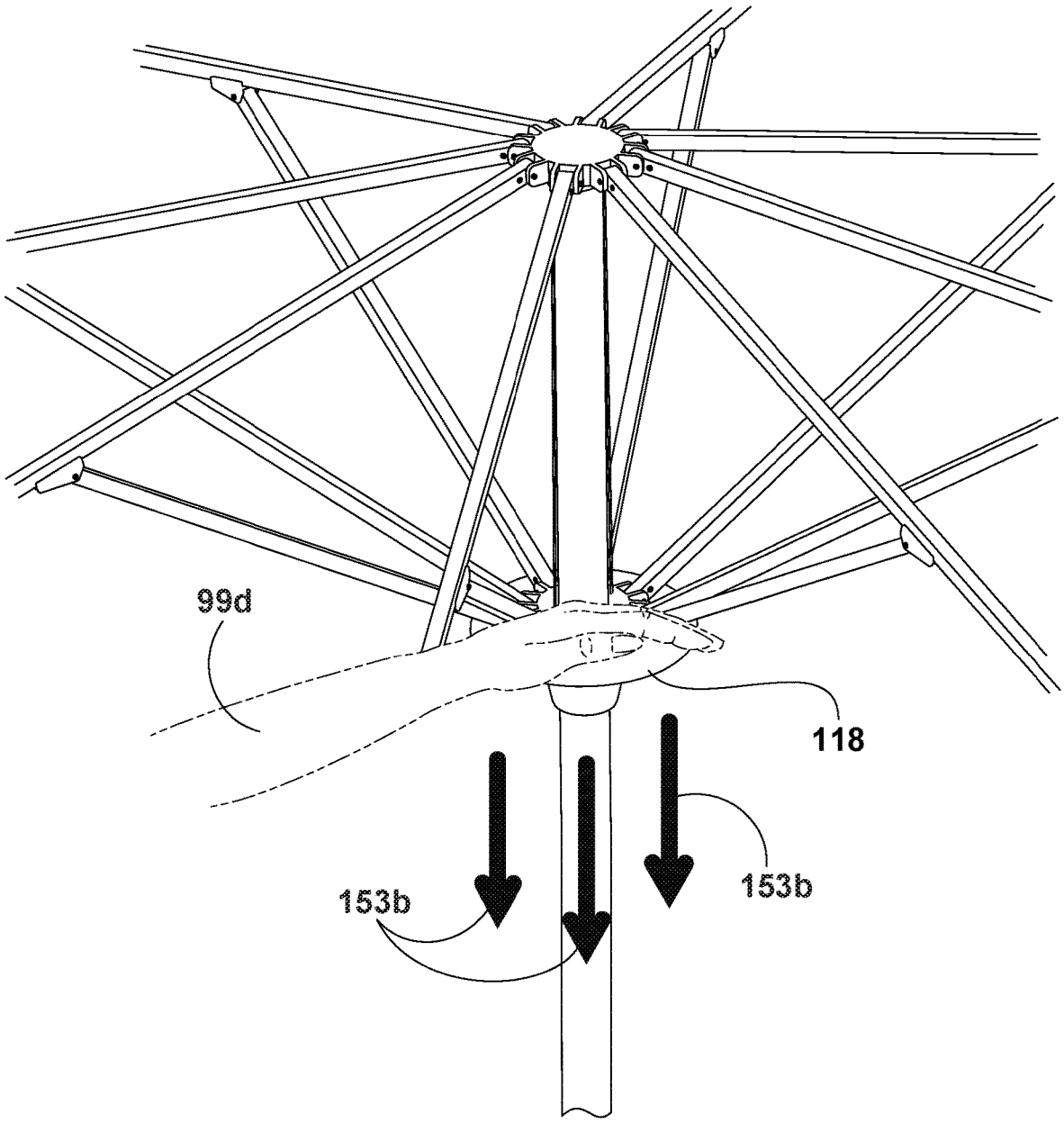

Therefore, the arthritic-aiding rainwater-sealing-to-protect-cable-pulley cable-pulley-hiding-hub LED-light-turning-on-and-off image-projecting counter-weight-decelerating umbrella:

a) Can provide an ergonomic arthritic-hand-accomodating surface
to eliminate pain for an arthritic person when operating arthritic-aiding arthritic-hand-accommodating lower hub 118,
as demonstrated by arthritic hand 99*d* in the directions of arrows 153*a* and 153*b*
(see FIG. 22E and FIG. 22F);

b) Can foldable rib joints 105 away from umbrella pole 106
to create larger angles between upper and lower ribs 103*a* and 103*b* which in turn will require less force and effort to move deceleration-capable hand-pain-eliminating counter-weight 120
as demonstrated by 100*d* and 100*e*
(see FIG. 1J (Prior Art) and FIG. 1K); and c) Can attach lower ribs 103*b* thereto
(see FIG. 3).

9) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
deceleration-capable hand-pain-eliminating counter-weight 120.

Therefore, the arthritic-aiding rainwater-sealing-to-protect-cable-pulley cable-pulley-hiding-hub LED-light-turning-on-and-off image-projecting counter-weight-decelerating umbrella:

a) Can help an arthritic with deploying or collapsing arthritic-aiding rainwater-sealing-for-cable-pulley cable-pulley-hiding-hub LED-light-turning-on-and-off image-projecting and weight-assisted umbrella, especially to help arthritic, small, or elderly persons who might have difficulty operating prior art umbrella systems
in the directions of arrows 151*a*, 151*b*, 151*c*, 152*a*, 152*b*, and 152*c*
(see FIG. 22A, FIG. 22B, FIG. 22C, and FIG. 22D); and b) Can require less effort during retraction and deployment of arthritic-aiding rainwater-sealing-to-protect-cable-pulley cable-pulley-hiding-hub LED-light-turning-on-and-off image-projecting counter-weight-decelerating umbrella
in the directions of arrows 145*a*, 145*b*, 145*c*, 145*d*, 145*e*, 145*f*, 145*g*, and 145*h*
(see FIG. 17A and FIG. 17B).

10) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
spiral flutes 123.
Therefore, the arthritic-aiding rainwater-sealing-to-protect-cable-pulley cable-pulley-hiding-hub LED-light-turning-on-and-off image-projecting counter-weight-decelerating umbrella:
Can allow air to flow over said deceleration-capable hand-pain-eliminating counter-weight 120 as said deceleration-capable hand-pain-eliminating counter-weight 120 ascends or descends within said umbrella pole 106
(see FIG. 22A and FIG. 22B).

11) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
locking pin 129.
Therefore, the arthritic-aiding rainwater-sealing-to-protect-cable-pulley cable-pulley-hiding-hub LED-light-turning-on-and-off image-projecting counter-weight-decelerating umbrella:

a) Can guide locking pin 129 and help the hand 99*d* of an arthritic to operate its locking pin
in the directions of arrows 99*a*, 99*b*, and 99*c*
(see FIG. 1A (Prior Art), FIG. 1B, and FIG. 1C);

b) Can lock arthritic-aiding arthritic-hand-accommodating lower hub 118 at one of three desired elevations of umbrella-pole pin openings 126, respectively, when being inserted into one of pin-centering pin-guiding tubes 132
in the directions of arrows 154, 155, and 156
(see FIG. 23A, FIG. 23B, FIG. 24A, FIG. 24B, and FIG. 24C);

c) Can push two of auditorily-snap-locking leaf springs 133 outward until two of auditorily-snap-locking nipples 134 auditorily snap-lock into auditorily-snap-locking recess 130
in the directions of arrows 157*a*, 157*b*, 157*c*, and 157*d*
(see FIG. 24A, FIG. 24B, and FIG. 24C);

d) Can generate snap-locking sounds 157*e* and 157*e* (see FIG. 24C); and e) Can lock locking pin 129 into one of pin-centering pin-guiding tubes 132
(see FIG. 13, FIG. 23A, FIG. 23B, FIG. 24C, and FIG. 25).

Figure 27A:
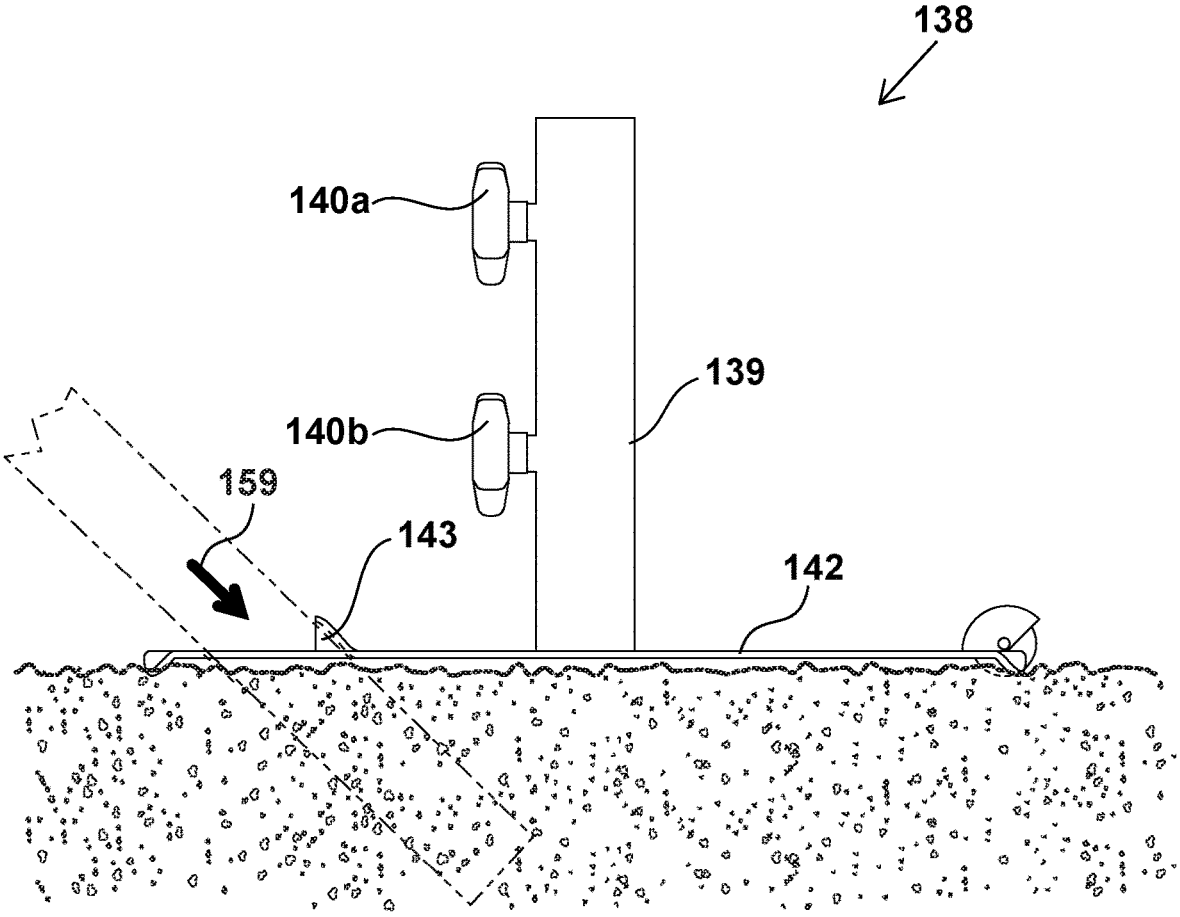
FIG. 27A, FIG. 27B, and FIG. 27C illustrate side views demonstrating how the portable tow-hitch-connectable pet-shade-and-chair-locking umbrella-base system can be used to insert an auxiliary pet shade/umbrella, or a chair leg through tow-hitch-connectable pet-shade-and-chair-locking receptacle, in sand or on a deck.
Figure 27B:
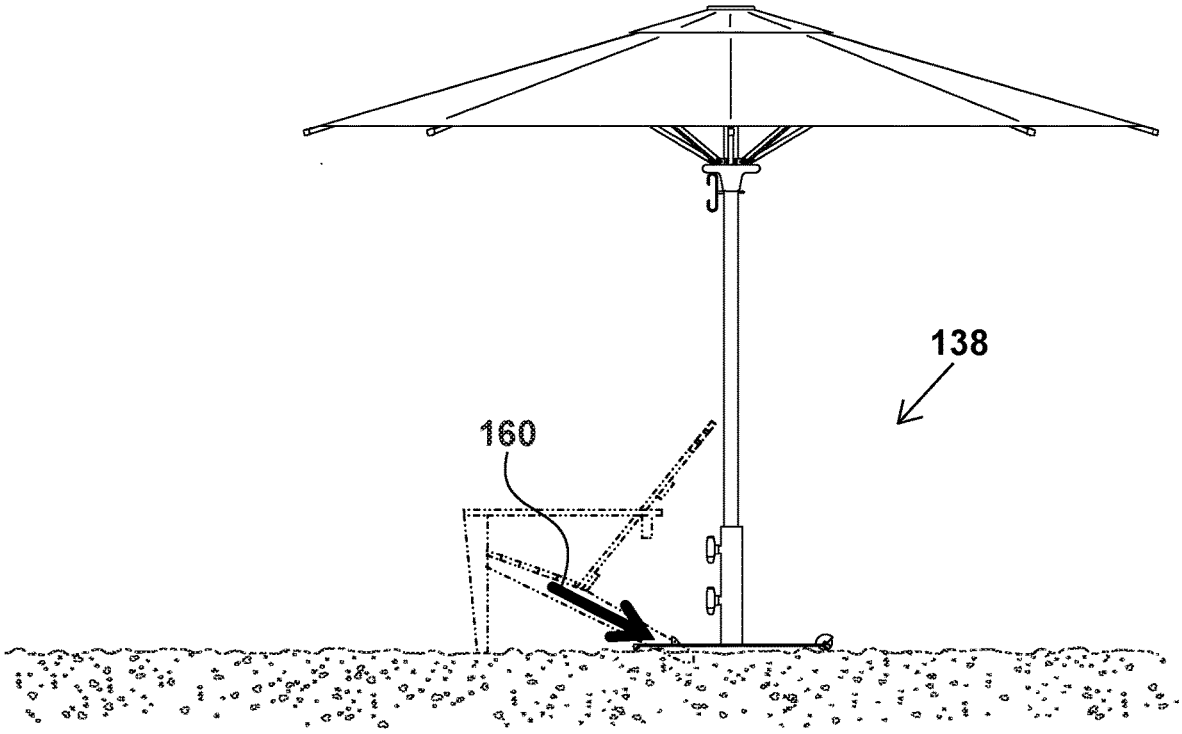
Figure 27C:
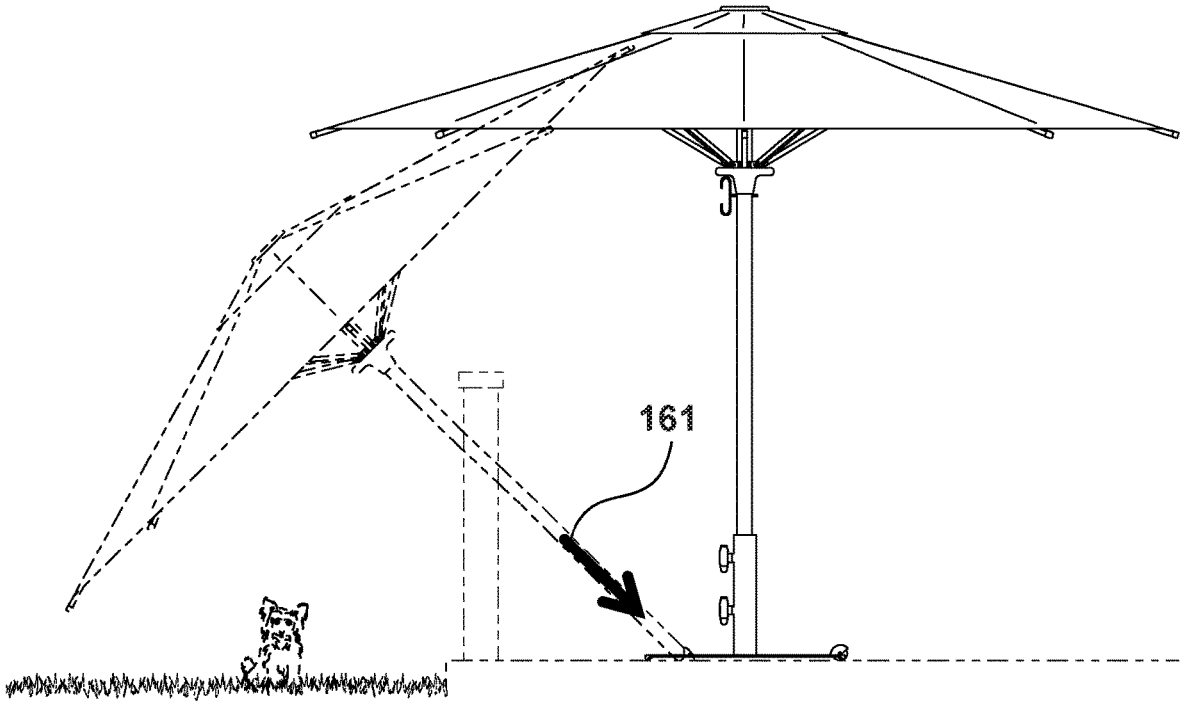

12) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
tow-hitch-connectable pet-shade-and-chair-locking receptacle 143.
Therefore, the arthritic-aiding rainwater-sealing-to-protect-cable-pulley cable-pulley-hiding-hub LED-light-turning-on-and-off image-projecting counter-weight-decelerating umbrella:

a) Can attach to a tow-hitch of a vehicle to provide shade to said vehicle
(see FIG. 28A);

b) Can attach an auxiliary umbrella post therein, in the directions of arrows 159, 160, and 161
(see FIG. 27A, FIG. 27B, and FIG. 27C); and c) Can secure a leg of a chair therein in the directions of arrows 159, 160, and 161
(see FIG. 27A, FIG. 27B, and FIG. 27C).

13) It is yet still an even further object of the new invention to provide (a or an) arthritic-aiding rainwater-sealing-to-protect-cable-pulley cable-pulley-hiding-hub LED-light-turning-on-and-off image-projecting counter-weight-decelerating umbrella, having
foldable rib joints 105.
Therefore, the arthritic-aiding rainwater-sealing-to-protect-cable-pulley cable-pulley-hiding-hub LED-light-turning-on-and-off image-projecting counter-weight-decelerating umbrella:

a) Can create larger angles 100*e* between upper and lower canopy ribs which in turn requires less force/effort to move the counter weight of the umbrella than smaller angles 100*d*
(see FIG. 1J (Prior Art), and FIG. 1K); and b) Can pivotably secure upper ribs 103*a* to lower ribs 103*b* to allow upper ribs 103*a* and lower ribs 103*b* to fold and to deploy.

What is claimed is:

1. An arthritic-aiding rainwater-sealing-to-protect-cable-pulley cable-pulley-hiding-hub LED-light-turning-on-and-off image-projecting counter-weight-decelerating umbrella comprising:
a canopy;
a plurality of upper and lower ribs;
a plurality of rib screws;
a plurality of foldable rib joints;
an umbrella pole
having
an umbrella-pole service life, a pole top, a pole inside, and two opposite pole walls;
a first rainwater-sealing corrosion-eliminating LED-light-turning-on-and-off pulley-plug;
a second rainwater-sealing corrosion-eliminating LED-light-turning-on-and-off pulley-plug;
an interchangeable multi-angle LED-light-magnifying image projector
having
two opposite projector sides;
an image-projector LED-light opening;
a plurality of projector docks;
an image-magnifying image-projecting lens;
two rotatable pulleys;

two upside-down rainwater-blocking cable-pulley holes;
an arthritic-aiding counter-weight-decelerating image-projector-locking elastic cable
having
an elastic-cable service life;
a cable-pulley-hiding pole-rust-eliminating counter-weight-rust-eliminating upper hub
having
an upper-hub service life, an upper-hub inside, and an upper-hub undersurface;
an arthritic-aiding arthritic-hand-accommodating lower hub;
a deceleration-capable hand-pain-eliminating counter-weight
having
a counter-weight service life, and a counter-weight end;
an aerodynamic propeller-shaped head blade;
a blade hole;
a plurality of umbrella-pole pin openings;
an arthritic-aiding cable-hook grip ring;
an anti-finger-pinching spacer;
a locking pin;
an umbrella-pole vertical support tube;
two umbrella-pole-locking knobs;
two threaded knob holes;
an umbrella base;
a tow-hitch-connectable pet-shade-and-chair-locking receptacle; and
two umbrella base wheels,
wherein:
said canopy
is screwed on said upper ribs,
said upper and lower ribs
are respectively foldably screwed together to said cable-pulley-hiding pole-rust-eliminating counter-weight-rust-eliminating upper hub, and to said foldable rib joints,
said rib screws
are respectively screwed to said upper and lower ribs, and screwed to said cable-pulley-hiding pole-rust-eliminating counter-weight-rust-eliminating upper hub, and said arthritic-aiding arthritic-hand-accommodating lower hub,
said foldable rib joints
are respectively molded to said arthritic-aiding arthritic-hand-accommodating lower hub,
said umbrella pole
is attached to said cable-pulley-hiding pole-rust-eliminating counter-weight-rust-eliminating upper hub,
said first rainwater-sealing corrosion-eliminating LED-light-turning-on-and-off pulley-plug is attached to said arthritic-aiding counter-weight-decelerating image-projector-locking elastic cable
for sealing out rainwater from penetrating said pole inside of said umbrella pole,
for protecting said cable-pulley-hiding pole-rust-eliminating counter-weight-rust-eliminating upper hub, said umbrella pole, said arthritic-aiding counter-weight-decelerating image-projector-locking elastic cable, and said deceleration-capable hand-pain-eliminating counter-weight from internal corrosion,
for increasing
said upper-hub service life of said cable-pulley-hiding pole-rust-eliminating counter-weight-rust-eliminating upper hub, and said umbrella-pole service life of said umbrella pole, and
said elastic-cable service life of said arthritic-aiding counter-weight-decelerating image-projector-locking elastic cable, and said counter-weight service life of said deceleration-capable hand-pain-eliminating counter-weight,
for inserting into one of said upside-down rainwater-blocking cable-pulley holes, respectively,
for sealing one of said upside-down rainwater-blocking cable-pulley holes, respectively, and
for frictionally activating and deactivating an LED-light-on-off switch,
said second rainwater-sealing corrosion-eliminating LED-light-turning-on-and-off pulley-plug
is attached to said arthritic-aiding counter-weight-decelerating image-projector-locking elastic cable
for sealing out rainwater from penetrating said pole inside of said umbrella pole,
for protecting said cable-pulley-hiding pole-rust-eliminating counter-weight-rust-eliminating upper hub, said umbrella pole, said arthritic-aiding counter-weight-decelerating image-projector-locking elastic cable, and said deceleration-capable hand-pain-eliminating counter-weight from internal corrosion,
for increasing
said upper-hub service life of said cable-pulley-hiding pole-rust-eliminating counter-weight-rust-eliminating upper hub, and said umbrella-pole service life of said umbrella pole, and
said elastic-cable service life of said arthritic-aiding counter-weight-decelerating image-projector-locking elastic cable, and said counter-weight service life of said deceleration-capable hand-pain-eliminating counter-weight,
for inserting into one of said upside-down rainwater-blocking cable-pulley holes, respectively,
for sealing one of said upside-down rainwater-blocking cable-pulley holes, respectively, and
for frictionally activating and deactivating an LED-light-on-off switch,
said interchangeable multi-angle LED-light-magnifying image projector
is removably and repositionably snapped into said LED light
for decreasing and enlarging a projected image on a table, a patio, a deck, or a floor,
for projecting an image at a plurality of angles,
for displaying a projected image in a plurality of color variations, and
for interchanging a plurality of images,
said image-projector LED-light opening
is molded to said interchangeable multi-angle LED-light-magnifying image projector,
said projector docks
are respectively molded to said interchangeable multi-angle LED-light-magnifying image projector
for repositionably clamping on said arthritic-aiding counter-weight-decelerating image-projector-locking elastic cable
to enlarge and decrease a projected image,
said image-magnifying image-projecting lens
is releasably and slidably clamped to said arthritic-aiding counter-weight-decelerating image-projector-locking elastic cable
for projecting an image on a floor surface, a patio, a deck, or a floor, for decreasing and enlarging a projected image on a table, a patio, a deck, or a floor, for displaying a projected image in a plurality of color variations, and for interchanging a plurality of images, said two rotatable pulleys are respectively hidden within said upper-hub inside of said cable-pulley-hiding pole-rust-eliminating counter-weight-rust-eliminating upper hub, and rotatably riveted to said cable-pulley-hiding pole-rust-eliminating counter-weight-rust-eliminating upper hub, said upside-down rainwater-blocking cable-pulley holes are respectively drilled into said upper-hub undersurface of said cable-pulley-hiding pole-rust-eliminating counter-weight-rust-eliminating upper hub for preventing rainwater from penetrating said upper-hub inside of said cable-pulley-hiding pole-rust-eliminating counter-weight-rust-eliminating upper hub, or said umbrella pole, for protecting said cable-pulley-hiding pole-rust-eliminating counter-weight-rust-eliminating upper hub, said umbrella pole, said arthritic-aiding counter-weight-decelerating image-projector-locking elastic cable, and said deceleration-capable hand-pain-eliminating counter-weight from internal corrosion, for increasing said upper-hub service life of said cable-pulley-hiding pole-rust-eliminating counter-weight-rust-eliminating upper hub, and said umbrella-pole service life of said umbrella pole, and said elastic-cable service life of said arthritic-aiding counter-weight-decelerating image-projector-locking elastic cable, and said counter-weight service life of said deceleration-capable hand-pain-eliminating counter-weight, and for inserting said arthritic-aiding counter-weight-decelerating image-projector-locking elastic cable therethrough, said arthritic-aiding counter-weight-decelerating image-projector-locking elastic cable is attached to said arthritic-aiding arthritic-hand-accommodating lower hub, is threaded over one of said two rotatable pulleys, is threaded into said pole top of said umbrella pole, and into said pole inside of said umbrella pole, is threaded through blade hole, is threaded over another one of said two rotatable pulleys, is threaded out of said pole top, and out of said pole inside of said umbrella pole, and is attached to said arthritic-aiding arthritic-hand-accommodating lower hub, said arthritic-aiding counter-weight-decelerating image-projector-locking elastic cable for decelerating said deceleration-capable hand-pain-eliminating counter-weight, for cushioning tension, vibration, and impact from operating said arthritic-aiding rainwater-sealing-to-protect-cable-pulley cable-pulley-hiding-hub LED-light-turning-on-and-off image-projecting counter-weight-decelerating umbrella to eliminate pain and discomfort experienced by an arthritic, and to assist in folding or deploying said canopy, for hoisting or lowering said deceleration-capable hand-pain-eliminating counter-weight to assist in operating said arthritic-aiding rainwater-sealing-to-protect-cable-pulley cable-pulley-hiding-hub LED-light-turning-on-and-off image-projecting counter-weight-decelerating umbrella, and for releasably and slidably locking said image-magnifying image-projecting lens thereto, said cable-pulley-hiding pole-rust-eliminating counter-weight-rust-eliminating upper hub is attached to said pole top of said umbrella pole, for housing said two rotatable pulleys, for preventing rainwater from entering into said pole top of said umbrella pole, or into said pole inside of said umbrella pole to prevent rust, for mounting said upper ribs, for mounting said rib screws, for inserting said first rainwater-sealing corrosion-eliminating LED-light-turning-on-and-off pulley-plug, and second rainwater-sealing corrosion-eliminating LED-light-turning-on-and-off pulley-plug therein, and for mounting solar panels thereto, said arthritic-aiding arthritic-hand-accommodating lower hub is slidably attached to said umbrella pole for providing an ergonomic arthritic-hand-accommodating surface to eliminate pain for an arthritic person when operating said arthritic-aiding arthritic-hand-accommodating lower hub, for pushing said foldable rib joints away from said umbrella pole to create a plurality of larger angles between said upper and lower ribs which in turn will require less force and effort to retract and deploy said canopy, and for attaching said lower ribs thereto, said deceleration-capable hand-pain-eliminating counter-weight is slid into said pole inside of said umbrella pole, for helping and arthritic with deploying or collapsing said arthritic-aiding rainwater-sealing-to-protect-cable-pulley cable-pulley-hiding-hub LED-light-turning-on-and-off image-projecting counter-weight-decelerating umbrella, and for requiring less effort during retraction and deployment of said arthritic-aiding rainwater-sealing-to-protect-cable-pulley cable-pulley-hiding-hub LED-light-turning-on-and-off image-projecting counter-weight-decelerating umbrella, said aerodynamic propeller-shaped head blade is molded to one of said counter-weight end of said deceleration-capable hand-pain-eliminating counter-weight, said blade hole is drilled out of said aerodynamic propeller-shaped head blade, said umbrella-pole pin openings are respectively drilled through said two opposite pole walls of said umbrella pole, said arthritic-aiding cord-hook grip ring is attached to said locking pin, said anti-finger-pinching spacer is screwed on said locking pin, said locking pin is molded to said anti-finger-pinching spacer, said umbrella-pole vertical support tube is welded to said umbrella base, said umbrella-pole-locking knobs are respectively screwed through said threaded knob holes, said threaded knob holes
are respectively drilled and threaded into said umbrella-pole vertical support tube,
said umbrella base
is welded to said umbrella-pole vertical support tube,
said tow-hitch-connectable pet-shade-and-chair-locking receptacle
is formed into said umbrella base,
for attaching to a tow-hitch of a vehicle to provide shade to said vehicle,
for attaching an auxiliary umbrella post therein, and
for securing a leg of a chair therein, and
said umbrella base wheels
are respectively welded to said umbrella base.

2. The arthritic-aiding rainwater-sealing-to-protect-cable-pulley cable-pulley-hiding-hub LED-light-turning-on-and-off image-projecting counter-weight-decelerating umbrella of claim 1, further comprising
a plurality of spiral flutes
molded to said deceleration-capable hand-pain-eliminating counter-weight
wherein
said spiral flutes
are respectively for
allowing air to flow over said deceleration-capable hand-pain-eliminating counter-weight as said deceleration-capable hand-pain-eliminating counter-weight ascends or descends within said umbrella pole.

3. The arthritic-aiding rainwater-sealing-to-protect-cable-pulley cable-pulley-hiding-hub LED-light-turning-on-and-off image-projecting counter-weight-decelerating umbrella of claim 1, further comprising:
an auditorily-snap-locking recess
molded in said locking pin,
a plurality of pin-centering pin-guiding plugs
respectively molded to each other, and respectively inserted into said umbrella pole,
a plurality of pin-centering pin-guiding tubes
having
opposite tube walls,
said pin-centering pin-guiding tubes
respectively molded in said pin-centering pin-guiding plugs, and are respectively aligned with said umbrella-pole pin openings
for accurately and conveniently guiding said locking pin from one of said umbrella-pole pin openings to another one of said umbrella-pole pin openings,
said pin-centering pin-guiding plugs
for centering and aligning said pin-centering pin-guiding tubes with said umbrella-pole pin openings within said pole inside of said umbrella pole,
a plurality of auditorily-snap-locking leaf springs
respectively molded on said opposite tube walls of said pin-centering pin-guiding tubes,
a plurality of auditorily-snap-locking nipples
respectively molded on said auditorily-snap-locking leaf springs
for auditorily snap-locking said locking pin inside said auditorily-snap-locking recess,
said auditorily-snap-locking leaf springs
for springably pushing and auditorily snap-locking said auditorily-snap-locking nipples within said auditorily-snap-locking recess, respectively,
four internally-taperedly-threaded flexible towers
respectively molded to one of two said pin-centering pin-guiding plugs,
said auditorily-snap-locking recess
for locking two of said auditorily-snap-locking nipples therein, and
for alerting auditorily that two of said auditorily-snap-locking nipples are locked therein,
twelve triangular tower leaf springs
respectively molded to said four internally-taperedly-threaded flexible towers, and a tower-locking screw
screwed between and on said four internally-taperedly-threaded flexible towers
for threadedly pushing said four internally-taperedly-threaded flexible towers outward to releasably secure two said pin-centering pin-guiding plugs, said pin-centering pin-guiding tubes, said auditorily-snap-locking leaf springs, said auditorily-snap-locking nipples, said four internally-taperedly-threaded flexible towers, and said twelve triangular tower leaf springs within said pole inside of said umbrella pole at a desired elevation,
said four internally-taperedly-threaded flexible towers
for springably being pushed outwardly by said tower-locking screw to releasably secure said pin-centering pin-guiding plugs, said pin-centering pin-guiding tubes said auditorily-snap-locking leaf springs, said auditorily-snap-locking nipples, said four internally-taperedly-threaded flexible towers, and said twelve triangular tower leaf springs within said pole inside of said umbrella pole at a desired elevation,
said twelve triangular tower leaf springs
for springably pushing said four internally-taperedly-threaded flexible towers toward the central axis therebetween when said four internally-taperedly-threaded flexible towers are pushed outward by said tower-locking screw.

4. The arthritic-aiding rainwater-sealing-to-protect-cable-pulley cable-pulley-hiding-hub LED-light-turning-on-and-off image-projecting counter-weight-decelerating umbrella of claim 1, wherein
said first rainwater-sealing corrosion-eliminating LED-light-turning-on-and-off pulley-plug and
said second rainwater-sealing corrosion-eliminating LED-light-turning-on-and-off pulley-plug
each are made of rubber material.

5. The arthritic-aiding rainwater-sealing-to-protect-cable-pulley cable-pulley-hiding-hub LED-light-turning-on-and-off image-projecting counter-weight-decelerating umbrella of claim 1, wherein
said image-magnifying image-projecting lens
is made of plastic material.

6. The arthritic-aiding rainwater-sealing-to-protect-cable-pulley cable-pulley-hiding-hub LED-light-turning-on-and-off image-projecting counter-weight-decelerating umbrella of claim 1, wherein
said two rotatable pulleys
each are made of metallic or plastic material.

7. The arthritic-aiding rainwater-sealing-to-protect-cable-pulley cable-pulley-hiding-hub LED-light-turning-on-and-off image-projecting counter-weight-decelerating umbrella of claim 1, wherein
said arthritic-aiding counter-weight-decelerating image-projector-locking elastic cable is made of elastic material.

8. The arthritic-aiding rainwater-sealing-to-protect-cable-pulley cable-pulley-hiding-hub LED-light-turning-on-and-off image-projecting counter-weight-decelerating umbrella of claim 1, wherein said cable-pulley-hiding pole-rust-eliminating counter-weight-rust-eliminating upper hub is made of plastic material.

9. The arthritic-aiding rainwater-sealing-to-protect-cable-pulley cable-pulley-hiding-hub LED-light-turning-on-and-off image-projecting counter-weight-decelerating umbrella of claim 1, wherein said arthritic-aiding arthritic-hand-accommodating lower hub is made of plastic material.

10. An arthritic-aiding rainwater-sealing-for-cable-pulley cable-pulley-hiding-hub counter-weight-decelerating umbrella comprising:

a canopy;
a plurality of upper and lower ribs;
a plurality of rib screws;
a plurality of foldable rib joints;
an umbrella pole
having
a pole top, a pole inside, and two opposite pole walls;
an image-projecting lens;
two rotatable pulleys;
two upside-down cable-pulley holes;
a counter-weight-decelerating elastic cable;
a cable-pulley-hiding pole-rust-eliminating counter-weight-rust-eliminating upper hub
having
a hub inside;
an arthritic-aiding lower hub;
a deceleration-capable counter-weight;
a propeller-shaped head blade;
a blade hole;
a plurality of pole pin openings;
an arthritic-aiding grip ring;
an anti-finger-pinching spacer;
a locking pin;
a vertical support tube;
two pole-locking knobs;
two threaded knob holes;
an umbrella base;
a tow-hitch-connectable receptacle; and
two base wheels,
wherein:
said canopy
is screwed on said upper ribs,
said upper and lower ribs
are respectively foldably screwed together to said cable-pulley-hiding pole-rust-eliminating counter-weight-rust-eliminating upper hub, and to said foldable rib joints,
said rib screws
are respectively screwed to said upper and lower ribs, and screwed to said cable-pulley-hiding pole-rust-eliminating counter-weight-rust-eliminating upper hub, and said arthritic-aiding lower hub,
said foldable rib joints
are respectively molded to said arthritic-aiding lower hub,
said umbrella pole
is attached to said cable-pulley-hiding pole-rust-eliminating counter-weight-rust-eliminating upper hub,
said image-projecting lens
is releasably and slidably clamped to said counter-weight-decelerating elastic cable,
said two rotatable pulleys
are respectively hidden within said hub inside said cable-pulley-hiding pole-rust-eliminating counter-weight-rust-eliminating upper hub, and rotatably riveted to said cable-pulley-hiding pole-rust-eliminating counter-weight-rust-eliminating upper hub,
said upside-down cable-pulley holes
are respectively riveted to said cable-pulley-hiding pole-rust-eliminating counter-weight-rust-eliminating upper hub,
said counter-weight-decelerating elastic cable
is attached to said arthritic-aiding lower hub, threaded over one of said two rotatable pulleys, threaded into said pole top of said umbrella pole, and into said pole inside of said umbrella pole, threaded through said blade hole, threaded over another one of said two rotatable pulleys, threaded out of said pole top, and out of said pole inside of said umbrella pole, and attached to said arthritic-aiding lower hub,
said cable-pulley-hiding pole-rust-eliminating counter-weight-rust-eliminating upper hub
is attached to said pole top of said umbrella pole,
said arthritic-aiding lower hub
is slidably attached to said umbrella pole,
said deceleration-capable counter-weight
is slid into said pole inside of said umbrella pole, and connected to said counter-weight-decelerating elastic cable,
said propeller-shaped head blade
is molded to said deceleration-capable counter-weight,
said blade hole
is drilled out of said propeller-shaped head blade,
said pole pin openings
are respectively drilled through said two opposite pole walls of said umbrella pole,
said arthritic-aiding grip ring
is attached to said locking pin,
said anti-finger-pinching spacer
is screwed on said locking pin,
said locking pin
is molded to said anti-finger-pinching spacer,
said vertical support tube
is welded to said umbrella base,
said pole-locking knobs
are respectively screwed through said threaded knob holes,
said threaded knob holes
are respectively drilled and threaded into said vertical support tube,
said umbrella base
is welded to said vertical support tube,
said tow-hitch-connectable receptacle
is formed into said umbrella base, and
said base wheels
are respectively welded to said umbrella base.

11. The arthritic-aiding rainwater-sealing-for-cable-pulley cable-pulley-hiding-hub counter-weight-decelerating umbrella of claim 10, further comprising
a plurality of spiral flutes
molded to said deceleration-capable counter-weight
wherein
said spiral flutes
each are for allowing air to flow through said deceleration-capable counter-weight as said deceleration-capable counter-weight ascends or descends within said umbrella pole.

12. The arthritic-aiding rainwater-sealing-for-cable-pulley cable-pulley-hiding-hub counter-weight-decelerating umbrella of claim 10, further comprising:

an auditorily-snap-locking recess
molded in said locking pin, a plurality of pin-centering pin-guiding plugs
respectively molded to each other, and respectively inserted into said umbrella pole, a plurality of pin-centering pin-guiding tubes
having
opposite tube walls,
said pin-centering pin-guiding tubes
respectively molded in said pin-centering pin-guiding plugs, and are respectively aligned with said umbrella-pole pin openings
for accurately and conveniently guiding said locking pin from one of said umbrella-pole pin openings to another one of said umbrella-pole pin openings,
said pin-centering pin-guiding plugs
for centering and aligning said pin-centering pin-guiding tubes with said umbrella-pole pin openings within said pole inside of said umbrella pole, a plurality of auditorily-snap-locking leaf springs
respectively molded on said opposite tube walls of said pin-centering pin-guiding tubes, a plurality of auditorily-snap-locking nipples
respectively molded on said auditorily-snap-locking leaf springs
for auditorily snap-locking said locking pin inside said auditorily-snap-locking recess,
said auditorily-snap-locking leaf springs
for springably pushing and auditorily snap-locking said auditorily-snap-locking nipples within said auditorily-snap-locking recess, respectively, four internally-taperedly-threaded flexible towers
respectively molded to one of two said pin-centering pin-guiding plugs,
said auditorily-snap-locking recess
for locking two of said auditorily-snap-locking nipples therein, and
for alerting auditorily that two of said auditorily-snap-locking nipples are locked therein, twelve triangular tower leaf springs
respectively molded to said four internally-taperedly-threaded flexible towers, and a tower-locking screw
screwed between and on said four internally-taperedly-threaded flexible towers
for threadedly pushing said four internally-taperedly-threaded flexible towers outward to releasably secure two said pin-centering pin-guiding plugs, said pin-centering pin-guiding tubes, said auditorily-snap-locking leaf springs, said auditorily-snap-locking nipples, said four internally-taperedly-threaded flexible towers,
and said twelve triangular tower leaf springs within said pole inside of said umbrella pole at a desired elevation,
said four internally-taperedly-threaded flexible towers
for springably being pushed outwardly by said tower-locking screw to releasably secure said pin-centering pin-guiding plugs, said pin-centering pin-guiding tubes said auditorily-snap-locking leaf springs, said auditorily-snap-locking nipples, said four internally-taperedly-threaded flexible towers, and said twelve triangular tower leaf springs within said pole inside of said umbrella pole at a desired elevation,
said twelve triangular tower leaf springs
for springably pushing said four internally-taperedly-threaded flexible towers toward the central axis therebetween when said four internally-taperedly-threaded flexible towers are pushed outward by said tower-locking screw.

13. The arthritic-aiding rainwater-sealing-for-cable-pulley cable-pulley-hiding-hub counter-weight-decelerating umbrella of claim 10,
wherein
said upside-down cable-pulley holes
each are formed into a circular shape.

14. The arthritic-aiding rainwater-sealing-for-cable-pulley cable-pulley-hiding-hub counter-weight-decelerating umbrella of claim 10,
wherein
said image-projecting lens
is made of plastic material.

15. The arthritic-aiding rainwater-sealing-for-cable-pulley cable-pulley-hiding-hub counter-weight-decelerating umbrella of claim 10,
wherein
said two rotatable pulleys
each are made of metallic or plastic material.

16. The arthritic-aiding rainwater-sealing-for-cable-pulley cable-pulley-hiding-hub counter-weight-decelerating umbrella of claim 10,
wherein
said counter-weight-decelerating elastic cable
is made of elastic material.

17. The arthritic-aiding rainwater-sealing-for-cable-pulley cable-pulley-hiding-hub counter-weight-decelerating umbrella of claim 10,
wherein
said cable-pulley-hiding pole-rust-eliminating counter-weight-rust-eliminating upper hub is made of plastic material.

18. The arthritic-aiding rainwater-sealing-for-cable-pulley cable-pulley-hiding-hub counter-weight-decelerating umbrella of claim 10,
wherein
said arthritic-aiding lower hub
is made of plastic material.

19. A cable-pulley-hiding-hub umbrella comprising:
a canopy;
a plurality of upper and lower ribs;
a plurality of rib screws;
a plurality of foldable rib joints;
an umbrella pole
having
a pole top, a pole inside, and two opposite pole walls;
two rotatable pulleys;
two upside-down cable holes;
a counter-weight cable;
a cable-pulley-hiding pole-rust-eliminating counter-weight-rust-eliminating upper hub
having
a hub inside;
a lower hub;
a counter-weight;
a head blade;

a blade hole;
a plurality of pole pin openings;
a grip ring;
an anti-finger-pinching spacer;
a locking pin;
a vertical support tube;
at least one pole-locking knob;
at least one threaded knob hole;
an umbrella base;
a receptacle; and
two base wheels,
wherein:
said canopy
is screwed on said upper ribs,
said upper and lower ribs
are respectively foldably screwed together to said cable-pulley-hiding pole-rust-eliminating counter-weight-rust-eliminating upper hub, and to said foldable rib joints,
said rib screws
are respectively screwed to said upper and lower ribs, and screwed to said cable-pulley-hiding pole-rust-eliminating counter-weight-rust-eliminating upper hub, and said lower hub,
said foldable rib joints
are respectively molded to said lower hub,
said umbrella pole
is attached to said cable-pulley-hiding pole-rust-eliminating counter-weight-rust-eliminating upper hub,
said two rotatable pulleys
are respectively hidden within said hub inside cable-pulley-hiding pole-rust-eliminating counter-weight-rust-eliminating upper hub, and rotatably riveted to said cable-pulley-hiding pole-rust-eliminating counter-weight-rust-eliminating upper hub,
said upside-down cable holes
are respectively riveted to said cable-pulley-hiding pole-rust-eliminating counter-weight-rust-eliminating upper hub,
said counter-weight cable
is attached to said lower hub, threaded over one of said two rotatable pulleys, threaded into said pole top of said umbrella pole, and into said pole inside of said umbrella pole, threaded through said blade hole, threaded over another one of said two rotatable pulleys, threaded out of said pole top, and out of said pole inside of said umbrella pole, and attached to said lower hub,
said cable-pulley-hiding pole-rust-eliminating counter-weight-rust-eliminating upper hub is attached to said pole top of said umbrella pole,
said lower hub
is slidably attached to said umbrella pole,
said counter-weight
is slid into said pole inside of said umbrella pole, and connected to said counter-weight cable,
said head blade
is molded to said counter-weight,
said blade hole
is drilled out of said head blade,
said pole pin openings
are respectively drilled through said two opposite pole walls of said umbrella pole,
said arthritic-aiding grip ring
is attached to said locking pin,
said anti-finger-pinching spacer
is screwed on said locking pin,
said locking pin
is molded to said anti-finger-pinching spacer,
said vertical support tube
is welded to said umbrella base,
said pole-locking knob
are respectively screwed through said threaded knob hole,
said threaded knob hole
are respectively drilled and threaded into said vertical support tube,
said umbrella base
is welded to said vertical support tube,
said receptacle
is formed into said umbrella base, and
said base wheels
are respectively welded to said umbrella base.

20. The cable-pulley-hiding-hub umbrella of claim 19, wherein
said cable-pulley-hiding pole-rust-eliminating counter-weight-rust-eliminating upper hub is made of plastic material.

* * * * *